US009088854B2

(12) United States Patent
Enamito et al.

(10) Patent No.: US 9,088,854 B2
(45) Date of Patent: Jul. 21, 2015

(54) ACOUSTIC CONTROL APPARATUS

(75) Inventors: Akihiko Enamito, Kawasaki (JP); Osamu Nishimura, Kawasaki (JP); Takahiro Hiruma, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 467 days.

(21) Appl. No.: 13/428,055

(22) Filed: Mar. 23, 2012

(65) Prior Publication Data

US 2012/0328108 A1 Dec. 27, 2012

(30) Foreign Application Priority Data

Jun. 24, 2011 (JP) ..... 2011-141094
Nov. 10, 2011 (JP) ..... 2011-246794

(51) Int. Cl.
*H04R 5/00* (2006.01)
*H04S 1/00* (2006.01)

(52) U.S. Cl.
CPC ..... *H04S 1/002* (2013.01); *H04S 2420/01* (2013.01)

(58) Field of Classification Search
CPC ..... H04R 5/02; H04R 2499/13; H04R 3/12; H04R 2420/07; H04R 5/033; H04R 1/403; H04R 3/00; H04R 3/14; H04R 1/26; H04R 29/001; H04R 2205/024; H04R 1/345; H04R 2201/401; H04R 2203/12; H04R 5/00; H04S 2420/07; H04S 7/303; H04S 2420/13; H04S 2420/11; H04S 2400/03; H04S 2400/09; H04S 2420/05; H04H 60/58; G06F 3/16; G06F 3/165; G06F 17/00; G06F 1/1626; G06F 17/3074; G06F 17/30761; H03G 3/20; B60R 11/0217; G10K 11/1784; G10K 2210/1282; G10K 11/1786; G10K 2210/3028; G10K 2210/30232; G10K 2210/3046; G10K 15/04; G10K 2210/12; G10K 2210/30391; H04N 2201/3264; H04N 21/4394
USPC ..... 381/1, 17, 18, 19, 20, 59, 300, 302, 381/303, 307, 309, 310, 311, 28, 61, 63, 381/71.11, 77, 80, 82, 85, 86, 89, 332, 97, 381/99, 100, 102, 103; 700/94; 708/300, 708/301, 303, 304, 305, 306, 307, 308, 309, 708/310, 311, 312
See application file for complete search history.

(56) References Cited

U.S. PATENT DOCUMENTS 5,581,618 A * 12/1996 Satoshi et al. ..... 381/17
5,857,026 A * 1/1999 Scheiber ..... 381/23

(Continued)

FOREIGN PATENT DOCUMENTS

JP 52-67301 6/1977
JP 2000-152397 5/2000

(Continued)

OTHER PUBLICATIONS

Bauck, Jerry, et al., "Generalized Transaural Stereo and Applicaitons", J. Audio Eng. Soc., vol. 44, No. 9, Sep. 1996, pp. 683-705.
First Office Action for Japanese Patent Application No. 2011-246794 Dated Feb. 17, 2015, 4 pages.

*Primary Examiner* — Leshui Zhang
(74) *Attorney, Agent, or Firm* — Amin, Turocy & Watson, LLP

(57) ABSTRACT

According to an embodiment, a control filter coefficient is calculated in such a manner that a second spatial average of one or more complex sound pressure ratios at one or more target binaural positions when a first loudspeaker and a second loudspeaker emit a second acoustic signal and a first acoustic signal is approximated to a first spatial average of one or more complex sound pressure ratios at the one or more target binaural positions when a target virtual acoustic source emits the first acoustic signal.

8 Claims, 95 Drawing Sheets

(56) References Cited

U.S. PATENT DOCUMENTS

| | | | | |
|---|---|---|---|---|
| 6,140,565 | A * | 10/2000 | Yamauchi et al. | 84/600 |
| 6,574,339 | B1 * | 6/2003 | Kim et al. | 381/17 |
| 6,718,039 | B1 * | 4/2004 | Klayman et al. | 381/1 |
| 8,085,958 | B1 * | 12/2011 | Trautmann et al. | 381/310 |
| 2006/0045295 | A1 * | 3/2006 | Kim | 381/310 |
| 2009/0034766 | A1 * | 2/2009 | Hamanaka et al. | 381/310 |
| 2012/0183150 | A1 | 7/2012 | Christoph et al. | |

FOREIGN PATENT DOCUMENTS

| | | | | |
|---|---|---|---|---|
| JP | 2008-154083 | | 7/2008 | |
| JP | 2008-278487 | | 11/2008 | |
| WO | WO 2011045751 | A1 * | 4/2011 | H04S 7/00 |

* cited by examiner

ACOUSTIC CONTROL APPARATUS

CROSS-REFERENCE TO RELATED APPLICATIONS

This application is based upon and claims the benefit of priority from prior Japanese Patent Applications No. 2011-141094, filed Jun. 24, 2011; and No. 2011-246794, filed Nov. 10, 2011, the entire contents of all of which are incorporated herein by reference.

FIELD

Embodiments described herein relate generally to acoustic control using a head-related transfer function.

BACKGROUND

There has been conventionally known a technique for simulating acoustic effects of a stereophonic signal (e.g., a 5.1 channel) using a front loudspeaker. According to this technique, a listener is enabled to perceive a stereophonic effect without requiring a surround speaker, an earphone, a headphone, and others. For examples, a listener can feel auditory lateralization behind himself/herself by using two front loudspeakers. Such a technique is based on a control policy for faithfully reproducing a binaural acoustic signal (or an acoustic signal coming from a virtual acoustic source) in both ears of a listener using a head-related transfer function.

As problems of such a technique, there are known a deterioration in acoustic quality due to deficiency in dynamic range, an increase in a hardware scale or a reduction in processing speed due to a signal processing load using a head-related transfer function, a localization of a binaural position at which auditory lateralization can be obtained, and others. For example, according to many conventional techniques, desired stereophonic effects can be achieved only when one listener is located at a vertex (a sweet spot) of a regular triangle having a line connecting two front loudspeakers as a bottom side. If a binaural position of the listener deviates from this sweet spot (e.g., approximately several tens of cm), the head-related transfer function fluctuates, and hence a binaural acoustic signal (or an acoustic signal coming from a virtual acoustic source) is not faithfully reproduced. That is, desired acoustic effects cannot be achieved. Therefore, the above-described control policy has a problem that it lacks robustness with respect to a fluctuation in binaural position of a listener.

DETAILED DESCRIPTION

Figure 1:
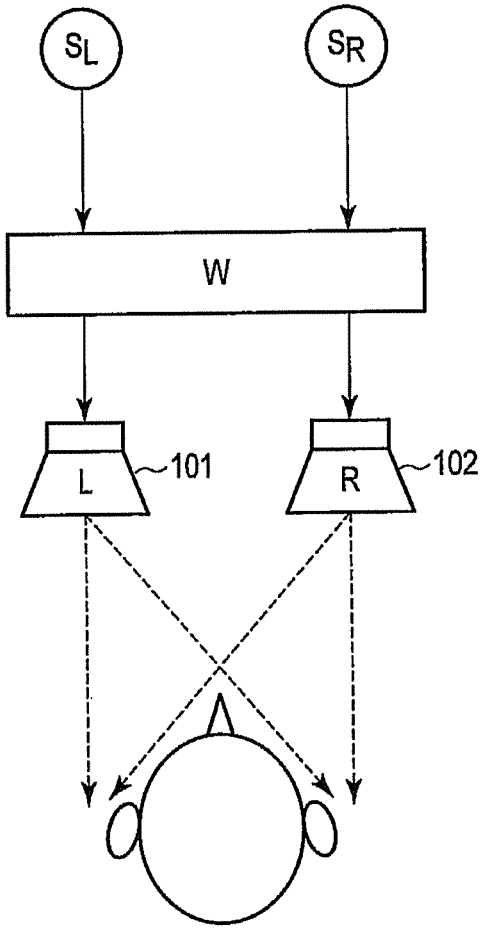
FIG. 1 is an explanatory view of a technique for reproducing binaural acoustic signals in both ears of a listener by using two front loudspeakers.

Embodiments will now be described hereinafter with reference to the drawings.

In general, according to an embodiment, an acoustic control apparatus includes a control filter, a first loudspeaker and a second loudspeaker. The control filter multiplies a first acoustic signal by a control filter coefficient to obtain a second acoustic signal. The first loudspeaker emits the second acoustic signal. The second loudspeaker emits the first acoustic signal. The control filter coefficient is calculated based on at least one first head-related transfer function set from the first loudspeaker and the second loudspeaker to at least one target binaural position and at least one second head-related transfer function set from a target virtual acoustic source to the at least one target binaural position in such a manner that a second spatial average of at least one complex sound pressure ratio at the at least one target binaural position when the first loudspeaker and the second loudspeaker emit the second acoustic signal and the first acoustic signal is approximated to a first spatial average of at least one complex sound pressure ratio at the at least one target binaural position when the target virtual acoustic source emits the first acoustic signal.

The same or like reference numerals will denote elements that are equal to or similar to the described elements, and overlapping explanation will be generally omitted.

As introduction for explaining each embodiment, a basic technique of acoustic control using a head-related transfer function will be described.

At first, a description will be given as to a basic technique that uses two front loudspeakers to reproduce binaural acoustic signals in both ears of a listener. An amplitude ratio based on amplitudes ($=\alpha_L$, $\alpha_R$) is provided and a phase difference based on phases ($=\theta_L$, $\theta_R$) is provided to binaural acoustic signals ($=S_L$, $S_R$) at a given time. When a listener directly listens the binaural acoustic signals ($=S_L$, $S_R$) using, e.g., a earphone or a headphone, he/she develops an illusion that the amplitude ratio and the phase difference of both the signals are produced due to a difference between incoming sound pressures from a virtual acoustic source to both ears. That is, the listener can perceive a virtual acoustic source position corresponding to the amplitude ratio and the phase difference. Here, the phase difference may be 0, and the amplitude ratio may be 1. That is, a left acoustic signal ($=S_L$) and a right acoustic signal ($=S_R$) may be signals which are different in both phase and amplitude or may be signals which are equal in one or both of the phases and the amplitudes.

In case of using loudspeakers to reproduce the binaural acoustic signals ($=S_L$, $S_R$) in the listener's both ears, control filter processing for canceling crosstalk is required. As shown in FIG. 1, the binaural acoustic signals ($=S_L$, $S_R$) (vectors) are multiplied by a control filter matrix (=W). In general, the control filter processing adjusts an amplitude and a phase of an acoustic signal. The left acoustic signal subjected to the control filter processing is emitted from a loudspeaker 101, and the right acoustic signal subjected to the control filter processing is emitted from a loudspeaker 102. The acoustic signals emitted from the loudspeakers 101 and 102 are subjected to amplitude and phase change based on a head-related transfer function and arrive at the listener's both ears. This phenomenon can be represented by a multiplication of a head-related transfer matrix (=C). That is, the incoming sound pressures ($=P_L$, $P_R$) in the listener's both ears can be derived by the following Expression (1). It is to be noted that influence of signal amplification by, e.g., an amplifier is ignored in the following analysis.

$$\begin{pmatrix} P_L \\ P_R \end{pmatrix} = CW\begin{pmatrix} S_L \\ S_R \end{pmatrix} = \begin{pmatrix} C_{LL} & C_{LR} \\ C_{RL} & C_{RR} \end{pmatrix}\begin{pmatrix} W_{LL} & W_{LR} \\ W_{RL} & W_{RR} \end{pmatrix}\begin{pmatrix} S_L \\ S_R \end{pmatrix} \tag{1}$$

$$\begin{pmatrix} S_L \\ S_R \end{pmatrix} = \begin{pmatrix} |\alpha_L| \cdot e^{j(\omega t-\theta_L)} \\ |\alpha_R| \cdot e^{j(\omega t-\theta_R)} \end{pmatrix}$$

If the control filter matrix (=W) coincides with an inverse matrix of the head-related transfer matrix (=C) as represented by the following Expression (2), the sound pressures ($=P_L$, $P_R$) that have arrived at the listener's both ears faithfully reproduce the binaural acoustic signals ($=S_L$, $S_R$) as represented by the following Expression (3). Therefore, the listener can perceive the acoustic source position that change every second.

$$\begin{pmatrix} W_{LL} & W_{LR} \\ W_{RL} & W_{RR} \end{pmatrix} = \begin{pmatrix} C_{LL} & C_{LR} \\ C_{RL} & C_{RR} \end{pmatrix}^{-1} \tag{2}$$

$$\begin{pmatrix} P_L \\ P_R \end{pmatrix} = \begin{pmatrix} S_L \\ S_R \end{pmatrix} \tag{3}$$

Subsequently, a description will now be given as to a basic technique for reproducing acoustic signals coming from a virtual acoustic source in the listener's both ears by using the two front loudspeakers. According to this technique, a monaural acoustic signal (=S) generated by the virtual acoustic source is reproduced in the listener's both ears. Here, it may be understood that the monaural acoustic signal (=S) has a relationship represented by the following Expressions (4), (5) or others with respect to the left acoustic signal ($=S_L$) and the right acoustic signal ($=S_R$).

$$S=S_L=S_R \tag{4}$$

$$S=S_L+S_R \tag{5}$$

When a head-related transfer function from the virtual acoustic source to the listener's left ear is represented as $d_L$, and a head-related transfer function from the virtual acoustic source to the listener's right ear is represented as $d_R$, the incoming sound pressures ($=P_L$, $P_R$) in the listener's both ears can be derived by the following expression (6).

$$\begin{pmatrix} P_L \\ P_R \end{pmatrix} = \begin{pmatrix} d_L & 0 \\ 0 & d_R \end{pmatrix}\begin{pmatrix} S \\ S \end{pmatrix} \tag{6}$$

Figure 2:
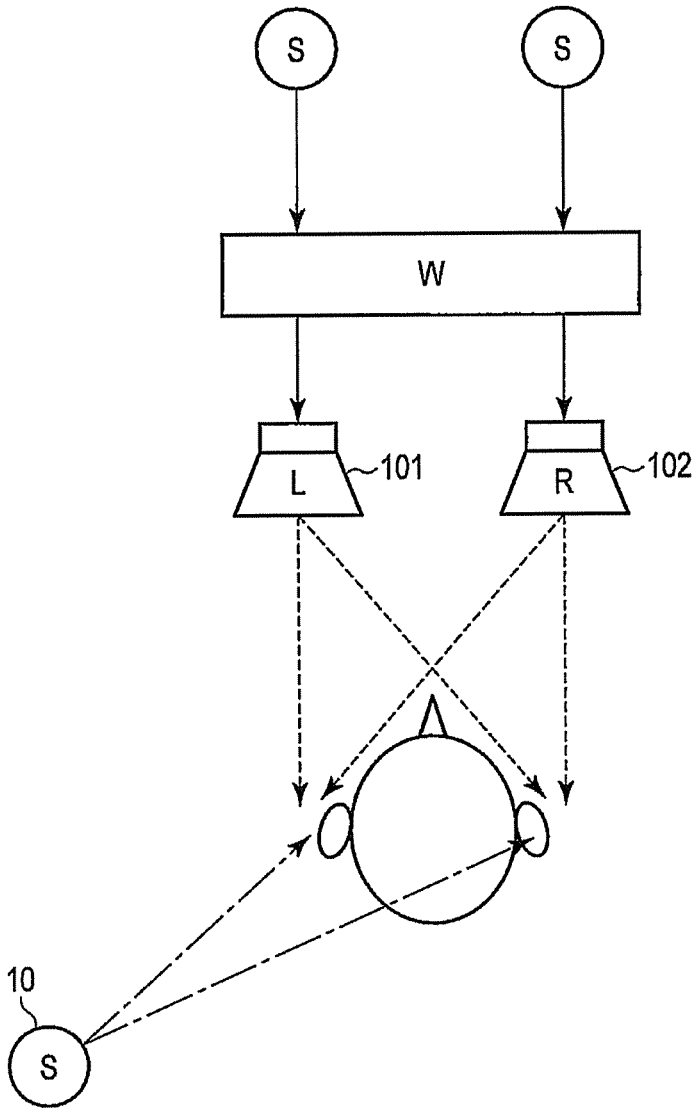
FIG. 2 is an explanatory view of a technique for reproducing an acoustic signal coming from a virtual acoustic source in both ears of a listener by using two front loudspeakers.

When using the loudspeakers to reproduce acoustic signals ($=d_LS$, $d_RS$) coming from the virtual acoustic source in the listener's both ears, the control filter processing for canceling crosstalk is required. As shown in FIG. 2, the monaural acoustic signal (=S) is divided into the left acoustic signal and the right acoustic signal and multiplied by the control filter matrix (=W). The left acoustic signal subjected to the control filter processing is emitted from the loudspeaker 101, and the right acoustic signal subjected to the control filter processing is emitted from the loudspeaker 102. The acoustic signals emitted from the loudspeakers 101 and 102 are subjected to amplitude and phase change based on the head-related transfer functions and arrive at the listener's both ears. This phenomenon can be represented by a multiplication of the head-related transfer matrix (=C). That is, the incoming sound pressures ($=P_L$, $P_R$) in the listener's both ears can be derived by the following Expression (7).

$$\begin{pmatrix} P_L \\ P_R \end{pmatrix} = \begin{pmatrix} C_{LL} & C_{LR} \\ C_{RL} & C_{RR} \end{pmatrix}\begin{pmatrix} W_{LL} & W_{LR} \\ W_{RL} & W_{RR} \end{pmatrix}\begin{pmatrix} S \\ S \end{pmatrix} \tag{7}$$

Therefore, if the control filter matrix (=W) coincides with a matrix obtained by multiplying the inverse matrix of the head-related transfer matrix (=C) by the head-related transfer matrix (=D) from the virtual acoustic source as represented by the following Expression (8), the incoming sound pressures ($=P_L$, $P_R$) in the listener's both ears faithfully reproduce the acoustic signals ($=d_LS$, $d_RS$) coming from the virtual acoustic source as represented by the following Expression (8). Therefore, the listener can perceive the virtual acoustic source position to obtain a sense of auditory lateralization.

$$\begin{pmatrix} W_{LL} & W_{LR} \\ W_{RL} & W_{RR} \end{pmatrix} = C^{-1}D \tag{8}$$

$$= \begin{pmatrix} C_{LL} & C_{LR} \\ C_{RL} & C_{RR} \end{pmatrix}^{-1} \begin{pmatrix} d_L & 0 \\ 0 & d_R \end{pmatrix}$$

$$\therefore \begin{pmatrix} P_L \\ P_R \end{pmatrix} = \begin{pmatrix} d_L & 0 \\ 0 & d_R \end{pmatrix} \begin{pmatrix} S \\ S \end{pmatrix}$$

According to the basic technique, when the head-related transfer functions from the loudspeakers 101 and 102 to the binaural position are determined, control filter coefficients (i.e., $W_{LL}$, $W_{LR}$, $W_{RL}$, and $W_{RR}$) for reproducing the binaural acoustic signals can be derived based on these functions. Further, when the head-related transfer functions from the virtual acoustic source to the binaural position (i.e., $d_L$, $d_R$) are determined in addition to the head-related transfer functions from the loudspeakers 101, 102 to the binaural position, the control filter coefficients for reproducing the acoustic signals coming from the virtual acoustic source can be derived based on these functions.

However, as described above, since the head-related transfer functions also fluctuate when the binaural position fluctuates, reproducibility of a desired acoustic signal (e.g., a binaural acoustic signal or an acoustic signal coming from the virtual acoustic source) deteriorates. If a plurality of control filter coefficients are prepared in advance and the plurality of control filter coefficients are switched over in accordance with a fluctuation in the binaural position of the listener, the high reproducibility of the desired acoustic signal may be maintained, but a processing load is high in this control, and hence it is hard to say that this control is reasonable. Therefore, to realize the acoustic control that is robust to a fluctuation in the binaural position of the listener, a control policy described below will be adopted in common to respective embodiments.

Figure 3A:
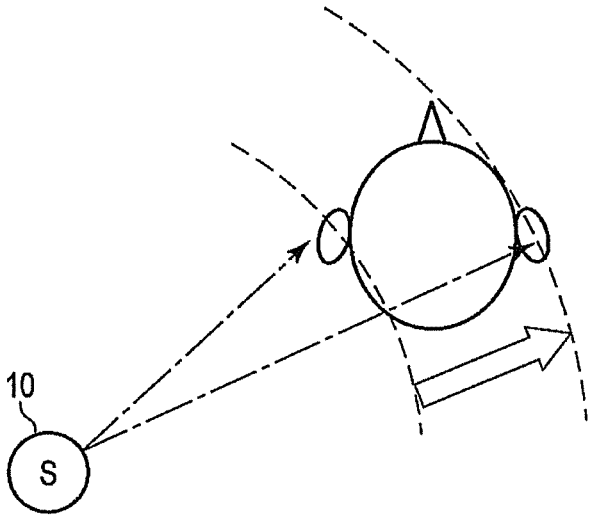
FIG. 3A is an explanatory view of a fluctuation of a binaural position of the listener.
Figure 3B:
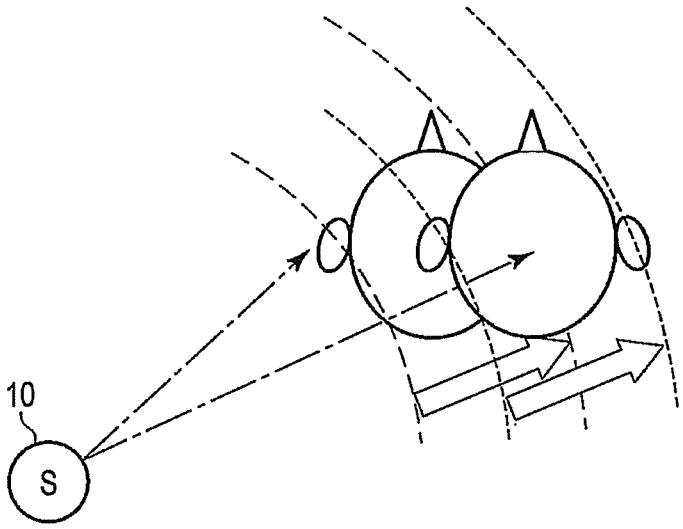
FIG. 3B is an explanatory view of a fluctuation of a binaural position of the listener.

For example, if an acoustic source is actually present at a virtual acoustic source position, an amplitude ratio and a time difference (i.e., a phase difference) are given to acoustic signals that arrive at the listener's both ears from the acoustic source depending on a difference between distances from the acoustic source to the listener's both ears. The listener can perceive a direction of the acoustic source in accordance with the amplitude ratio and the time difference. As shown in FIG. 3A and FIG. 3B, it is assumed that a head of the listener turns away or the head of the listener moves approximately several tens of cm so that a binaural position of the listener fluctuates. In this case, the listener may be hard to perceive a distance to the acoustic source, but he/she can usually perceive at least a direction of the acoustic source. That is, it can be considered that fluctuations of the amplitude ratio and the time difference of the acoustic signals that arrive at both the ears are small with respect to a fluctuation of the binaural position of the listener.

Based on the above consideration, the control policy that is common to respective embodiments approximates a complex sound pressure ratio at the binaural position of the listener to a (incoming) complex sound pressure ratio of binaural acoustic signals (or acoustic signals coming from the virtual acoustic source). In other words, this control policy does not demand to faithfully reproduce absolute sound pressures of the binaural acoustic signals (or the acoustic signals coming from the virtual acoustic source) in the listener's both ears as a necessary condition. According to this control policy, for example, when reproducing acoustic signals coming from the virtual acoustic source, particulars of the control filter processing are decided to meet the following Expression (9).

$$\frac{d_{Ri}s}{d_{Li}s} = \frac{d_{Ri}}{d_{Li}} \cong \frac{P_{Ri}}{P_{Li}} \tag{9}$$

where i (=1, 2, . . . ) represents an index for identifying presumed binaural position. When complex volume velocities of the loudspeakers 101 and 102 are represented as $q_L$, $q_R$, incoming sound pressures ($=P_{Li}$, $P_{Ri}$) at a binaural position (i) can be derived by the following Expression (10).

$$P_{Li} = C_{LiL} \cdot q_L + C_{LiR} \cdot q_R$$

$$P_{Ri} = C_{RiL} \cdot q_L + C_{RiR} q_R \tag{10}$$

The control policy aims at minimizing acoustic energy (=Q) represented by the following Expression (11) to meet Expression (9). Here, N indicates a total number of indexes (10).

$$Q = \sum_{i=1}^{N} (\Delta P_i \cdot \Delta P_i^*) \rightarrow \min \tag{11}$$

$$\Delta P_i = d_{Ri} \cdot P_{Li} - d_{Li} \cdot P_{Ri}$$

When the complex volume velocity ($=q_L$) is divided into a real part ($=q_L^r$) and an imaginary part ($=q_L^i$) as shown in the following Expression (12) and the acoustic energy (=Q) is partially differentiated using the real part ($=q_L^r$) and the imaginary part ($=q_L^i$) as shown in the following Expression (13), the following Expression (14) is derived. When Expression (14) is met, the complex sound pressure ratio at the listener's binaural position coincide with the complex sound pressure ratio of the desired acoustic signal.

$$q_L = q_L^r + j \cdot q_L^i \tag{12}$$

$$\frac{\partial Q}{\partial q_L^r} = 0, \ \frac{\partial Q}{\partial q_L^i} = 0 \tag{13}$$

$$\therefore q_L = -\frac{\sum_{i=1}^{N} (B_i \cdot A_i^*)}{\sum_{i=1}^{N} (A_i \cdot A_i^*)} q_R$$

$$\because A_i = C_{LiL} \cdot d_{Ri} - C_{RiL} \cdot d_{Li} \tag{14}$$

$$B_i = C_{LiR} \cdot d_{Ri} - C_{RiR} \cdot d_{Li}$$

where $C_{LiL}$ is a head-related transfer function from the left loudspeaker to the listener's left ear at the binaural position (i); $C_{LiR}$ is a head-related transfer function from the right loudspeaker to the listener's left ear at the binaural position (i); $C_{RiL}$ is a head-related transfer function from the left loudspeaker to the listener's right ear at the binaural position (i); $C_{RiR}$ is a head-related transfer function from the right loudspeaker to the listener's right ear at the binaural position (i); $d_{Li}$ is a head-related transfer function from a loudspeaker for the virtual acoustic source to the listener's left ear at the binaural position (i); and $d_{Ri}$ is a head-related transfer function from the loudspeaker for the virtual acoustic source to the listener's right ear at the binaural position (i).

For example, if the number of the binaural position to be considered is 1, N=1 can be determined. Further, since the volume velocities ($=q_L$, $q_R$) correspond to acoustic signals after the control filter processing, the control filter that can meet Expression (14) can be derived from the following Expression (15) and expression (16).

$$\begin{pmatrix} P_L \\ P_R \end{pmatrix} = \begin{pmatrix} C_{LL} & C_{LR} \\ C_{RL} & C_{RR} \end{pmatrix} \begin{pmatrix} q_L \\ q_R \end{pmatrix} \tag{15}$$

$$\begin{pmatrix} q_L \\ q_R \end{pmatrix} = \begin{pmatrix} W_L & 0 \\ 0 & W_R \end{pmatrix} \begin{pmatrix} S_L \\ S_R \end{pmatrix}$$

$$\therefore \begin{pmatrix} P_L \\ P_R \end{pmatrix} = \begin{pmatrix} C_{LL} & C_{LR} \\ C_{RL} & C_{RR} \end{pmatrix} \begin{pmatrix} W_L & 0 \\ 0 & W_R \end{pmatrix} \begin{pmatrix} S_L \\ S_R \end{pmatrix}$$

In Expression (15), a left control filter coefficient ($=W_L$) and a right control filter coefficient ($=W_R$) meet the following Relational Expression (16).

$$W_L = -\frac{B \cdot A^*}{A \cdot A^*} W_R = -\frac{B \cdot A^*}{|A|^2} W_R \tag{16}$$

$$\because A = C_{LL} \cdot d_R - C_{RL} \cdot d_L$$

$$B = C_{LR} \cdot d_R - C_{RR} \cdot d_L$$

where $C_{LL}$ is a head-related transfer function from the left loudspeaker to the listener's left ear; $C_{LR}$ is a head-related transfer function from the right loudspeaker to the listener's left ear; $C_{RL}$ is a head-related transfer function from the left loudspeaker to the listener's right ear; $C_{RR}$ is a head-related transfer function from the right loudspeaker to the listener's right ear; $d_L$ is a head-related transfer function from a loudspeaker for the virtual acoustic source to the listener's left ear; and $d_R$ is a head-related transfer function from the loudspeaker for virtual acoustic source to the listener's right ear.

Figure 4:
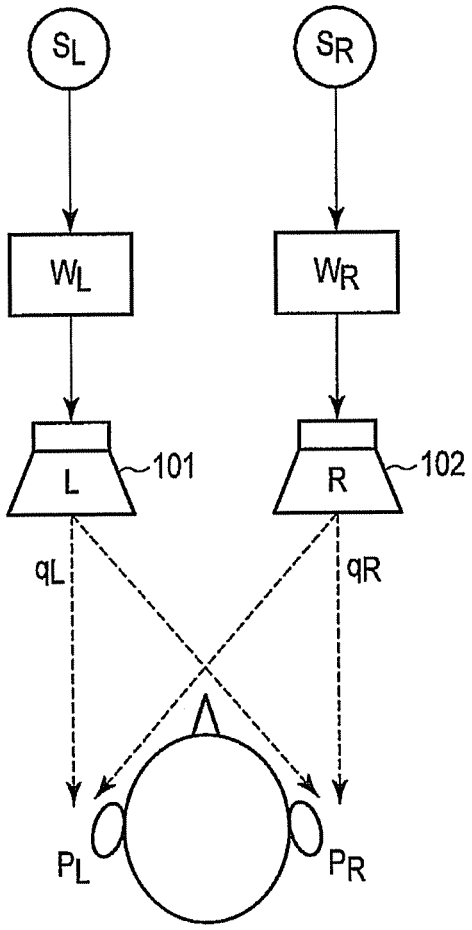
FIG. 4 is an explanatory view of acoustic control when there is one target binaural position to be considered at a time.

As shown in FIG. 4, the acoustic signals ($=S_L$, $S_R$) are multiplied by the control filter coefficients ($=W_L$, $W_R$) and emitted from the loudspeakers 101 and 102. In the acoustic control depicted in FIG. 4, the total number of the control filter coefficients required in the control filter processing is reduced to 2 from 4 as compared with the technique shown in FIG. 1 and FIG. 2.

It is to be noted that the left control filter coefficient ($=W_L$) is derived based on the right control filter coefficient ($=W_R$) in the above description, but the right control filter coefficient ($=W_R$) may be derived based on the left control coefficient ($=W_L$) as a reverse pattern. In any case, based on one control filter coefficient, the other control filter coefficient is derived.

(First Embodiment)

Figure 5:
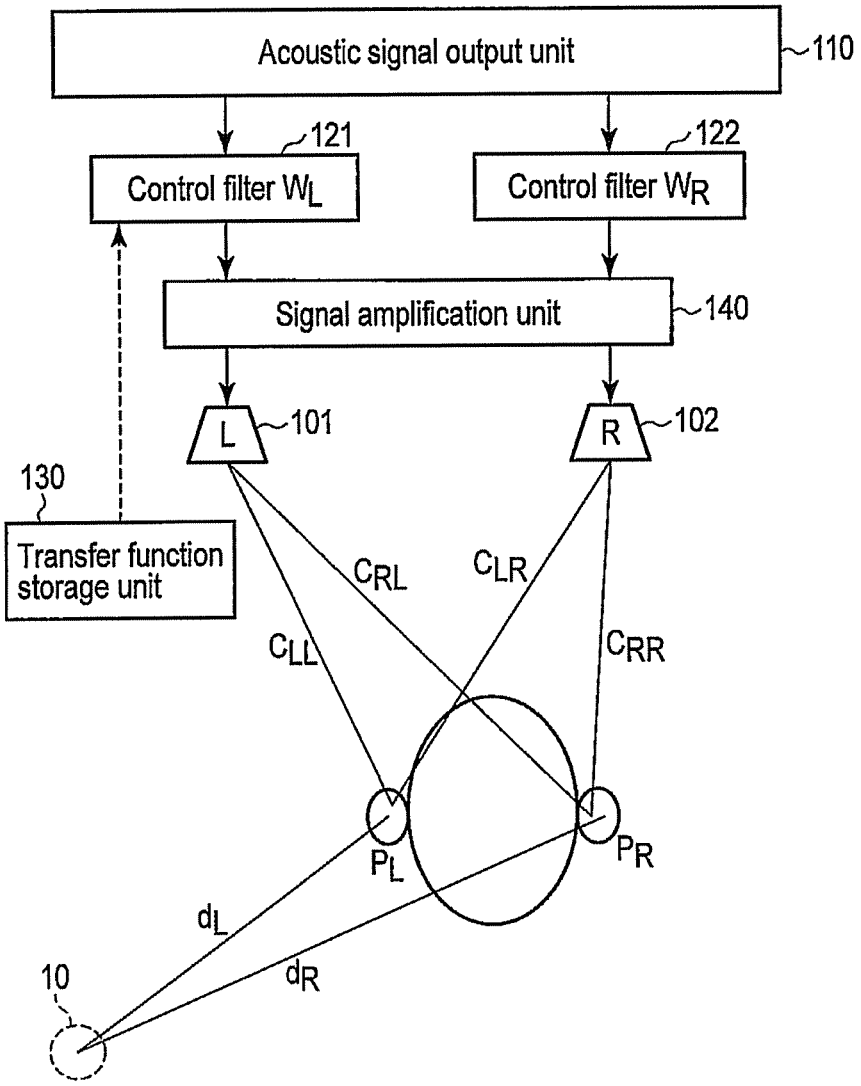
FIG. 5 is a block diagram showing an acoustic control apparatus according to a first embodiment.

As shown in FIG. 5, an acoustic control apparatus according to a first embodiment comprises loudspeakers 101 102, an acoustic signal output unit 110, control filters 121 and 122, a transfer function storage unit 130, and a signal amplification unit 140.

The acoustic control apparatus depicted in FIG. 5 performs later-described acoustic control over monaural acoustic signals output from the acoustic signal output unit 110 and approximates (e.g., conforms) a complex sound pressure ratio at a target binaural position to a complex sound pressure ratio of acoustic signals coming from a target virtual acoustic source to the target binaural position. Here, the target binaural position represents an assumed binaural position. The target virtual acoustic source represents an assumed virtual acoustic source (e.g., a virtual acoustic source 10). According to the acoustic control apparatus in FIG. 5, even when a listener's binaural position fluctuates from the target binaural position to some extent, since a fluctuation of the complex sound pressure ratio at the binaural position is small, the listener can perceive a direction of the target virtual acoustic source.

The loudspeaker 101 emits a left acoustic signal amplified by the signal amplification unit 140. The loudspeaker 102 emits a right acoustic signal amplified by the signal amplification unit 140. The acoustic signal output unit 110 outputs monaural acoustic signals (=S) to the control filter 121 and the control filter 122 as a left acoustic signal and a right acoustic signal, respectively. The transfer function storage unit 130 stores a head-related transfer function in regard to at least one target binaural position. Specifically, the transfer function storage unit 130 stores a head-related transfer function set from the loudspeakers 101 and 102 to at least one target binaural position and a head-related transfer set from at least one target virtual acoustic source (e.g., the virtual acoustic source 10) to at least one target binaural position.

The control filter 121 reads from the transfer function storage unit 130 a head-related transfer function ($=C_{LL}$) from the loudspeaker 101 to the listener's left ear at the target binaural position, a head-related transfer function ($=C_{LR}$) from the loudspeaker 102 to the listener's left ear at the target binaural position, a head-related transfer function ($=C_{RL}$) from the loudspeaker 101 to the listener's right ear at the target binaural position, a head-related transfer function ($=C_{RR}$) from the loudspeaker 102 to the listener's right ear at the target binaural position, a head-related transfer function ($=d_L$) from the target virtual acoustic source to the listener's left ear at the target binaural position, and a head-related transfer function ($=d_R$) from the target virtual acoustic source to the listener's right ear at the target binaural position as required. That is, when the binaural position largely fluctuates from the target binaural position or when the target virtual acoustic source changes, the control filter 121 may switch over the head-related transfer function.

The control filter 121 calculates a control filter coefficient ($=W_L$) to meet Expression (16) based on the head-related transfer function read from the transfer function storage unit 130 and a control filter coefficient ($=W_R$) of the control filter 122. It is to be noted that the calculation of the control filter coefficient ($=W_L$) may be performed by a non-illustrated coefficient calculation unit in place of the control filter 121. Alternatively, the control filter coefficient ($=W_L$) associated with a combination of the control filter coefficient ($=W_R$) of the control filter 122, the target binaural position and the target virtual acoustic source may be calculated in advance, and the control filter 121 may read the appropriate control filter coefficient ($=W_L$).

The control filter 121 multiplies the control filter coefficient ($=W_L$) by the left acoustic signal (=S) from the acoustic signal output unit 110 and inputs an obtained result to the signal amplifier 140. The control filter 122 multiplies the control filter coefficient ($=W_R$) by the right acoustic signal (=S) from the acoustic signal output unit 110 and inputs an obtained result to the signal amplification unit 140. The signal amplification unit 140 amplifies the left acoustic signal ($=W_LS$) from the control filter 121 and the right acoustic signal ($=W_RS$) from the control filter 122 in accordance with gain and supplies obtained results to the loudspeakers 101 and 102, respectively. The signal amplification unit 140 is, e.g., an amplifier.

According to the acoustic control apparatus in FIG. 5, incoming sound pressures ($=P_L$, $P_R$) at the target binaural position can be represented by the following Expression (17).

$$\begin{pmatrix} P_L \\ P_R \end{pmatrix} = \begin{pmatrix} C_{LL} & C_{LR} \\ C_{RL} & C_{RR} \end{pmatrix} \begin{pmatrix} -\frac{B \cdot A^*}{|A|^2} W_R & 0 \\ 0 & W_R \end{pmatrix} \begin{pmatrix} S \\ S \end{pmatrix} \tag{17}$$

$$= \begin{pmatrix} C_{LL} & C_{LR} \\ C_{RL} & C_{RR} \end{pmatrix} \begin{pmatrix} \frac{C_{RR}}{\det|C|} & -\frac{C_{LR}}{\det|C|} \\ -\frac{C_{RL}}{\det|C|} & \frac{C_{LL}}{\det|C|} \end{pmatrix}$$

$$\begin{pmatrix} \frac{\det|C| \cdot A^* \cdot W_R}{|A|^2} & 0 \\ 0 & \frac{\det|C| \cdot A^* \cdot W_R}{|A|^2} \end{pmatrix} \begin{pmatrix} d_L & 0 \\ 0 & d_R \end{pmatrix} \begin{pmatrix} S \\ S \end{pmatrix}$$

$$= \begin{pmatrix} \frac{\det|C| \cdot A^* \cdot W_R}{|A|^2} & 0 \\ 0 & \frac{\det|C| \cdot A^* \cdot W_R}{|A|^2} \end{pmatrix} \begin{pmatrix} d_L & 0 \\ 0 & d_R \end{pmatrix} \begin{pmatrix} S \\ S \end{pmatrix}$$

$$= \begin{pmatrix} \frac{\det|C| \cdot A^* \cdot W_R \cdot d_L \cdot S}{|A|^2} \\ \frac{\det|C| \cdot A^* \cdot W_R \cdot d_R \cdot S}{|A|^2} \end{pmatrix}$$

$$= \begin{pmatrix} \frac{\det|C| \cdot A^* \cdot W_R \cdot S}{|A|^2} & 0 \\ 0 & \frac{\det|C| \cdot A^* \cdot W_R \cdot S}{|A|^2} \end{pmatrix} \begin{pmatrix} d_L \\ d_R \end{pmatrix}$$

That is, the incoming sound pressures ($=P_L$, $P_R$) at the target binaural position are equal to results obtained by multiplying the acoustic signals ($=d_L S$, $d_R S$) that arrive at the target binaural position from the target virtual acoustic source by a coefficient represented by the following Expression (18).

$$\frac{\det|C| \cdot A^* \cdot W_R}{|A|^2} = \frac{\det|C| \cdot (C_{LL} \cdot d_R - C_{RL} \cdot d_L)^* \cdot W_R}{|C_{LL} \cdot d_R - C_{RL} \cdot d_L|^2} \tag{18}$$

Therefore, as represented by the following Expression (19), the complex sound pressure ratio at the target binaural position coincides with a complex sound pressure ratio of the acoustic signals that arrive at the target binaural positions from the target virtual acoustic source.

$$\frac{P_R}{P_L} = \frac{d_R}{d_L} \tag{19}$$

As described above, the acoustic control apparatus according to the first embodiment approximates the complex sound pressure ratio at the target binaural position to the complex sound pressure ratio of the acoustic signals that arrive at the target binaural position from the target virtual acoustic source. Therefore, according to this acoustic control apparatus, even when the listener's binaural position fluctuates from the target binaural position to some extent, since the fluctuation of the complex sound pressure ratio at the binaural position is small, the listener can perceive a direction of the virtual acoustic source.

(Second Embodiment)

In the first embodiment, as represented by Expression (16), based on one control filter coefficient ($W_R$ in Expression (16)), the other control filter coefficient ($W_L$ in Expression (16)) is determined. Here, a value of the one control filter coefficient can be arbitrarily set. For example, the one control filter coefficient may be set to have through characteristic, and the other control filter coefficient may be determined based on this coefficient. That is, in Expression (16), $W_R=1$ may be set. In the second embodiment, one control filter coefficient is set to have through characteristic.

Figure 6:
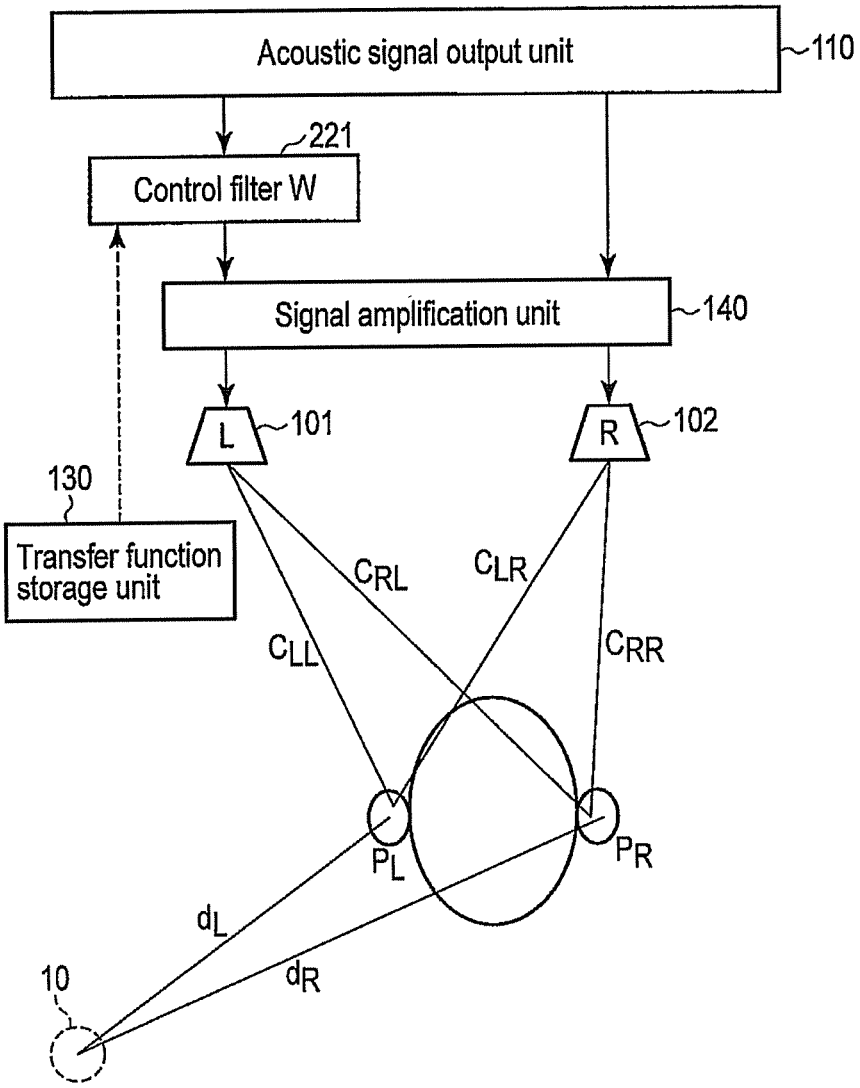
FIG. 6 is a block diagram showing an acoustic control apparatus according to a second embodiment.

When a right control filter coefficient ($=W_R$) has the through characteristic, control filter processing for a right acoustic signal can be omitted. That is, desired acoustic control can be realized by just performing control filter processing to a left acoustic signal. Therefore, as shown in FIG. 6, an acoustic control apparatus according to the present embodiment comprises loudspeakers 101 and 102, an acoustic signal output unit 110, a control filter 221, a transfer function storage unit 130, and a signal amplification unit 140.

The acoustic control apparatus shown in FIG. 6 performs later-described acoustic control to monaural acoustic signals output from the acoustic signal output unit 110 to approximate (e.g., conform) a complex sound pressure ratio at a target binaural position to a complex sound pressure ratio of acoustic signals that arrive at the target binaural position from a target virtual acoustic source. According to the acoustic control apparatus depicted in FIG. 6, even when a listener's binaural position fluctuates from the target binaural position to some extent, since a fluctuation of the complex sound pressure ratio at the binaural position is small, the listener can perceive a direction of the target virtual acoustic source.

The acoustic signal output unit 110 outputs the monaural acoustic signals (=S) as a left acoustic signal and a right acoustic signal to the control filter 221 and the signal amplification unit 140, respectively.

The control filter 221 reads from the transfer function storage unit 130 a head-related transfer function ($=C_{LL}$) from the loudspeaker 101 to the listener's left ear at the target binaural position, a head-related transfer function ($=C_{LR}$) from the loudspeaker 102 to the listener's left ear at the target binaural position, a head-related transfer function ($=C_{RL}$) from the loudspeaker 101 to the listener's right ear at the target binaural position, a head-related transfer function ($=C_{RR}$) from the loudspeaker 102 to the listener's right ear at the target binaural position, a head-related transfer function ($=d_L$) from the target virtual acoustic source to the listener's left ear at the target binaural position, and a head-related transfer function ($=d_R$) from the target virtual acoustic source to the listener's right ear at the target binaural position as required. That is, when the listener's binaural position greatly fluctuates from the target binaural position or when the target virtual acoustic source is changed, the control filter 221 may switch over the head-related transfer function.

The control filter 221 calculates a control filter coefficient (=W) to meet the following Expression (20) based on the head-related transfer function read from the transfer function storage unit 130. The following expression (20) can be derived by setting $W_L=W$ and $W_R=1$ in the above Expression (16). It is to be noted that the calculation of the control filter coefficient (=W) may be performed by a non-illustrated coefficient calculation unit in place of the control filter 221. Alternatively, a control filter coefficient (=W) associated with a combination of the target binaural position and the target virtual acoustic source may be calculated in advance, and the control filter 221 may read out an appropriate control filter coefficient (=W).

$$W = -\frac{B \cdot A^*}{A \cdot A^*} = -\frac{B \cdot A^*}{|A|^2} \tag{20}$$

$$\because A = C_{LL} \cdot d_R - C_{RL} \cdot d_L$$

$$B = C_{LR} \cdot d_R - C_{RR} \cdot d_L$$

The control filter 221 multiplies the control filter coefficient (=W) by the left acoustic signal (=S) from the acoustic signal output unit 110 and inputs a result to the signal amplification unit 140. On the other hand, as described above, the right acoustic signal is not subjected to the control filter processing. The signal amplification unit 140 amplifies the acoustic signal (=WS) from the control filter 221 and the acoustic signal (=S) from the acoustic signal output unit 110 in accordance with gain, and supplies the amplified signals to the loudspeaker 101 and the loudspeaker 102, respectively.

According to the acoustic control apparatus depicted in FIG. 6, incoming sound pressures (=$P_L$, $P_R$) at the target binaural position can be expressed by the following Expression (21).

$$\begin{aligned}\begin{pmatrix} P_L \\ P_R \end{pmatrix} &= \begin{pmatrix} C_{LL} & C_{LR} \\ C_{RL} & C_{RR} \end{pmatrix} \begin{pmatrix} -\frac{B \cdot A^*}{|A|^2} & 0 \\ 0 & 1 \end{pmatrix} \begin{pmatrix} S \\ S \end{pmatrix} \\ &= \begin{pmatrix} C_{LL} & C_{LR} \\ C_{RL} & C_{RR} \end{pmatrix} \begin{pmatrix} \frac{C_{RR}}{\det|C|} & -\frac{C_{LR}}{\det|C|} \\ -\frac{C_{RL}}{\det|C|} & \frac{C_{LL}}{\det|C|} \end{pmatrix} \\ &\quad \begin{pmatrix} \frac{\det|C| \cdot A^*}{|A|^2} & 0 \\ 0 & \frac{\det|C| \cdot A^*}{|A|^2} \end{pmatrix} \begin{pmatrix} d_L & 0 \\ 0 & d_R \end{pmatrix} \begin{pmatrix} S \\ S \end{pmatrix} \\ &= \begin{pmatrix} \frac{\det|C| \cdot A^*}{|A|^2} & 0 \\ 0 & \frac{\det|C| \cdot A^*}{|A|^2} \end{pmatrix} \begin{pmatrix} d_L & 0 \\ 0 & d_R \end{pmatrix} \begin{pmatrix} S \\ S \end{pmatrix} \\ &= \begin{pmatrix} \frac{\det|C| \cdot A^* \cdot d_L \cdot S}{|A|^2} \\ \frac{\det|C| \cdot A^* \cdot d_R \cdot S}{|A|^2} \end{pmatrix} \\ &= \begin{pmatrix} \frac{\det|C| \cdot A^* \cdot S}{|A|^2} & 0 \\ 0 & \frac{\det|C| \cdot A^* \cdot S}{|A|^2} \end{pmatrix} \begin{pmatrix} d_L \\ d_R \end{pmatrix}\end{aligned} \tag{21}$$

That is, the incoming sound pressures (=$P_L$, $P_R$) at the target binaural position are equal to results obtained by multiplying acoustic signals (=$d_L$S, $d_R$S) arriving at the target binaural position from the target virtual acoustic source by a coefficient shown in the following Expression (22).

$$\frac{\det|C| \cdot A^*}{|A|^2} = \frac{\det|C| \cdot (C_{LL} \cdot d_R - C_{RL} \cdot d_L)^*}{|C_{LL} \cdot d_R - C_{RL} \cdot d_L|^2} \tag{22}$$

Therefore, as represented by the above Expression (19), a complex sound pressure ratio at the target binaural position coincides with a complex sound pressure ratio of acoustic signal arriving at the target binaural position from the target virtual acoustic source.

Adequacy of effects of the acoustic control apparatus according to the present embodiment will now be described hereinafter with reference to an experimental result.

A measuring method for a head-related transfer function will be first explained. Each head-related transfer function (i.e., $C_{L1L}$, $C_{L1R}$, $C_{R1L}$, $C_{R1R}$) from the loudspeakers 101 and 102 to the target binaural position (i=1) can be measured by emitting acoustic signals from the loudspeakers 101 and 102 and receiving the signals by microphones put on both ears of a dummy head disposed at the target binaural position.

Figure 7:
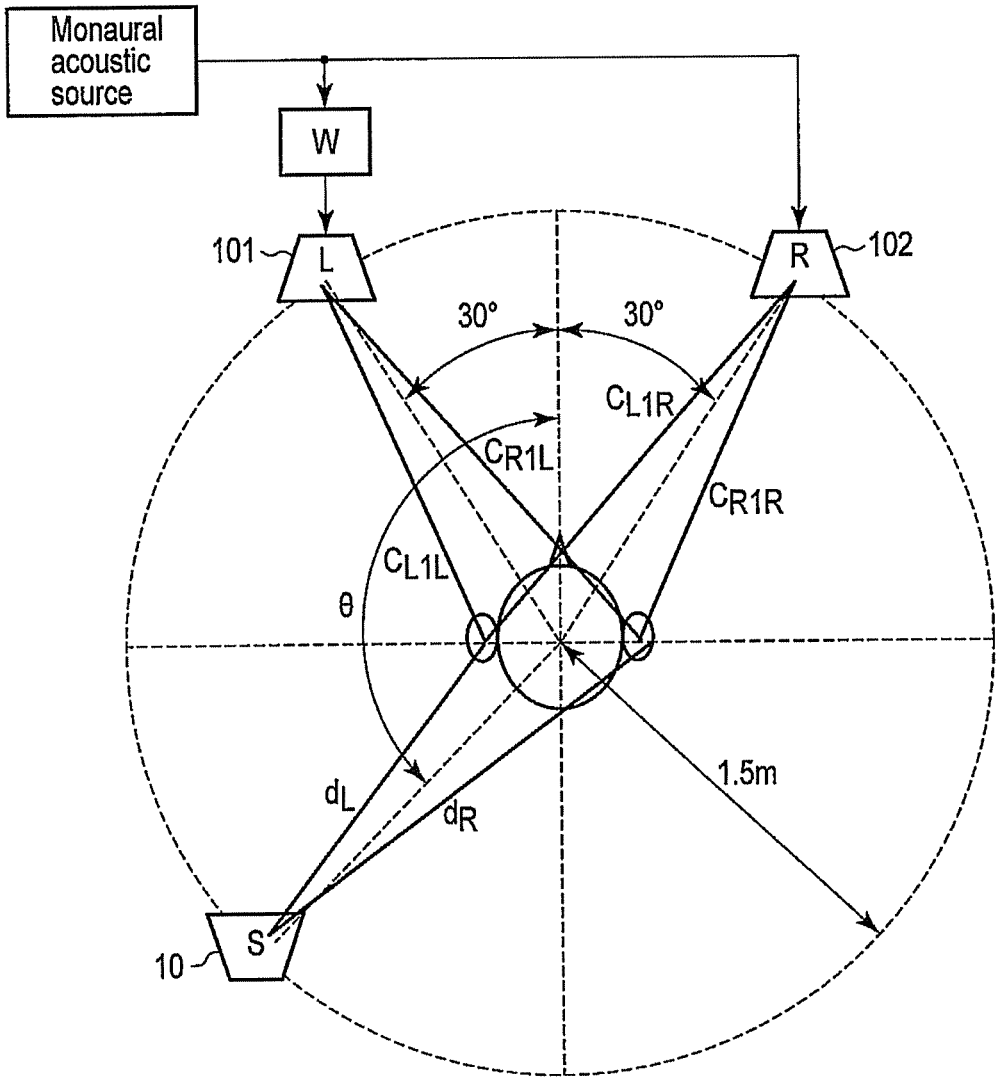
FIG. 7 is an explanatory view of a measuring method for a head-related transfer function from a target virtual acoustic source to a target binaural position.

Further, as shown in FIG. 7, each head-related transfer function (i.e., $d_L$, $d_R$) from the virtual acoustic source 10 to the target binaural position can be measured by actually installing a loudspeaker at a position of the virtual acoustic source 10 to emit acoustic signals and receiving he signals by the microphones.

Figure 8:
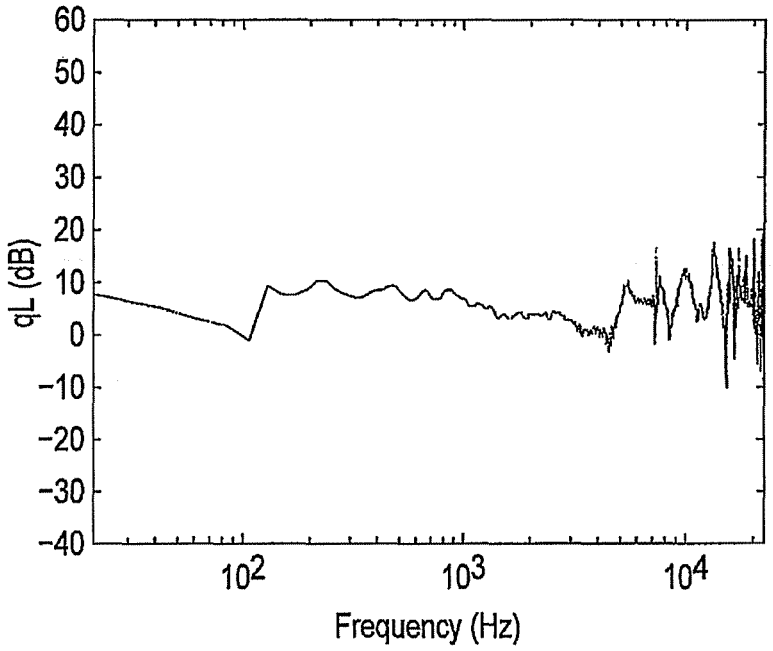
FIG. 8 is a graph showing frequency characteristic of a complex volume velocity of a left loudspeaker of the acoustic control apparatus according to the second embodiment.
Figure 9:
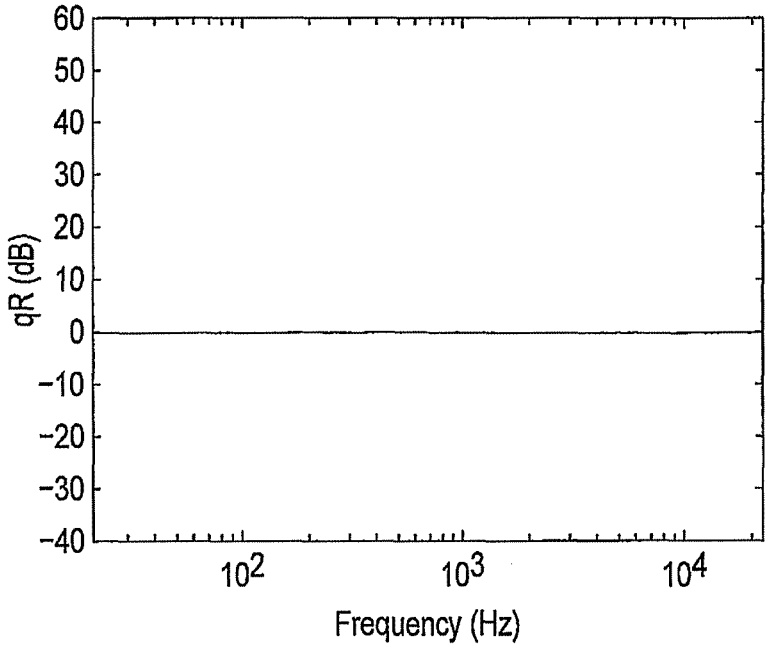
FIG. 9 is a graph showing frequency characteristic of a complex volume velocity of a right loudspeaker of the acoustic control apparatus according to the second embodiment.

FIG. 8 shows frequency characteristic of a complex volume velocity (=$q_L$) of the loudspeaker 101 under first conditions that the virtual acoustic source 10 is set to a direction of 135 degrees (45 degrees in a left rear direction of the listener) and a distance of 1.5 m. Furthermore, FIG. 9 shows frequency characteristic of a complex volume velocity (=$q_R$) of the loudspeaker 102 under the first conditions. It is to be noted that, since the right acoustic signal is not subjected to the control filter processing, an amplitude is 0 dB (i.e., 1) over a band as obvious from FIG. 9.

Figure 10:
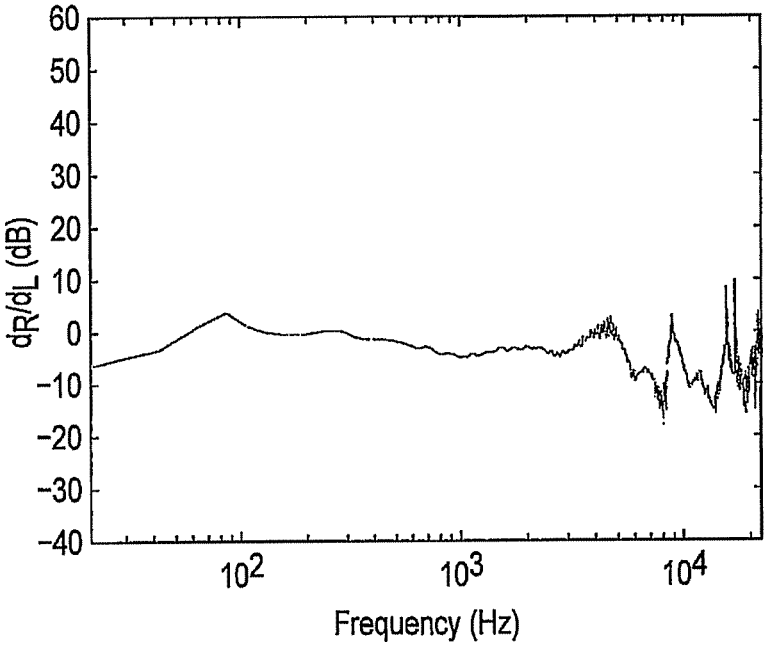
FIG. 10 is a graph showing amplitude characteristic of a head-related transfer function ratio from a target virtual acoustic source to a target binaural position.
Figure 11:
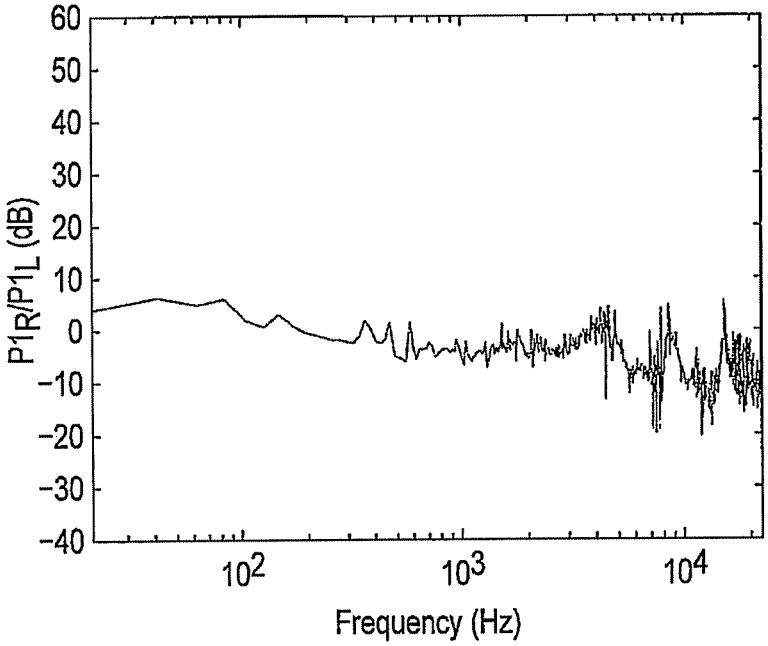
FIG. 11 is a graph showing amplitude characteristic of a complex sound pressure ratio at the target binaural position when the complex volume velocities depicted in FIG. 8 and FIG. 9 are given.

FIG. 10 shows amplitude characteristic of a head-related transfer function ratio (=$d_R/d_L$) from the target virtual acoustic source to the target binaural position under the first conditions. FIG. 11 shows amplitude characteristic of a complex sound pressure ratio (=$P_R/P_L$) at the target binaural position under the first conditions. Comparing FIG. 10 and FIG. 11 to each other, it can be confirmed that an amplitude of the complex sound pressure ratio at the target binaural position substantially coincides with an amplitude of the head-related transfer function ratio from the target virtual acoustic source to the target binaural position over a broadband (up to at least 20 kHz).

Figure 12:
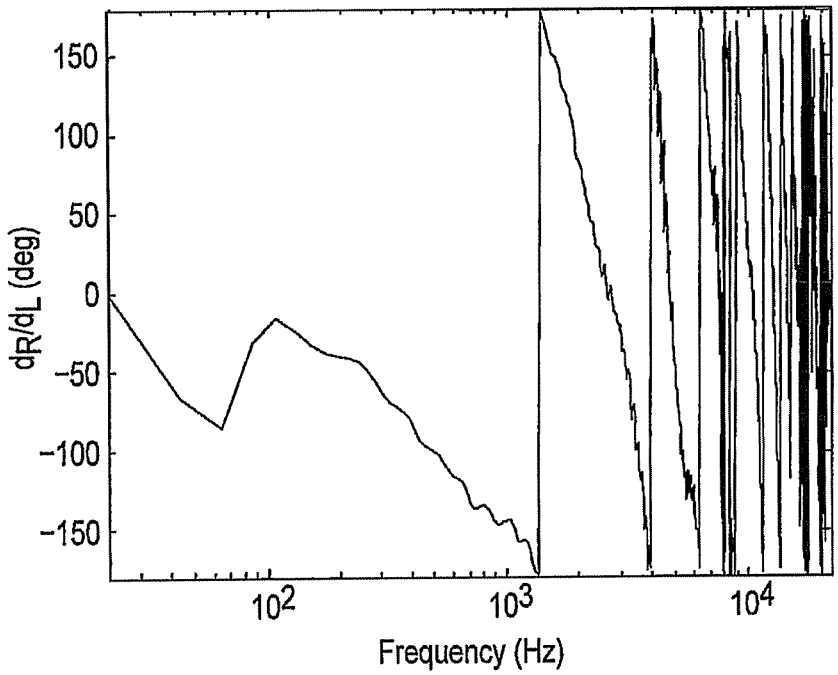
FIG. 12 is a graph showing phase characteristic of a head-related transfer function ratio from the target virtual acoustic source to the target binaural position.
Figure 13:
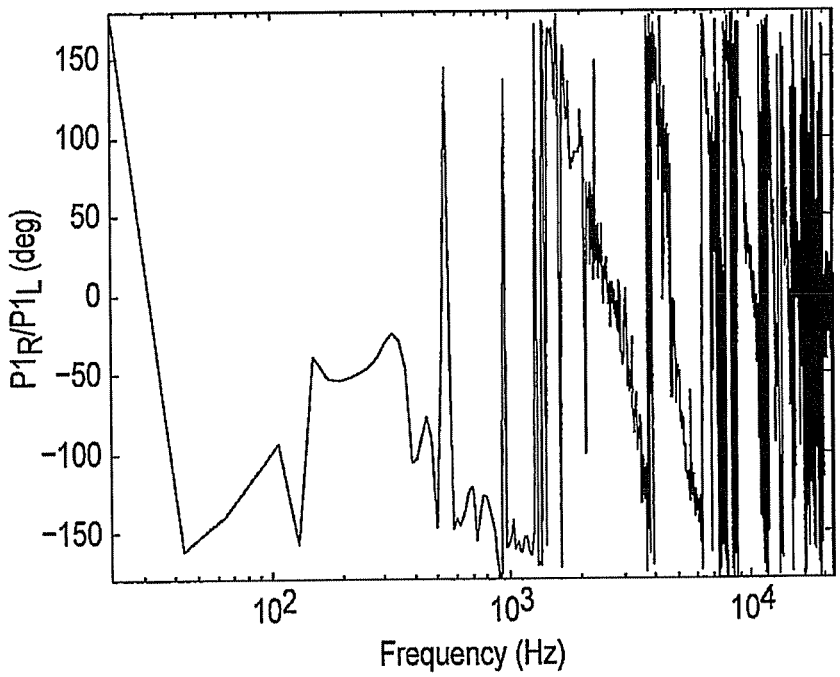
FIG. 13 is a graph showing phase characteristic of a complex sound pressure ratio at the target binaural position when the complex volume velocities depicted in FIG. 8 and FIG. 9 are given.

FIG. 12 shows phase characteristic of the head-related transfer function ratio (=$d_R/d_L$) from the target virtual acoustic source to the target binaural position under the first conditions. FIG. 13 shows phase characteristic of the complex sound pressure ratio (=$P_R/P_L$) at the target binaural position under the first conditions. Comparing FIG. 12 and FIG. 13 to each other, it can be confirmed that a phase of the complex sound pressure ratio at the target binaural position substantially coincides with a phase of the head-related transfer function ratio from the target virtual acoustic source to the target binaural position over a broadband (up to at least 20 kHz).

Figure 14:
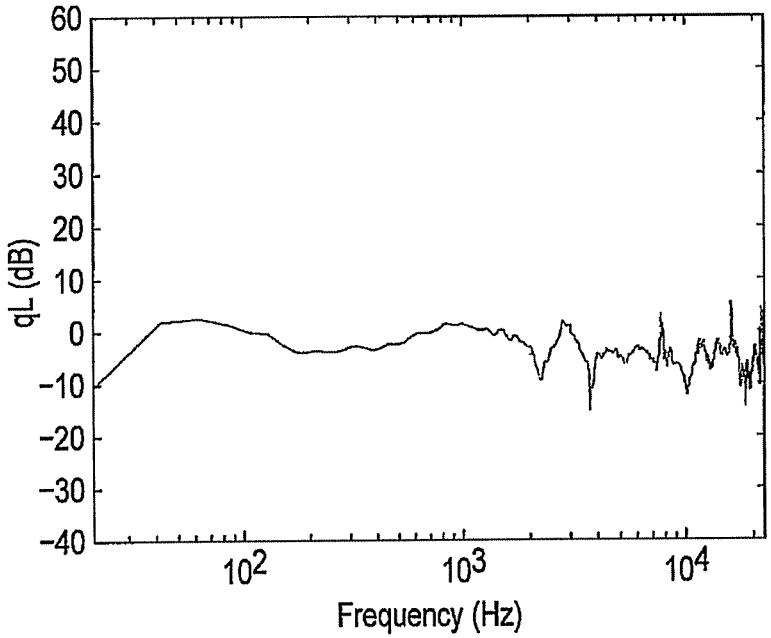
FIG. 14 is a graph showing frequency characteristic of the complex volume velocity of the left loudspeaker of the acoustic control apparatus according to the second embodiment.
Figure 15:
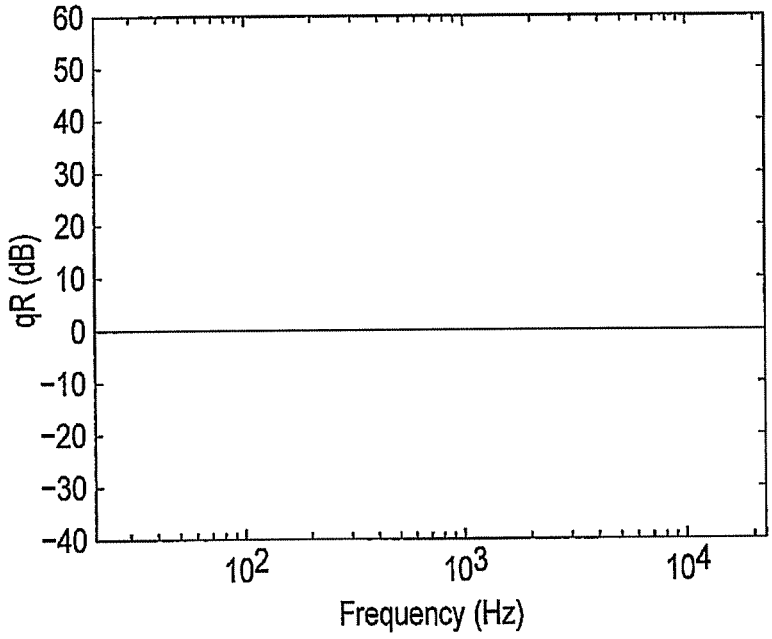
FIG. 15 is a graph showing frequency characteristic of the complex volume velocity of the right loudspeaker of the acoustic control apparatus according to the second embodiment.

FIG. 14 shows frequency characteristic of the complex volume velocity (=$q_L$) of the loudspeaker 101 under second conditions that the virtual acoustic source is set to a direction of 270 degrees (the right-hand side of the listener) and a distance of 1.5 m. Furthermore, FIG. 15 shows frequency characteristic of the complex volume velocity (=$q_R$) of the loudspeaker 102 under the second conditions. It is to be noted that, since the right acoustic signal is not subjected to the control filter processing, an amplitude is 0 dB (i.e., 1) over a band like FIG. 9 as obvious from FIG. 15. On the other hand, since the head-related transfer function (=$d_L$, $d_R$) from the target virtual acoustic source to the target binaural position fluctuates in response to a change of the target virtual acoustic source, the control filter coefficient W also fluctuates. Therefore, the frequency characteristic depicted in FIG. 14 do not coincide with the frequency characteristic shown in FIG. 8.

Figure 16:
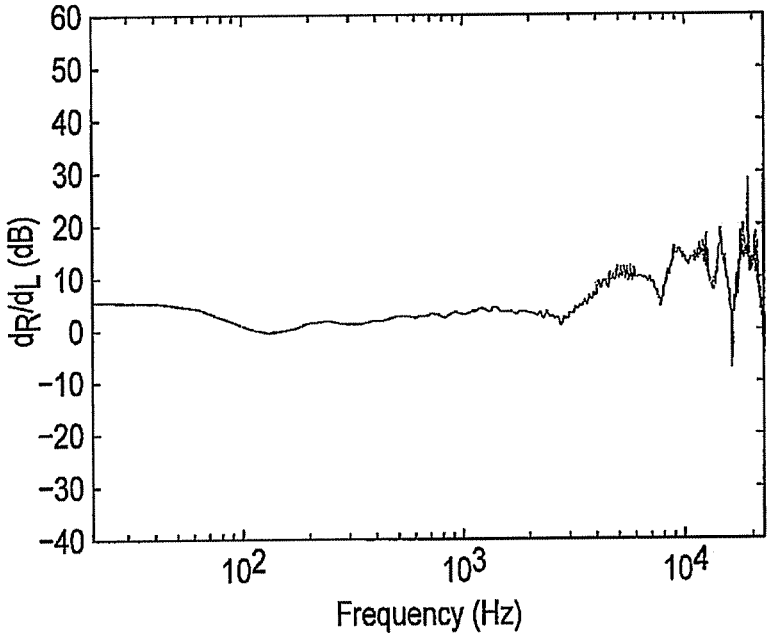
FIG. 16 is a graph showing amplitude characteristic of a head-related transfer function ratio from the target virtual acoustic source to the target binaural position.
Figure 17:
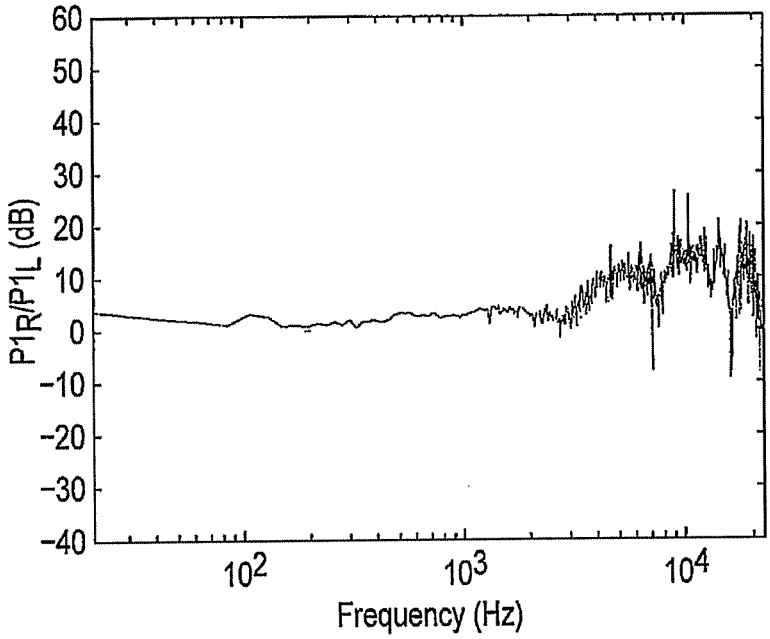
FIG. 17 is a graph showing amplitude characteristic of a complex sound pressure ratio at the target binaural position when the complex volume velocities depicted in FIG. 14 and FIG. 15 are given.

FIG. 16 shows amplitude characteristic of a head-related transfer function ratio (=$d_R/d_L$) from the target virtual acoustic source to the target binaural position under the second conditions. FIG. 17 shows amplitude characteristic of a complex sound pressure ratio (=$P_R/P_L$) at the target binaural position under the second conditions. Comparing FIG. 16 and FIG. 17 to each other, it can be confirmed that an amplitude of the complex sound pressure ratio at the target binaural position substantially coincides with an amplitude of the head-related transfer function ratio from the target virtual acoustic source to the target binaural position over a broadband (up to at least 20 kHz).

Figure 18:
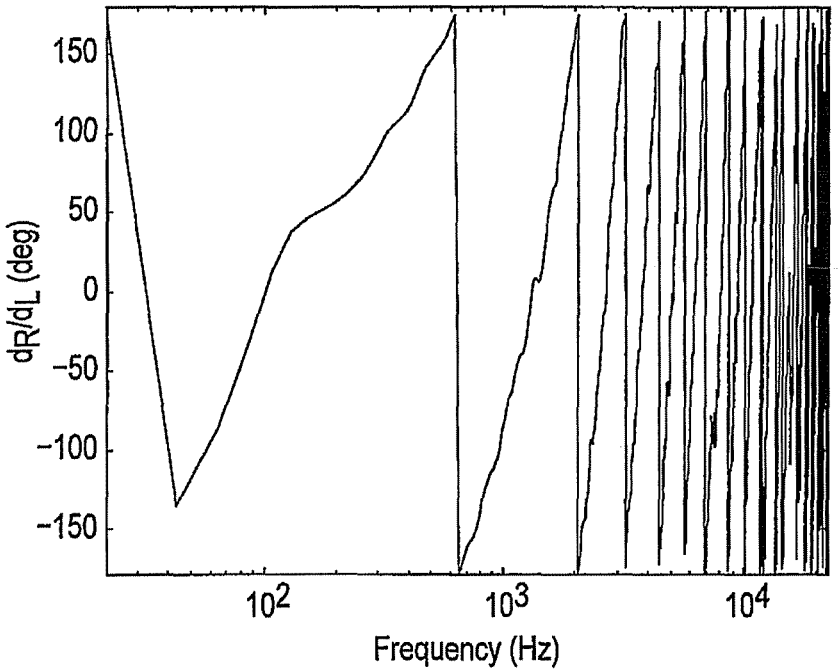
FIG. 18 is a graph showing phase characteristic of a head-related transfer function ratio from the target virtual acoustic source to the target binaural position.
Figure 19:
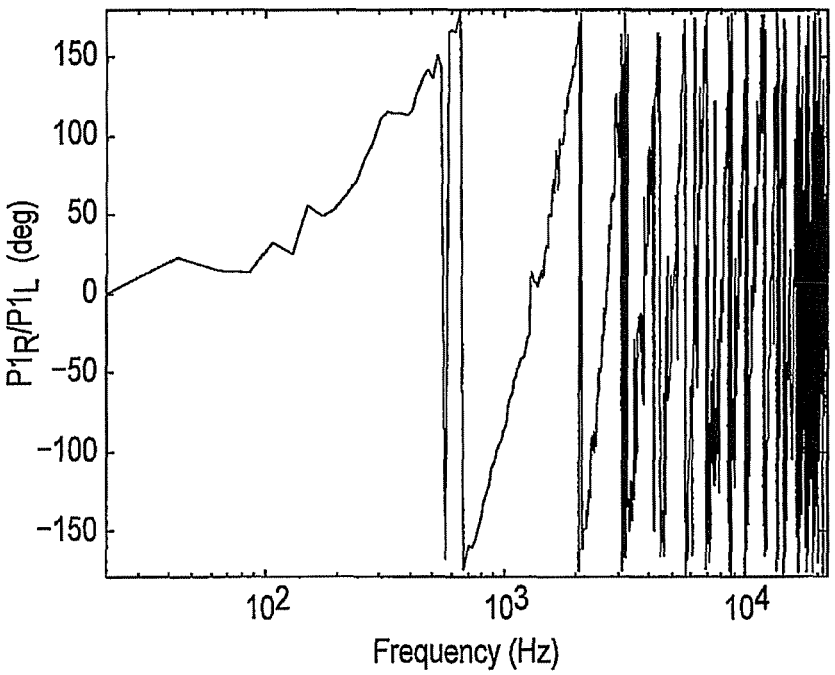
FIG. 19 is a graph showing phase characteristic of a complex sound pressure ratio at the target binaural position when the complex volume velocities depicted in FIG. 14 and FIG. 15 are given.

FIG. 18 shows phase characteristic of the head-related transfer function ratio ($=d_R/d_L$) from the target virtual acoustic source to the target binaural position under the second conditions. FIG. 19 shows phase characteristic of the complex sound pressure ratio ($=P_R/P_L$) at the target binaural position under the second conditions. Comparing FIG. 18 and FIG. 19 to each other, it can be confirmed that a phase of the complex sound pressure ratio at the target binaural position substantially coincides with a phase of the head-related transfer function ratio from the target virtual acoustic source to the target binaural position over a broadband (up to at least 20 kHz).

As described above, it can be confirmed from the comparison of the graphs that the complex sound pressure ratio at the target binaural position substantially coincides with the head-related transfer function ratio from the target virtual acoustic source to the target binaural position. Moreover, the adequacy of a sense of lateralization provided by the acoustic control apparatus depicted in FIG. 6 can be evaluated based on an interaural cross-correlation function (IACF). The IACF is generally used as an index of extensity of sound. The IACF is represented by the following Expression (23).

$$IACF(\tau) = \frac{\int_{t1}^{t2} P_L(t)P_R(t+\tau)dt}{\sqrt{\int_{t1}^{t2} P_L^2(t)dt \cdot \int_{t1}^{t2} P_R^2(t)dt}} \tag{23}$$

In Expression (23), each of $P_L(t)$ and $P_R(t)$ indicates a sound pressure arriving at the left ear and a sound pressure arriving at the right ear at a time t, respectively. t1 and t2 represent a measurement start time and a measurement end time, respectively. Although t1=0 and t2=∞ are set in theory, a time associated with a reverberation time is usually give to t2. τ represents a correlation peak time. Usually, −1 msec ≤τ≤ msec is set.

A maximum value of an absolute value of the IACF is called an interaural cross-correlation (IACC). The IACC represents a degree of coincidence of sound pressure waveforms arriving at the listener's both ears. A sense of auditory lateralization is increased as the IACC is larger, and the sense of auditory lateralization is lowered (i.e., a sound image blurs) as the IACC is smaller. Evaluation based on the IACF will now be described.

Figure 20:
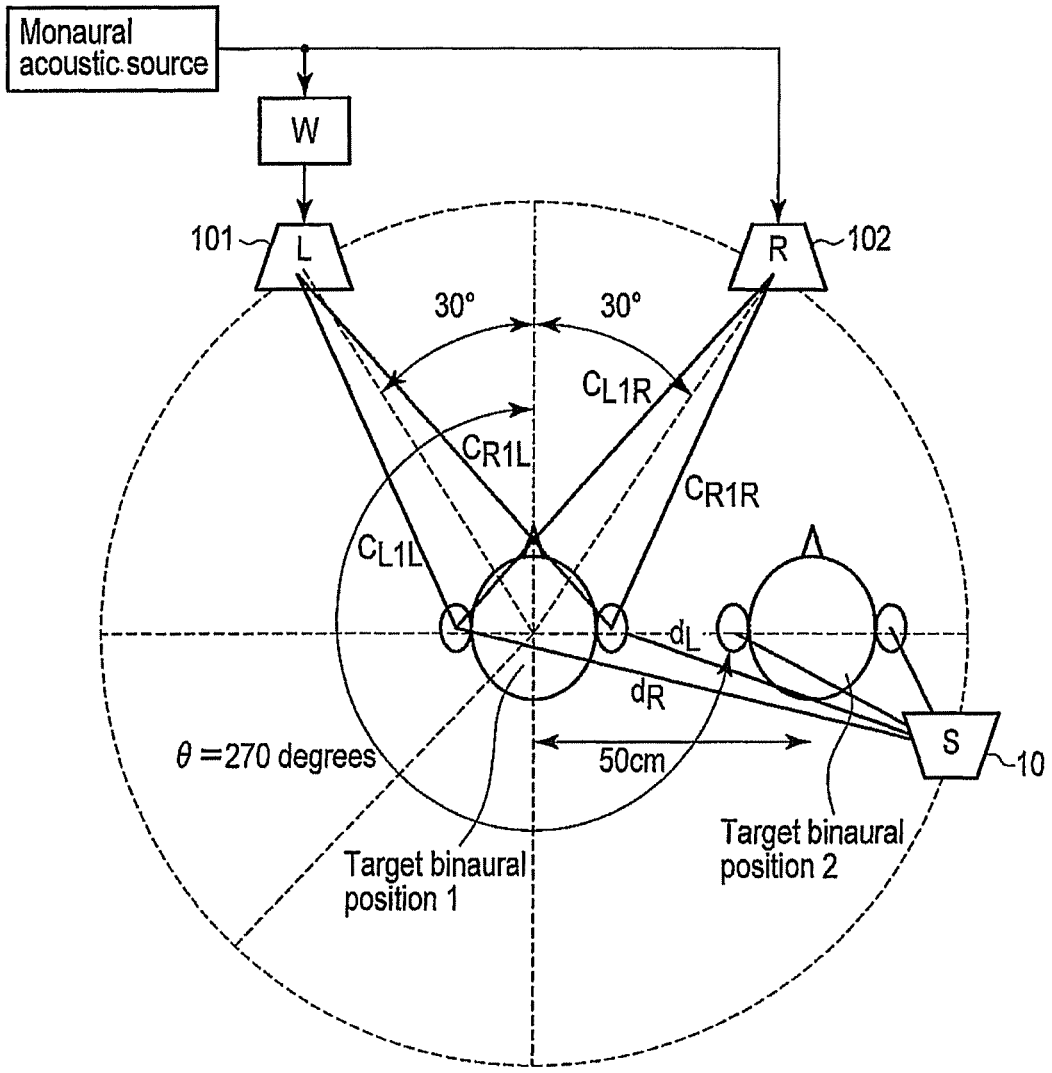
FIG. 20 is an explanatory view of a measuring method for an IACF.

A measuring method for the head-related transfer function will be first explained. Each head-related transfer function (i.e., $C_{L1L}$, $C_{L1R}$, $C_{R1L}$, $C_{R1R}$ or $C_{L2L}$, $C_{L2R}$, $C_{R2L}$, $C_{R2R}$) from the loudspeakers 101 and 102 to the target binaural position (i=1 or 2) can be measured by emitting acoustic signals from the loudspeakers 101 and 102 and receiving the signals by the microphones put on both ears of the dummy head disposed at the target binaural position. Further, each head-related transfer function (i.e., $d_L$, $d_R$) from the virtual acoustic source 10 to the target binaural position can be measured by actually installing the loudspeaker at the position of the virtual acoustic source 10 to emit acoustic signals and receiving the signals by the microphones as shown in, e.g., FIG. 20.

Figure 21:
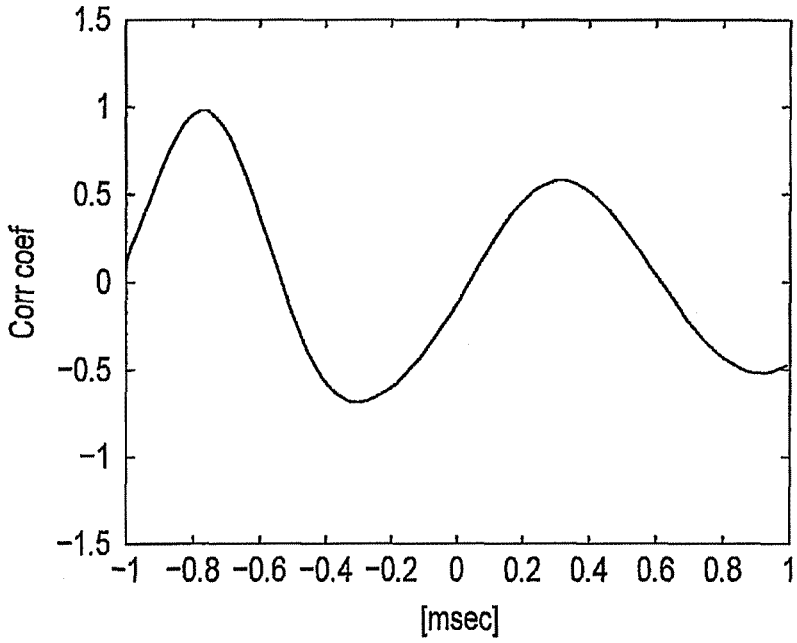
FIG. 21 is a graph showing a measurement result of an IACF at a first binaural position when a loudspeaker is actually installed at a position of the virtual acoustic source and a test acoustic signal is emitted.

FIG. 21 shows a measurement result of the IACF when the loudspeaker is actually installed at the position of the virtual acoustic source 10 to emit test acoustic signals under third conditions that the virtual acoustic source 10 is set to a direction of 270 degrees (the right-hand side of the target binaural position (i=1)). Here, as the test acoustic signals, a crow's caw that continues for approximately 1 second was used. Since the IACF in FIG. 21 is based on the left ear, a maximum correlation peak appeared in a negative time region (approximately −0.8 msec). That is, it can be confirmed that direct sound arrives at the left ear after a time lag of approximately 0.8 msec from arrival of the direct sound at the right ear. Furthermore, the test acoustic signals have a band containing 1 kHz as a major component and its cycle is approximately 1 msec. Therefore, another correlation peak also appeared in a positive time region (approximately 0.2 msec).

Figure 22:
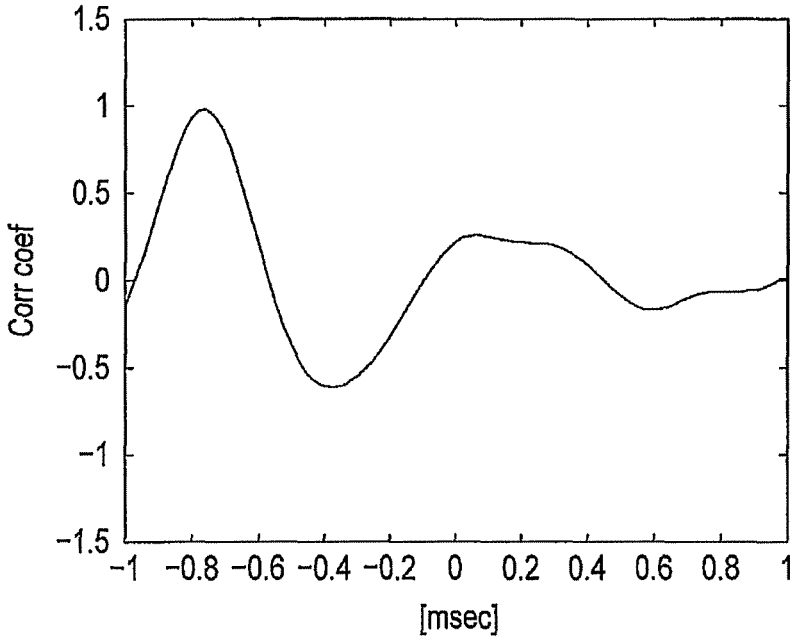
FIG. 22 is a graph showing a calculation result of the IACF at the first binaural position when control filter processing based on a head-related transfer function concerning the first binaural position is performed.
Figure 23:
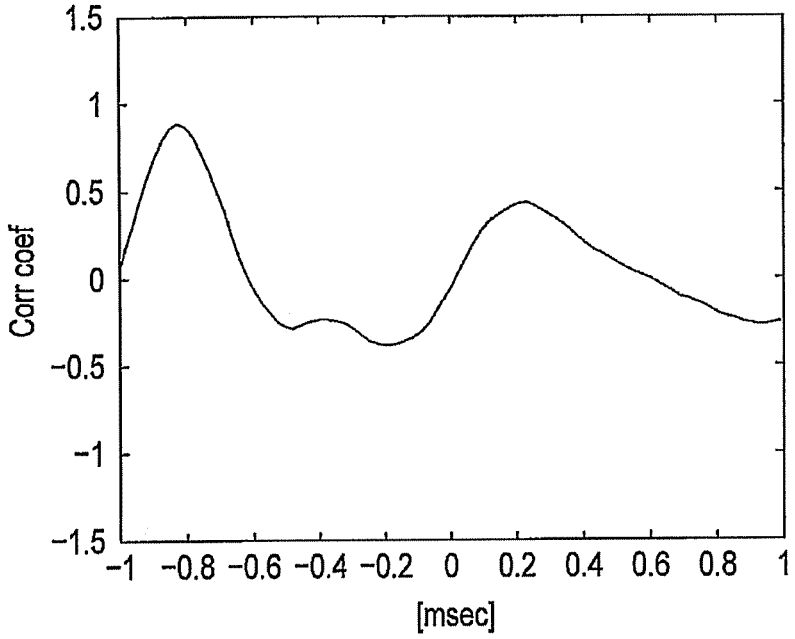
FIG. 23 is a graph showing a measurement result of the IACF at the first binaural position when the control filter processing based on the head-related transfer function concerning the first binaural position is performed.

Additionally, FIG. 22 shows a calculation result of the IACF at the target binaural position (i=1) when a control filter coefficient is calculated based on the head-related transfer function measured under the third conditions and the acoustic control according to the present embodiment is applied to the test acoustic signals. In regard to the IACF in FIG. 22, it can be confirmed that a maximum correlation peak appeared at substantially the same time as that of the IACF in FIG. 21. Further, FIG. 23 shows a measurement result of the IACF at the binaural position (i=1) when a control filter coefficient is calculated based on the head-related transfer function measured under the third conditions and the acoustic control according to the present embodiment is applied to the test acoustic signals. In regard to the IACF in FIG. 23, it can be also confirmed that a maximum peak appeared at substantially the same time as the IACF in FIG. 21. Furthermore, a test subject's auditory impression was examined when a control filter coefficient was calculated based on the head-related transfer function measured under the third conditions and the acoustic control according to the present embodiment was applied to the test acoustic signals. Based on this examination, a sense of auditory lateralization in the direction of 270 degrees was likewise confirmed.

Figure 24:
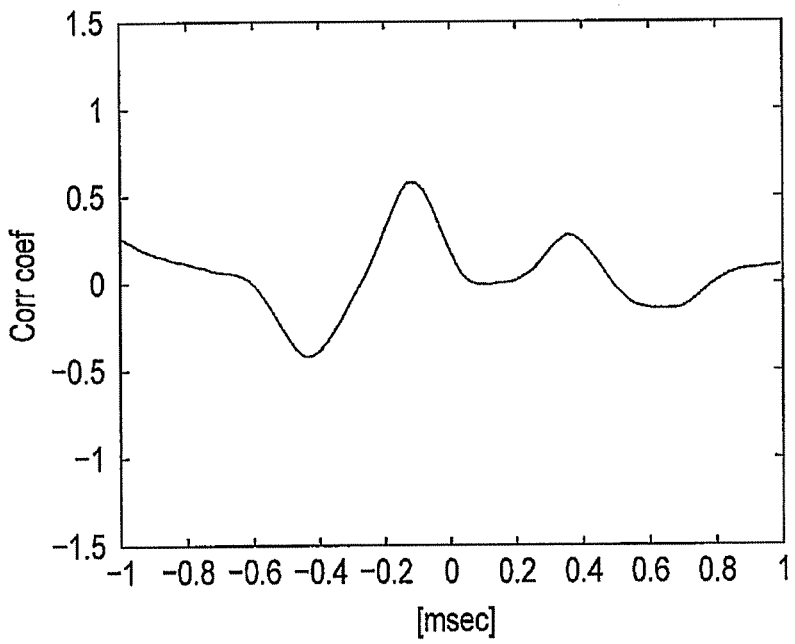
FIG. 24 is a graph showing a measurement result of the IACF at a second binaural position when the control filter processing based on the head-related transfer function concerning the first binaural position is performed.

A description will now be given as to a measurement result of the IACF under fourth conditions that the target binaural position (i=1) is moved to a target binaural position (i=2) that is 50 cm apart in the right direction, the position of the virtual acoustic source 10 being the same as that in the third conditions. FIG. 24 shows a measurement result of the IACF at the target binaural position (i=2) when a control filter coefficient was calculated based on the head-related transfer function measured under the third conditions and the acoustic control according to the present embodiment was applied to the test acoustic signals. In regard to the IACF in FIG. 24, a time at which a maximum peak appears is different from that of the IACF in FIG. 21. Furthermore, according to the auditory impression examined from the test subject, a sound image is attached to the right loudspeaker 102, and a sense of auditory lateralization in the direction of 270 degrees cannot be confirmed.

Figure 25:
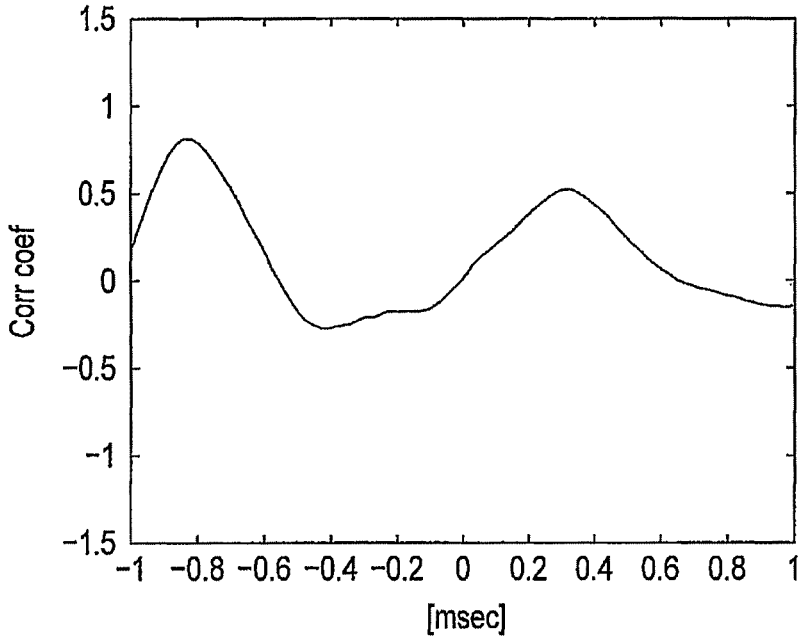
FIG. 25 is a graph showing a measurement result of the IACF at the second binaural position when the control filter processing based on a head-related transfer function concerning the second binaural position is performed.

Then, the head-related transfer function was newly measured under the fourth conditions, a control filter coefficient was calculated based on the measurement result, and the acoustic control according to the present embodiment was applied to the test acoustic signals. As a result, FIG. 25 shows the IACF measured at the target binaural position (i=2). In regard to the IACF in FIG. 25, it can be confirmed that a maximum peak appeared at substantially the same time as that in FIG. 21. Moreover, a sense of auditory lateralization in the direction of 270 degrees was also confirmed from the test subject's auditory impression. On the other hand, FIG. 26 shows a measurement result of the IACF at the target binaural position (i=1) when a control filter coefficient was calculated based on the head-related transfer function measured under the fourth conditions and the acoustic control according to the present embodiment was applied to the test acoustic signals.

Figure 26:
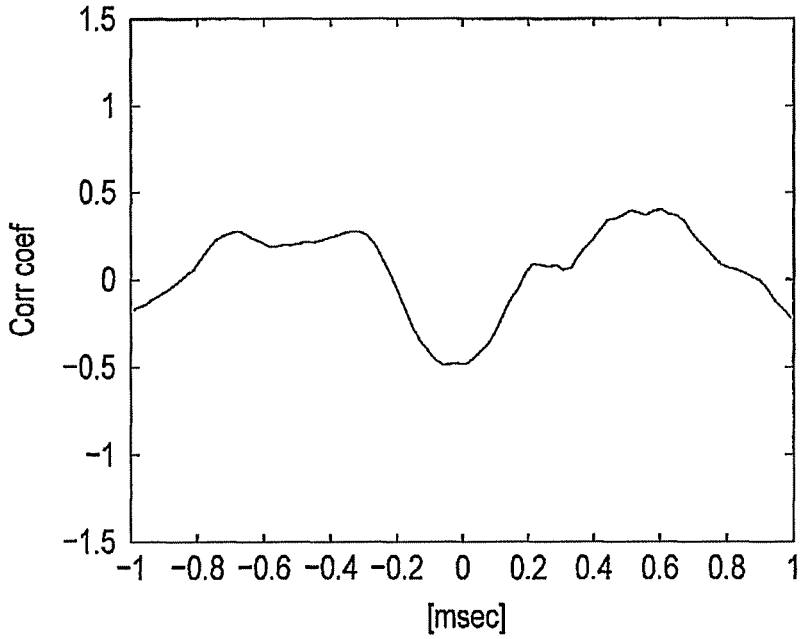
FIG. 26 is a graph showing a measurement result of the IACF at the first binaural position when the control filter processing based on the head-related transfer function concerning the second binaural position is performed.

The IACF in FIG. 26 is different from the IACF in FIG. 21 in a time at which a maximum peak appears.

It was confirmed from the measurement results that the sense of auditory lateralization of the virtual acoustic source is hard to be maintained unless the head-related transfer function at the binaural position after movement is used even though the listener's binaural position is moved from the target binaural position 50 cm only which corresponds to one chair. On the other hand, it was confirmed that, if the head-related transfer function is appropriate, the sense of auditory lateralization of the virtual acoustic source can be obtained by just applying the control filter processing to one acoustic signal.

As described above, the acoustic control apparatus according to the second embodiment approximates the complex sound pressure ratio at the target binaural position to the complex sound pressure ratio of the acoustic signals arriving at the target binaural position from the virtual acoustic source while omitting the control filter processing for one acoustic signal. Therefore, according to this acoustic control apparatus, a hardware configuration can be simplified, and the same effects as those of the first embodiment can be obtained.

(Third Embodiment)

Figure 27:
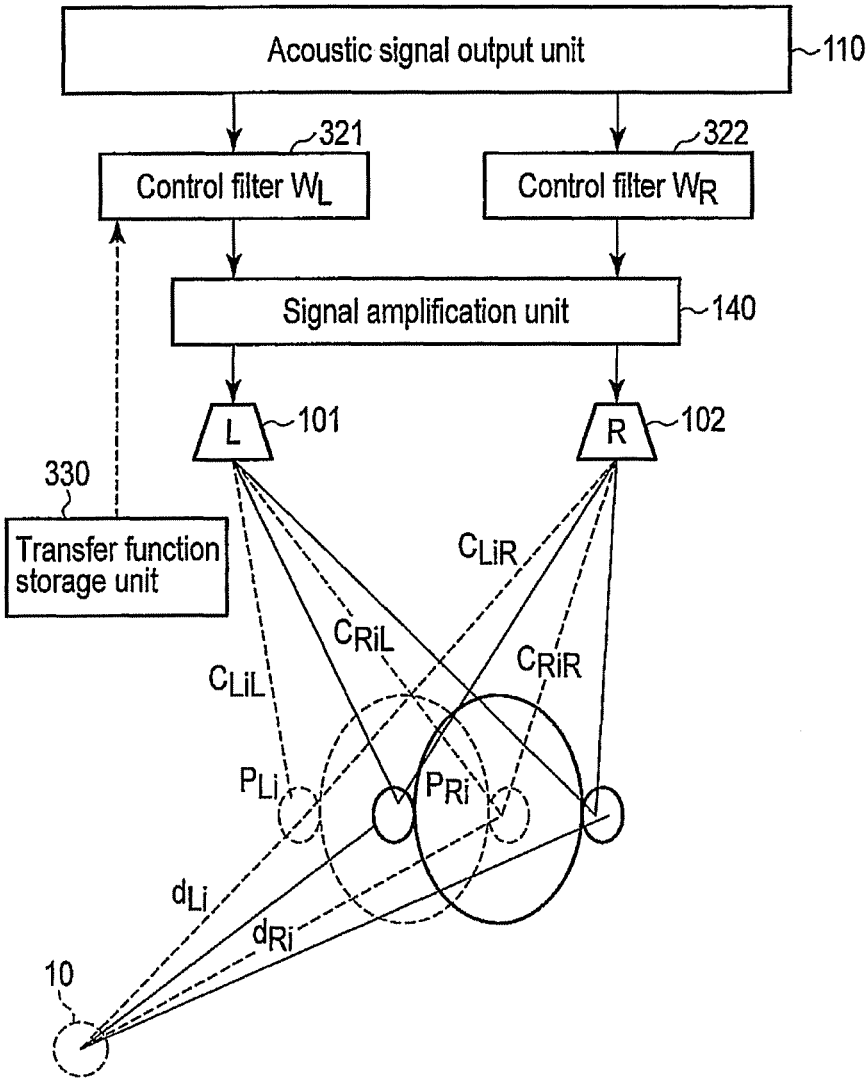
FIG. 27 is a block diagram showing an acoustic control apparatus according to a third embodiment.

In the first and second embodiments, the total number of the target binaural position that is considered at a time is 1. In a third embodiment, the total number of the target binaural positions that are considered at a time is increased to 2 or more, thereby enhancing robustness with respect to a fluctuation of a listener's binaural position. That is, according to the present embodiment, the above Expression (14) is met with regard to N≥2. As shown in FIG. 27, an acoustic control apparatus according to the present embodiment comprises loudspeakers 101 and 102, an acoustic signal output unit 110, control filters 321 and 322, a transfer function storage unit 330, and a signal amplification unit 140.

The acoustic control apparatus in FIG. 27 performs later-described acoustic control with respect to monaural acoustic signals output from the acoustic signal output unit 110 and approximates (e.g., conforms) a spatial average of complex sound pressure ratios at target binaural positions to a spatial average of complex sound pressure ratios of acoustic signals arriving at these target binaural positions from a target virtual acoustic source. Here, the spatial average of the complex sound pressure ratios means a ratio of the sums of the squares of complex amplitude functions at the target binaural positions at a given time as represented by, e.g., the following Expression (24). The complex amplitude function means a function represented by using a head-related transfer function (=C) from each loudspeaker to each of a left ear and a right ear at each target binaural position and a head-related transfer function (=d) from each target virtual acoustic source to each of the left ear and the right ear at each target binaural position. It is to be noted that the sum may possibly include a weighted sum. When a control filter coefficient represented by Expression (24) is convoluted in acoustic signals (=S), spatial averaging of the incoming complex sound pressure ratios at the target binaural positions can be realized. According to the acoustic control apparatus depicted in FIG. 27, since the incoming complex sound pressure ratios at the target binaural positions can be spatially averaged, deterioration of a sense of auditory lateralization can be suppressed even though the listener's binaural position greatly fluctuates (e.g., approximately several tens of cm). That is, robust acoustic control can be realized with respect to a fluctuation in the listener's binaural position.

The acoustic signal output unit 110 outputs monaural acoustic signals (=S) as a left acoustic signal and a right acoustic signal to the control filter 321 and the control filter 322, respectively. The transfer function storage unit 330 stores head-related transfer functions with regard to a plurality of (at least N) target binaural positions. Specifically, the transfer function storage unit 330 stores head-related transfer function sets from the loudspeakers 101 and 102 to the target binaural positions and head-related transfer function sets from at least one target virtual acoustic source (e.g., the virtual acoustic source 10) to the target binaural positions.

The control filter 321 reads from the transfer function storage unit 330 head-related transfer functions ($C_{LiL}$) from the loudspeaker 101 to the listener's left ear at the target binaural positions (i=1, . . . , N), head-related transfer functions (=$C_{LiR}$) from the loudspeaker 102 to the listener's left ear at the target binaural positions (i=1, . . . , N), head-related transfer functions (=$C_{RiL}$) from the loudspeaker 101 to the listener's right ear at the target binaural positions (i=1, . . . , N), head-related transfer functions (=$C_{RiR}$) from the loudspeaker 102 to the listener's right ear at the target binaural positions (i=1, . . . , N), head-related transfer functions (=$d_{Li}$) from the target virtual acoustic source to the listener's left ear at the target binaural positions, and head-related transfer functions (=$d_{Ri}$) from the target virtual acoustic source to the listener's right ear at the target binaural positions (i=1, . . . , N) as required. That is, when the listener's binaural position greatly fluctuates from any one of the target binaural positions (i=1, . . . , N) or when the target virtual acoustic source is changed, the control filter 321 may switch over the head-related transfer function.

The control filter 321 calculates a control filter coefficient (=$W_L$) to meet the following Expression (24) based on the head-related transfer function read from the transfer function storage unit 330 and a control filter coefficient (=$W_R$) of the control filter 322. It is to be noted that the calculation of the control filter coefficient (=$W_L$) may be carried out by a non-illustrated coefficient calculation unit in place of the control filter 321. Alternatively, the control filter coefficients (=$W_L$) associated with a combination of the control filter coefficient (=$W_R$) of the control filter 322, the target binaural positions and the target virtual acoustic source may be calculated in advance, and the control filter 321 may read out the appropriate control filter coefficient (=$W_L$).

$$W_L = -\frac{\sum_{i=1}^{N}(B_i \cdot A_i^*)}{\sum_{i=1}^{N}(A_i \cdot A_i^*)} W_R = -\frac{\sum_{i=1}^{N}(B_i \cdot A_i^*)}{\sum_{i=1}^{N}|A_i|^2} W_R \tag{24}$$

$$\because A_i = C_{LiL} \cdot d_{Ri} - C_{RiL} \cdot d_{Li}$$

$$B_i = C_{LiR} \cdot d_{Ri} - C_{RiR} \cdot d_{Li}$$

The control filter 321 multiplies the control filter coefficient (=$W_L$) by the left acoustic signal (=S) from the acoustic signal output unit 110 and inputs a result to the signal amplification unit 140. The control filter 322 multiplies the control filter coefficient (=$W_R$) by the right acoustic signal (=S) from the acoustic signal output unit 110 and inputs a result to the signal amplification unit 140. The signal amplification unit 140 amplifies the left acoustic signal (=$W_L$S) from the control filter 321 and the right acoustic signal (=$W_R$S) from the control filter 322 in accordance with gain and supplies results to the loudspeaker 101 and the loudspeaker 102, respectively.

The control filter coefficient (=$W_L$) calculated based on Expression (24) conforms a spatial average of complex sound pressure ratios at the target binaural positions (i=1, . . . , N) to a spatial average of complex sound pressure ratios of the acoustic signals arriving at these target binaural positions from the target virtual audio source. According to the control filter coefficient (=$W_L$), since the incoming complex sound pressure ratios at the target binaural positions (i=1, . . . , N) are spatially averaged, if the listener's binaural position is present around any one of the target binaural positions, an excellent sense of auditory lateralization can be maintained.

It is to be noted that a fluctuation among the target binaural positions is assumed to be at most approximately several tens of cm in the present embodiment. Then, it can be considered that a fluctuation of the head-related transfer function from the target virtual acoustic source to the target binaural position is smaller than a fluctuation of the head-related transfer function from each of the loudspeakers 101 and 102 to the target binaural position. That is, as represented by the following Expression (25), as the head-related transfer functions (=$d_{Li}$, $d_{Ri}$) from the target virtual acoustic source to the target binaural positions (i=1, . . . , N), fixed values (=$d_L$, $d_R$) may be used.

$$\because A_i = C_{LiL} \cdot d_R - C_{RiL} \cdot d_L$$

$$B_i = C_{LiR} \cdot d_R - C_{RiR} \cdot d_L \tag{25}$$

As described above, the acoustic control apparatus according to the third embodiment approximates the spatial average of the complex sound pressure ratios at the target binaural positions to the spatial average of the complex sound pressure ratios of the acoustic signals arriving at the target binaural positions from the virtual acoustic source. Therefore, according to this acoustic control apparatus, even if the listener's binaural position greatly fluctuates (e.g., approximately several tens of cm), the listener can stably perceive a direction of the virtual acoustic source.

(Fourth Embodiment)

In the third embodiment, as represented by, e.g., the above Expression (24), based on one control filter coefficient ($W_R$ in Expression (24)), the other control filter coefficient ($W_L$ in Expression (24)) is determined. Here, a value of the one control filter coefficient can be arbitrarily set. For example, the one control filter coefficient may be set to have through characteristic, and the other control filter coefficient may be determined based on this setting. That is, in Expression (24), $W_R$=1 may be set. Therefore, in the fourth embodiment, one control filter coefficient is set to have through characteristic.

Figure 28:
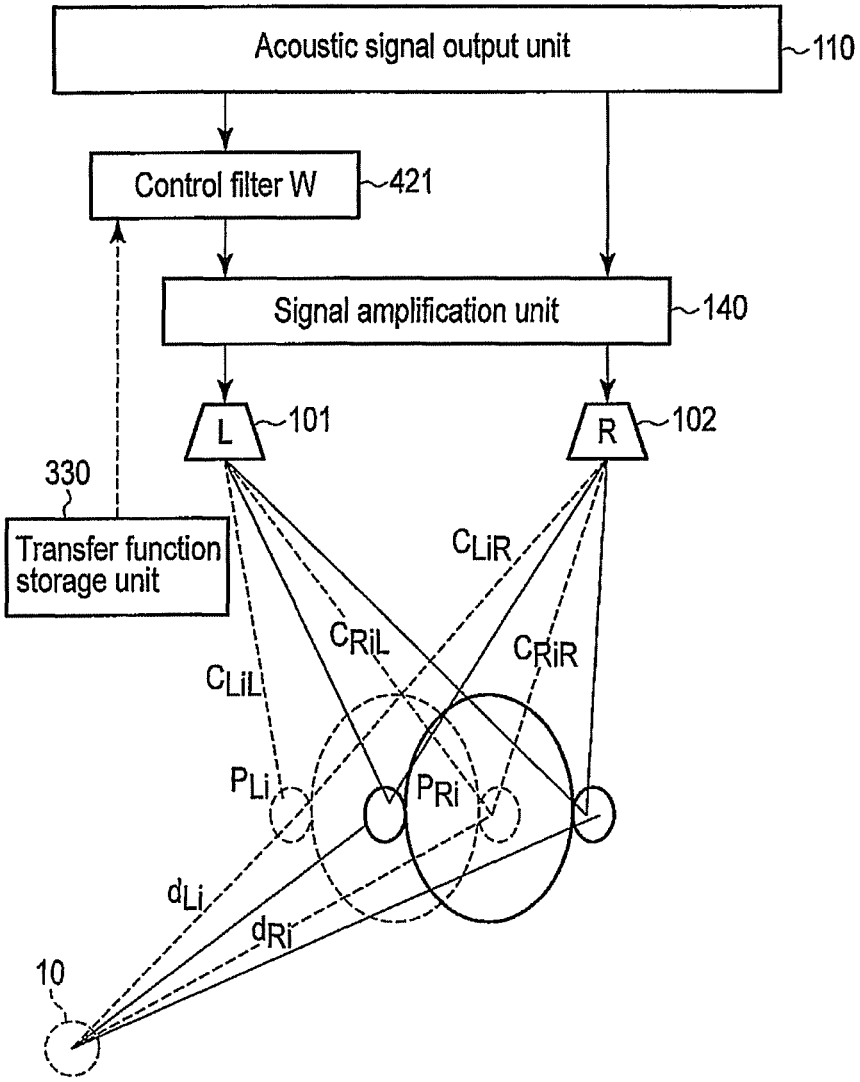
FIG. 28 is a block diagram showing an acoustic control apparatus according to a fourth embodiment.

If a right control filter coefficient (=$W_R$) has through characteristic, control filter processing with respect to a right acoustic signal can be omitted. That is, desired acoustic control can be realized by just performing control filter processing to a left acoustic signal. Therefore, as shown in FIG. 28, an acoustic control apparatus according to the present embodiment comprises loudspeakers 101 and 102, an acoustic signal output unit 110, a control filter 421, a transfer function storage unit 330, and a signal amplification unit 140.

The acoustic control apparatus shown in FIG. 28 performs later-described acoustic control to monaural acoustic signals output from the acoustic signal output unit 110 to approximate (e.g., conform) a spatial average of complex sound pressure ratios at target binaural positions to a spatial average of complex sound pressure ratios of acoustic signals that arrive at the target binaural positions from a target virtual acoustic source. According to the acoustic control apparatus depicted in FIG. 28, since the incoming complex sound pressure ratios at the target binaural positions are spatially averaged, even when a listener's binaural position largely fluctuates (e.g., approximately several tens of cm), deterioration of a sense of auditory lateralization can be suppressed. That is, the acoustic control that is robust to the fluctuation of the listener's binaural position can be realized.

The acoustic signal output unit 110 outputs the monaural acoustic signals (=S) as a left acoustic signal and a right acoustic signal to the control filter 421 and the signal amplification unit 140, respectively.

The control filter 421 reads from the transfer function storage unit 330 head-related transfer functions (=$C_{LiL}$) from the loudspeaker 101 to the listener's left ear at the target binaural positions (i=1, . . . , N), head-related transfer functions (=$C_{LiR}$) from the loudspeaker 102 to the listener's left ear at the target binaural positions (i=1, . . . , N), head-related transfer functions (=$C_{RiL}$) from the loudspeaker 101 to the listener's right ear at the target binaural positions (i=1, . . . , N), head-related transfer listener's right ear at the target binaural positions (i=1, . . . , N), head-related transfer functions (=$d_{id}$) from the target virtual acoustic source to the listener's left ear at the target binaural positions, and head-related transfer functions (=$d_{Ri}$) from the target virtual acoustic source to the listener's right ear at the target binaural positions (i=1, . . . , N) as required. That is, when the binaural position greatly fluctuates from any one of the target binaural positions (i=1, . . . , N) or when the target virtual acoustic source is changed, the control filter 421 may switch over the head-related transfer function.

The control filter 421 calculates a control filter coefficient (=W) to meet the following Expression (26) based on the head-related transfer function read from the transfer function storage unit 330. The following Expression (26) can be derived by setting $W_L$=W and $W_R$=1 in the above Expression (24). It is to be noted that the calculation of the control filter coefficient (=W) may be carried out by a non-illustrated coefficient calculation unit in place of the control filter 421. Alternatively, the control filter coefficient (=W) associated with a combination of the target binaural positions and the target virtual acoustic source may be calculated in advance, and the control filter 421 may read out the appropriate control filter coefficient (=W). It is to be noted that, as represented by the above Expression (25), fixed values (=$d_L$, $d_R$) may be used as the head-related transfer functions (=$d_{Li}$, $d_{Ri}$) from the target virtual acoustic source to the target binaural positions (i=1, . . . , N).

$$W = -\frac{\sum_{i=1}^{N}(B_i \cdot A_i^*)}{\sum_{i=1}^{N}(A_i \cdot A_i^*)} = -\frac{\sum_{i=1}^{N}(B_i \cdot A_i^*)}{\sum_{i=1}^{N}|A_i|^2} \tag{26}$$

$$\because A_i = C_{LiL} \cdot d_{Ri} - C_{RiL} \cdot d_{Li}$$

$$B_i = C_{LiR} \cdot d_{Ri} - C_{RiR} \cdot d_{Li}$$

The control filter 421 multiplies the control filter coefficient (=W) by the left acoustic signal (=S) from the acoustic signal output unit 110 and inputs a result to the signal amplification unit 140. On the other hand, as described above, the right acoustic signal (=S) is not subjected to the control filter processing. The signal amplification unit 140 amplifies the acoustic signal (=WS) from the control filter 421 and the acoustic signal (=S) from the acoustic signal output unit 110 in accordance with gain and supplies results to the loudspeaker 101 and the loudspeaker 102, respectively.

The control filter coefficient (=W) calculated based on Expression (26) conforms a spatial average of complex sound pressure ratios at the target binaural positions (i=1, . . . , N) to a spatial average of complex sound pressure ratios of the acoustic signals arriving at these target binaural positions from the virtual acoustic source. According to the control filter coefficient (=W), since the incoming complex sound pressure ratios at the target binaural positions are spatially averaged, if the listener's binaural position is present around any one of the target binaural positions (i=1, . . . , N), an excellent sense of auditory lateralization can be maintained.

Adequacy of effects of the acoustic control apparatus according to the present embodiment will now be described hereinafter with reference to an experimental result.

Figure 29:
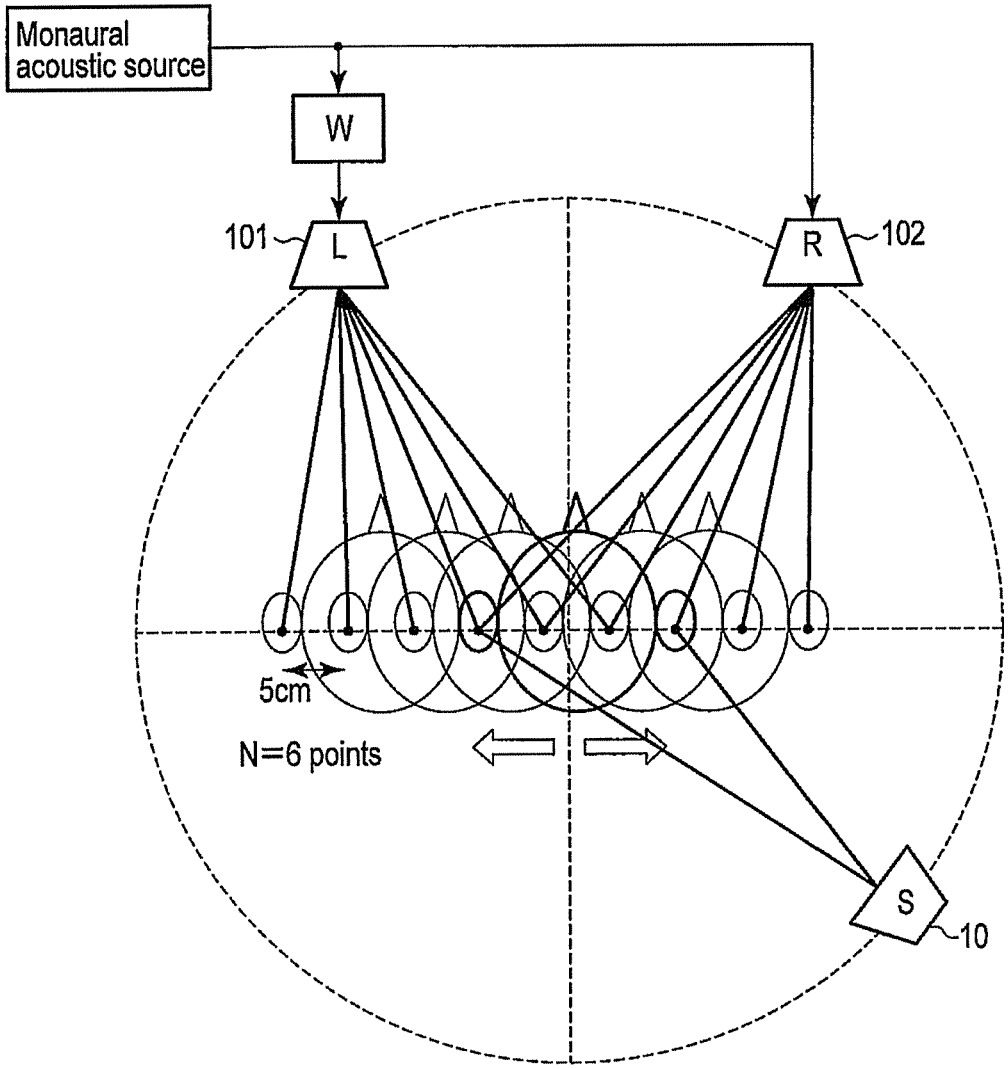
FIG. 29 is an explanatory view of an experiment for evaluating a change in sense of auditory lateralization when a binaural position of a listener fluctuates.

Here, a sense of auditory lateralization when the listener's binaural position moves up to 25 cm was evaluated. Specifically, as shown in FIG. 29, one target binaural position (i=1) was provided at the center, target binaural positions (i=2, 3, 4) were provided at positions of 5 cm, 10 cm, and 15 cm from the center in the left direction, and target binaural positions (i=5, 6) were provided at positions of 5 cm and 10 cm from the center in the right direction. That is, N=6. At each of the target binaural positions (i=1, . . . , 6), microphones were put on a dummy head to measure a head-related transfer function. The virtual acoustic source 10 was provided in a direction of 225 degrees (45 degrees in a right rear direction) from the target binaural position (i=1). Head-related transfer functions (=$d_{Li}$, $d_{Ri}$) from this virtual acoustic source 10 to the target binaural positions (i=1, . . . , 6) were fixed to head-related transfer functions (=$d_{L1}$, $d_{Ri}$) from the virtual acoustic source 10 to one target binaural position (i=1).

Figure 30:
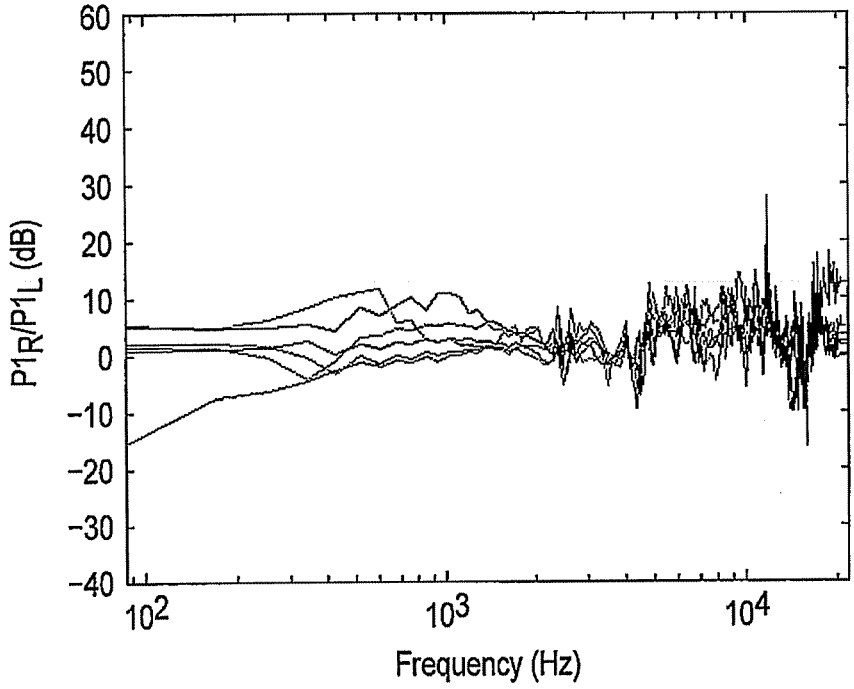
FIG. 30 is a graph showing amplitude characteristic of a complex sound pressure ratio at each of target binaural positions when a control filter coefficient based on one target binaural position is applied.
Figure 31:
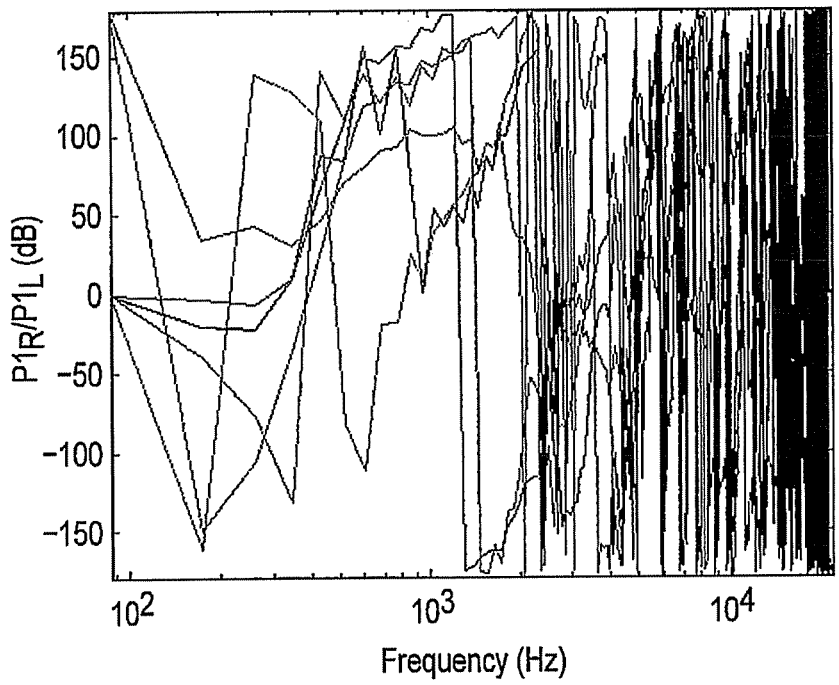
FIG. 31 is a graph showing phase characteristic of the complex sound pressure ratio at each of the target binaural positions when the control filter coefficient based on one target binaural position is applied.

First, a control filter coefficient (=W) was calculated based on the head-related transfer functions measured in regard to one target binaural position (i=1). That is, it can be considered that this control filter coefficient (=W) can realize the acoustic control according to the second embodiment. This control filter coefficient (=W) was applied to emit acoustic signals from the loudspeakers 101 and 102, and complex sound pressure ratios at the target binaural positions (i=1, . . . , 6) were measured. FIG. 30 shows amplitude characteristic of the measured complex sound pressure ratios, and FIG. 31 shows phase characteristic of the measured complex sound pressure ratios. It can be confirmed from FIG. 30 and FIG. 31 that both the amplitudes and phases change with respect to a small fluctuation of the binaural position, i.e., 5 cm in a band of 1 kHz in the drawings as well as other frequencies.

Figure 32:
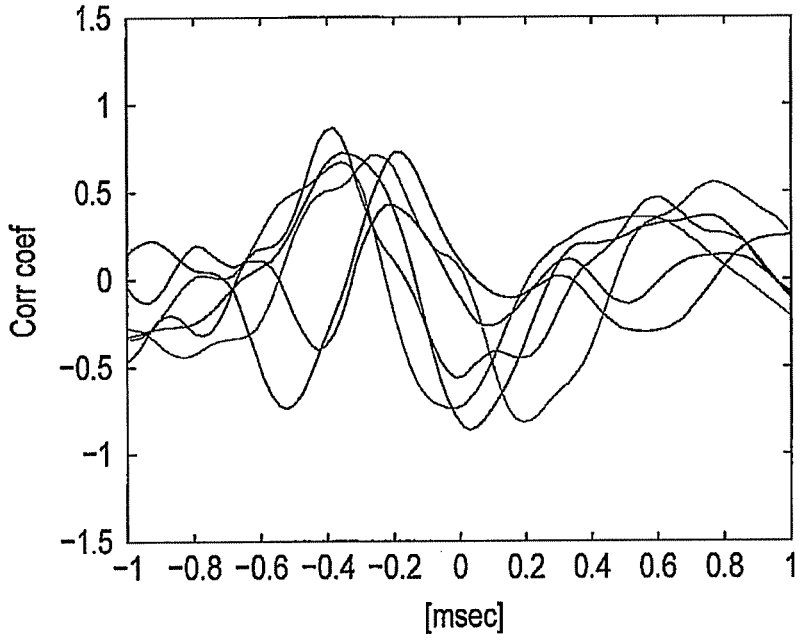
FIG. 32 is a graph showing a calculation result of the IACF at each of the target binaural positions when the control filter coefficient based on one target binaural position is applied.
Figure 33:
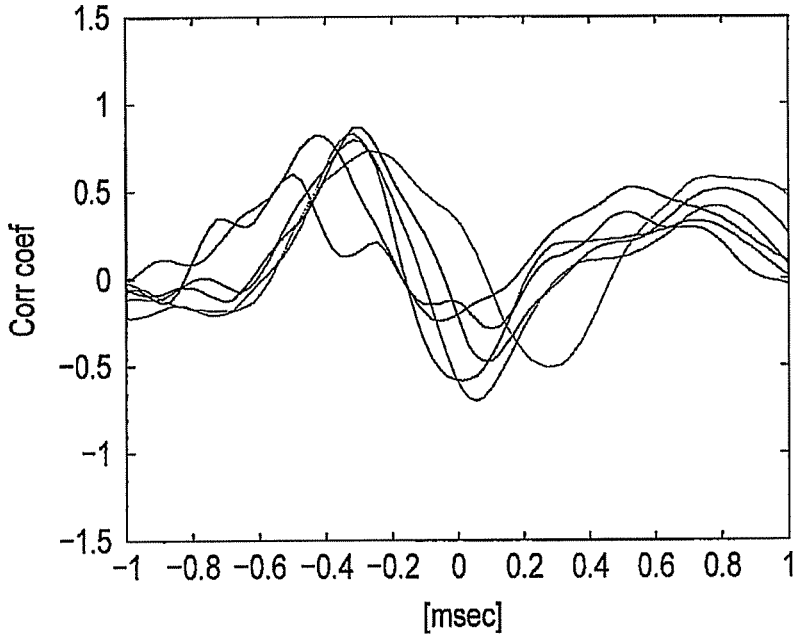
FIG. 33 is a graph showing a measurement result of the IACF at each of the target binaural positions when the control filter coefficient based on one target binaural position is applied.

Further, an IACF at each of the target binaural positions (i=1, . . . , 6) when test acoustic signals (approximately 1 second of the above-described crow's caw) were emitted from the loudspeakers 101 and 102 based on this control filter coefficient (=W) was calculated and measured. FIG. 32 shows a calculation result, and FIG. 33 shows a measurement result. It is to be noted that the calculation of the IACF was carried out based on each actually measured head-related transfer function. Further, the measurement of the IACF was carried out by utilizing microphones put on both ears of a dummy head installed at each target binaural position. As obvious from the calculation result in FIG. 32 and the measurement result in FIG. 33, times, at which a maximum peak of the IACF which can be a guide for a direction of the sense of auditory lateralization appears, are different among the target binaural positions. Furthermore, according to a test subject, although the auditory impressions are equal, but a sound image direction changes every time the binaural position shifts 5 cm.

Figure 34:
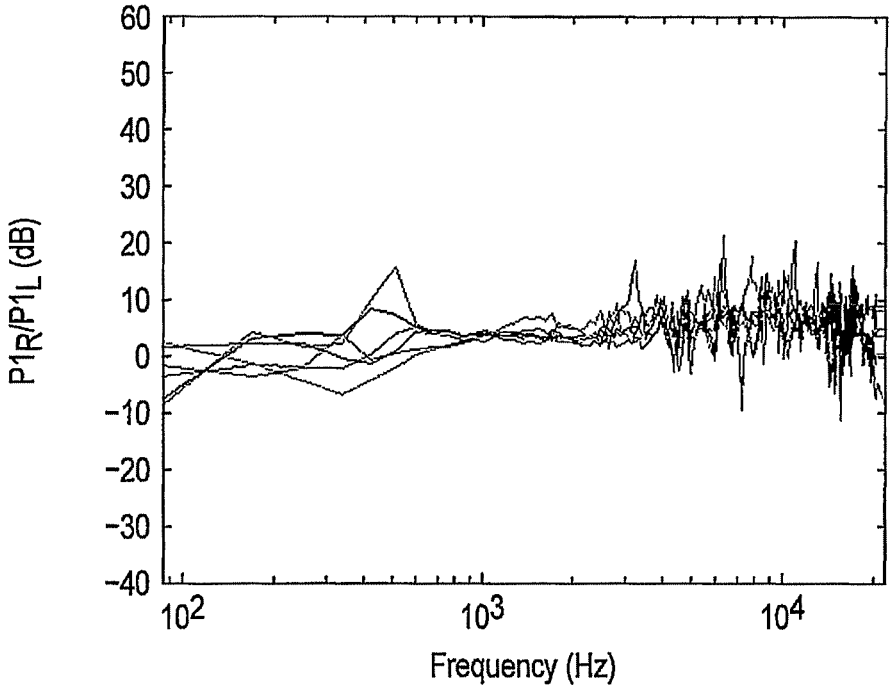
FIG. 34 is a graph showing amplitude characteristic of the complex sound pressure ratio at each of the target binaural positions when a control filter coefficient based on the target binaural positions is applied.
Figure 35:
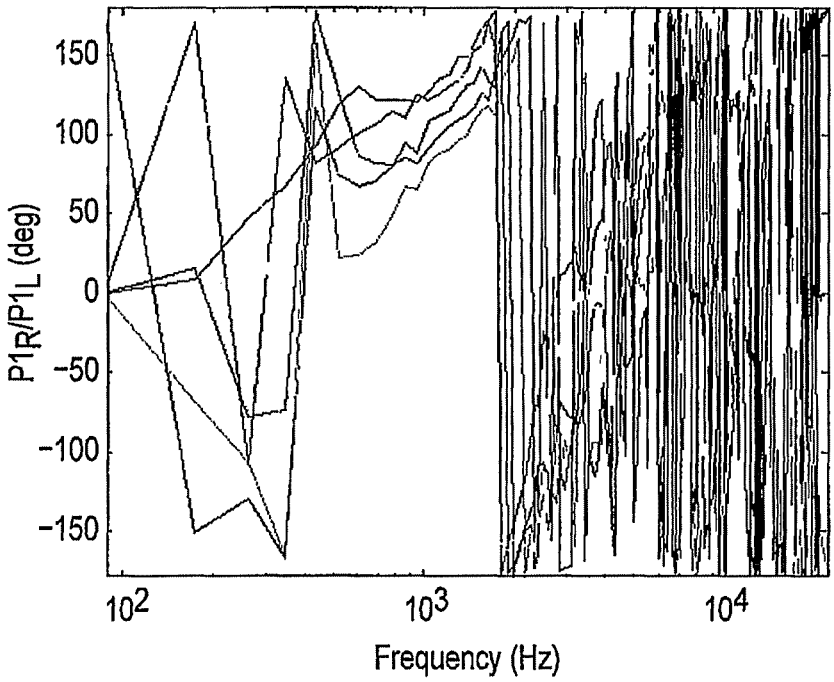
FIG. 35 is a graph showing phase characteristic of the complex sound pressure ratio at each of the target binaural positions when the control filter coefficient based on the target binaural positions is applied.

Then, the control filter coefficient (=W) was calculated based on the head-related transfer function measured in regard to each of the target binaural positions (i=1, . . . , 6). That is, it can be considered that this control filter coefficient realizes the acoustic control according to the present embodiment. This control filter coefficient (=W) was applied to emit acoustic signals from the loudspeakers 101 and 102, and complex sound pressure ratios at the respective target binaural positions (i=1, . . . , 6) were measured. FIG. 34 shows amplitude characteristic of the measured complex sound pressure ratios, and FIG. 35 shows phase characteristic of the measured complex sound pressure ratios. Comparing FIG. 34 and FIG. 35 to FIG. 30 and FIG. 31, it can be confirmed that the difference of the amplitude and the phase among the target binaural positions in a midrange frequency band and higher bands reproducible by the loudspeakers 101 and 102 is suppressed.

Figure 36:
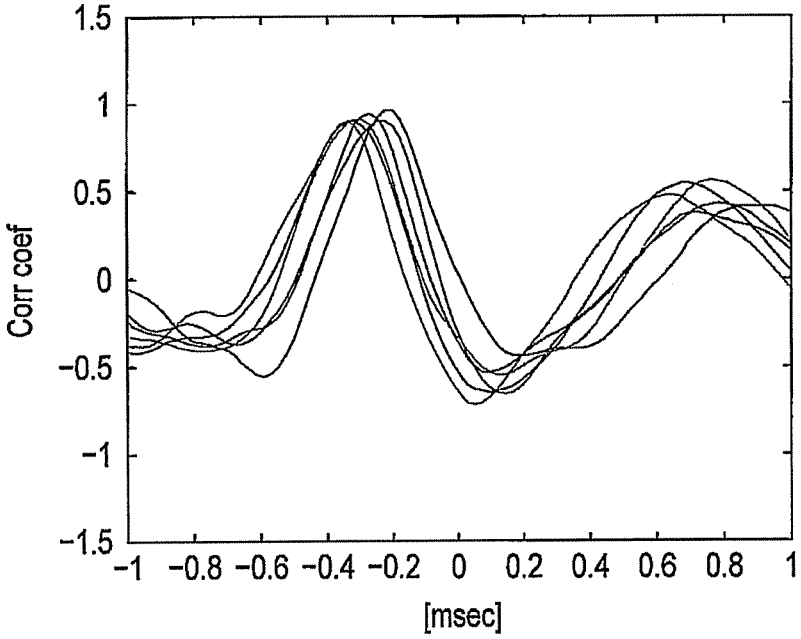
FIG. 36 is a graph showing a calculation result of the IACF at each of the target binaural positions when the control filter coefficient based on the target binaural positions is applied.
Figure 37:
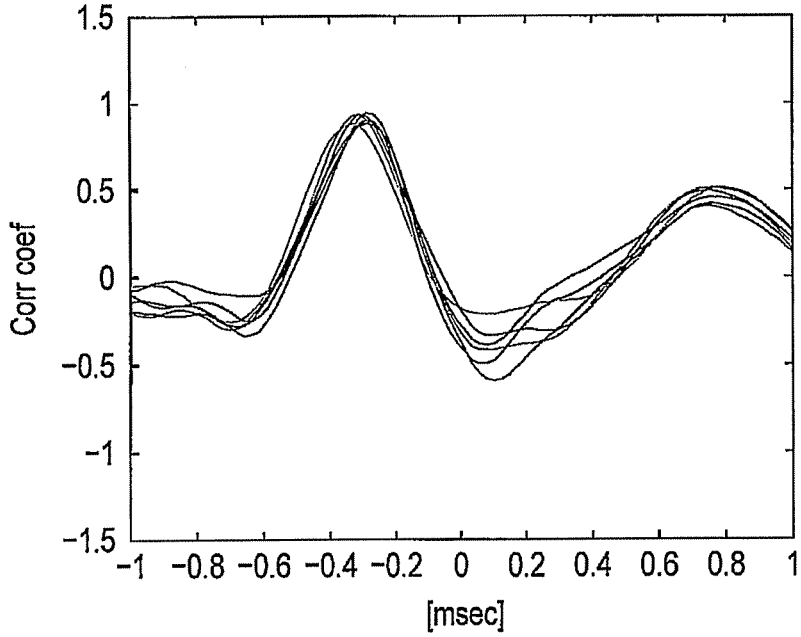
FIG. 37 is a graph showing a measurement result of the IACF at each of the target binaural positions when the control filter coefficient based on the target binaural positions is applied.
Figure 38:
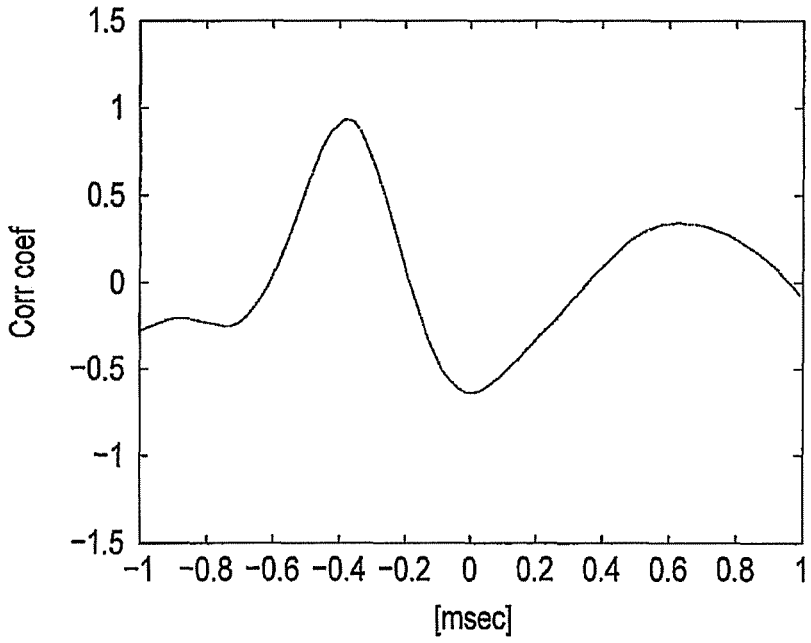
FIG. 38 is a graph showing a measurement result of the IACF at one target binaural position when a loudspeaker is actually installed at a position of a virtual acoustic source and a test acoustic signal is emitted.

Moreover, the IACF at each of the target binaural positions (i=1, . . . , 6) when the test acoustic signals are emitted from the loudspeakers 101 and 102 based on this control filter coefficient (=W) was calculated and measured. FIG. 36 shows a calculation result, and FIG. 37 shows a measurement result. According to the calculation result in FIG. 36 and the measurement result in FIG. 37, it can be confirmed that times at which the maximum peak of the IACF appears are substantially equal among the target binaural positions. FIG. 38 shows the IACF measured by actually installing a loudspeaker at a position of the virtual acoustic source 10 (i.e., a direction of 225 degrees from the target binaural position (i=1)) and emitting the test acoustic signals. It was also confirmed that the calculation result in FIG. 36 and the measurement result in FIG. 37 substantially coincide with the desired IACF in FIG. 8. Additionally, according to the test subject, sound image directions (the direction of 225 degrees) coincide with each other irrespective of shift of the binaural position.

Based on the above-described measurement result, it can be confirmed that the acoustic control that is robust to a fluctuation of the listener's binaural position can be achieved by spatial averaging the incoming complex sound pressure ratios. Specifically, it was confirmed that, if the incoming complex sound pressure ratios are appropriately spatially averaged, the sense of auditory lateralization of the virtual acoustic source can be stably reproduced without switching over the control filter coefficient even through the listener's binaural position moves several cm to up to several tens of cm. Further, like the second embodiment, it was also confirmed that the sense of auditory lateralization of the virtual acoustic source can be reproduced by just applying the control filter processing to one acoustic signal.

As described above, the acoustic control apparatus according to the fourth embodiment approximates a spatial average of the complex sound pressure ratios at the target binaural positions to a spatial average of the complex sound pressure ratios of acoustic signals arriving at the target binaural positions from the virtual acoustic source while omitting the control filter processing for one acoustic signal. Therefore, according to this acoustic control apparatus, the same effects as those of the third embodiment can be obtained while simplifying the hardware configuration.

(Fifth Embodiment)

According to a fifth embodiment, the acoustic control according to the first embodiment is applied to a binaural acoustic signal. It is to be noted that a binaural acoustic signal can include a 2-channel acoustic signal obtained by down-mixing stereophonic signals of multi channels, e.g., a 5.1 channel are down-mixed in the following embodiments. A technique for down-mixing stereophonic acoustic signals of multi channels into the 2-channel acoustic signal is known, thereby omitting a detailed description thereof.

Figure 39:
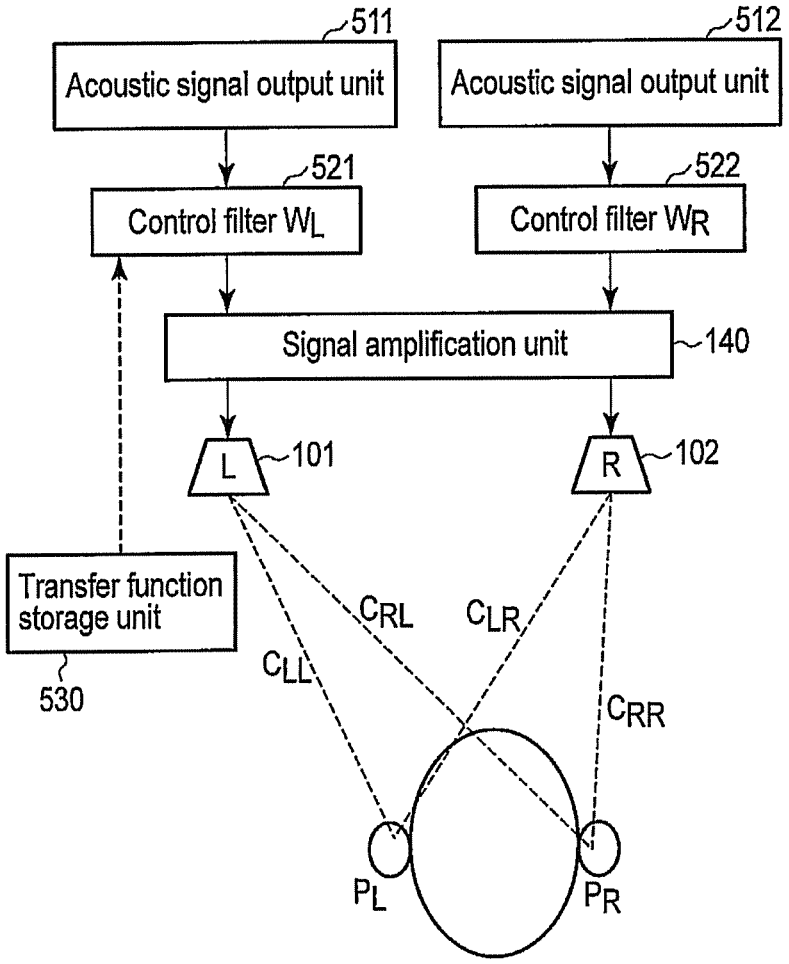
FIG. 39 is a block diagram showing an acoustic control apparatus according to a fifth embodiment.

As shown in FIG. 39, an acoustic control apparatus according to the present embodiment includes loudspeakers 101 and 102, acoustic signal output units 511 and 512, control filters 521 and 522, and a transfer function storage unit 530, and a signal amplification unit 140.

The acoustic control apparatus in FIG. 39 performs later-described acoustic control with respect to binaural acoustic signals output from the acoustic signal output units 511 and 512 and approximates (conforms) a complex sound pressure ratio at a target binaural position to a complex sound pressure ratio of the binaural acoustic signals. According to the acoustic control apparatus in FIG. 39, when the listener's binaural position fluctuates from the target binaural position to some extent, since the fluctuation of the complex sound pressure ratio at the binaural position is small, the listener can perceive the stereophonic acoustic effect based on the binaural acoustic signals.

The acoustic signal output unit 511 outputs a left acoustic signal ($=S_L$) in the binaural acoustic signals to the control filter 521. The acoustic signal output unit 512 outputs a right acoustic signal ($=S_R$) in the binaural acoustic signals to the control filter 522. The transfer function storage unit 530 stores a head-related transfer function in regard to at least one target binaural position. Specifically, the transfer function storage unit 530 stores a head-related transfer function set from the loudspeakers 101 and 102 to at least one target binaural position.

The control filter 521 reads from the transfer function storage unit 530 a head-related transfer function ($=C_{LL}$) from the loudspeaker 101 to the listener's left ear at the target binaural position, a head-related transfer function ($=C_{LR}$) from the loudspeaker 102 to the listener's left ear at the target binaural position, a head-related transfer function ($=C_{RL}$) from the loudspeaker 101 to the listener's right ear at the target binaural position, a head-related transfer function ($=C_{RR}$) from the loudspeaker 102 to the listener's right ear at the target binaural position as required. That is, when the listener's binaural position largely fluctuates from the target binaural position, the control filter 521 may switch over the head-related transfer function.

The control filter 521 calculates a control filter coefficient ($=W_L$) to meet the following Expression (27) based on the head-related transfer function read from the transfer function storage unit 530 and a control filter coefficient ($=W_R$) of the control filter 522. The following Expression (27) can be derived by assigning $d_L=d_R=1$ in the above Expression (16). It is to be noted that the calculation of the control filter coefficient ($=W_L$) may be carried out by a non-illustrated coefficient calculation unit in place of the control filter 521. Alternatively, the control filter coefficients ($=W_L$) associated with a combination of the control filter coefficient ($=W_R$) of the control filter 522 and the target binaural position may be calculated in advance, and the control filter 521 may read out the appropriate control filter coefficient ($=W_L$).

$$W_L = -\frac{B \cdot A^*}{A \cdot A^*} W_R = -\frac{B \cdot A^*}{|A|^2} W_R \tag{27}$$

$$\because A = C_{LL} - C_{RL}$$

$$B = C_{LR} - C_{RR}$$

The control filter 521 multiplies the control filter coefficient ($=W_L$) by the left acoustic signal ($=S_L$) from the acoustic signal output unit 511 and inputs a result to the signal amplification unit 140. The control filter 522 multiplies the control filter coefficient ($=W_R$) by the right acoustic signal ($=S_R$) from the acoustic signal output unit 512 and inputs a result to the signal amplification unit 140. The signal amplification unit 140 amplifies the left acoustic signal ($=W_LS_L$) from the control filter 521 and the right acoustic signal ($=W_RS_R$) from the control filter 522 in accordance with gain and supplies results to the loudspeaker 101 and the loudspeaker 102, respectively.

As described above, the acoustic control apparatus according to the fifth embodiment approximates the complex sound pressure ratio at the target binaural position to the complex sound pressure ratio of the binaural acoustic signals. Therefore, according to the acoustic control apparatus, even if the listener's binaural position fluctuates from the target binaural position to some extent, since a fluctuation of the complex sound pressure ratio at the binaural position is small, the listener can perceive the stereophonic acoustic effects based on the binaural acoustic signals.

(Sixth Embodiment)

Figure 40:
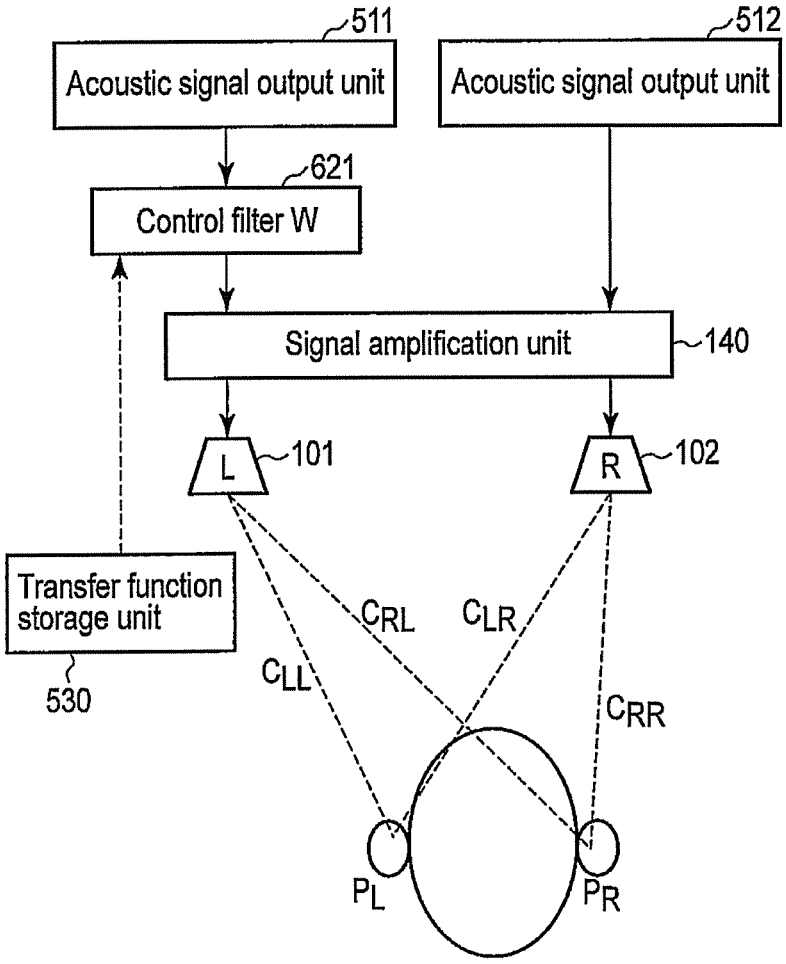
FIG. 40 is a block diagram showing an acoustic control apparatus according to a sixth embodiment.

In a sixth embodiment, the acoustic control according to the second embodiment is applied to binaural acoustic signals. As shown in FIG. 40, an acoustic control apparatus according to the present embodiment includes loudspeakers 101 and 102, acoustic signal output units 511 and 512, a control filter 621, a transfer function storage unit 530, and a signal amplification unit 140.

The acoustic control apparatus in FIG. 40 performs later-described acoustic control with respect to binaural acoustic signals output from the acoustic signal output units 511 and 512 and approximates (e.g., conforms) a complex sound pressure ratio at a target binaural position to a complex sound pressure ratio of the binaural acoustic signals. According to the acoustic control apparatus in FIG. 40, since a fluctuation of the complex sound pressure ratio at a binaural position is small even when a listener's binaural position fluctuates from a target binaural position to some extent, the listener can perceive acoustic effect based on the binaural acoustic signals.

The acoustic signal output unit 511 outputs a left acoustic signal ($=S_L$) in the binaural acoustic signals to the control filter 621. The acoustic signal output unit 512 outputs a right acoustic signal ($=S_R$) in the binaural acoustic signals to the signal amplification unit 140.

The control filter 621 reads from the transfer function storage unit 530 a head-related transfer function ($=C_{LL}$) from the loudspeaker 101 to the listener's left ear at the target binaural position, a head-related transfer function ($=C_{LR}$) from the loudspeaker 102 to the listener's left ear at the target binaural position, a head-related transfer function ($=C_{RL}$) from the loudspeaker 101 to the listener's right ear at the target binaural position, and a head-related transfer function ($=C_{RR}$) from the loudspeaker 102 to the listener's right ear at the target binaural position as required. That is, when the listener's binaural position largely fluctuates from the target binaural position, the control filter 621 may switch over the head-related transfer function.

The control filter 621 calculates a control filter coefficient ($=W$) to meet the following Expression (28) based on the head-related transfer function read from the transfer function storage unit 530. The following Expression (28) can be derived by assigning $W_L=W$ and $W_R=1$ (through characteristic) in the above Expression (27). It is to be noted that the calculation of the control filter coefficient ($=W$) may be carried out by a non-illustrated coefficient calculation unit in place of the control filter 621. Alternatively, the control filter coefficient ($=W$) associated with the target binaural position may be calculated in advance, and the control filter 621 may read out the appropriate control filter coefficient (=W).

$$W = -\frac{B \cdot A^*}{A \cdot A^*} = -\frac{B \cdot A^*}{|A|^2} \tag{28}$$

$$\because A = C_{LL} - C_{RL}$$

$$B = C_{LR} - C_{RR}$$

The control filter 621 multiplies the control filter coefficient (=W) by the left acoustic signal (=$S_L$) from the acoustic signal output unit 511 and inputs a result to the signal amplification unit 140. On the other hand, as described above, the right acoustic signal (=$S_R$) is not subjected to the control filter processing. The signal amplification unit 140 amplifies the left acoustic signal (=$WS_L$) from the control filter 621 and the right acoustic signal (=$S_R$) from the acoustic signal output unit 512 in accordance with gain and supplies results to the loudspeaker 101 and the loudspeaker 102, respectively.

As described above, the acoustic control apparatus according to the sixth embodiment approximates the complex sound pressure ratio at the target binaural position to the complex sound pressure ratio of the binaural acoustic signals while omitting the control filter processing for one acoustic signal. Therefore, according to this acoustic control apparatus, a hardware configuration can be simplified, and the same effects as those of the first embodiment can be obtained.

It is to be noted that, in the present embodiment, the second embodiment is applied to the binaural acoustic signals, and hence its effects are substantially the same as those of the second embodiment. Therefore, for example, when precision of auditory lateralization in a specific direction is lowered in the acoustic control according to the second embodiment (e.g., when the listener's binaural position greatly fluctuates), precision of auditory lateralization in the specific direction is also lowered in the acoustic control according to the present embodiment.

(Seventh Embodiment)

Figure 41:
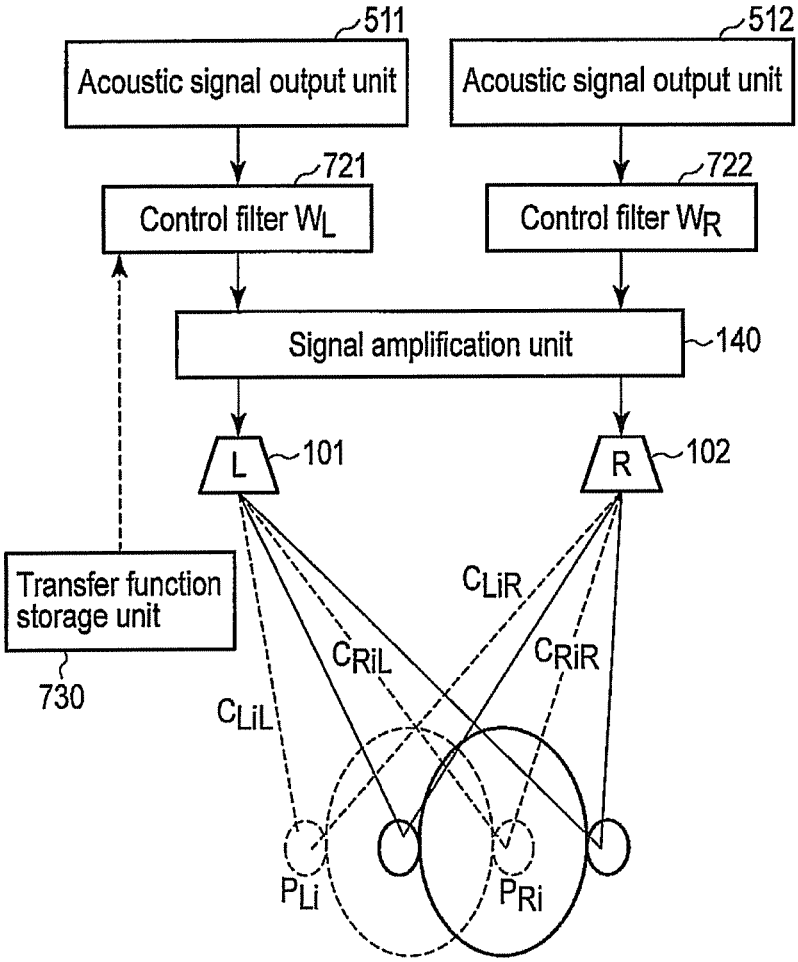
FIG. 41 is a block diagram showing an acoustic control apparatus according to a seventh embodiment.

In a seventh embodiment, the acoustic control according to the third embodiment is applied to binaural acoustic signals. As shown in FIG. 41, an acoustic control apparatus according to the present embodiment comprises loudspeakers 101 and 102, acoustic signal output units 511 and 512, control filters 721 and 722, a transfer function storage unit 730, and a signal amplification unit 140.

The acoustic control apparatus in FIG. 41 performs later-described acoustic control with respect to binaural acoustic signals output from the acoustic signal output units 511 and 512 and approximates (e.g., conforms) a spatial average of complex sound pressure ratios at target binaural positions to a complex sound pressure ratio of binaural acoustic signals. According to the acoustic control apparatus depicted in FIG. 41, since the incoming complex sound pressure ratios at the target binaural positions are spatially averaged, deterioration of a sense of auditory lateralization can be suppressed even if the listener's binaural position greatly fluctuates (e.g., approximately several tens of cm). That is, robust acoustic control can be realized with respect to a fluctuation in the listener's binaural position.

The acoustic signal output unit 511 outputs a left acoustic signal (=$S_L$) in the binaural acoustic signals to the control filter 721. The acoustic signal output unit 512 outputs a right acoustic signal (=$S_R$) in the binaural acoustic signals to the control filter 722. The transfer function storage unit 730 stores head-related transfer functions with regard to a plurality of (at least N) target binaural positions. Specifically, the transfer function storage unit 730 stores head-related transfer function sets from the loudspeakers 101 and 102 to the target binaural positions.

The control filter 721 reads out from the transfer function storage unit 730 head-related transfer functions (=$C_{LiL}$) from the loudspeaker 101 to the listener's left ear at the target binaural positions (i=1, . . . , N), head-related transfer functions (=$C_{LiR}$) from the loudspeaker 102 to the listener's left ear at the target binaural positions (i=1, . . . , N), head-related transfer functions (=$C_{RiL}$) from the loudspeaker 101 to the listener's right ear at the target binaural positions (i=1, . . . , N), and head-related transfer functions (=$C_{RiR}$) from the loudspeaker 102 to the listener's right ear at the target binaural positions (i=1, . . . , N) as required. That is, when the listener's binaural position greatly fluctuates from any one of the target binaural positions (i=1, . . . , N), the control filter 721 may switch over the head-related transfer function.

The control filter 721 calculates a control filter coefficient (=$W_L$) to meet the following Expression (29) based on the head-related transfer function read from the transfer function storage unit 730 and a control filter coefficient (=$W_R$) of the control filter 722. The following Expression (29) can be derived by assigning $d_L$=$d_R$=1 in the above Expression (24). It is to be noted that the calculation of the control filter coefficient (=$W_L$) may be performed by a non-illustrated coefficient calculation unit in place of the control filter 721. Alternatively, the control filter coefficients (=$W_L$) associated with a combination of the control filter coefficient (=$W_R$) of the control filter 722 and the target binaural positions may be calculated in advance, and the control filter 321 may read out the appropriate control filter coefficient (=$W_L$).

$$W_L = -\frac{\sum_{i=1}^{N}(B_i \cdot A_i^*)}{\sum_{i=1}^{N}(A_i \cdot A_i^*)} W_R = -\frac{\sum_{i=1}^{N}(B_i \cdot A_i^*)}{\sum_{i=1}^{N}|A_i|^2} W_R \tag{29}$$

$$\because A_i = C_{LiL} - C_{RiL}$$

$$B_i = C_{LiR} - C_{RiR}$$

The control filter 721 multiplies the control filter coefficient (=$W_L$) by the left acoustic signal (=$S_L$) from the acoustic signal output unit 511 and inputs a result to the signal amplification unit 140. The control filter 722 multiplies the control filter coefficient (=$W_R$) by the right acoustic signal (=$S_R$) from the acoustic signal output unit 512 and inputs a result to the signal amplification unit 140. The signal amplification unit 140 amplifies the left acoustic signal (=$W_LS_L$) from the control filter 721 and the right acoustic signal (=$W_RS_R$) from the control filter 722 in accordance with gain and supplies results to the loudspeaker 101 and the loudspeaker 102, respectively.

The control filter coefficient (=$W_L$) calculated based on Expression (29) conforms a spatial average of complex sound pressure ratios at the target binaural positions (i=1, . . . , N) to a complex sound pressure ratio of the binaural acoustic signals. According to the control filter coefficient (=$W_L$), since the incoming complex sound pressure ratios at the target binaural positions (i=1, . . . , N) are spatially averaged, if the listener's binaural position is present around any one of the target binaural positions, an excellent sense of auditory lateralization can be maintained.

As described above, the acoustic control apparatus according to the seventh embodiment approximates the spatial average of the complex sound pressure ratios at the target binaural positions to the complex sound pressure ratio of the binaural acoustic signals. Therefore, according to the acoustic control apparatus, even when the listener's binaural position largely fluctuates (e.g., approximately several tens of cm), since a fluctuation of the complex sound pressure ratio at the binaural position is small, the listener can perceive stereophonic effects based on the binaural acoustic signals. It is to be noted that the present embodiment applies the third embodiment to the binaural acoustic signals, and hence effects of the present embodiment are substantially the same as those of the third embodiment.

(Eighth Embodiment)

Figure 42:
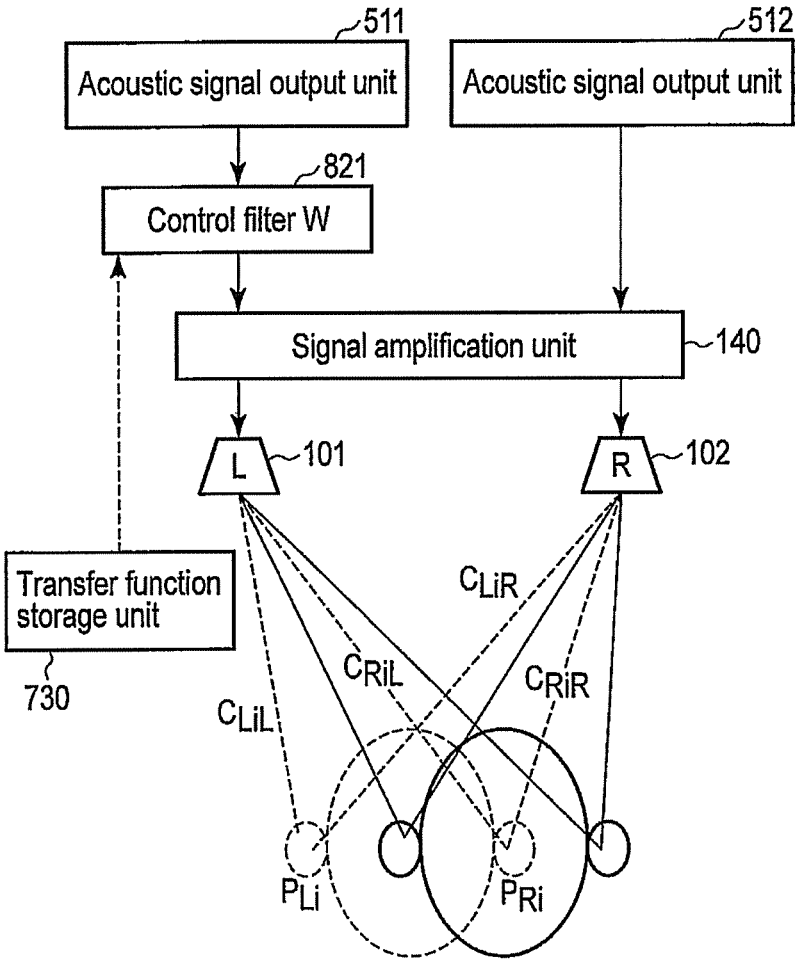
FIG. 42 is a block diagram showing an acoustic control apparatus according to an eighth embodiment.

In an eighth embodiment, the acoustic control according to the fourth embodiment is applied to binaural acoustic signals. As shown in FIG. 42, an acoustic control apparatus according to the present embodiment comprises loudspeakers 101 and 102, acoustic signal output units 511 and 512, a control filter 821, a transfer function storage unit 730, and a signal amplification unit 140.

The acoustic control apparatus shown in FIG. 42 performs later-described acoustic control to binaural acoustic signals output from the acoustic signal output units 511 and 512 to approximate (e.g., conform) a spatial average of complex sound pressure ratios at target binaural positions to a complex sound pressure ratio of the binaural acoustic signals. According to the acoustic control apparatus depicted in FIG. 42, since the incoming complex sound pressure ratios at the target binaural positions are spatially averaged, even when a listener's binaural position largely fluctuates (e.g., approximately several tens of cm), deterioration of a sense of auditory lateralization can be suppressed. That is, the acoustic control that is robust to the fluctuation of the listener's binaural position can be realized.

The acoustic signal output unit 511 outputs a left acoustic signal ($=S_L$) in the binaural acoustic signals to the control filter 821. The acoustic signal output unit 512 outputs a right acoustic signal ($=S_R$) in the binaural acoustic signals to the signal amplification unit 140.

The control filter 821 reads from the transfer function storage unit 730 head-related transfer functions ($=C_{LiL}$) from the loudspeaker 101 to the listener's left ear at the target binaural positions (i=1, . . . , N), head-related transfer functions ($=C_{LiR}$) from the loudspeaker 102 to the listener's left ear at the target binaural positions (i=1, . . . , N), head-related transfer functions ($=C_{RiL}$) from the loudspeaker 101 to the listener's right ear at the target binaural positions (i=1, . . . , N), and head-related transfer functions ($=C_{RiR}$) from the loudspeaker 102 to the listener's right ear at the target binaural positions (i=1, . . . , N) as required. That is, when the listener's binaural position greatly fluctuates from any one of the target binaural positions (i=1, . . . , N), the control filter 821 may switch over the head-related transfer function.

The control filter 821 calculates a control filter coefficient (=W) to meet the following Expression (30) based on the head-related transfer function read from the transfer function storage unit 730. The following Expression (30) can be derived by setting $W_L$=W and $W_R$=1 (through characteristic) in the above Expression (29). It is to be noted that the calculation of the control filter coefficient (=W) may be carried out by a non-illustrated coefficient calculation unit in place of the control filter 821. Alternatively, the control filter coefficient (=W) associated with a combination of the target binaural positions may be calculated in advance, and the control filter 821 may read out the appropriate control filter coefficient (=W).

$$W = -\frac{\sum_{i=1}^{N}(B_i \cdot A_i^*)}{\sum_{i=1}^{N}(A_i \cdot A_i^*)} = -\frac{\sum_{i=1}^{N}(B_i \cdot A_i^*)}{\sum_{i=1}^{N}|A_i|^2} \tag{30}$$

$$\because A_i = C_{LiL} - C_{RiL}$$

$$B_i = C_{LiR} - C_{RiR}$$

The control filter 821 multiplies the control filter coefficient (=W) by the left acoustic signal ($=S_L$) from the acoustic signal output unit 511 and inputs a result to the signal amplification unit 140. On the other hand, as described above, the control filter processing is not applied to the right acoustic signal ($=S_R$). The signal amplification unit 140 amplifies the left acoustic signal ($=WS_L$) from the control filter 821 and the right acoustic signal ($=S_R$) from the acoustic signal output unit 512 in accordance with gain and supplies results to the loudspeaker 101 and the loudspeaker 102, respectively.

The control filter coefficient (=W) calculated based on Expression (30) conforms a spatial average of complex sound pressure ratios at the target binaural positions (i=1, . . . , N) to a complex sound pressure ratio of the binaural acoustic signals. According to the control filter coefficient (=W), since the incoming complex sound pressure ratios at the target binaural positions (i=1, . . . , N) are spatially averaged, if the listener's binaural position is present around any one of the target binaural positions, an excellent sense of auditory lateralization can be maintained.

As described above, the acoustic control apparatus according to the eighth embodiment approximates the spatial average of the complex sound pressure ratios at the target binaural positions to the complex sound pressure ratio of the binaural acoustic signals while omitting the control filter processing for one acoustic signal. Therefore, according to the acoustic control apparatus, the same effects as those of the seventh embodiment can be obtained while simplifying a hardware configuration. It is to be noted that the present embodiment applies the fourth embodiment to the binaural acoustic signals, and hence effects of the present embodiment are substantially the same as those of the fourth embodiment.

(Ninth Embodiment)

The first to fourth embodiment have been described on the assumption that one target virtual acoustic source is used at a time for ease of the explanation. However, a plurality of target virtual acoustic sources may be used at a time. In the following description, a total number of target virtual acoustic sources is generalized to M(≥1). Further, each target virtual acoustic source is identified by a value of j. To define the target virtual acoustic sources in this manner, the above Expression (9) needs to be replaced by the following Expression (31).

$$\frac{d_{Rij}S}{d_{Lij}S} = \frac{d_{Rij}}{d_{Lij}} \cong \frac{P_{Rij}}{P_{Lij}} \tag{31}$$

In Expression (31), $d_{Lij}$ represents a head-related transfer function from the target virtual acoustic source (=j) to a listener's left year at a target binaural position (=i), and $d_{Rij}$ represents a head-related transfer function from the target virtual acoustic source (=j) to the listener's right ear at the target binaural position (=i). Further, $P_{Lij}$ represents a component, which is based on the target virtual acoustic source (=j), in an incoming sound pressure in the listener's left ear at the target binaural position (=i), and $P_{Rij}$ represents a component, which is based on the target virtual acoustic source (=j), in an incoming sound pressure in the listener's right ear at the target binaural position (=i).

Figure 48:
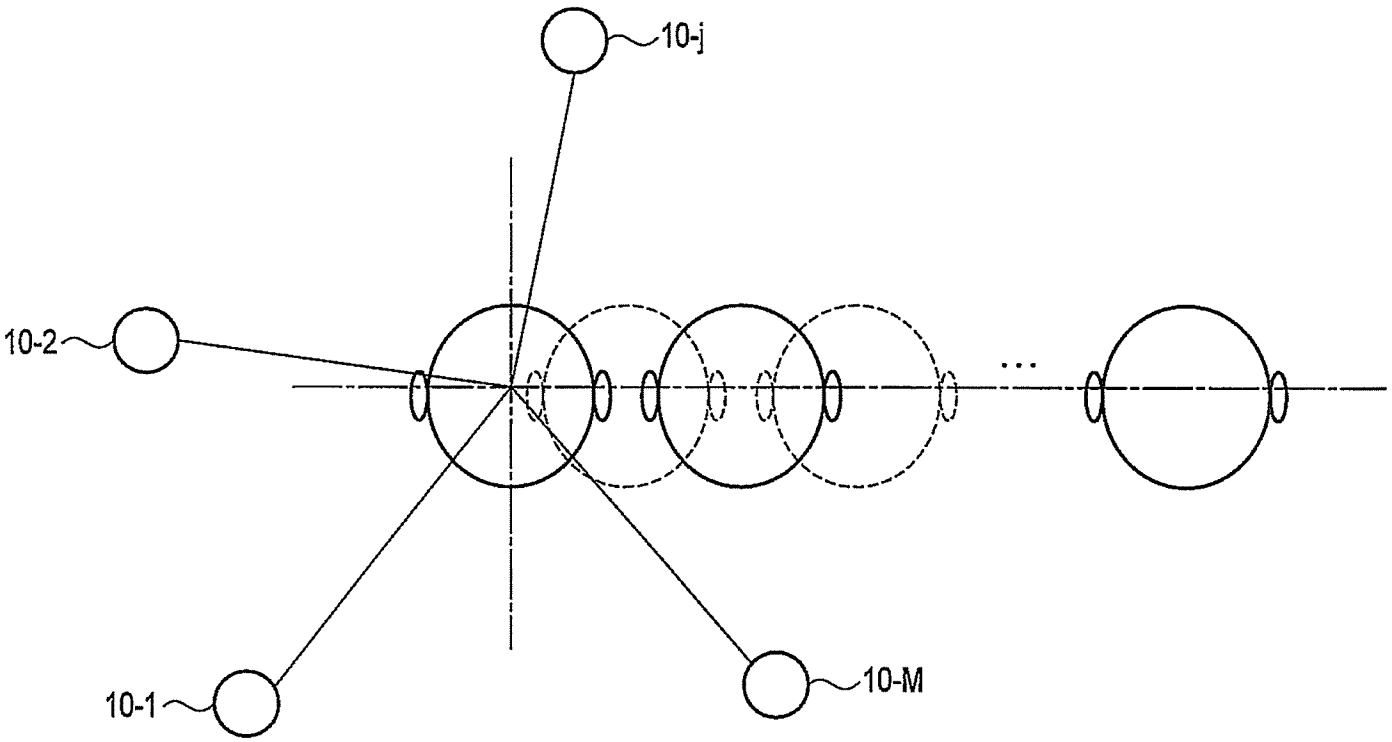
FIG. 48 is a view showing M target virtual acoustic sources.

Here, positions of the M target virtual acoustic sources may be absolutely determined with respect to N target binaural positions. For example, as shown in FIG. 48, positions of the target virtual acoustic sources 10-1, . . . , 10-M may be fixed irrespective of movement of the target binaural position (i.e., a change in i). In this case, when i changes, $d_{Lij}$ and $d_{Rij}$ can also change, and hence N×M $d_{L11}$, . . . , $d_{LNM}$ and N×M $d_{R11}$, . . . , $d_{RNM}$ are required.

Figure 49:
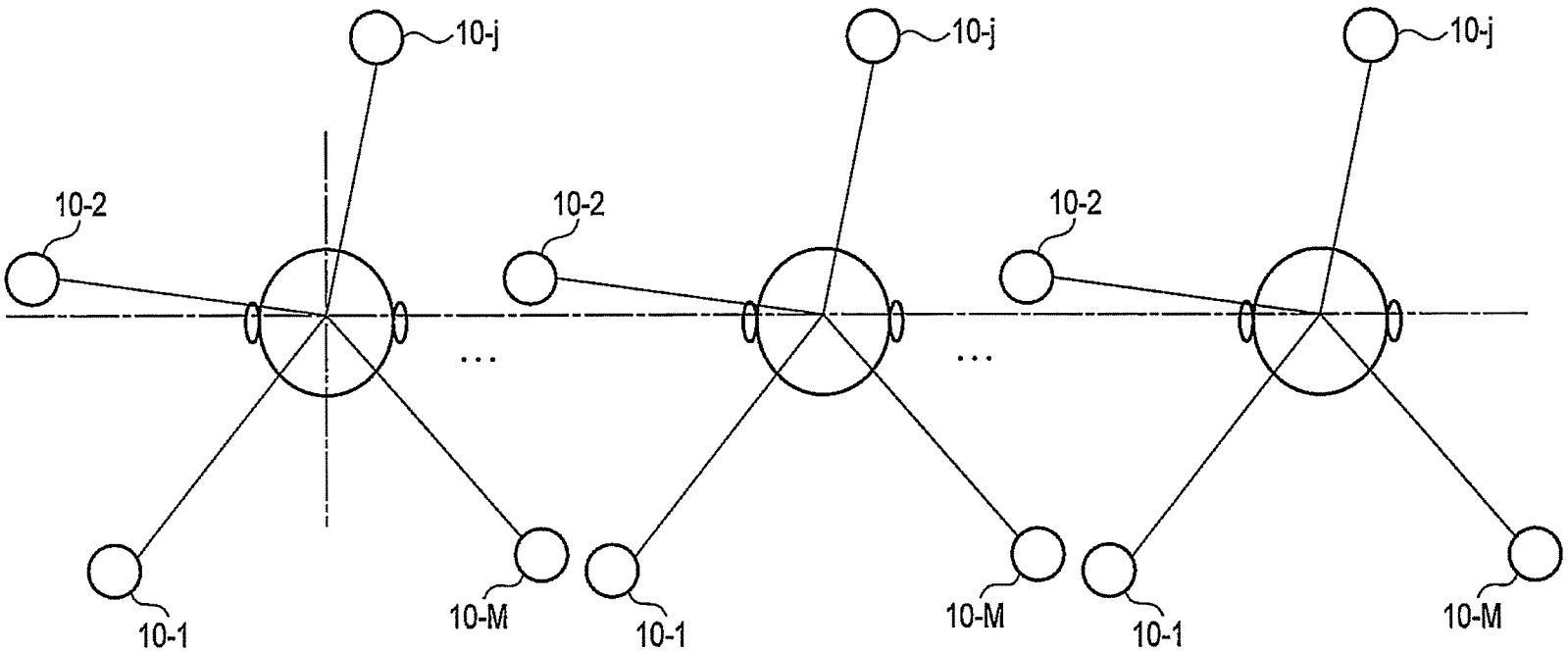
FIG. 49 is a view showing M target virtual acoustic sources.

On the other hand, the positions of the M target virtual acoustic sources may be relatively determined with respect to the N target binaural positions. For example, as shown in FIG. 49, the positions of the target virtual acoustic sources 10-1, . . . , 10-M may be moved in accordance with movement of the target binaural position (i.e., a change in i). In this case, since $d_{Lij}$ and $d_{Rij}$ are not dependent on i, M $d_{L1}$, $d_{LM}$ and M $d_{R1}$, . . . , $d_{RM}$ are required. When the positions of the M target virtual acoustic sources are relatively determined with respect to the N target binaural positions, a sense of auditory lateralization that is common to all the N target binaural positions can be obtained.

Further, the target virtual acoustic source may be set at the time of producing an acoustic signal, but it may be set afterward. For example, when a desired acoustic signal included in content is extracted and the target virtual acoustic source associated with the acoustic signal is switched over, the listener can listen to the same contents with different impressions.

The above Expression (11) needs to be replaced by the following Expression (32).

$$Q_j = \sum_{i=1}^{N} (\Delta P_{ij} \cdot \Delta P_{ij}^*) \rightarrow \min \tag{32}$$

$$\Delta P_{ij} = d_{Rij} \cdot P_{Li} - d_{Lij} \cdot P_{Ri}$$

In Expression (32), $Q_j$ represents acoustic energy about the target virtual acoustic source (=j). Minimization of these M pieces of acoustic energy $Q_1$, . . . , $Q_M$ can be achieved by replacing the above Expression (14) with the following Expression (33).

$$\therefore q_{Lj} = -\frac{\sum_{i=1}^{N} (B_{ij} \cdot A_{ij}^*)}{\sum_{i=1}^{N} (A_{ij} \cdot A_{ij}^*)} q_{Rj} \tag{33}$$

$$\because A_{ij} = C_{LiL} \cdot d_{Rij} - C_{RiL} \cdot d_{Lij}$$

$$B_{ij} = C_{LiR} \cdot d_{Rij} - C_{RiR} \cdot d_{Lij}$$

In Expression (33), $q_{Lj}$ represents a component, which is based on the target virtual acoustic source (=j), in a complex volume velocity of the loudspeaker 101, and $q_{Rj}$ represents a component, which is based on the target virtual acoustic source (=j), in a complex volume velocity of the loudspeaker 102.

Based on the above Expression (33), a filter coefficient set (=$W_{L1}$, . . . , $W_{LM}$, $W_{R1}$, . . . , $W_{RM}$) can be derived. When acoustic signals ($S_1$, . . . , $S_M$) associated with the target virtual acoustic sources (=1, . . . , M) are multiplied by the filter coefficient set (=$W_{Li}$, . . . , $W_{LM}$) and then combined, a left acoustic signal (=$W_{L1}S_1$+ . . . +$W_{LM}S_M$) supplied to the loudspeaker 101 can be derived. Likewise, when acoustic signals ($S_1$, . . . , $S_M$) associated with the target virtual acoustic sources (=1, . . . , M) are multiplied by the filter coefficient set (=$W_{R1}$, . . . , $W_{RM}$) and then combined, a right acoustic signal (=$W_{R1}S_1$+ . . . +$W_{RM}S_M$) supplied to the loudspeaker 102 can be derived.

As described above, the acoustic control apparatus according to the ninth embodiment allows the target virtual acoustic sources. Therefore, in this acoustic control apparatus, acoustic sources in, e.g., 5.1 ch surround system depicted in FIG. 57 or any other stereophonic system are considered as target virtual acoustic sources, whereby the same effects as those of the first to fourth embodiments can be obtained.

(Tenth Embodiment)

Each of the foregoing embodiments has been described on the assumption that the two loudspeakers are used for ease of explanation. However, the further effects can be obtained by increasing the total number of the loudspeakers to three or more. In the following explanation, the total number of the loudspeakers is assumed to be X.

Figure 43:
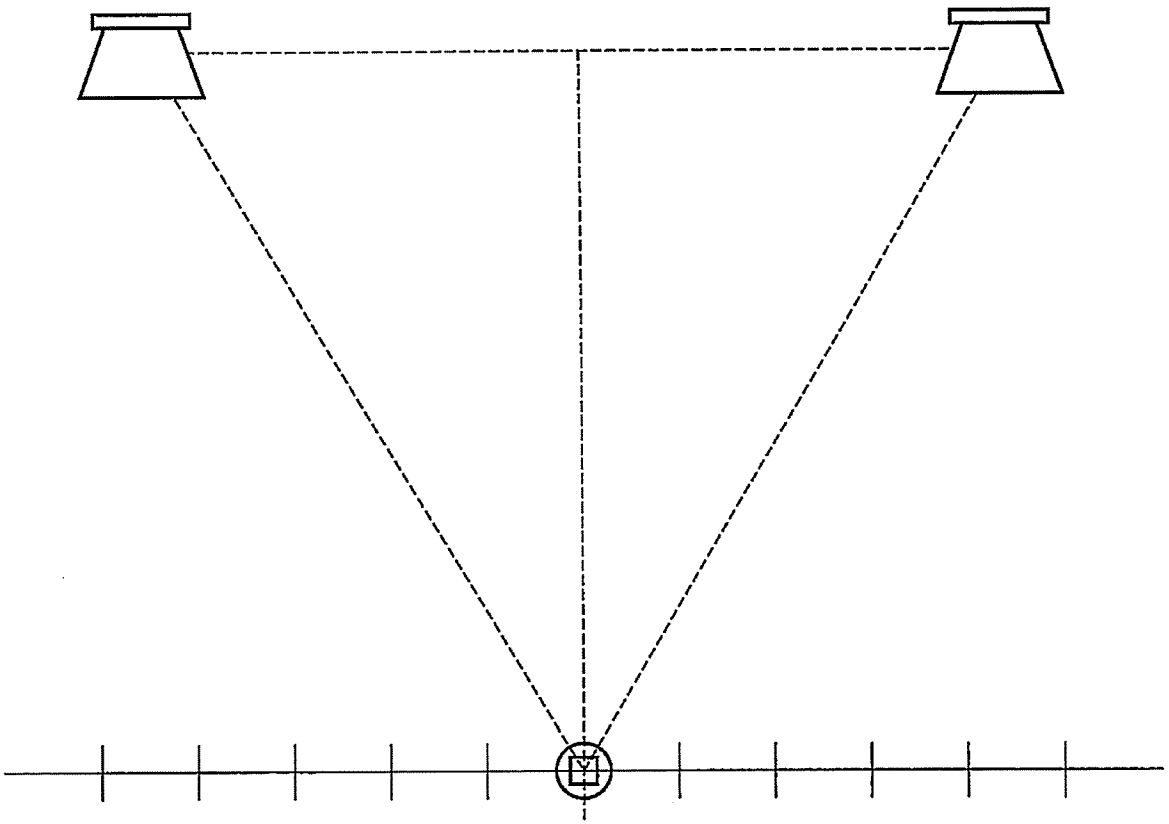
FIG. 43 is a view showing a target binaural position that can be treated when X=2.

The conventional control policy faithfully reproduces desired sound pressures at one target binaural position when X=2 (see a square mark in FIG. 43). Likewise, according to the control policy of each of the foregoing embodiments, when X=2, a complex sound pressure ratio can conform to a desired ratio at one target binaural position (see a circle mark in FIG. 43). It is to be noted that the square mark and the circle mark in FIG. 43, FIG. 44, and FIG. 45 indicate a central position of a listener's head region in a precise sense, and his/her both ears are placed on left and right sides of the central position.

Since the conventional control policy needs to faithfully reproduce the desired sound pressures at each target binaural position, the total number of the target binaural positions×two loudspeakers are required. On the other hand, since the control policy according to each embodiment needs to conform (or approximate) the complex sound pressure ratio at each target binaural position to a desired ratio, the total number of the target binaural position+one loudspeaker are required. That is, if the total number of the target binaural positions is the same, the control policy according to each embodiment can reduce the total number of the required loudspeakers.

Figure 44:
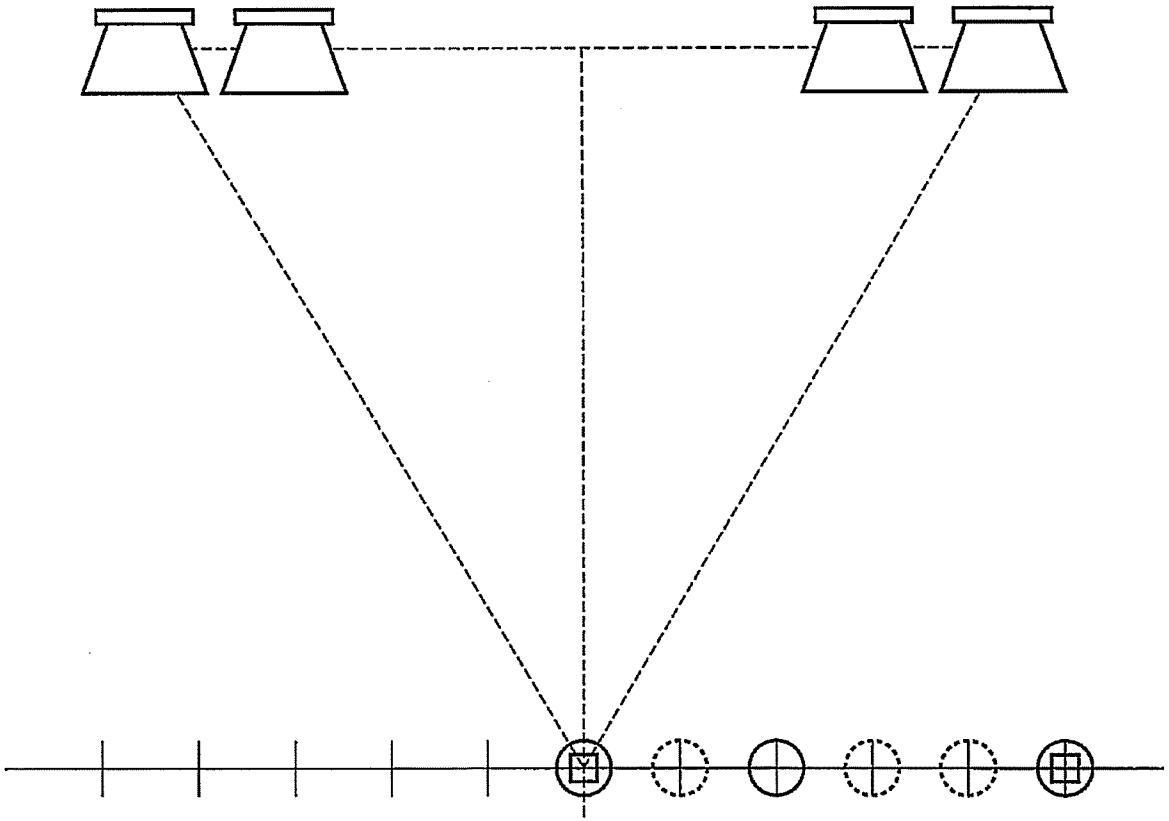
FIG. 44 is a view showing a target binaural position that can be treated when X=4.
Figure 45:
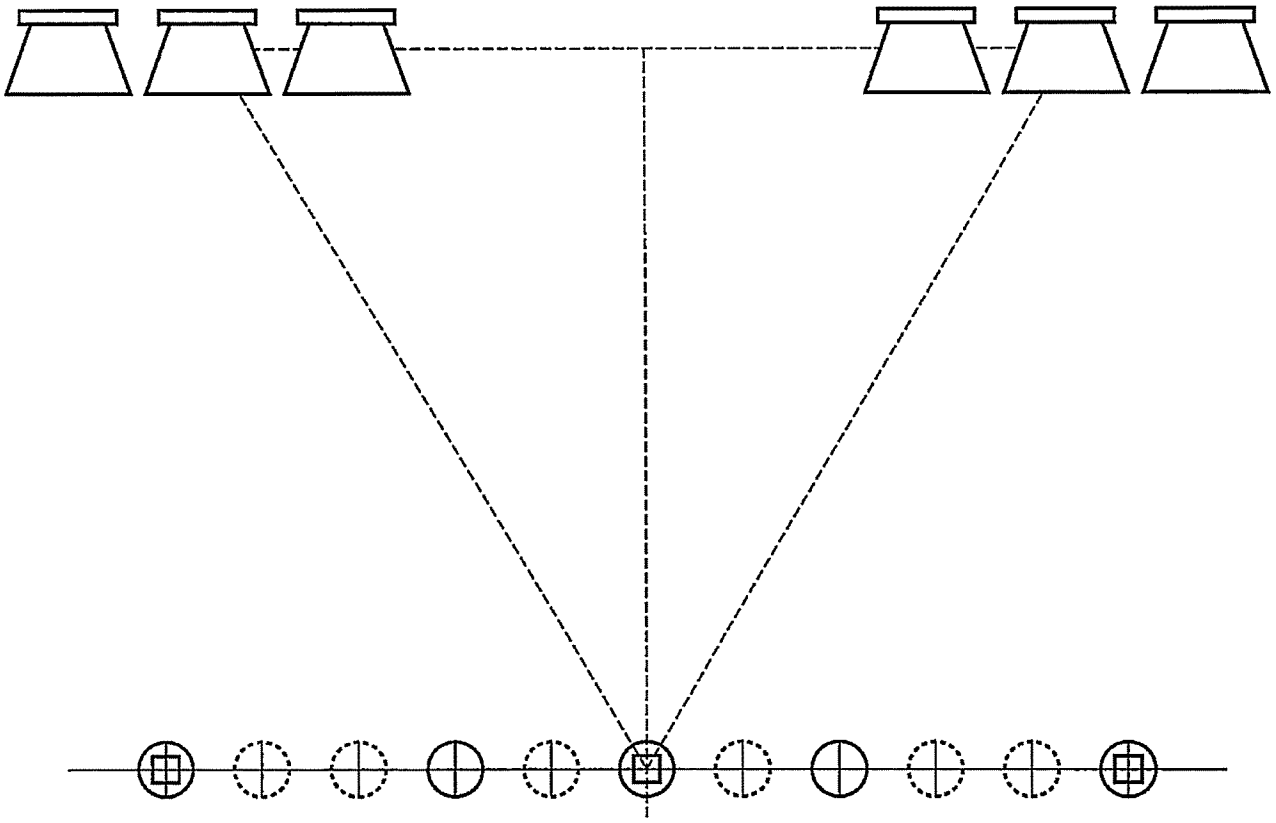
FIG. 45 is a view showing a target binaural position that can be treated when X=6.

In other words, according to the conventional control policy, the target sound pressures can be faithfully reproduced at X/2 (truncated) target binaural positions (see square marks in FIG. 44 and FIG. 45). On the other hand, according to the control policy of each embodiment, the complex sound pressure ratio can conform to the desired ratio at X−1 target binaural positions (see solid circle marks in FIG. 44 and FIG. 45). In short, the control policy according to each embodiment can deal with more target binaural positions when X≥3 as compared with the conventional control policy. Further, according to the control policy of each embodiment, the complex sound pressure ratio close to the desired ratio can be expected at X−1 target binaural positions and gaps formed between these binaural positions (see dotted line circle marks in FIG. 44 and FIG. 45).

According to the tenth embodiment, the first or second embodiment is generalized and applied when X≥3.

Figure 46:
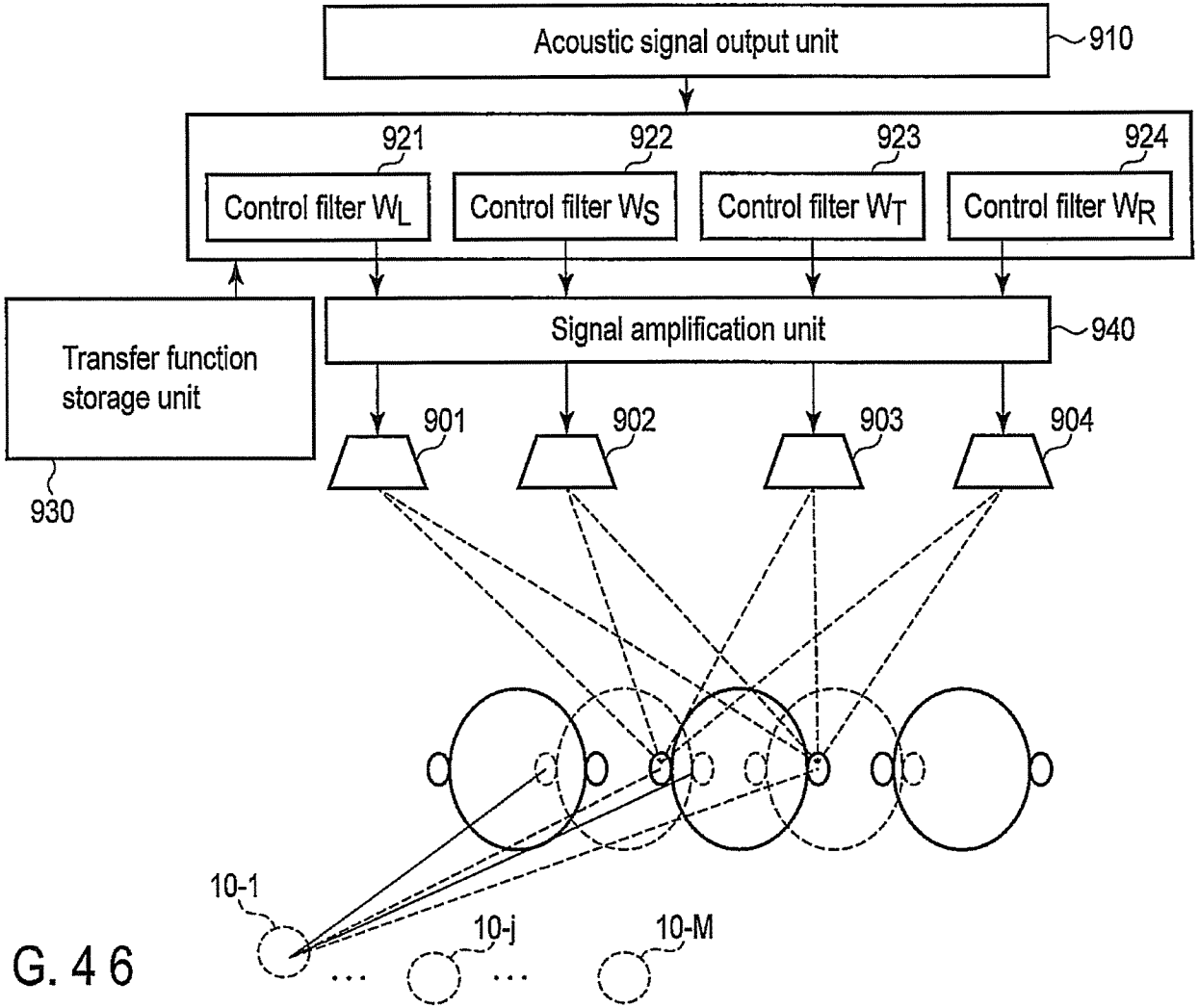
FIG. 46 is a block diagram showing an acoustic control apparatus according to a tenth embodiment.

As shown in FIG. 46, an acoustic control apparatus according to the tenth embodiment comprises loudspeakers 901, 902, 903, and 904, an acoustic signal output unit 910, control filters 921, 922, 923, and 924, a transfer function storage unit 930, and a signal amplification unit 940. In the acoustic control apparatus in FIG. 46, X=4 is set. The acoustic control apparatus in FIG. 46 supports M target virtual acoustic sources 10-1, . . . , 10-M.

The acoustic control apparatus shown in FIG. 46 performs later-described acoustic control to M acoustic signals output from the acoustic signal output unit 910 to approximate (e.g., conform) a spatial average of complex sound pressure ratios at three target binaural positions to a spatial average of complex sound pressure ratios that arrive at the target binaural positions from the M target virtual acoustic sources 10-1, . . . , 10-M. According to the acoustic control apparatus depicted in FIG. 46, the listener can perceive directions of the M target virtual acoustic sources at, e.g., the respective three (=X−1) target binaural positions.

The loudspeakers 901, 902, 903, and 904 emit (combined) acoustic signals of four channels amplified by the signal amplification unit 940. The acoustic signal output unit 910 outputs the M acoustic signals to the control filters 921, 922, 923, and 924, respectively. The transfer function storage unit 930 stores head-related transfer functions in relation to at least three (=X−1) target binaural positions. Specifically, the transfer function storage unit 930 stores three head-related transfer function sets from the loudspeakers 901, 902, 903, and 904 to at least three target binaural position and 3×M (or 1×M) head-related transfer function sets from the M target virtual acoustic sources to at least three target binaural positions. It is to be noted that the head-related transfer function sets may be derived by preliminary measurement or calculation and stored in the transfer function storage unit 930. Further, the acoustic control apparatus in FIG. 46 may derive the head-related transfer function sets by measurement or calculation at any timing (e.g., setting or activation) and store them in the transfer function storage unit 930.

The control filters 921, 922, and 923 read from the transfer function storage unit 930 head-related transfer functions ($=C_{L1L}, \ldots, C_{LNL}$) from the loudspeaker 901 to the listener's left ear at the N (=X−1) target binaural positions (i=1, . . . , N), head-related transfer functions ($=C_{L1S}, \ldots, C_{LNS}$) from the loudspeaker 902 to the listener's left ear at the N target binaural positions (i=1, . . . , N), head-related transfer functions ($=C_{L1T}, \ldots, C_{LNT}$) from the loudspeaker 903 to the listener's left ear at the N target binaural positions (i=1, . . . , N), head-related transfer functions ($=C_{L1R}, \ldots, C_{LNR}$) from the loudspeaker 904 to the listener's left ear at the N target binaural positions (i=1, . . . , N), head-related transfer functions ($=C_{R1L}, \ldots, C_{RNL}$) from the loudspeaker 901 to the listener's right ear at the N target binaural positions (i=1, . . . , N), head-related transfer functions ($=C_{R1S}, C_{RNS}$) from the loudspeaker 902 to the listener's right ear at the N target binaural positions (i=1, . . . , N), head-related transfer functions ($=C_{R1T}, \ldots, C_{RNT}$) from the loudspeaker 903 to the listener's right ear at the N target binaural positions (i=1, . . . , N), head-related transfer functions ($=C_{R1R}, \ldots, C_{RNR}$) from the loudspeaker 904 to the listener's right ear at the N target binaural positions (i=1, . . . , N), head-related transfer functions ($=d_{L11}, \ldots, d_{LNM}$) from the M target virtual acoustic sources (=1, . . . , M) to the listener's left ear at the N target binaural positions (i=1, . . . , N), and head-related transfer functions ($=d_{R11}, \ldots, d_{RNM}$) from the M target virtual acoustic sources (=1, . . . , M) to the listener's right ear at the N target binaural positions (i=1, . . . , N) as required. When the listener's binaural position greatly fluctuates from any one of the target binaural positions or when the target virtual acoustic source is changed, the control filter 921, 922, and 923 may switch over the head-related transfer function. It is to be noted that, if $d_{Lij}$ and $d_{Rij}$ are not dependent on as described above, the head-related transfer functions ($=d_{L11}, \ldots, d_{LNM}$) may be substituted by the head-related transfer functions ($=d_{L1}, \ldots, d_{LM}$), and the head-related transfer functions ($=d_{R11}, \ldots, d_{RNM}$) may be substituted by the head-related transfer functions ($=d_{R1}, \ldots, d_{RM}$).

The control filters 921, 922, and 923 calculate control filter coefficient sets ($=W_{L1}, \ldots, W_{LM}, W_{S1}, \ldots, W_{SM}, W_{T1}, \ldots, W_{TM}$) based on the head-related transfer functions read from the transfer function storage unit 930 and a control filter coefficient set ($=W_{R1}, \ldots, W_{RM}$) of the control filter 924. It is to be noted that the calculation of the control filter coefficient sets ($=W_{L1}, \ldots, W_{LM}, W_{S1}, \ldots, W_{SM}, W_{T1}, \ldots, W_{TM}$) may be performed by a non-illustrated coefficient calculation unit in place of the control filters 921, 922, and 923. Control filter coefficients ($=W_{Lj}, W_{Sj}, W_{Tj}$) associated with a combination of a control filter coefficient ($=W_{Rj}$) of the control filter 924, the N target binaural position (i=1, . . . , N), and the target virtual acoustic source (=j) may be previously calculated, and the control filters 921, 922, and 923 may read out appropriate control filter coefficients ($=W_{Lj}, W_{Sj}, W_{Tj}$).

A description will now be given as to a calculation technique of the control filter coefficient sets ($=W_{L1}, \ldots, W_{LM}, W_{S1}, \ldots, W_{SM}, W_{T1}, \ldots, W_{TM}$) when X=4. Here, the control filter coefficient set ($=W_{R1}, \ldots, W_{RM}$) of the control filter 924 may have through characteristic, and $W_{Rj}=1$ is generally presumed in the following description. First, the above Expression (10) may be replaced by the following Expression (34).

$$P_{Li}=C_{LiL}\cdot q_L+C_{LiR}\cdot q_R+C_{LiS}\cdot q_S+C_{LiT}\cdot q_T$$

$$P_{Ri}=C_{RiL}\cdot q_L+C_{RiR}\cdot q_R+C_{RiS}\cdot q_S+C_{RiT}\cdot q_T \tag{34}$$

In Expression (34), $q_L$, $q_S$, $q_T$, and $q_R$ represent complex volume velocities of the loudspeakers 901, 902, 903, and 904, respectively. Referring to Expression (34) and the description of each foregoing embodiment, the following Expressions (35) to (39) can be derived.

$$W_R = \sum_{j=1}^{M} W_{Rj} = 1 \tag{35}$$

$$W_L = \sum_{j=1}^{M} W_{Lj} = \sum_{j=1}^{M}\left(-\frac{\sum_{i=1}^{N}(P_{ij}\cdot O_{ij}^*)}{\sum_{i=1}^{N}(O_{ij}\cdot O_{ij}^*)} W_{Rj}\right)$$

$$W_S = \sum_{j=1}^{M} W_{Sj} = \sum_{j=1}^{M}\left(-\frac{L_j\cdot W_{Lj}+M_j\cdot W_{Rj}}{N_j}\right)$$

$$W_T = \sum_{j=1}^{M} W_{Tj} = \sum_{j=1}^{M}\left(-\frac{E_j\cdot W_{Lj}+F_j\cdot W_{Sj}+G_j\cdot W_{Rj}}{H_j}\right)$$

$$\begin{aligned} A_{ij} &= C_{RiL}\cdot d_{Lij} - C_{LiL}\cdot d_{Rij} \\ B_{ij} &= C_{RiS}\cdot d_{Lij} - C_{LiS}\cdot d_{Rij} \\ C_{ij} &= C_{RiT}\cdot d_{Lij} - C_{LiT}\cdot d_{Rij} \\ D_{ij} &= C_{RiR}\cdot d_{Lij} - C_{LiR}\cdot d_{Rij} \\ i &= 1, 2, \ldots, N \\ j &= 1, 2, \ldots, M \end{aligned} \tag{36}$$

-continued $$E_j = \sum_{i=1}^{N} (A_{ij} \cdot C_{ij}^*) \tag{37}$$

$$F_j = \sum_{i=1}^{N} (B_{ij} \cdot C_{ij}^*)$$

$$G_j = \sum_{i=1}^{N} (D_{ij} \cdot C_{ij}^*)$$

$$H_j = \sum_{i=1}^{N} (C_{ij} \cdot C_{ij}^*)$$

$$I_{ij} = A_{ij} - \frac{C_{ij} \cdot E_j}{H_j} \tag{38}$$

$$J_{ij} = B_{ij} - \frac{C_{ij} \cdot F_j}{H_j}$$

$$K_{ij} = D_{ij} - \frac{C_{ij} \cdot G_j}{H_j}$$

$$i = 1, 2, \ldots, N$$
$$j = 1, 2, \ldots, M$$

$$L_j = \sum_{i=1}^{N} (I_{ij} \cdot J_{ij}^*) \tag{39}$$

$$M_j = \sum_{i=1}^{N} (K_{ij} \cdot J_{ij}^*)$$

$$N_j = \sum_{i=1}^{N} (J_{ij} \cdot J_{ij}^*)$$

$$O_{ij} = I_{ij} - \frac{J_{ij} \cdot L_j}{N_j}$$

$$P_{ij} = K_{ij} - \frac{J_{ij} \cdot M_j}{N_j}$$

$$i = 1, 2, \ldots, N$$
$$j = 1, 2, \ldots, M$$

Figure 47:
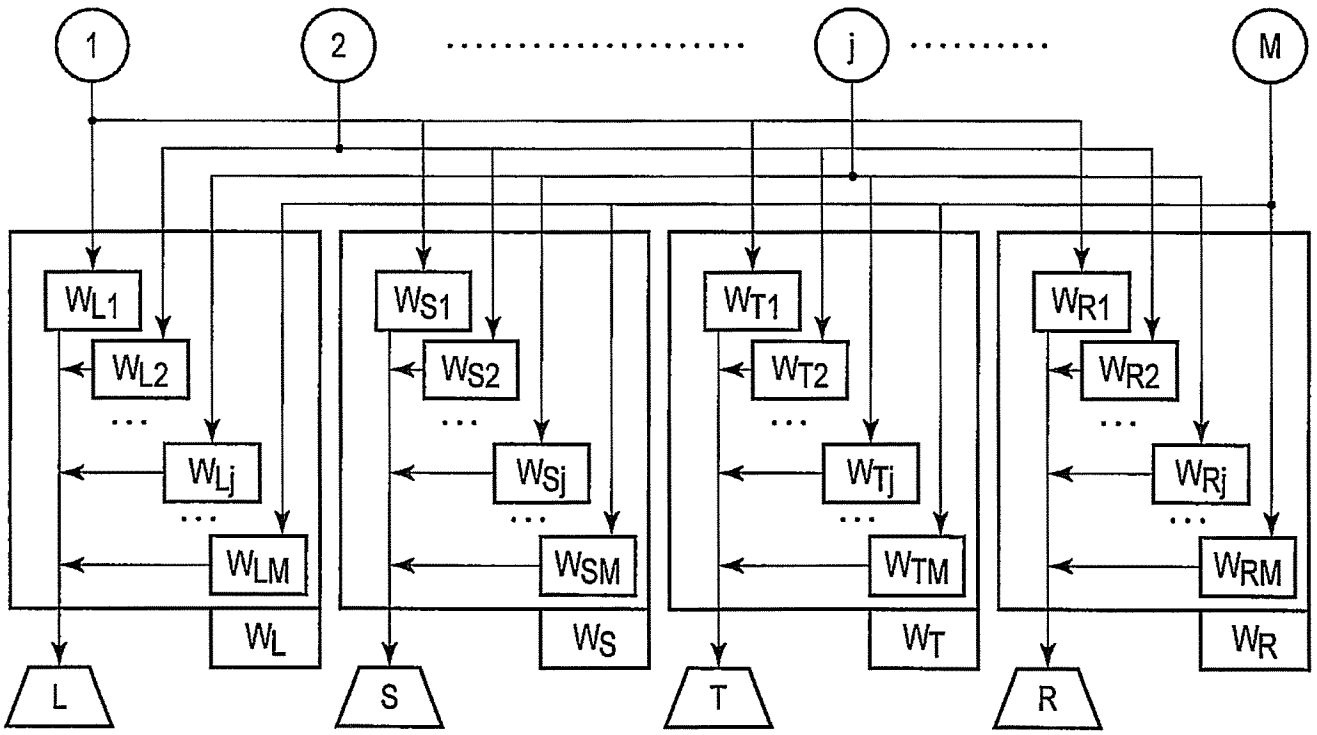
FIG. 47 is an explanatory view of control filter processing with respect to M acoustic signals associated with M target virtual acoustic sources.

As shown in FIG. 47, the control filter 921 multiplies the control filter coefficient set (=$W_{L1}, \ldots, W_{LM}$) by M acoustic signals (=$S_1, \ldots, S_M$), then combines products, and inputs a combined acoustic signal to the signal amplification unit 940.

As shown in FIG. 47, the control filter 922 multiplies the control filter coefficient set (=$W_{S1}, \ldots, W_{SM}$) by the M acoustic signals (=$S_1, \ldots, S_M$), then combines products, and inputs a combined acoustic signal to the signal amplification unit 940.

As shown in FIG. 47, the control filter 923 multiplies the control filter coefficient set (=$W_{T1}, \ldots, W_{TM}$) by the M acoustic signals (=$S_1, \ldots, S_M$), then combines products, and inputs a combined acoustic signal to the signal amplification unit 940.

As shown in FIG. 47, the control filter 924 multiplies the control filter coefficient set (=$W_{R1}, \ldots, W_{RM}$) by the M acoustic signals (=$S_1, \ldots, S_M$), then combines products, and inputs a combined acoustic signal to the signal amplification unit 940. However, if the control filter coefficient set (=$W_{R1}, \ldots, W_{RM}$) of the control filter 924 has the through characteristic, the control filter 924 simply combines the M acoustic signals (=$S_1, \ldots, S_M$) and inputs the combined acoustic signal to the signal amplification unit 940. Moreover, if the control filter coefficient set (=$W_{R1}, \ldots, W_{RM}$) of the control filter 924 has the through characteristic and M=1 is set, the control filter 924 can be omitted.

The signal amplification unit 940 amplifies the combined acoustic signals of 4 channels from the control filters 921, 922, 923, and 924 in accordance with gain and supplies the amplified signals to the loudspeakers 901, 902, 903, and 904. The signal amplification unit 940 is e.g., an amplifier.

Adequacy of effects of the acoustic control apparatus according to the present embodiment will now be described hereinafter with reference to an experimental result.

Figure 50:
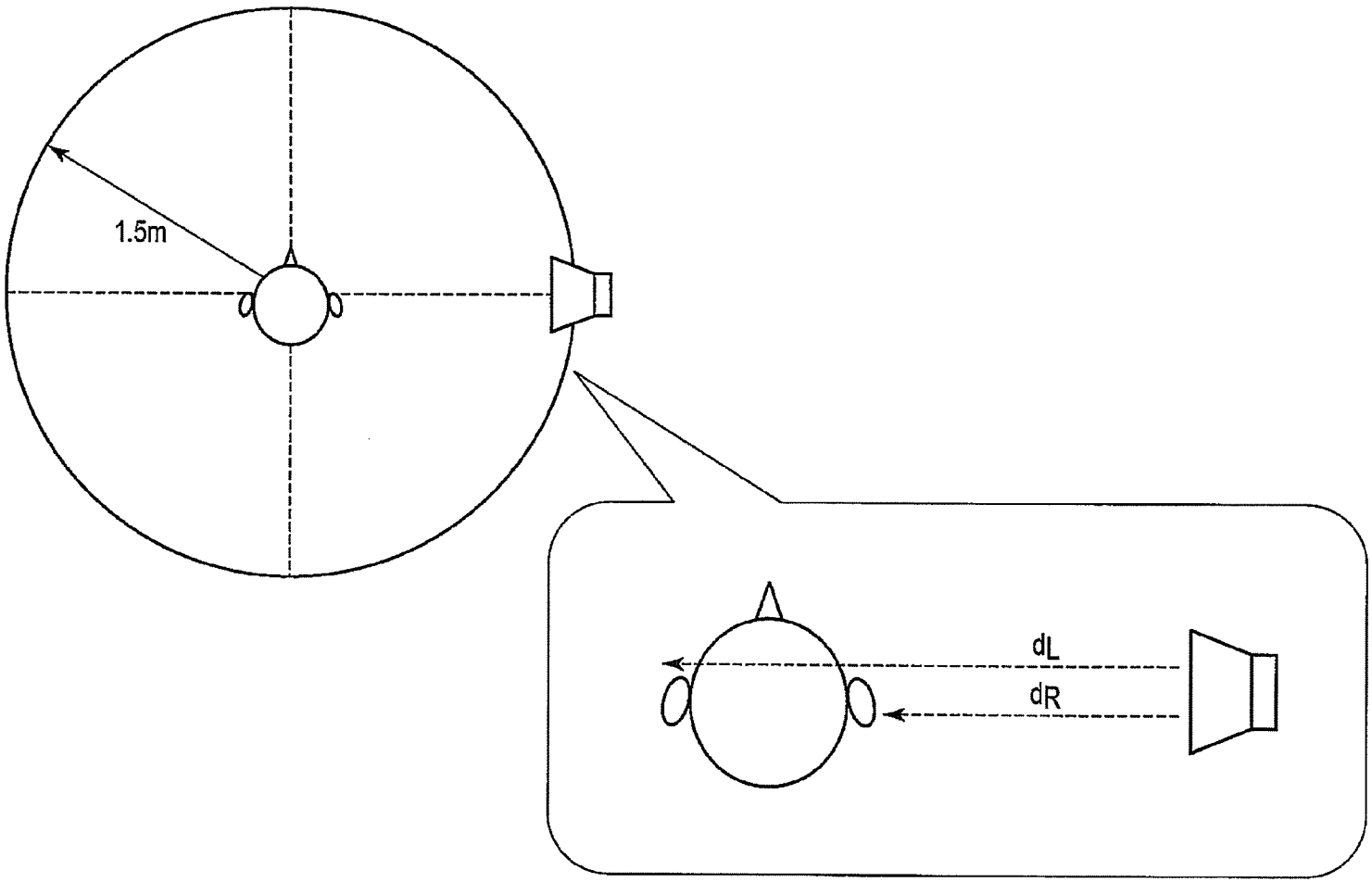
FIG. 50 is an explanatory view of a measuring method for a head-related transfer function from a virtual acoustic source to a target binaural position.
Figure 51:
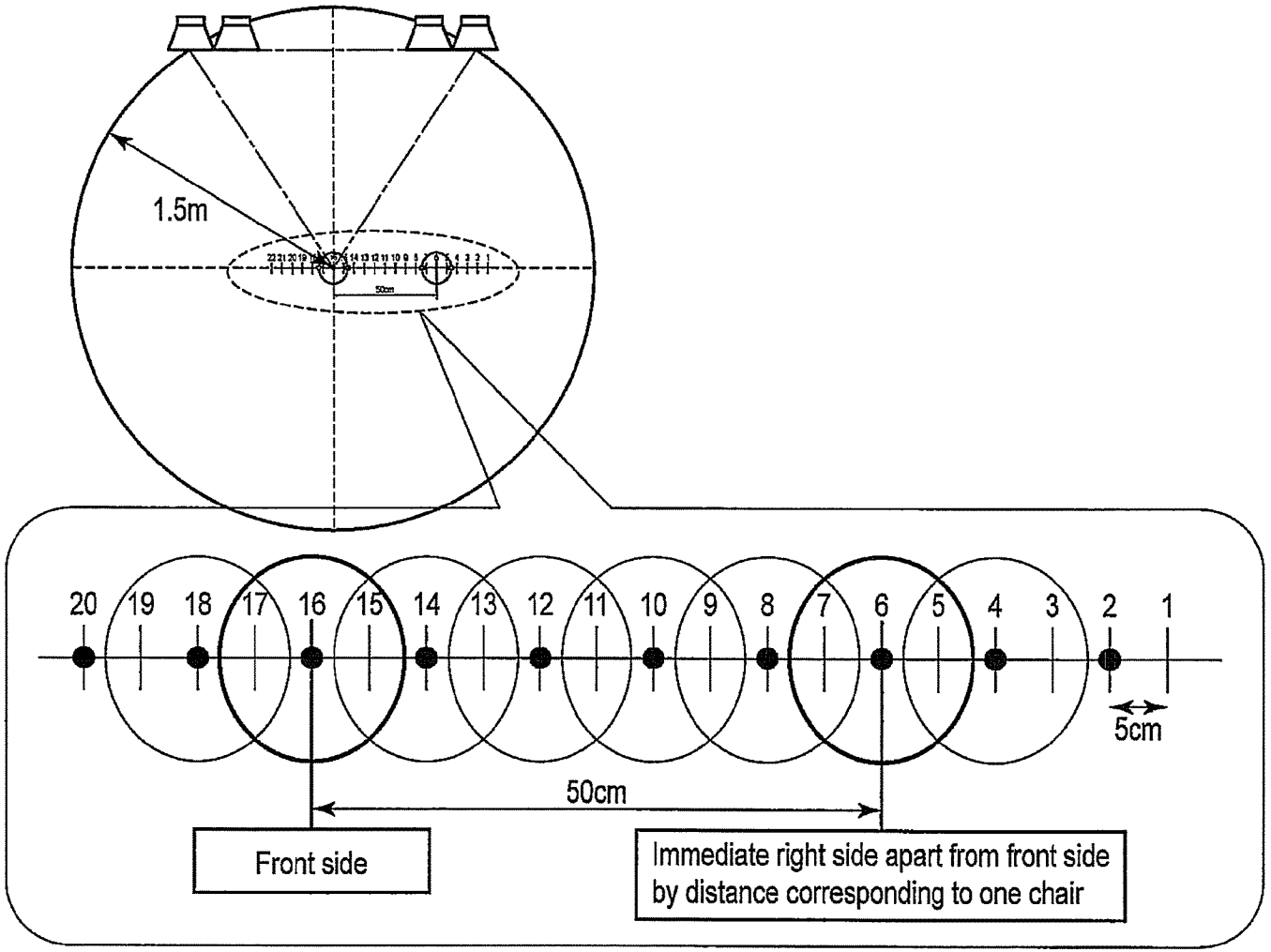
FIG. 51 is an explanatory view of the measuring method for a head-related transfer function from the loudspeaker to binaural positions.
Figure 52A:
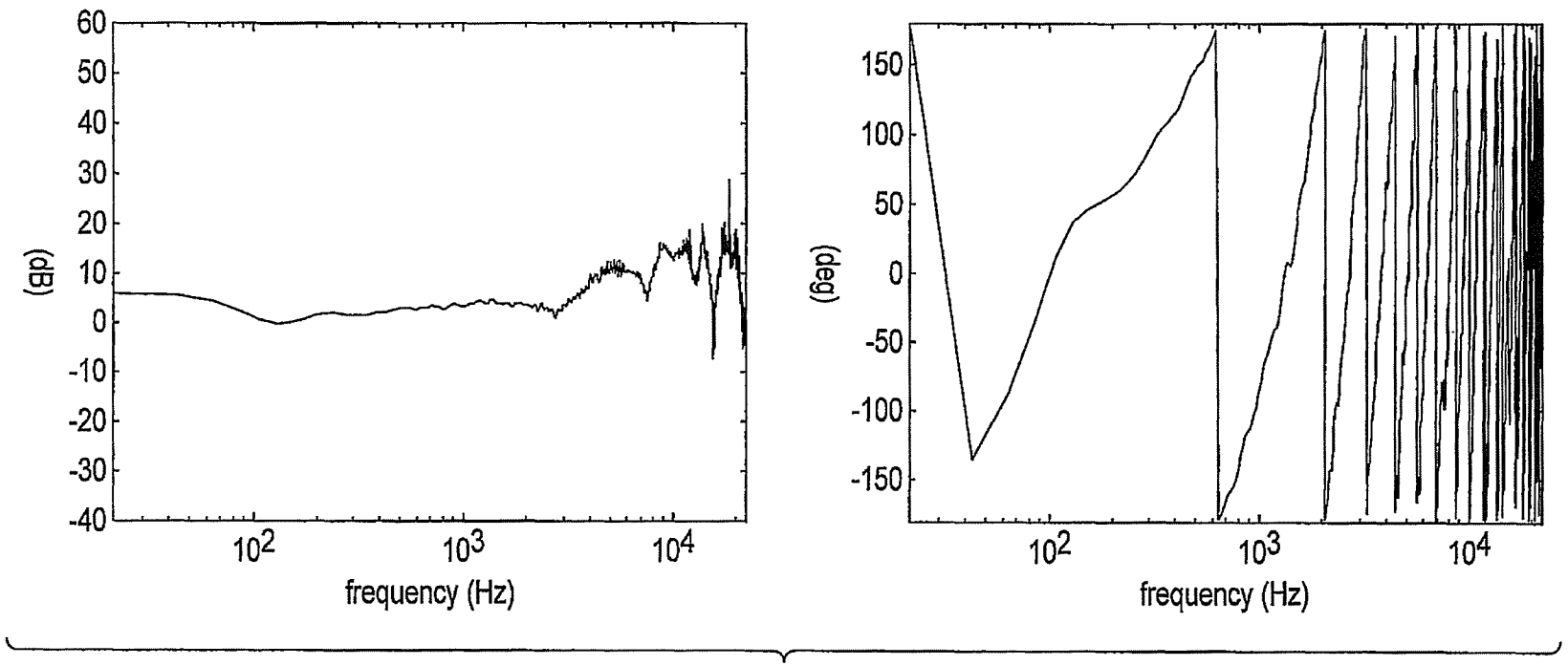
FIG. 52A is a graph showing amplitude characteristic and phase characteristic of a complex sound pressure ratio at a binaural position (16)
Figure 52B:
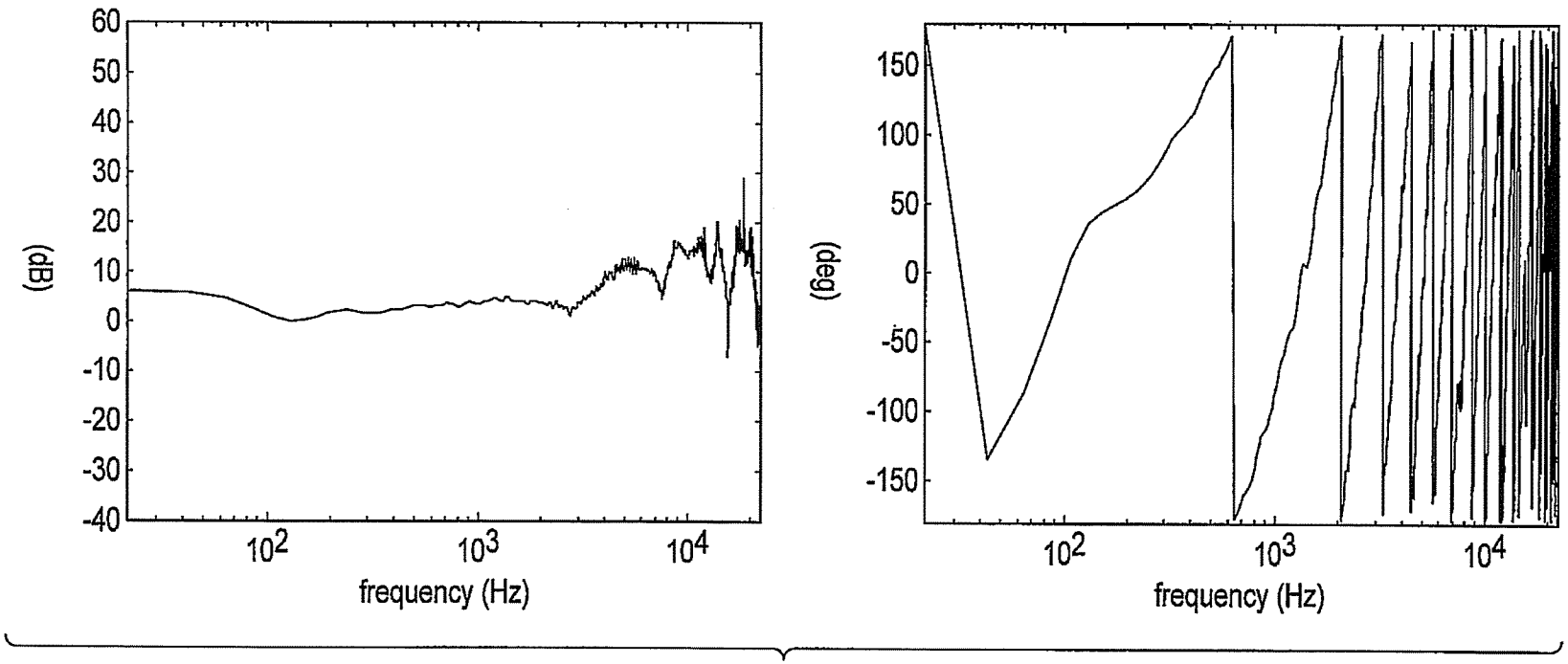
FIG. 52B is a graph showing amplitude characteristic and phase characteristic of the complex sound pressure ratio at a binaural position (14)
Figure 52C:
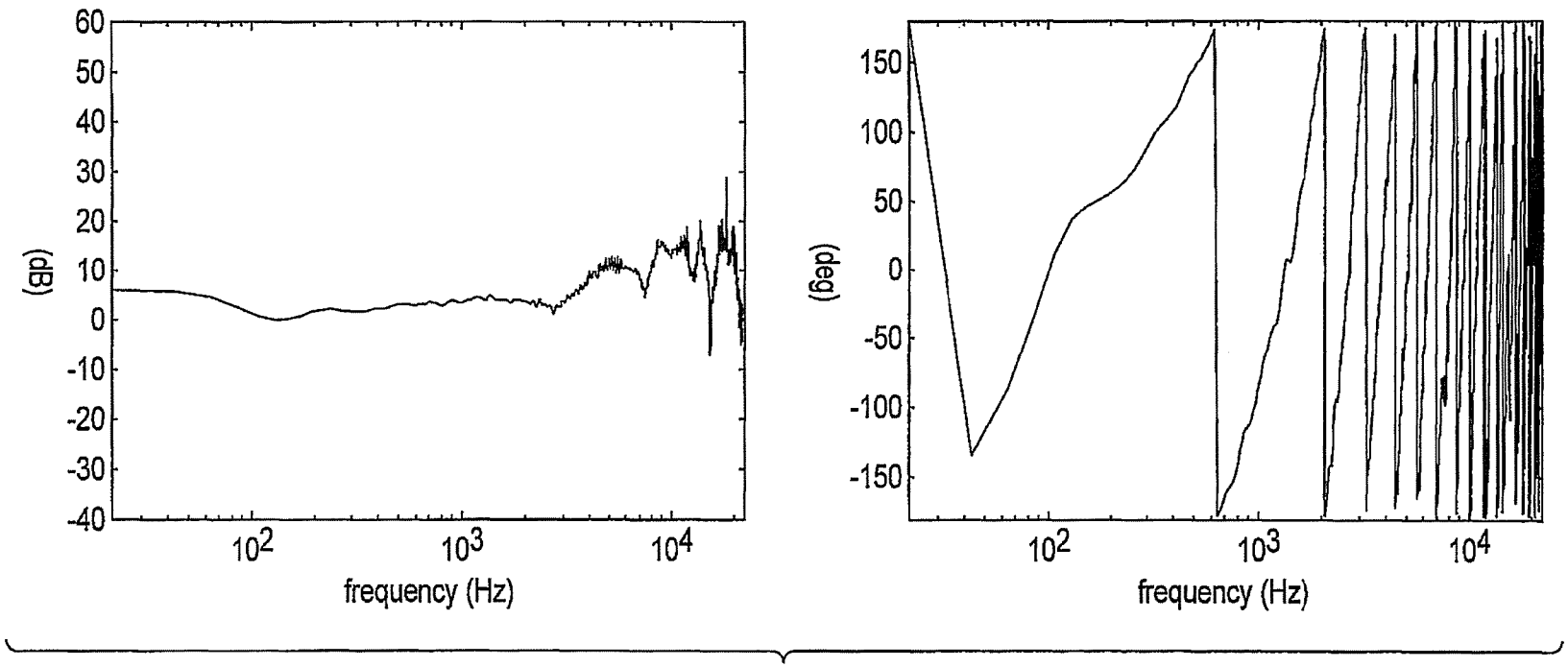
FIG. 52C is a graph showing amplitude characteristic and phase characteristic of the complex sound pressure ratio at a binaural position (12)
Figure 52D:
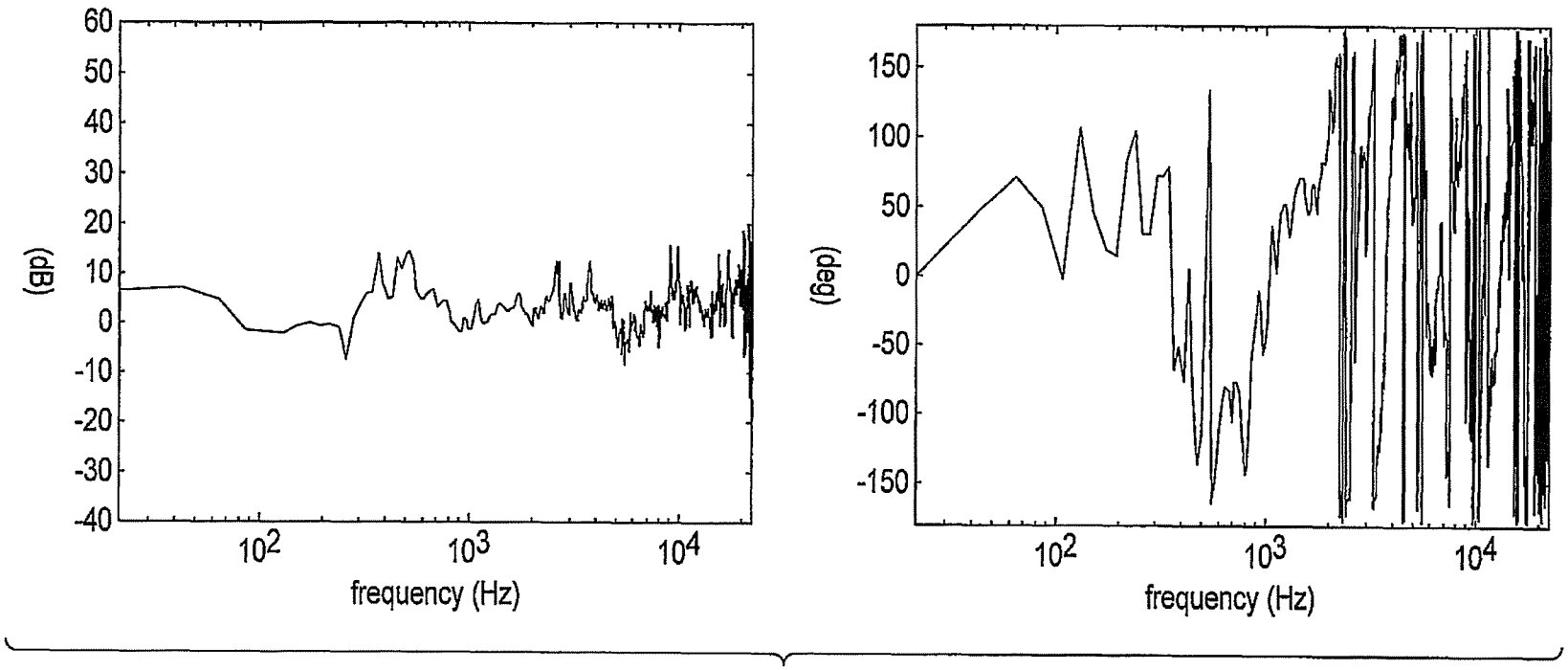
FIG. 52D is a graph showing amplitude characteristic and phase characteristic of the complex sound pressure ratio at a binaural position (10)
Figure 52E:
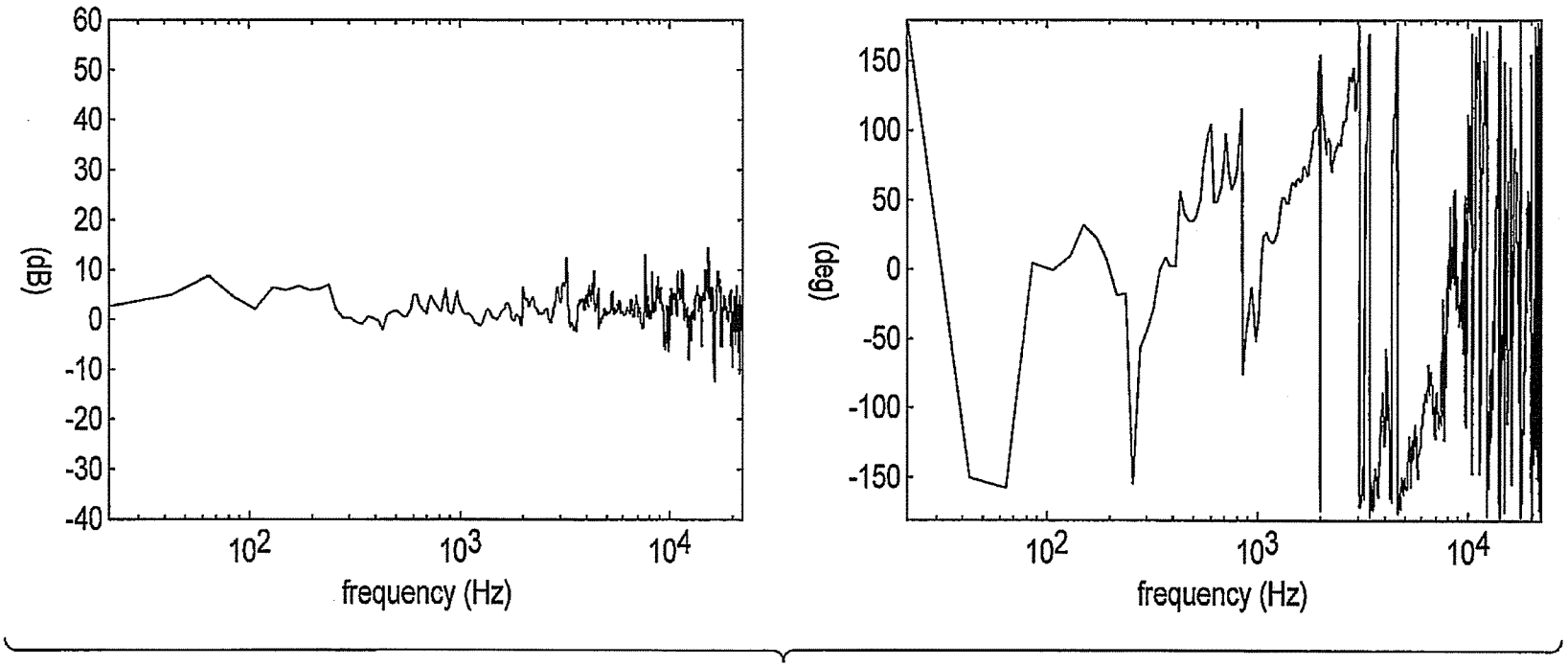
FIG. 52E is a graph showing amplitude characteristic and amplitude characteristic of the complex sound pressure ratio at a binaural position (8)
Figure 52F:
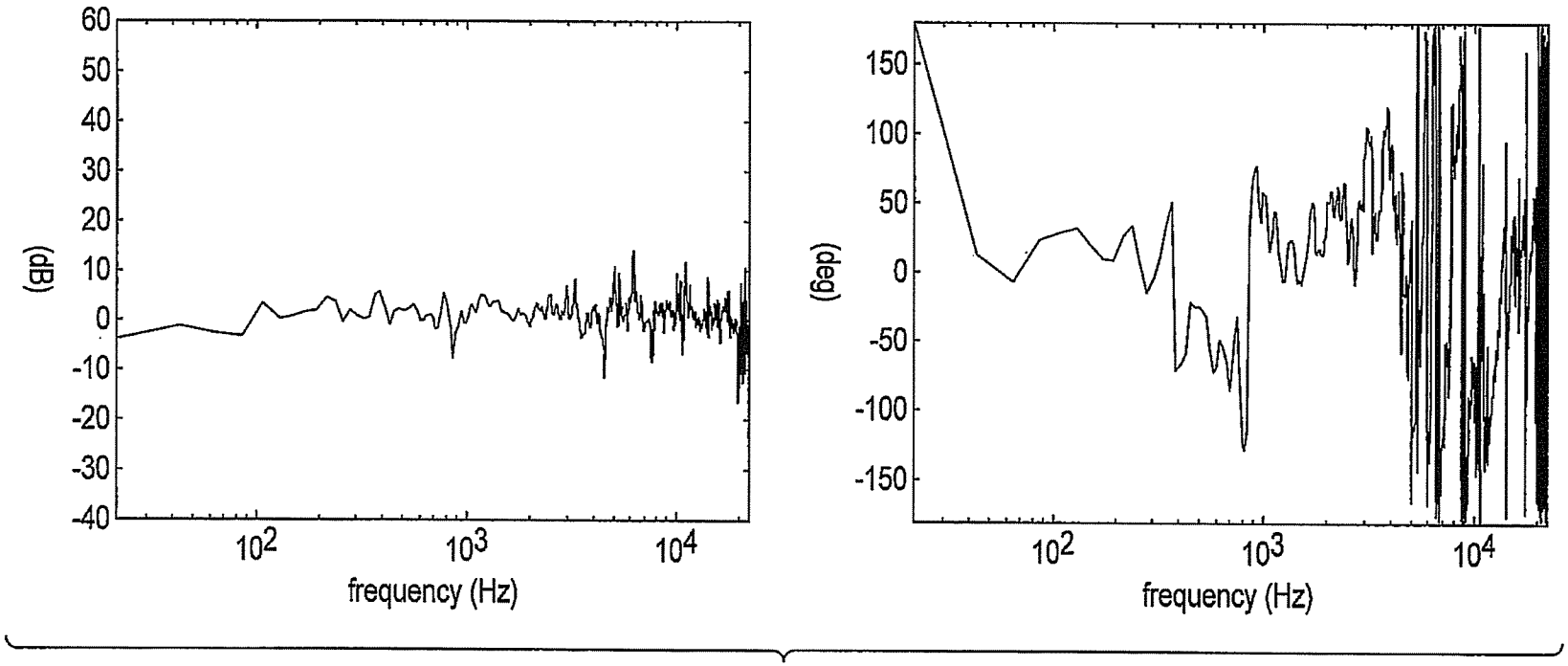
FIG. 52F is a graph showing amplitude characteristic and phase characteristic at the complex sound pressure ratio at a binaural position (6)

Evaluated was robustness of the acoustic control apparatus according to the present embodiment when the binaural position moves every 10 cm from a predetermined position in front of the loudspeaker in a direction of 270 degrees (the right direction) up to 50 cm. It is to be noted that the total number of target virtual acoustic sources can be considered to be irrelevant to the robustness of the acoustic control apparatus according to the present embodiment, M=1 was assumed for simplification. Specifically, as shown in FIG. 50, the dummy head was installed at the predetermined position, and the loudspeaker was set at a position 1.5 m apart from the dummy head in the direction of 270 degrees to measure head-related transfer functions (=$d_L$, $d_R$). In a precise sense, when the binaural position deviates, the head-related transfer functions (=$d_1$, $d_R$) also fluctuate. However, since the target virtual acoustic source is present at a position immediately lateral to each binaural position in the experiment, it can be considered that the fluctuation of the head-related transfer functions (=$d_L$, $d_R$) is small. Therefore, the head-related transfer functions (=$d_L$, $d_R$) were determined to be common to all the target binaural positions. As shown in FIG. 51, the dummy heads were set at respective binaural positions (16), (14), (12), (10), (8), and (6) from the binaural position (16) corresponding to the predetermined position to the binaural position (6) that is 50 cm apart from the binaural position (16) in the direction of 270 degrees, a predetermined acoustic signal (noise) was reproduced from the loudspeaker, and amplification characteristic and phase characteristic of $P_L/P_R$ were measured. A length of 50 cm corresponds to a width of approximately one chair. In any case, the dummy head faces a direction of 90 degrees (a front direction), and microphones are disposed to both ears.

Figure 53:
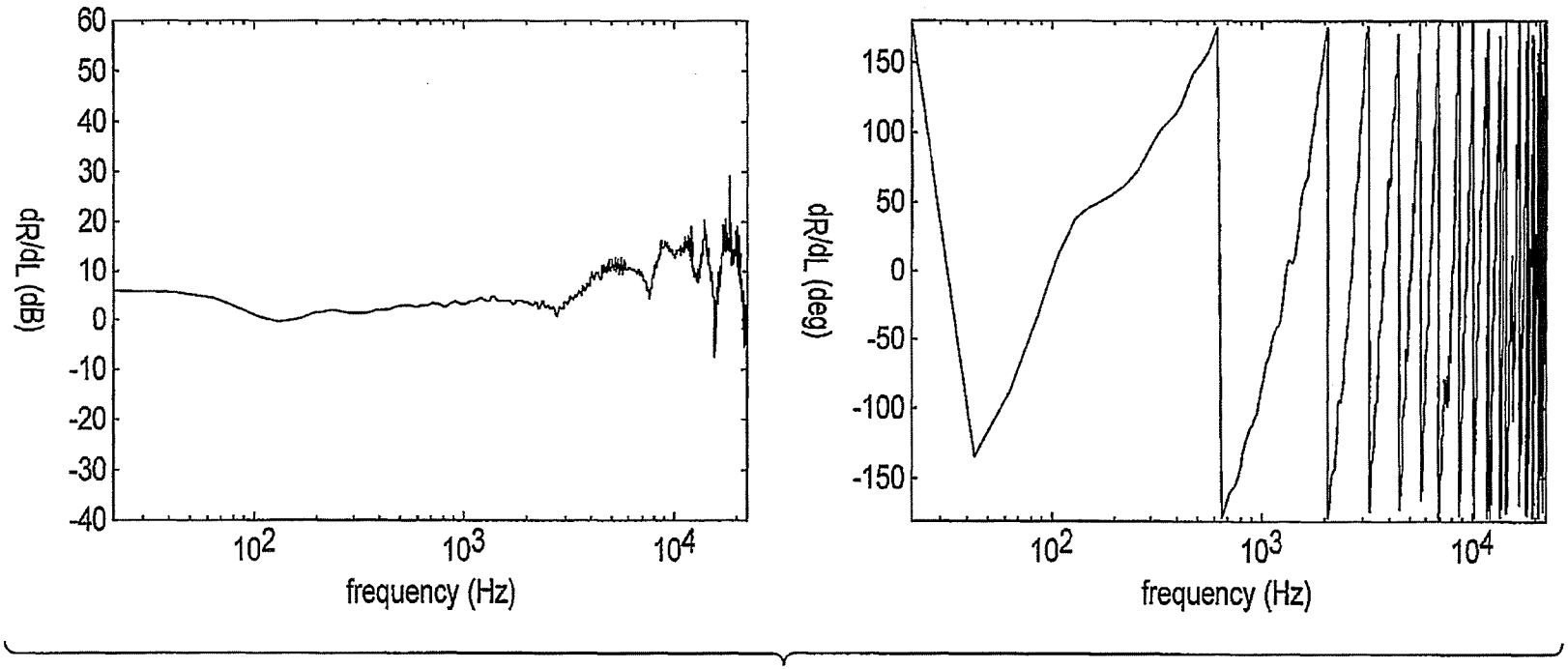
FIG. 53 is a graph showing desired amplitude characteristic and desired phase characteristic of the complex sound pressure ratio.
Figure 54A:
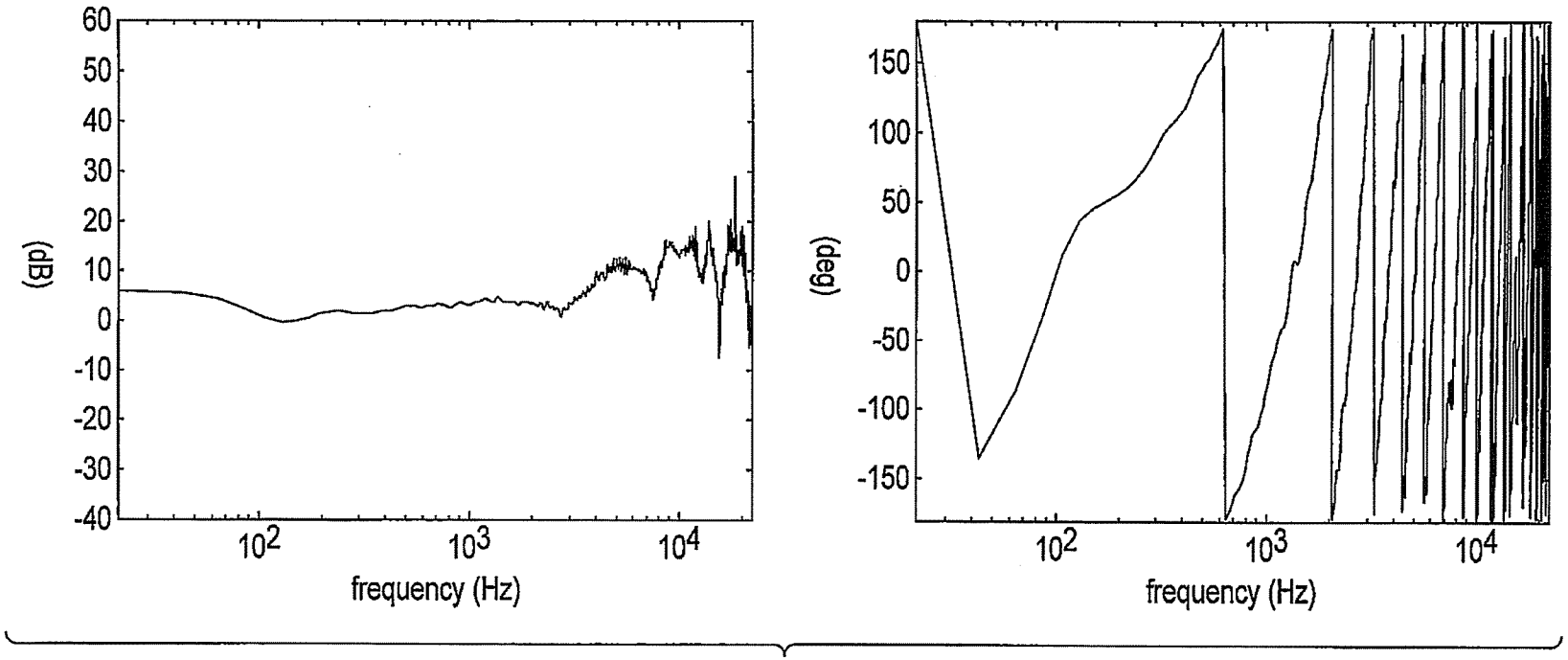
FIG. 54A is a graph showing amplitude characteristic and phase characteristic of the complex sound pressure ratio at the binaural position (16)
Figure 54B:
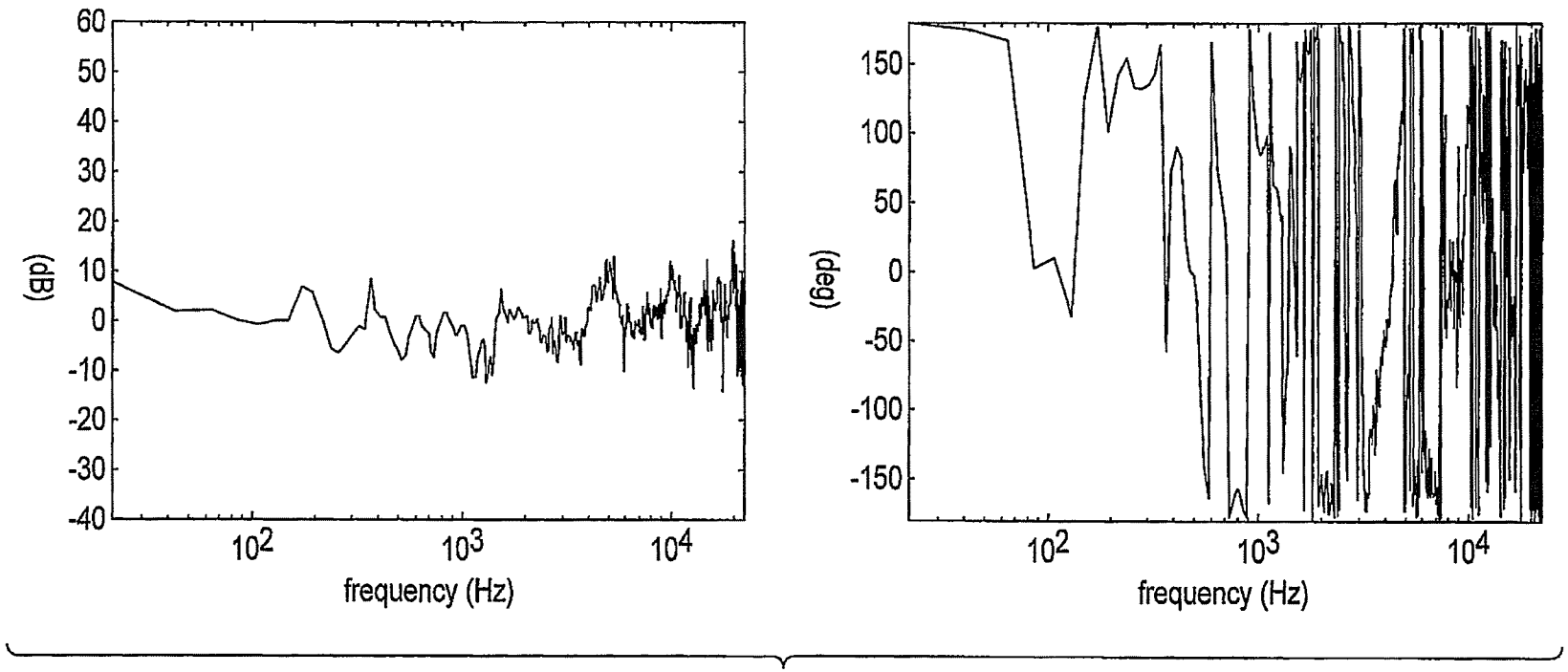
FIG. 54B is a graph showing amplitude characteristic and phase characteristic of the complex sound pressure ratio at the binaural position (14)
Figure 54C:
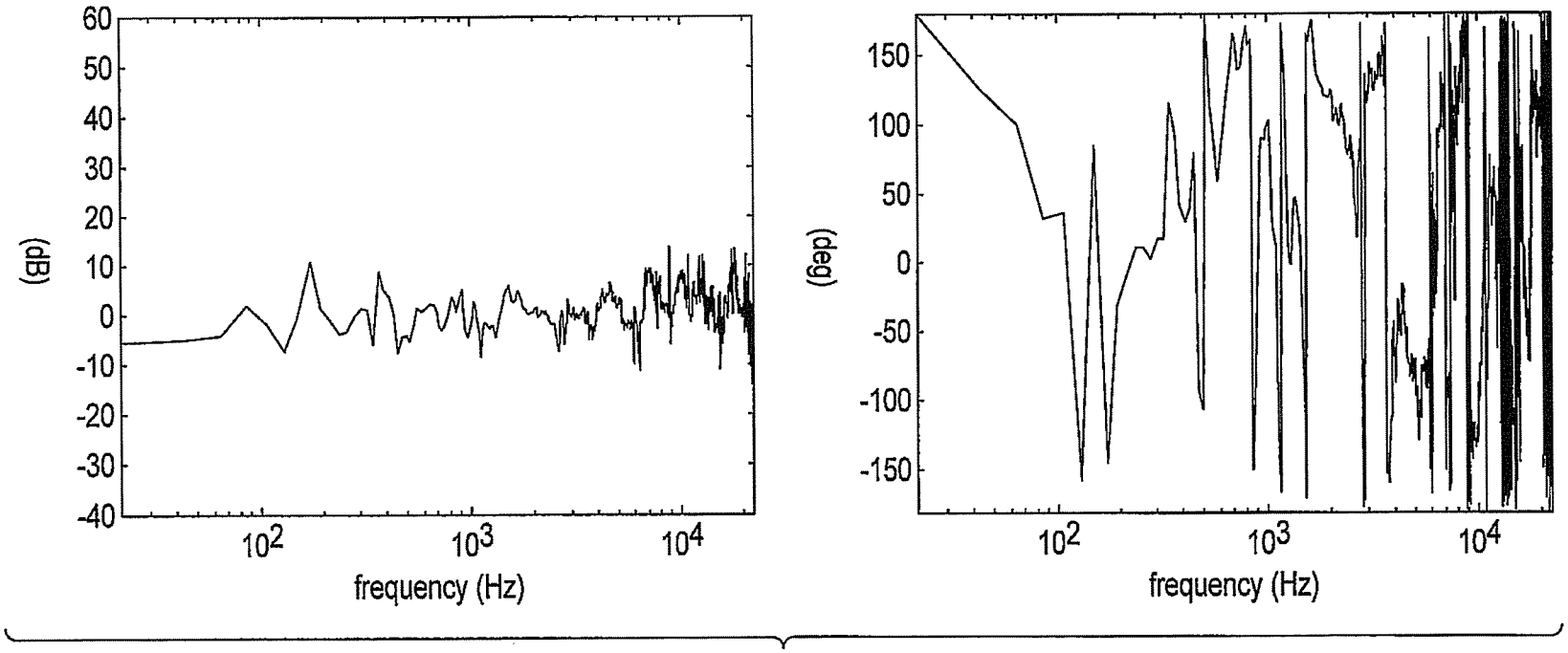
FIG. 54C is a graph showing amplitude characteristic and phase characteristic of the complex sound pressure ratio at the binaural position (12)
Figure 54D:
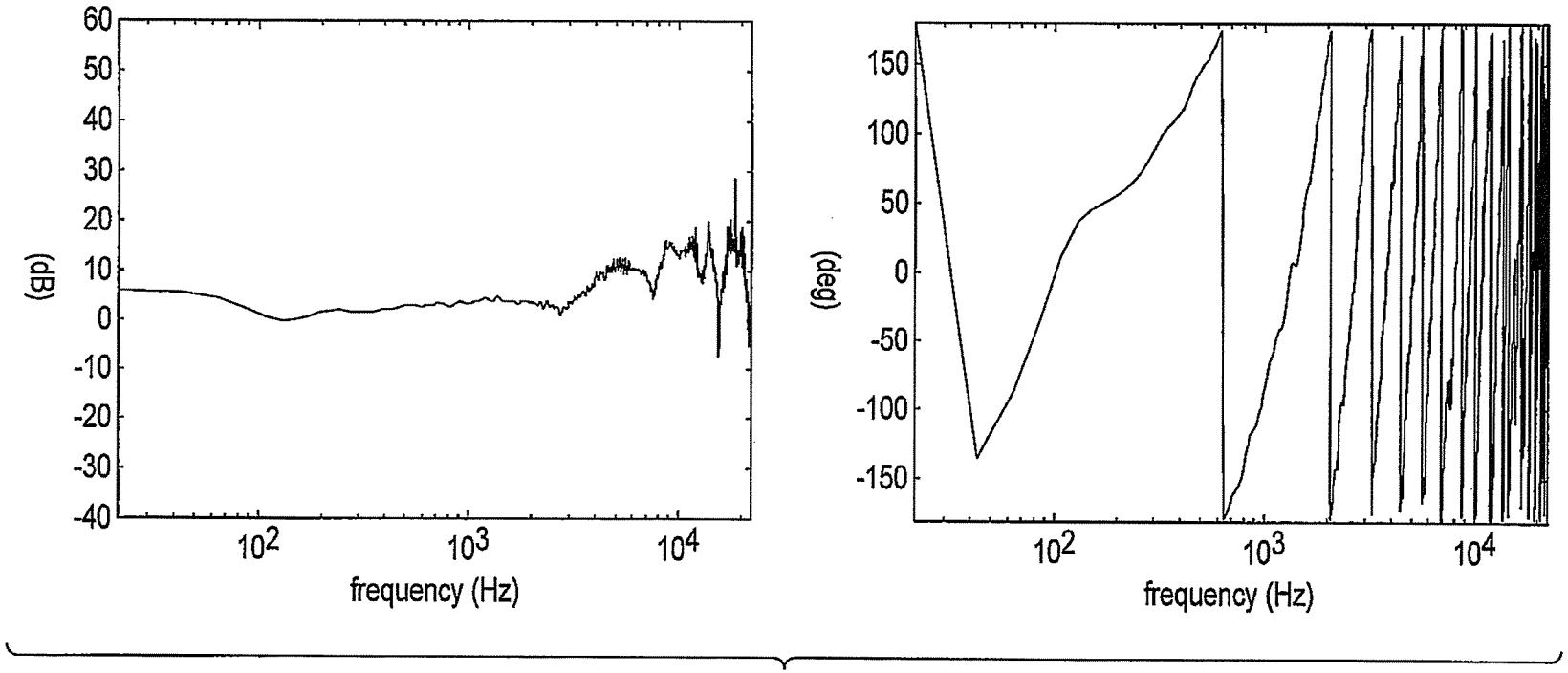
FIG. 54D is a graph showing amplitude characteristic and phase characteristic of the complex sound pressure ratio at the binaural position (10)
Figure 54E:
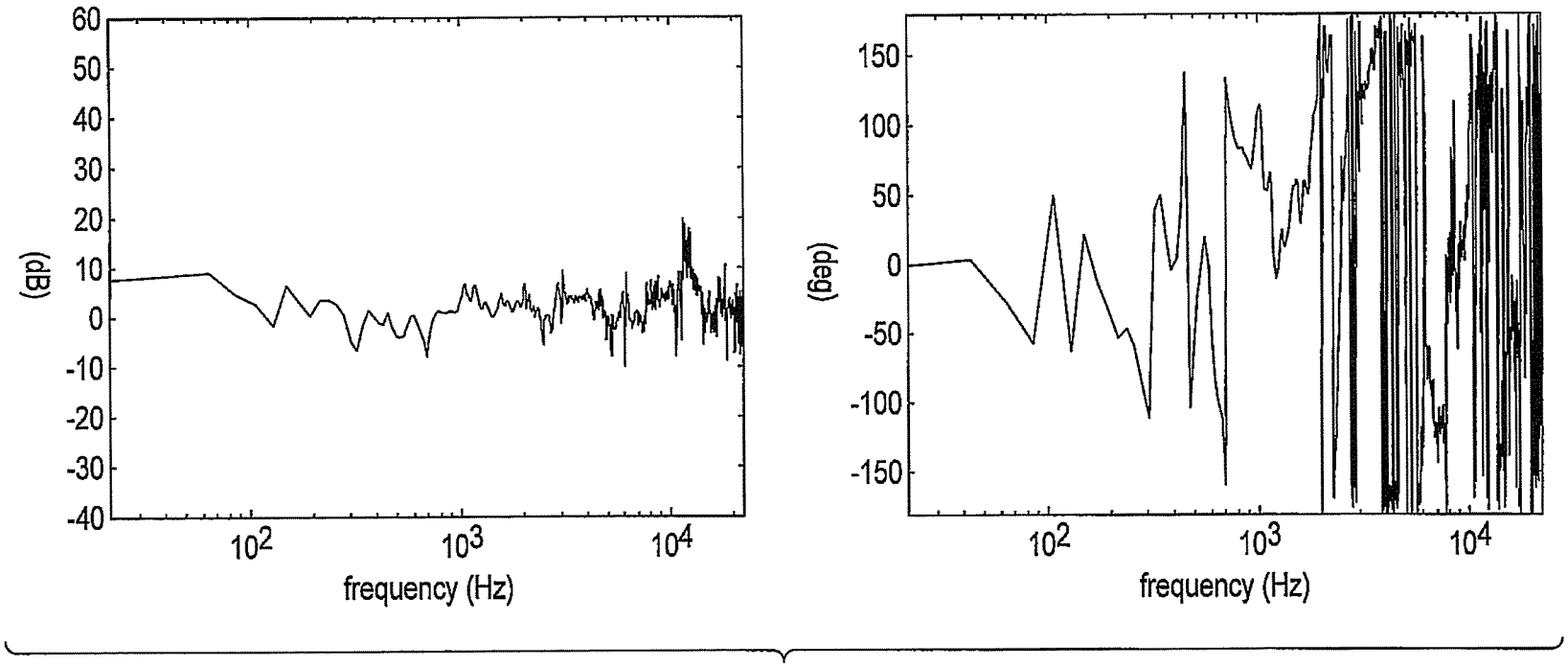
FIG. 54E is a graph showing amplitude characteristic and phase characteristic of the complex sound pressure ratio at the binaural position (8)
Figure 54F:
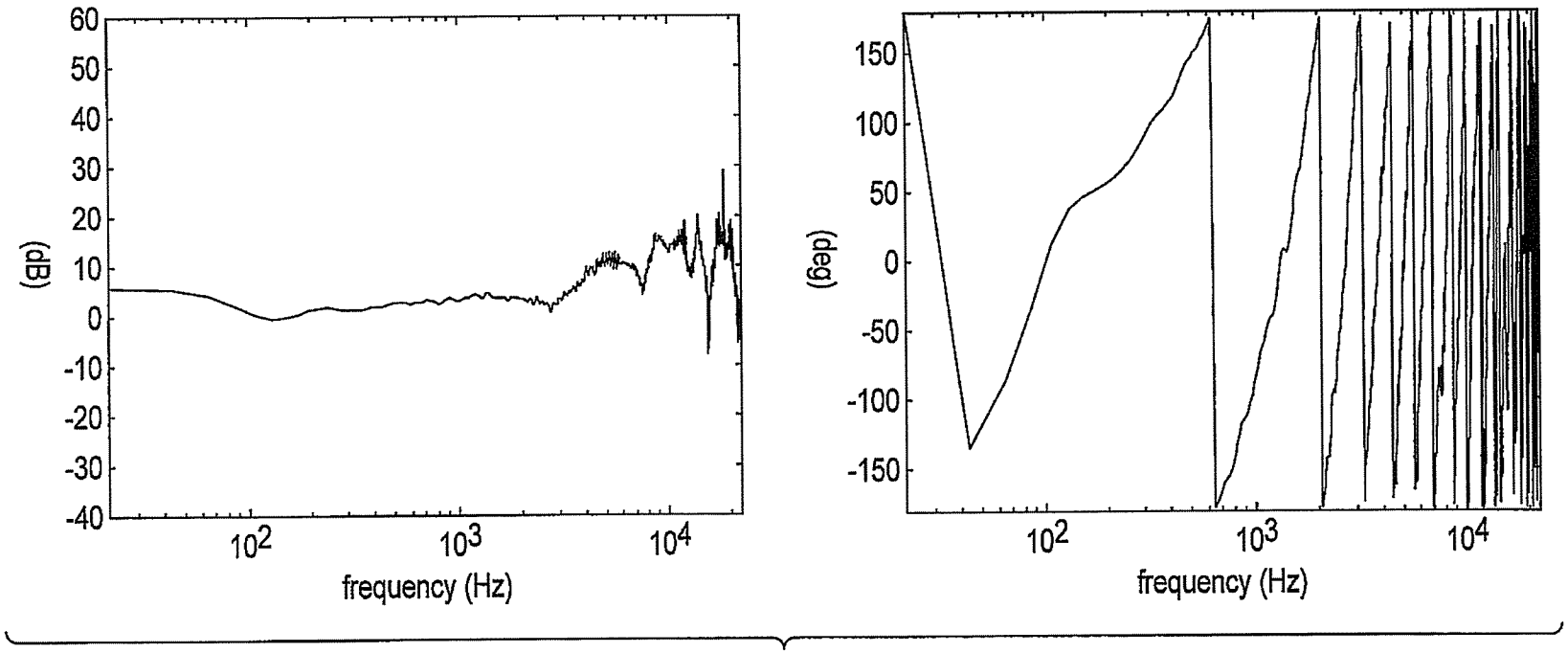
FIG. 54F is a graph showing amplitude characteristic and phase characteristic of the complex sound pressure ratio at the binaural position (6)

FIG. 52A, FIG. 52B, FIG. 52C, FIG. 52D, FIG. 52E, and FIG. 52F show amplitude characteristic and phase characteristic of $P_L/P_R$ at the binaural positions (16), (14), (12), (10), (8), and (6) when the binaural positions (16), (14), and (12) were treated as target binaural positions. That is, head-related transfer functions (=$C_{LiL}$, $C_{LiS}$, $C_{LiT}$, $C_{LiR}$, $C_{RiL}$, $C_{RiS}$, $C_{RiT}$, $C_{RiR}$) from the respective loudspeakers were measured at the respective binaural positions (16), (14), and (12), and filter coefficients (=$W_L$, $W_S$, $W_T$, $W_R$) were calculated and applied based on the measured functions and the head-related transfer functions (=$d_L$, $d_R$). It is to be noted that desired amplitude characteristic and desired phase characteristic (i.e., amplitude characteristic and phase characteristic of $d_L/d_R$) are shown in FIG. 53. It can be confirmed from comparison between FIG. 52A, FIG. 52B, FIG. 52C, FIG. 52D, FIG. 52E, FIG. 52F, and FIG. 53 that a complex sound pressure ratio close to a desired ratio was obtained at each of the binaural positions (16), (14), and (12) treated as the target binaural positions. On the other hand, it was also confirmed that the complex sound pressure ratio close to the desired ratio was not obtained at each of the binaural positions (10), (8), and (6) which were not treated as the target binaural positions.

Likewise, FIG. 54A, FIG. 54B, FIG. 54C, FIG. 54D, FIG. 54E, and FIG. 54F show amplitude characteristic and phase characteristic of $P_L/P_R$ at the binaural positions (16), (14), (12), (10), (8), and (6) when the binaural positions (16), (10), and (6) were treated as the target binaural positions. It can be also confirmed from comparison between FIG. 54A, FIG. 54B, FIG. 54C, FIG. 54D, FIG. 54E, FIG. 54F, and FIG. 53 that the complex sound pressure ratio close the desired ratio was obtained at each of the binaural position (16), (10), and (6) treated as the target binaural positions. On the other hand, it can be also confirmed that the complex sound pressure ratio close to the desired ratio was not obtained at each of the binaural positions (14), (12), and (8) that were not treated as the target binaural positions. In particular, the complex sound pressure ratio close to the desired ratio was not be obtained at the binaural position (8) even though the binaural positions (10) and (6) on both adjacent sides were treated as the target binaural positions.

It was confirmed from the above-described experimental result that the complex sound pressure ratio close to the desired ratio can be obtained at three target binaural positions when X=4. On the other hand, it was also confirmed that obtaining the complex sound pressure ratio close to the desired ratio is difficult when distanced from each target binaural position approximately 10 cm.

As described above, the acoustic control apparatus according to the tenth embodiment is applied by generalizing the first or second embodiment when using three or more loudspeakers. Therefore, according to this acoustic control apparatus, the same effects as those of the first or second embodiment can be obtained at the target binaural positions corresponding to the total number of loudspeakers−1 in number.

(Eleventh Embodiment)

The acoustic control apparatus according to the tenth embodiment is applied by generalizing the first or second embodiment when using three or more loudspeakers. That is, the total number of target binaural positions is the total number of loudspeakers−1. An eleventh embodiment treats more target binaural positions than those in the tenth embodiment while making reference to the third or fourth embodiment to improve robustness.

Figure 55:
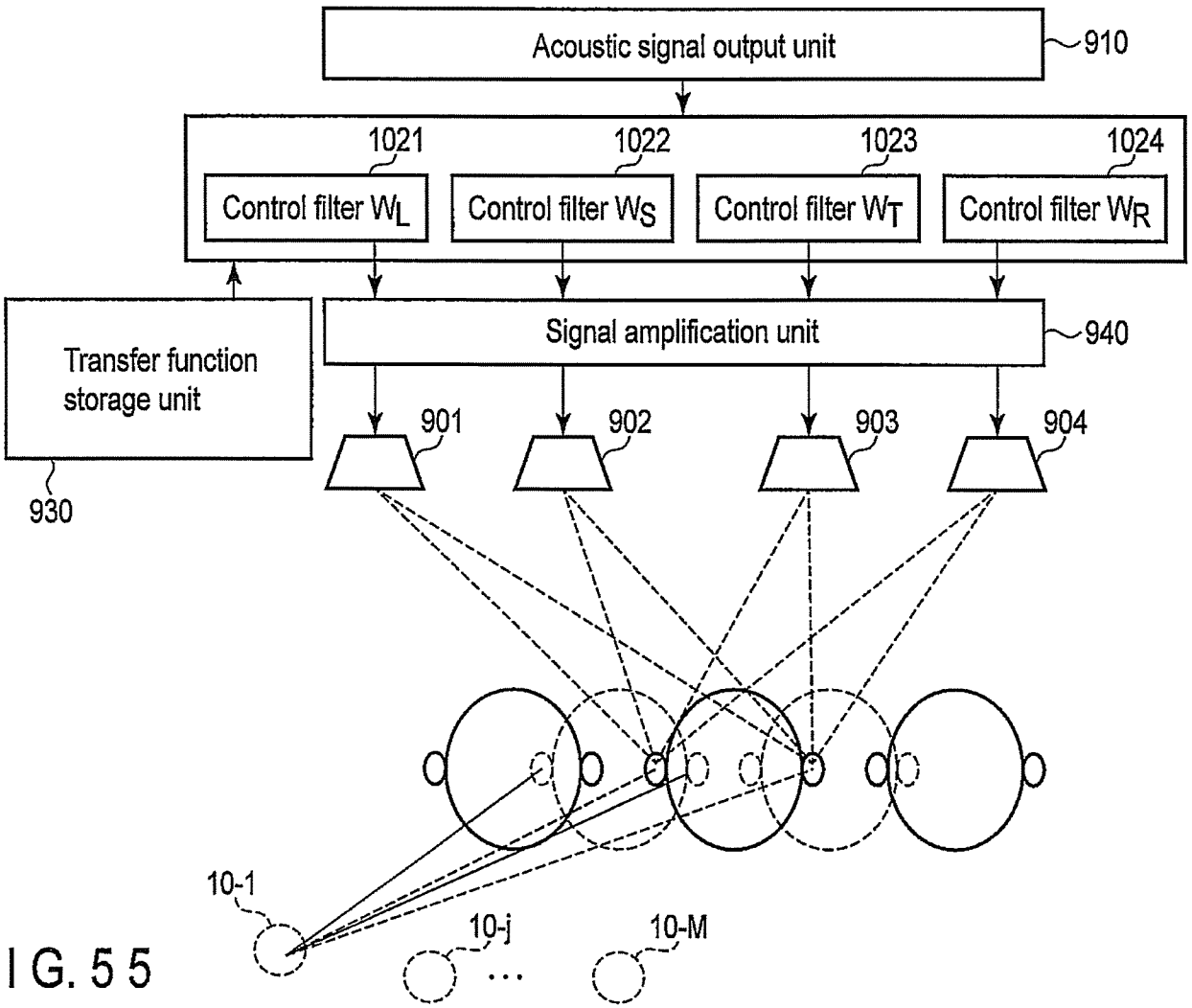
FIG. 55 is a block diagram showing an acoustic control apparatus according to an eleventh embodiment.
Figure 56A:
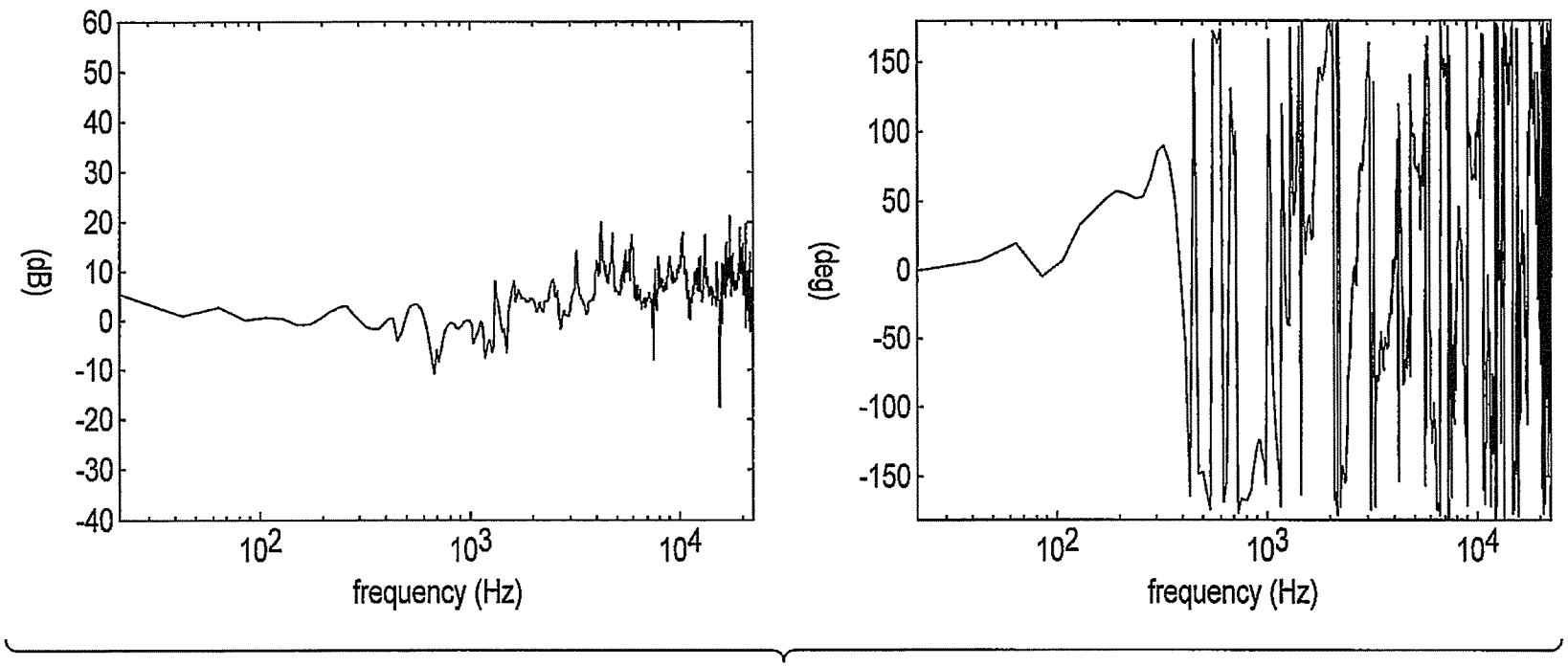
FIG. 56A is a graph showing amplitude characteristic and phase characteristic of a complex sound pressure ratio at the binaural position (16)
Figure 56B:
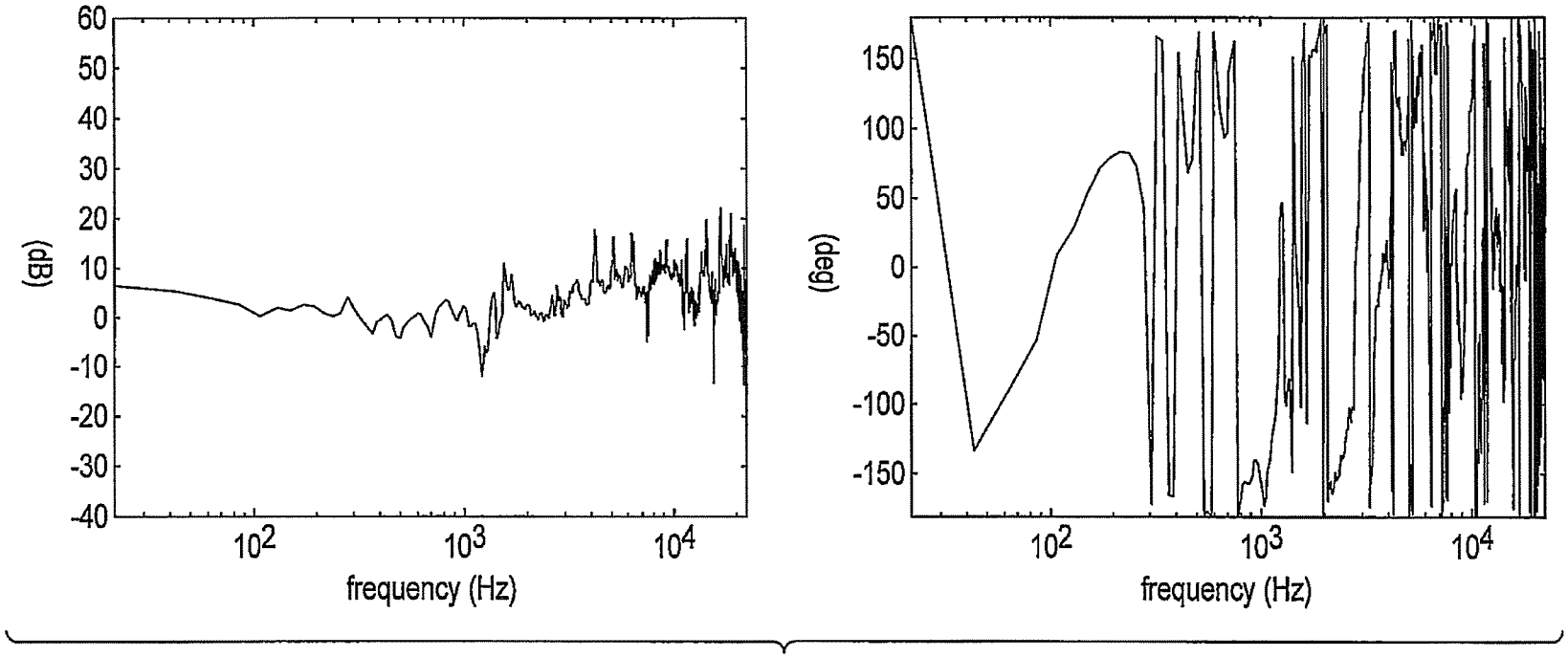
FIG. 56B is a graph showing amplitude characteristic and phase characteristic of the complex sound pressure ratio at the binaural position (14)
Figure 56C:
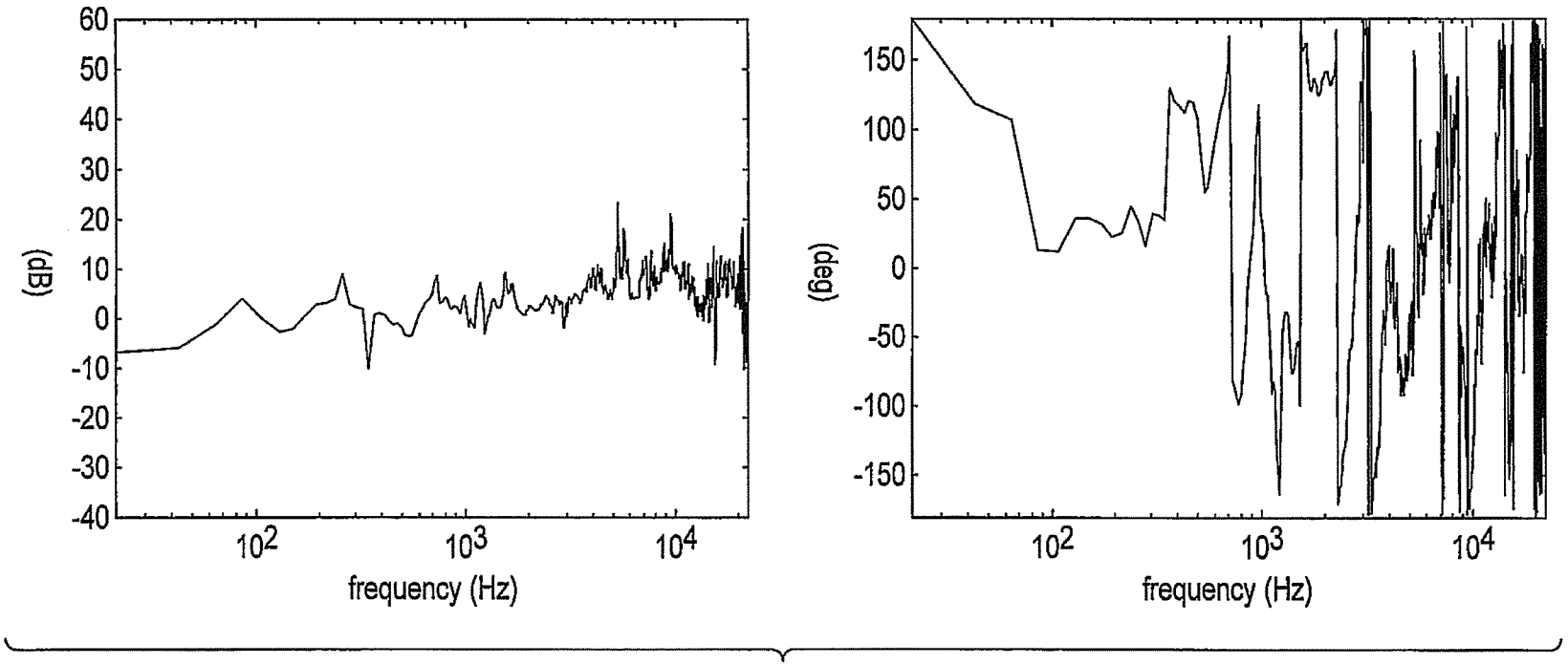
FIG. 56C is a graph showing amplitude characteristic and phase characteristic of the complex sound pressure ratio at the binaural position (12)
Figure 56D:
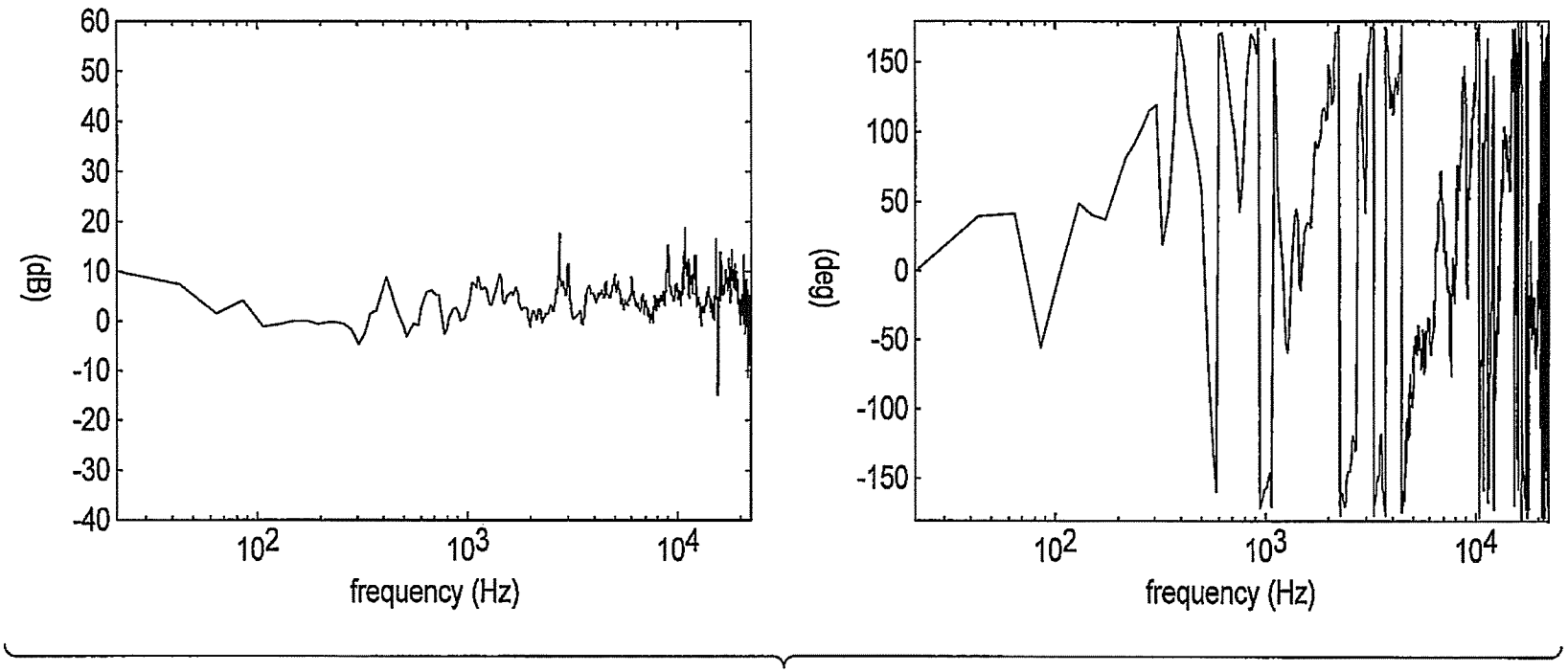
FIG. 56D is a graph showing amplitude characteristic and phase characteristic of the complex sound pressure ratio at the binaural position (10)
Figure 56E:
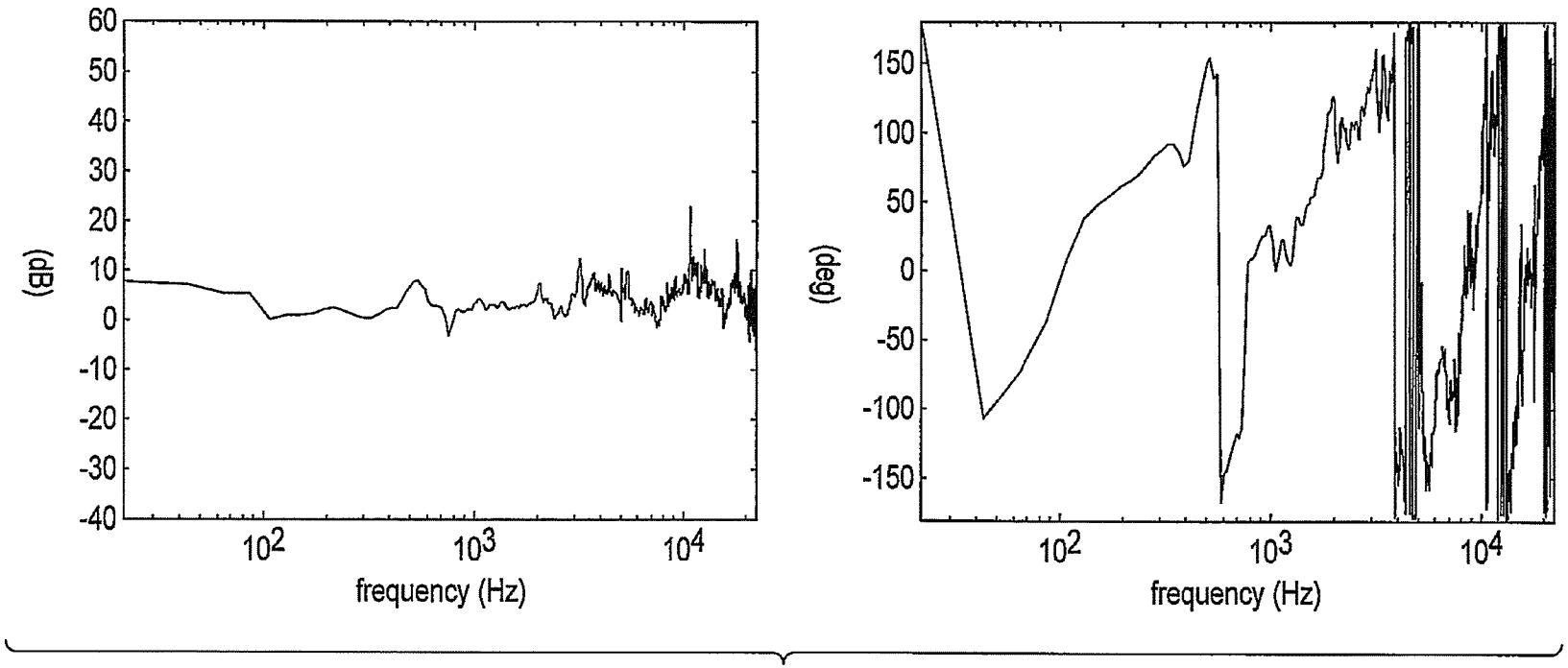
FIG. 56E is a graph showing amplitude characteristic and phase characteristic of the complex sound pressure ratio at the binaural position (8)
Figure 56F:
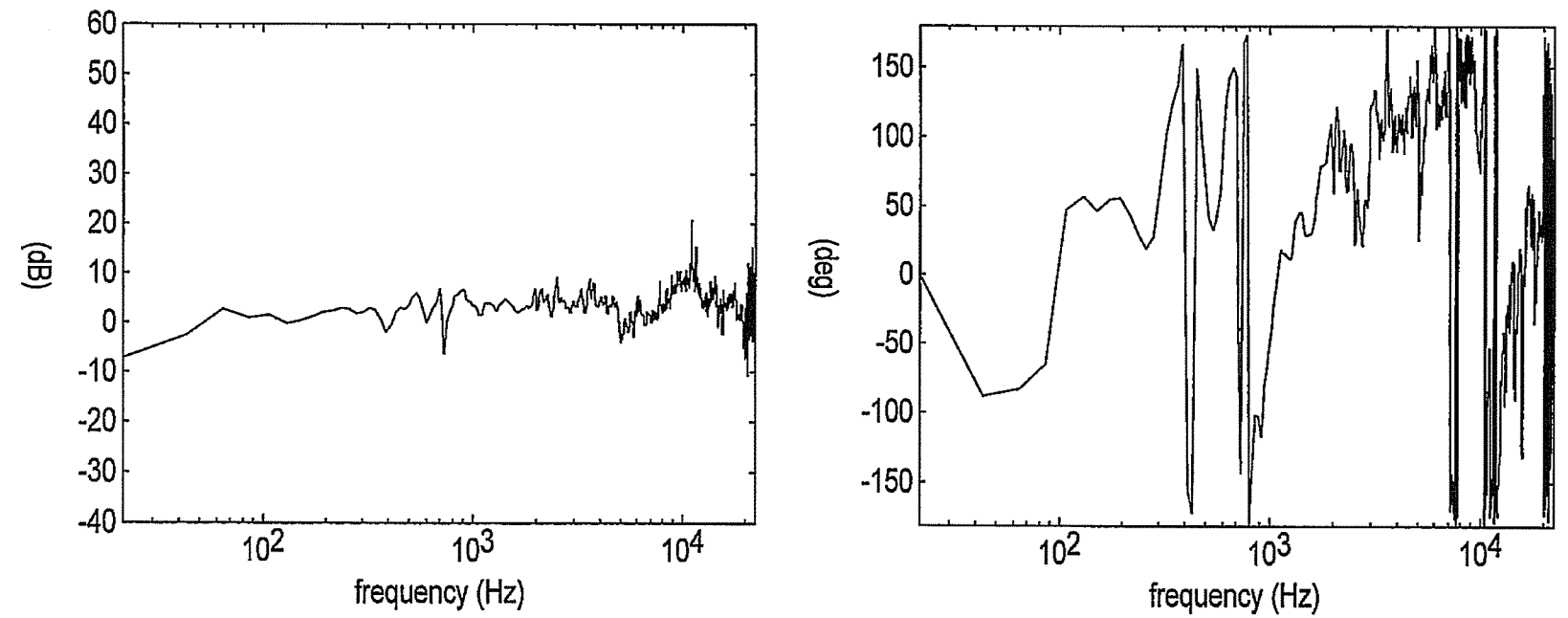
FIG. 56F is a graph showing amplitude characteristic and phase characteristic of the complex sound pressure ratio at the binaural position (6)

As shown in FIG. 55, an acoustic control apparatus according to the present embodiment comprises loudspeakers 901, 902, 903, and 904, an acoustic signal output unit 910, control filters 1021, 1022, 1023, and 1024, a transfer function storage unit 930, and a signal amplification unit 940. In the acoustic control apparatus shown in FIG. 55, X=4 is set. The acoustic control apparatus shown in FIG. 55 supports M target virtual acoustic sources 10-1, . . . , 10-M.

The acoustic control apparatus shown in FIG. 55 performs later-described acoustic control to M acoustic signals output from the acoustic signal output unit 910 to approximate (e.g., conform) a spatial average of complex sound pressure ratios at four or more target binaural positions to a spatial average of complex sound pressure ratios that arrive at the target binaural positions from the M target virtual acoustic sources 10-1, . . . , 10-M. According to the acoustic control apparatus depicted in FIG. 55, the listener can perceive directions of the M target virtual acoustic sources at, e.g., the respective six (X) target binaural positions.

The acoustic signal output unit 910 outputs the M acoustic signals to the control filters 1021, 1022, 1023, and 1024, respectively. The transfer function storage unit 930 stores head-related transfer functions in relation to at least four (=X) target binaural positions. Specifically, the transfer function storage unit 930 stores four head-related transfer function sets from the loudspeakers 901, 902, 903, and 904 to at least four target binaural positions and 4×M (or 1×M) head-related transfer function sets from the M target virtual acoustic sources to at least four target binaural positions. It is to be noted that the head-related transfer function sets may be derived by preliminary measurement or calculation and stored in the transfer function storage unit 930. Further, the acoustic control apparatus in FIG. 55 may derive the head-related transfer function sets by measurement or calculation at any timing (e.g., setting or activation) and store them in the transfer function storage unit 930.

The control filters 1021, 1022, and 1023 read from the transfer function storage unit 930 head-related transfer functions (=$C_{L1L}$, . . . , $C_{LNL}$) from the loudspeaker 901 to the listener's left ear at the N (X) target binaural positions (i=1, . . . , N), head-related transfer functions (=$C_{L1S}$, . . . , $C_{LNS}$) from the loudspeaker 902 to the listener's left ear at the N target binaural positions (i=1, . . . , N), head-related transfer functions (=$C_{L1T}$, . . . , $C_{LNT}$) from the loudspeaker 903 to the listener's left ear at the N target binaural positions (i=1, . . . , N), head-related transfer functions (=$C_{L1R}$, . . . , $C_{LNR}$) from the loudspeaker 904 to the listener's left ear at the N target binaural positions (i=1, . . . , N), head-related loudspeaker 901 to the listener's right ear at the N target binaural positions (i=1, . . . , N), head-related transfer functions (=$C_{R1S}$, . . . , $C_{RNS}$) from the loudspeaker 902 to the listener's right ear at the N target binaural positions (i=1, . . . , N), head-related transfer functions (=$C_{R1T}$, . . . , $C_{RNT}$) from the loudspeaker 903 to the listener's right ear at the N target binaural positions (i=1, . . . , N), head-related transfer functions (=$C_{R1R}$, . . . , $C_{RNR}$) from the loudspeaker 904 to the listener's right ear at the N target binaural positions (i=1, . . . , N), head-related transfer functions (=$d_{L11}$, . . . , $d_{LNM}$) from the M target virtual acoustic sources (=1, . . . , M) to the listener's left ear at the N target binaural positions (i=1, . . . , N), and head-related transfer functions (=$d_{R11}$, . . . , $d_{RNM}$) from the M target virtual acoustic sources (=1, . . . , M) to the listener's right ear at the N target binaural positions (i=1, . . . , N) as required. When the listener's binaural position greatly fluctuates from any one of the target binaural positions or when the target virtual acoustic source is changed, the control filters 1021, 1022, and 1023 may switch over the head-related transfer function. It is to be noted that, if $d_{Lij}$ and $d_{Rij}$ are not dependent on as described above, the head-related transfer functions (=$d_{L11}$, . . . , $d_{LNM}$) may be substituted by the head-related transfer functions (=$d_{L1}$, . . . , $d_{LM}$), and the head-related transfer functions (=$d_{R11}$, . . . , $d_{RNM}$) may be substituted by the head-related transfer functions (=$d_{R1}$, . . . , $d_{RM}$).

The control filters 1021, 1022, and 1023 calculate control filter coefficient sets (=$W_{L1}$, . . . , $W_{LM}$, $W_{S1}$, . . . , $W_{SM}$, $W_{T1}$, . . . , $W_{TM}$) based on the head-related transfer functions read from the transfer function storage unit 930 and a control filter coefficient set (=$W_{R1}$, . . . , $W_{RM}$) of the control filter 1024. It is to be noted that the calculation of the control filter coefficient sets (=$W_{L1}$, . . . , $W_{LM}$, $W_{S1}$, . . . , $W_{SM}$, $W_{T1}$, . . . , $W_{TM}$) may be performed by a non-illustrated coefficient calculation unit in place of the control filters 1021, 1022, and 1023. Control filter coefficients (=$W_{Lj}$, $W_{Sj}$, $W_{Tj}$) associated with a combination of the control filter coefficient (=$W_{Rj}$) of the control filter 1024, the N target binaural position (i=1, . . . , N), and the target virtual acoustic source (=j) may be previously calculated, and the control filters 1021, 1022, and 1023 may read at appropriate control filter coefficients (=$W_{Lj}$, $W_{Sj}$, $W_{Tj}$). It is to be noted that a calculation technique of the control filter coefficient sets (=$W_{L1}$, . . . , $W_{LM}$, $W_{S1}$, . . . , $W_{SM}$, $W_{T1}$, . . . , $W_{TM}$) in the present embodiment is the same as that in the tenth embodiment except that N is X or more.

As shown in FIG. 47, the control filter 1021 multiplies the control filter coefficient set (=$W_{L1}$, . . . , $W_{LM}$) by M acoustic signals (=$S_1$, . . . , $S_M$), then combines products, and inputs a combined acoustic signal to the signal amplification unit 940.

As shown in FIG. 47, the control filter 1022 multiplies the control filter coefficient set (=$W_{S1}$, . . . , $W_{SM}$) by the M acoustic signals (=$S_1, \ldots, S_M$), then combines products, and inputs a combined acoustic signal to the signal amplification unit 940.

As shown in FIG. 47, the control filter 1023 multiplies the control filter coefficient set (=$W_{T1}, \ldots, W_{TM}$) by the M acoustic signals (=$S_1, \ldots, S_M$), then combines products, and inputs a combined acoustic signal to the signal amplification unit 940.

As shown in FIG. 47, the control filter 1024 multiplies the control filter coefficient set (=$W_{R1}, \ldots, W_{RM}$) by the M acoustic signals (=$S_1, \ldots, S_M$), then combines products, and inputs a combined acoustic signal to the signal amplification unit 940. However, if the control filter 1024 has the through characteristic, the control filter 1024 simply combines the M acoustic signals (=$S_1, \ldots, S_M$) and inputs the combined acoustic signal to the signal amplification unit 940.

The signal amplification unit 940 amplifies the combined acoustic signals of 4 channels from the control filters 1021, 1022, 1023, and 1024 in accordance with gain and supplies the amplified signals to the loudspeakers 901, 902, 903, and 904.

Adequacy of effects of the acoustic control apparatus according to the present embodiment will now be described hereinafter with reference to an experimental result. Conditions of this experiment are the same as those described in the tenth embodiment except that six binaural positions (16), (14), (12), (10), (8), and (6) are treated as target binaural positions.

FIG. 56A, FIG. 56B, FIG. 56C, FIG. 56D, FIG. 56E, and FIG. 56F show amplitude characteristic and phase characteristic of $P_L/P_R$ obtained by this experiment. It can be confirmed from FIG. 56A, FIG. 56B, FIG. 56C, FIG. 56D, FIG. 56E, and FIG. 56F that fluctuations of amplitude characteristic and phase characteristic between the respective binaural positions is suppressed as compared with the experimental result explained in the tenth embodiment. Further, it was also confirmed that a complex sound pressure ratio that is close to a desired ratio to some extent can be obtained at each target binaural position even though the total number of target binaural positions is increased to the total number of the loudspeakers or more. That is, increasing the total number of the target binaural positions can improve robustness. In particular, since the virtual acoustic source can be basically considered as a fixed point, the listener can easily notice deterioration of a sense of auditory lateralization as compared with a binaural acoustic signal whose acoustic source continuously moves. If the robustness is improved, the sense of auditory lateralization is not easily deteriorated when the listener's binaural position fluctuates, thereby excellently maintaining the listener's auditory impression.

On the other hand, it was confirmed from comparison between this experimental result and the experimental result explained in the tenth embodiment that a difference of the complex sound pressure ratio from the desired ratio at each target binaural position is increased when the total number the target binaural positions is raised. That is, when the total number of the target binaural positions is increased, robustness is improved, but a reproduction precision (e.g., IACF) of a desired acoustic signal at each target binaural position is sacrificed.

Therefore, the total number (=N) of the target binaural positions can be determined in design while considering a trade-off between the robustness and the reproduction precision of a desired acoustic signal. For example, an allowable lower limit value of an IACF peak value may be determined in advance, and N may be determined in such a manner that the IACF peak value does not fall below this lower limit value at each target binaural position. Further, in the range of X−1 or below, it can be considered that deterioration of the reproduction precision of a desired acoustic signal does not occur even if the total number of target binaural positions is increased, and hence setting X−1 to the lower limit value of N is desired.

As described above, the acoustic control apparatus according to the eleventh embodiment increases the total number (=N) of the target binaural positions to the total number of the loudspeakers or more in the tenth embodiment. Therefore, according to this acoustic control apparatus, although the reproduction precision of a desired acoustic signal needs to be sacrificed to some extent, the desired acoustic signal can be excellently reproduced at more binaural positions.

Figure 57:
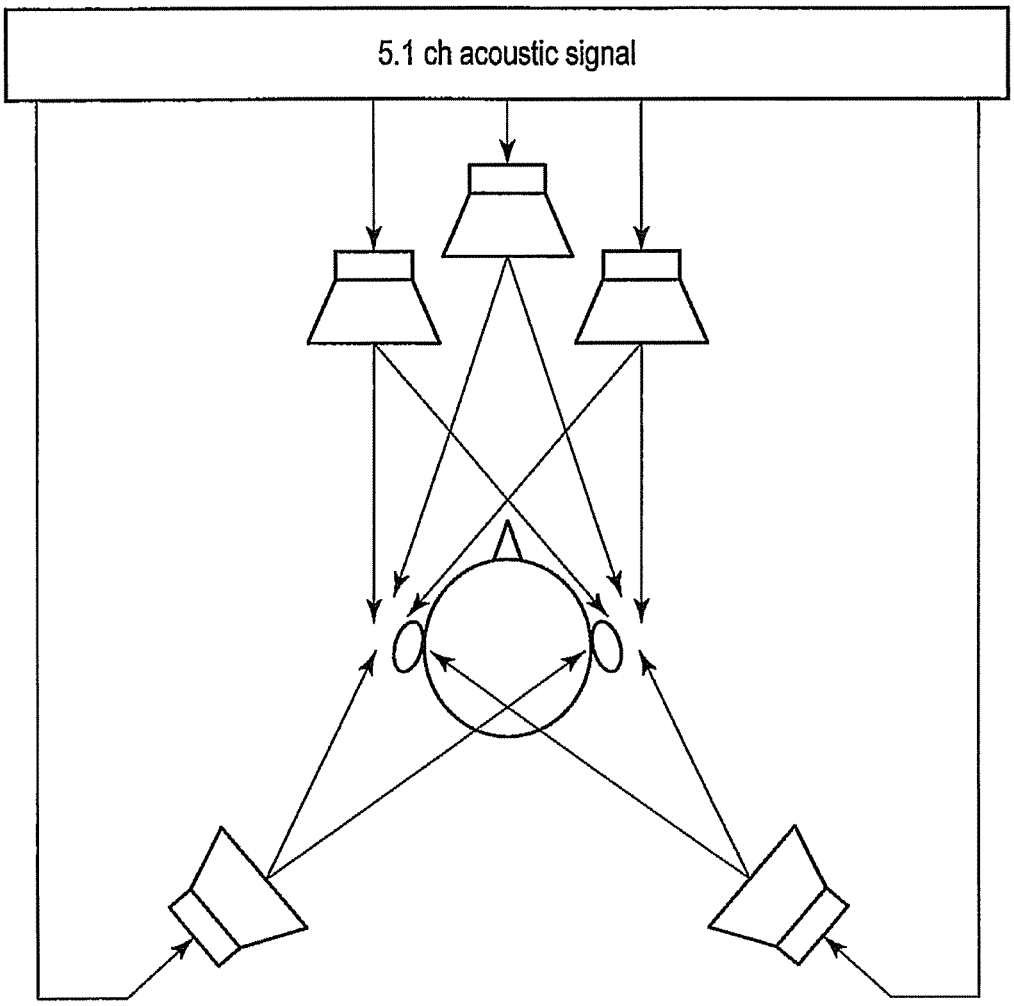
FIG. 57 is a view showing a specific example of target virtual acoustic sources.
Figure 58:
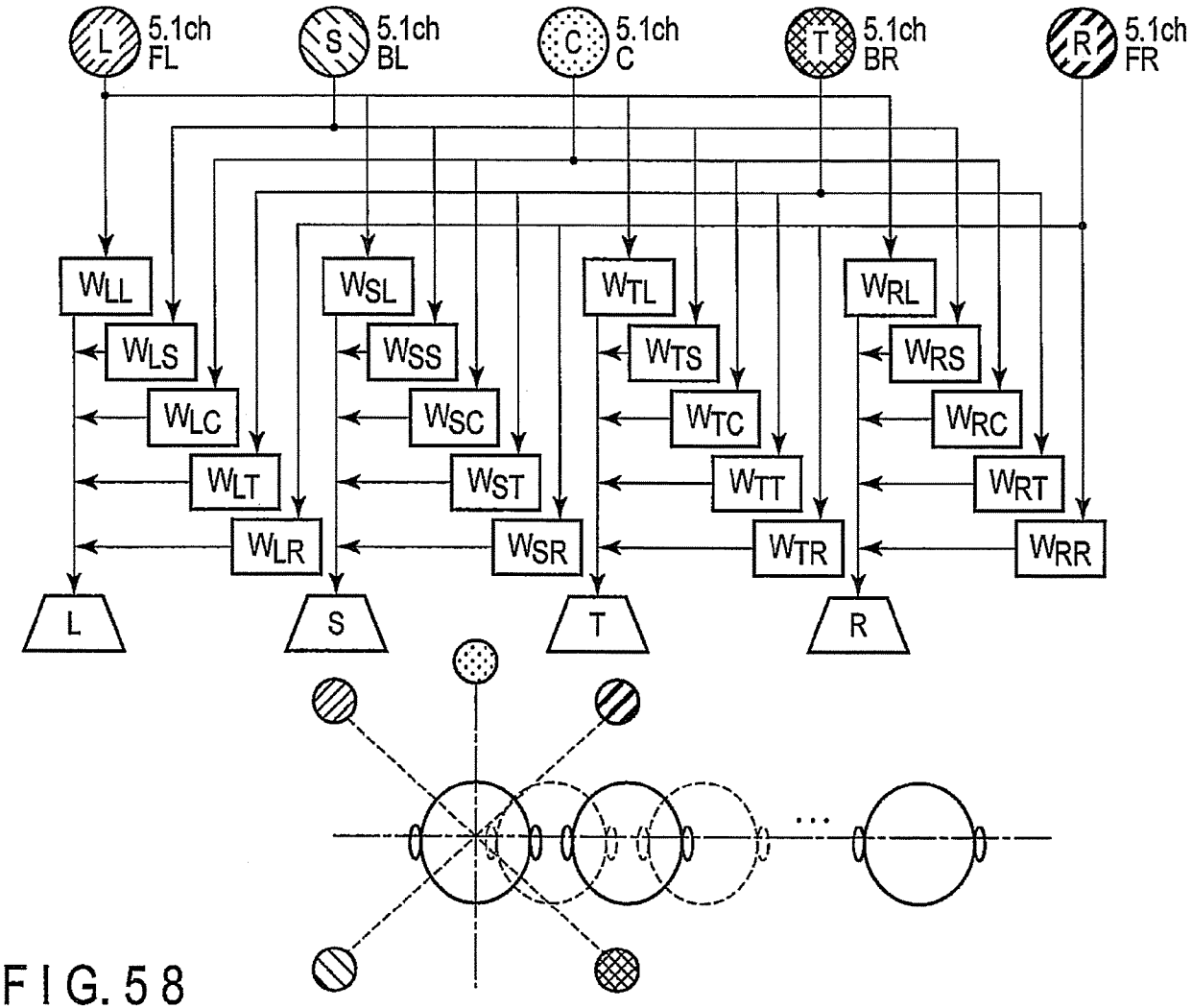
FIG. 58 is a view showing an operation of a control filter for five acoustic signals associated with five target virtual acoustic sources in FIG. 57.

The first to fourth, and tenth or eleventh embodiment can be applied to a 5.1 ch surround system depicted in, e.g., FIG. 57. The 5.1 ch surround system has five loudspeakers associated with 5 ch excluding 0.1 ch of a woofer. When these five loudspeakers are treated as five target virtual acoustic sources, each embodiment can be applied as shown in FIG. 58. That is, at the target binaural positions, acoustic effects that sound circles the listener or acoustic effects that sound passes over the listener's head can be reproduced.

(Twelfth Embodiment)

In a twelfth embodiment, the acoustic control according to the tenth embodiment is applied to a binaural acoustic signal. In other words, the twelfth embodiment is applied by generalizing the fifth or sixth embodiment when X≥3.

Figure 59:
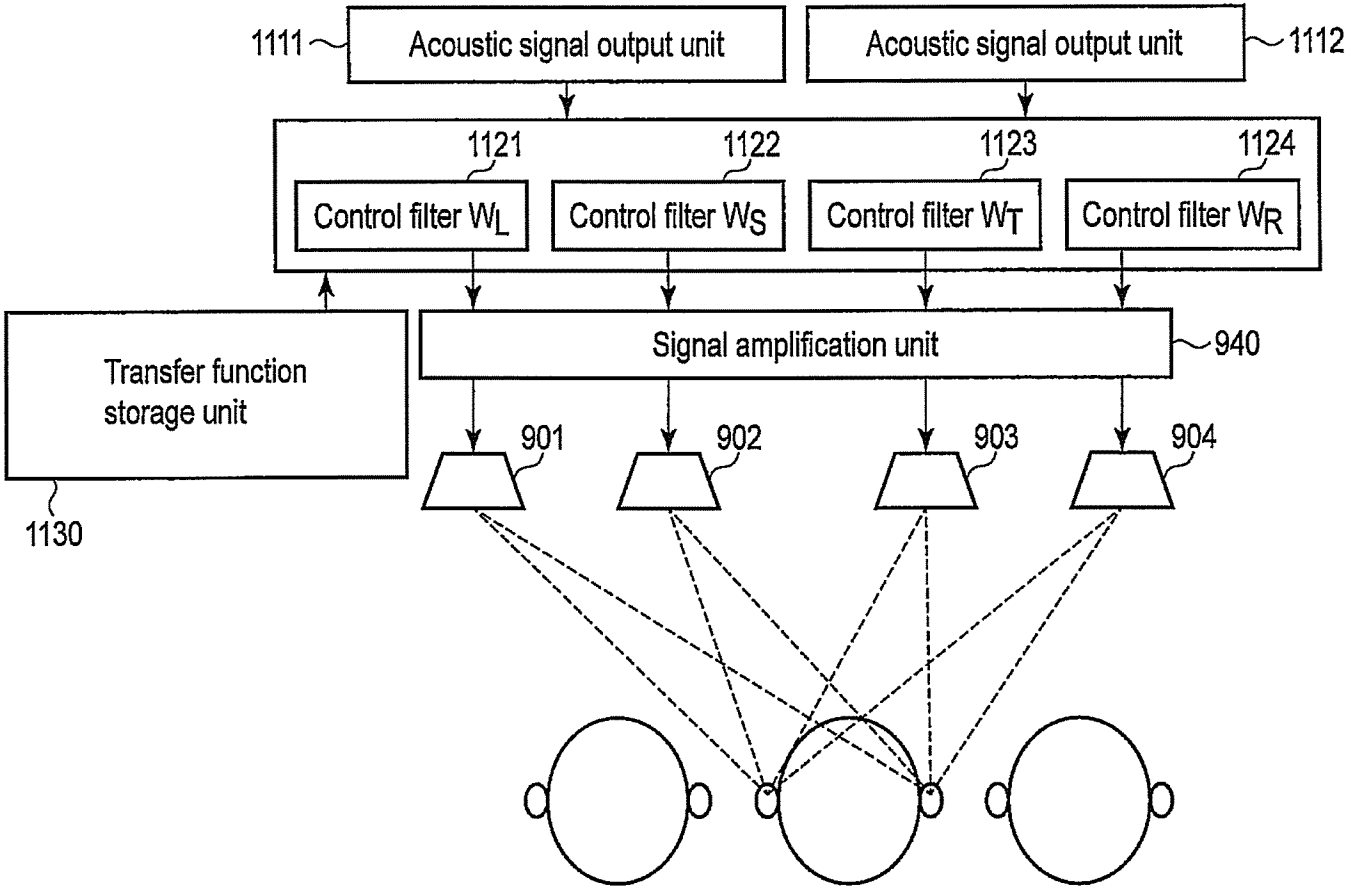
FIG. 59 is a block diagram showing an acoustic control apparatus according to a twelfth embodiment.
Figure 60A:
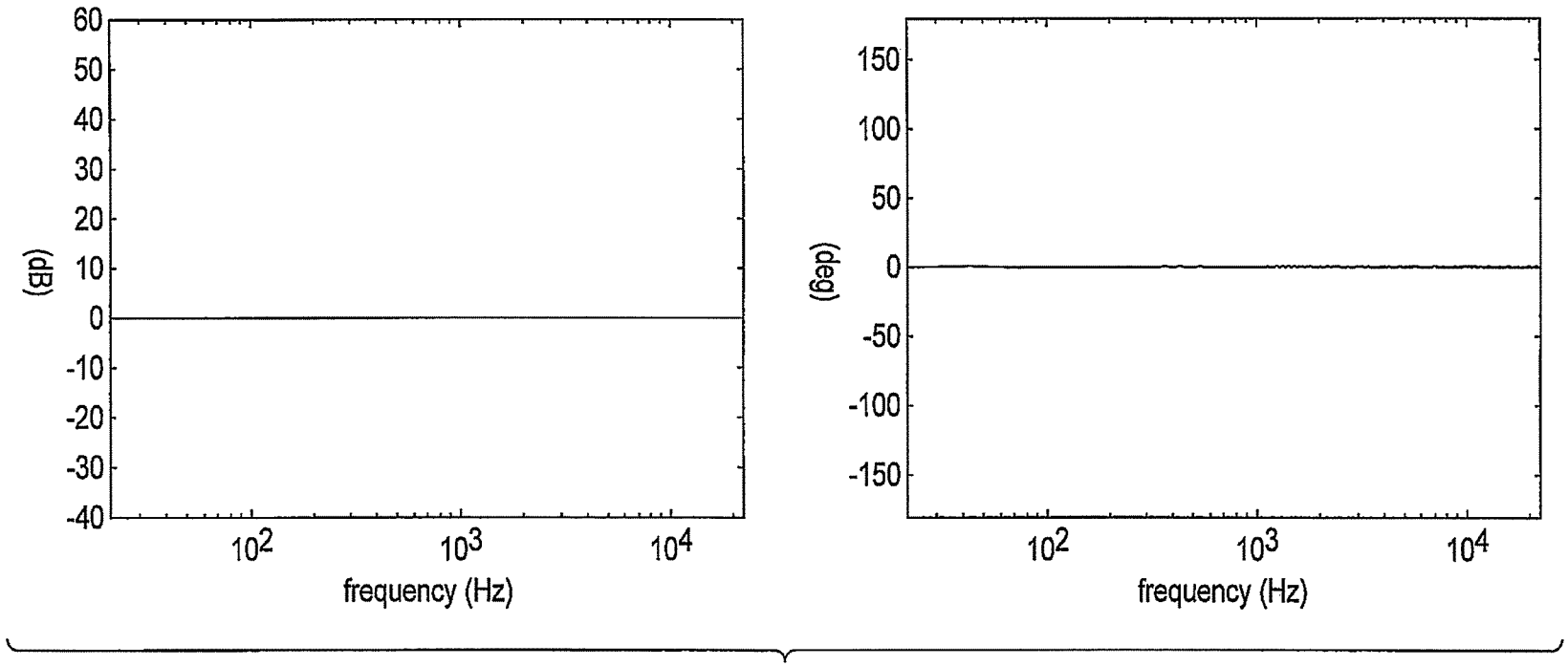
FIG. 60A is a graph showing amplitude characteristic and phase characteristic of a complex sound pressure ratio at the binaural position (16)
Figure 60B:
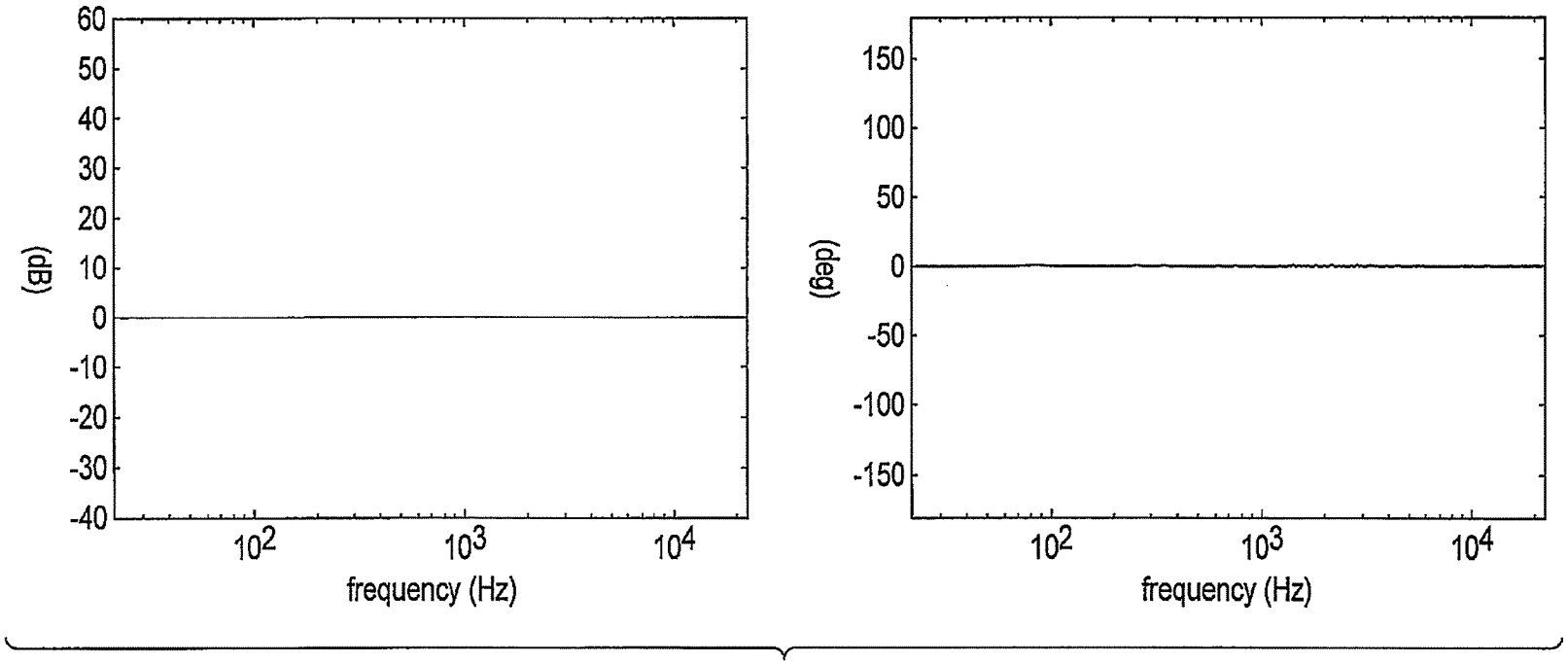
FIG. 60B is a graph showing amplitude characteristic and phase characteristic of the complex sound pressure ratio at the binaural position (14)
Figure 60C:
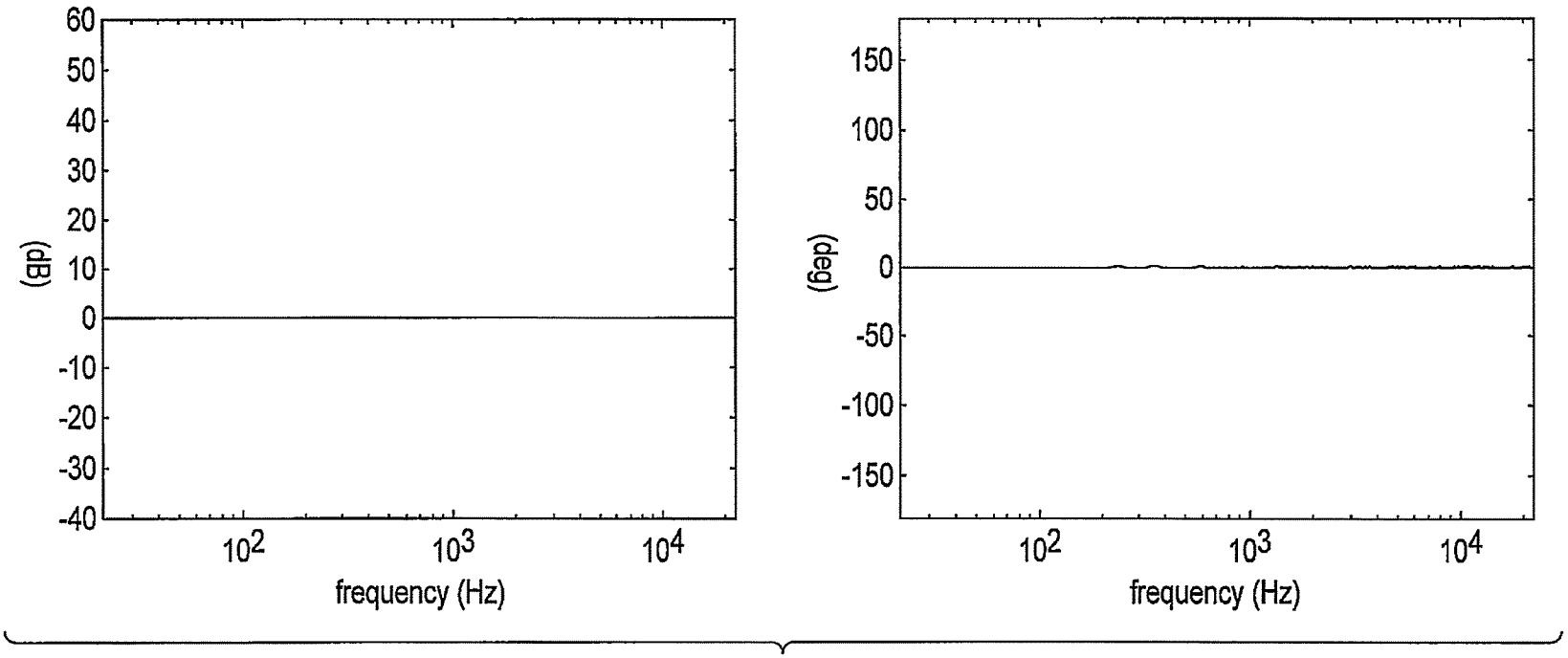
FIG. 60C is a graph showing amplitude characteristic and phase characteristic of the complex sound pressure ratio at the binaural position (12)
Figure 60D:
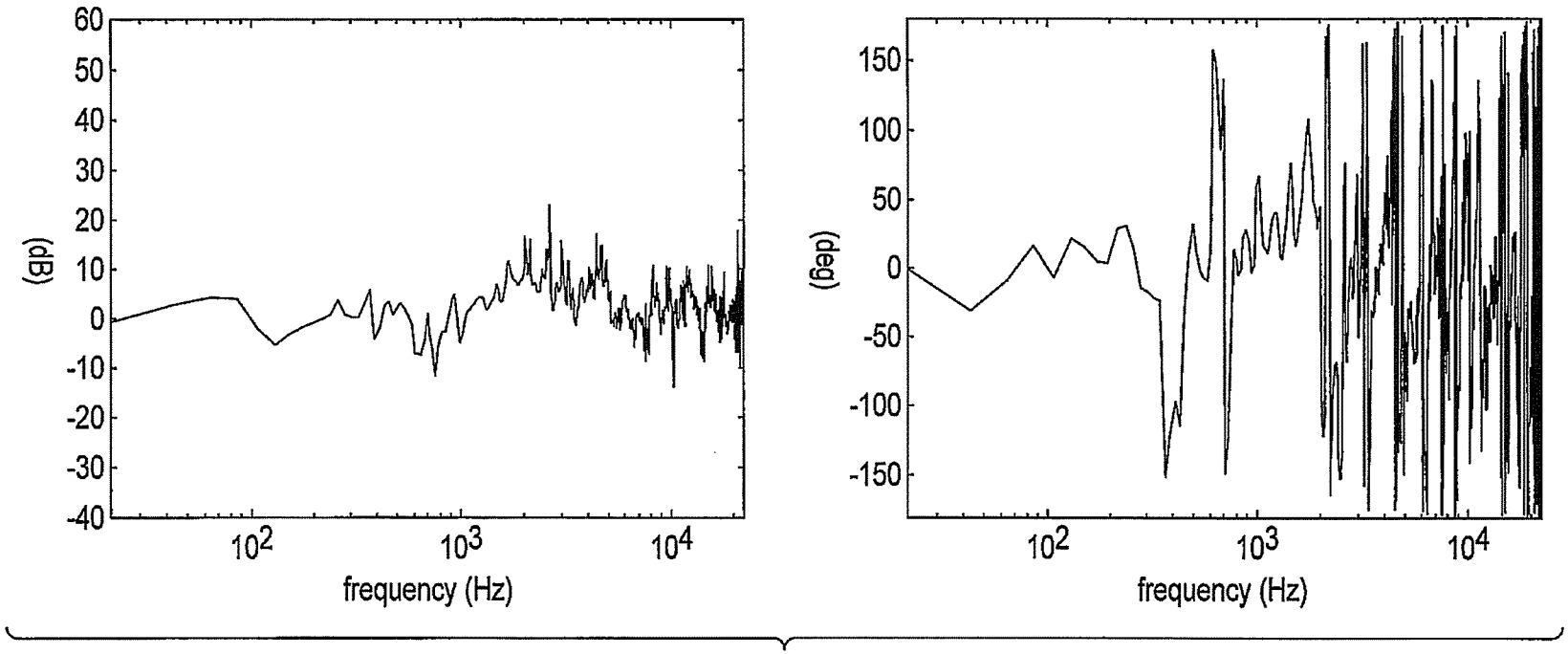
FIG. 60D is a graph showing amplitude characteristic and phase characteristic of the complex sound pressure ratio at the binaural position (10)
Figure 60E:
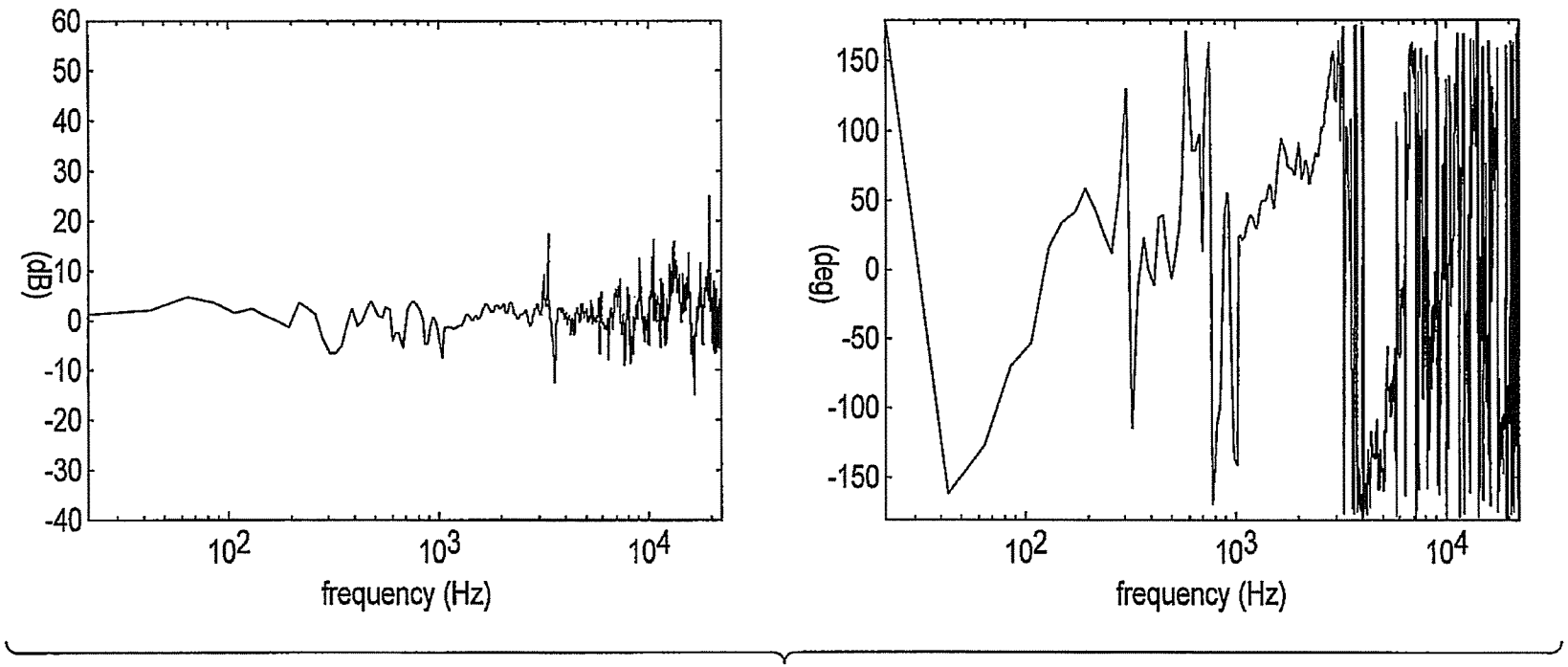
FIG. 60E is a graph showing amplitude characteristic and phase characteristic of the complex sound pressure ratio at the binaural position (8)
Figure 60F:
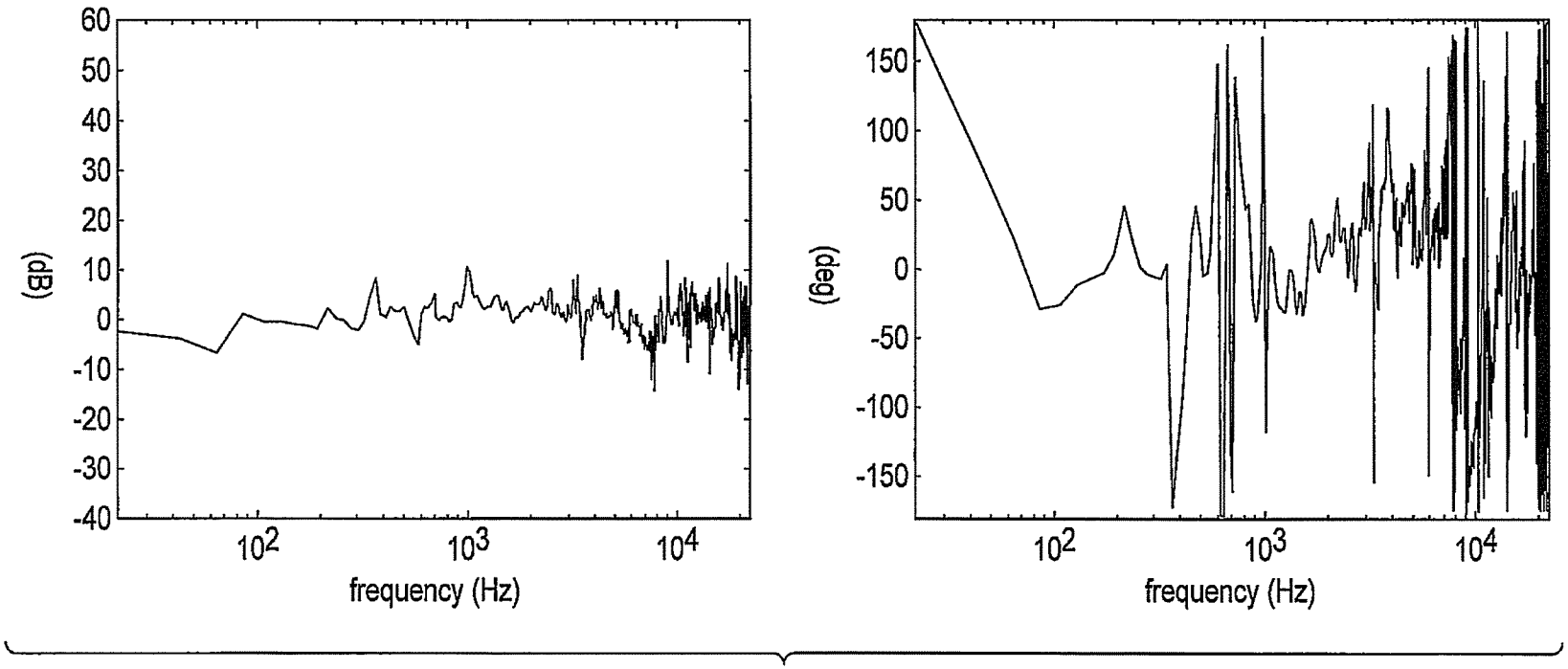
FIG. 60F is a graph showing amplitude characteristic and phase characteristic of the complex sound pressure ratio at the binaural position (6)

As shown in FIG. 59, an acoustic control apparatus according to the present embodiment comprises loudspeakers 901, 902, 903, and 904, acoustic signal output units 1111 and 1112, control filters 1121, 1122, 1123, and 1124, a transfer function storage unit 1130, and a signal amplification unit 940. In the acoustic control apparatus depicted in FIG. 58, X=4 is set.

The acoustic control apparatus shown in FIG. 59 performs later-described acoustic control to binaural acoustic signals output from the acoustic signal output units 1111 and 1112 to approximate (e.g., conform) a spatial average of complex sound pressure ratios at three target binaural positions to a complex sound pressure ratio of the binaural acoustic signals. According to the acoustic control apparatus depicted in FIG. 59, the listener can perceive stereophonic effects based on the binaural acoustic signal at, e.g., 3(=X−1) target binaural positions, respectively.

The acoustic signal output unit 1111 outputs a left acoustic signal (=$S_L$) in the binaural acoustic signals to the control filters 1121 and 1122. The acoustic signal output unit 1112 outputs a right acoustic signal (=$S_R$) in the binaural acoustic signals to the control filters 1123 and 1124.

It is to be noted that, since X=2 in the fifth to eighth embodiments, the left acoustic signal (=$S_L$) and the right acoustic signal (=$S_R$) must be distributed to 1:1. On the other hand, since X≥3 in the present embodiment and a later-described thirteenth embodiment, the left acoustic signal (=$S_L$) and the right acoustic signal (=$S_R$) can be distributed in various conformations. However, it is basically preferable for the total number of loudspeakers to which the left acoustic signal (=$S_L$) and the right acoustic signal (=$S_R$) are distributed to be in the same range. Further, it is preferable for the left acoustic signal (=$S_L$) to be distributed to the loudspeaker relatively arranged on the left side and for the right acoustic signal (=$S_R$) to be distributed to the loudspeaker relatively arranged on the right side. Therefore, for example, it is preferable to divide X loudspeakers into a left group and a right group so that the respective groups include substantially the same total number of loudspeakers and to distribute the left acoustic signal ($=S_L$) to the left group and the right acoustic signal ($=S_R$) to the right group.

The transfer function storage unit 1130 stores head-related transfer functions in relation to at least three (=X−1) target binaural positions. Specifically, the transfer function storage unit 1130 stores three head-related transfer function sets from the loudspeakers 901, 902, 903, and 904 to at least three target binaural positions. It is to be noted that the head-related transfer function sets may be derived by preliminary measurement or calculation and stored in the transfer function storage unit 1130. Further, the acoustic control apparatus in FIG. 59 may derive the head-related transfer function sets by measurement or calculation at any timing (e.g., setting or activation) and store them in the transfer function storage unit 1130.

The control filters 1121, 1122, and 1123 read from the transfer function storage unit 1130 head-related transfer functions ($=C_{L1L}, \ldots, C_{LNL}$) from the loudspeaker 901 to the listener's left ear at the N (=X−1) target binaural positions (i=1, . . . , N), head-related transfer functions ($=C_{L1S}, \ldots, C_{LNS}$) from the loudspeaker 902 to the listener's left ear at the N target binaural positions (i=1, . . . , N), head-related transfer functions ($=C_{L1T}, \ldots, C_{LNT}$) from the loudspeaker 903 to the listener's left ear at the N target binaural positions (i=1, . . . , N), head-related transfer functions ($=C_{L1R}, \ldots, C_{LNR}$) from the loudspeaker 904 to the listener's left ear at the N target binaural positions (i=1, . . . , N), head-related transfer functions ($=C_{R1L}, \ldots, C_{RNL}$) from the =loudspeaker 901 to the listener's right ear at the N target binaural positions (i=1, . . . , N), head-related transfer functions ($=C_{R1S}, \ldots, C_{RNS}$) from the loudspeaker 902 to the listener's right ear at the N target binaural positions (i=1, . . . , N), head-related transfer functions ($=C_{R1T}, \ldots, C_{RNT}$) from the loudspeaker 903 to the listener's right ear at the N target binaural positions (i=1, . . . , N), and head-related transfer functions ($=C_{R1R}, \ldots, C_{RNR}$) from the loudspeaker 904 to the listener's right ear at the N target binaural positions (i=1, . . . , N) as required. When the listener's binaural position greatly fluctuates from any one of the target binaural positions, the control filters 1121, 1122, and 1123 may switch over the head-related transfer function.

The control filters 1121, 1122, and 1123 calculate control filter coefficients ($=W_L, W_S, W_T$) based on the head-related transfer functions read from the transfer function storage unit 1130 and a control filter coefficient ($=W_R$) of the control filter 1124. It is to be noted that the calculation of the control filter coefficients ($=W_L, W_S, W_T$) may be performed by a non-illustrated coefficient calculation unit in place of the control filters 1121, 1122, and 1123. The control filter coefficients ($=W_L, W_S, W_T$) associated with a combination of the control filter coefficient ($=W_R$) of the control filter 1124 and the N target binaural position (i=1, . . . , N) may be previously calculated, and the control filters 1121, 1122, and 1123 may read out appropriate control filter coefficients ($=W_L, W_S, W_T$).

A calculation technique of the control filter coefficient set ($=W_L, W_S, W_T$) in the present embodiment is the same as that when M=1 and $d_{Lij}=d_{Rij}=1$ are set in the tenth embodiment. Further, the control filter 1124 may have through characteristic, and $W_R=1$ is generally assumed in the following description. That is, the above Expressions (35) to (39) are substituted by the following Expressions (40) to (44).

$$W_R = 1 \tag{40}$$

$$W_L = -\frac{\sum_{i=1}^{N}(P_i \cdot O_i^*)}{\sum_{i=1}^{N}(O_i \cdot O_i^*)} W_R$$

$$W_S = -\frac{L \cdot W_L + M \cdot W_R}{N}$$

$$W_T = -\frac{E \cdot W_L + F \cdot W_S + G \cdot W_R}{H}$$

$$\begin{aligned} A_i &= C_{RiL} - C_{LiL} \\ B_i &= C_{RiS} - C_{LiS} \\ C_i &= C_{RiT} - C_{LiT} \\ D_i &= C_{RiR} - C_{LiR} \\ i &= 1, 2, \ldots, N \end{aligned} \tag{41}$$

$$E = \sum_{i=1}^{N}(A_i \cdot C_i^*) \tag{42}$$

$$F = \sum_{i=1}^{N}(B_i \cdot C_i^*)$$

$$G = \sum_{i=1}^{N}(D_i \cdot C_i^*)$$

$$H = \sum_{i=1}^{N}(C_i \cdot C_i^*)$$

$$\begin{aligned} I_i &= A_i - \frac{C_i \cdot E}{H} \\ J_i &= B_i - \frac{C_i \cdot F}{H} \\ K_i &= D_i - \frac{C_i \cdot G}{H} \\ i &= 1, 2, \ldots, N \end{aligned} \tag{43}$$

$$L = \sum_{i=1}^{N}(I_i \cdot J_i^*) \tag{44}$$

$$M = \sum_{i=1}^{N}(K_i \cdot J_i^*)$$

$$N = \sum_{i=1}^{N}(J_i \cdot J_i^*)$$

$$O_i = I_i - \frac{J_i \cdot L}{N}$$

$$P_i = K_i - \frac{J_i \cdot M}{N}$$

$$i = 1, 2, \ldots, N$$

The control filter 1121 multiplies the control filter coefficient ($=W_L$) by the left acoustic signal ($=S_L$) and inputs an acoustic signal ($=W_L S_L$) to the signal amplification unit 940. The control filter 1122 multiplies the control filter coefficient ($=W_S$) by the left acoustic signal ($=S_L$) and inputs an acoustic signal ($=W_S S_L$) to the signal amplification unit 940.

The control filter 1123 multiplies the control filter coefficient ($=W_T$) by the right acoustic signal ($=S_R$) and inputs an acoustic signal ($=W_T S_R$) to the signal amplification unit 940. The control filter 1124 multiplies the control filter coefficient ($=W_R$) by the right acoustic signal ($=S_R$) and inputs an acoustic signal ($=W_R S_R$) to the signal amplification unit 940. However, if the control filter coefficient ($=W_R$) of the control filter 1124 has the through characteristic, the control filter 1124 may be omitted.

The signal amplification unit 940 amplifies the acoustic signals of 4 channels from the control filters 1121, 1122, 1123, and 1124 in accordance with gain and supplies the amplified signals to the loudspeakers 901, 902, 903, and 904.

Adequacy of effects of the acoustic control apparatus according to the present embodiment will now be described hereinafter with reference to an experimental result. Conditions of this experiment are the same as those explained in the tenth embodiment except that binaural acoustic signals are treated. Further, the left acoustic signal ($=S_L$) is equal to the right acoustic signal ($=S_R$). That is, desired amplitude characteristic of a complex sound pressure ratio are 0 (dB) over all frequencies, and desired phase characteristic of the complex sound pressure ratio are 0 (deg) over all frequencies.

Figure 61:
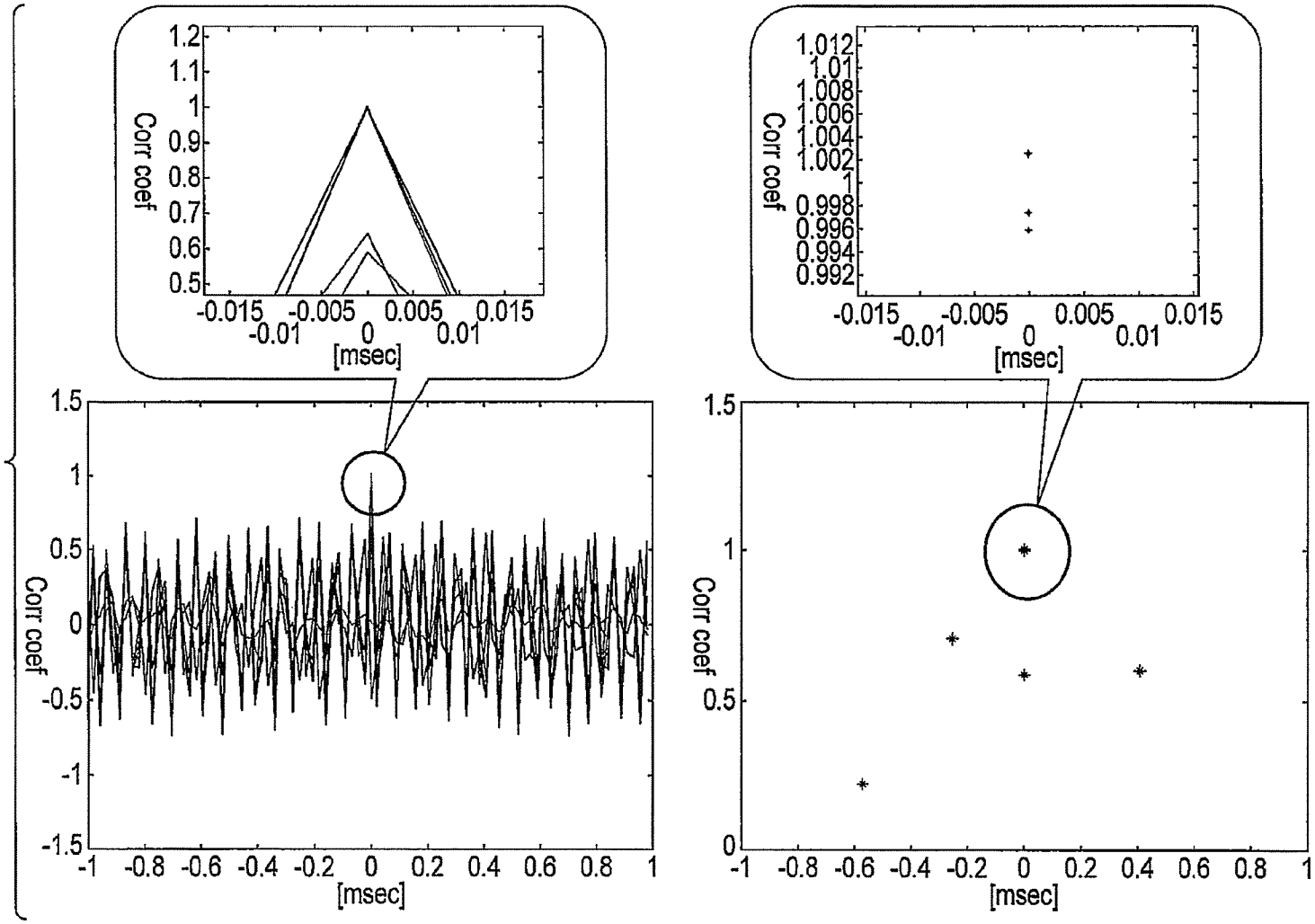
FIG. 61 is a graph showing an IACF at each of six binaural positions when control filter coefficients based on three target binaural positions are applied.
Figure 62A:
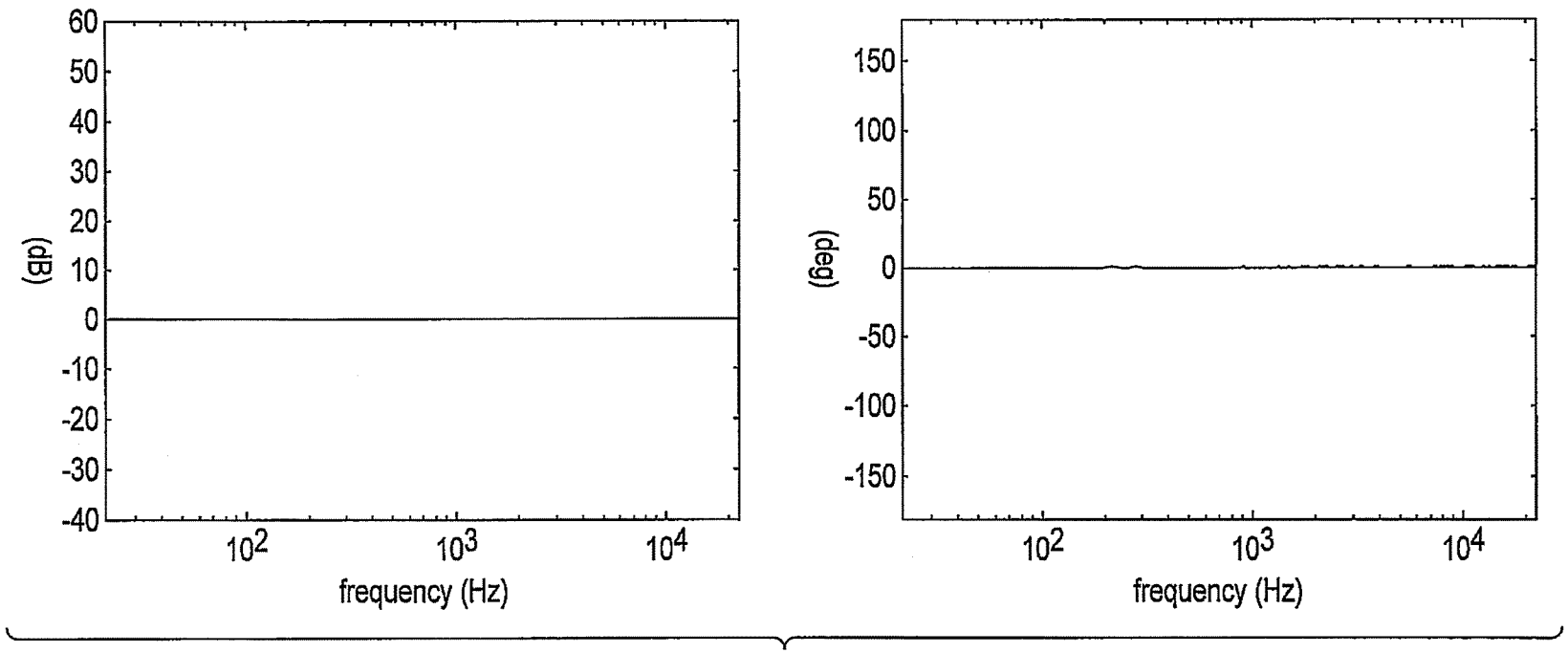
FIG. 62A is a graph showing amplitude characteristic and phase characteristic of a complex sound pressure ratio at the binaural position (16)
Figure 62B:
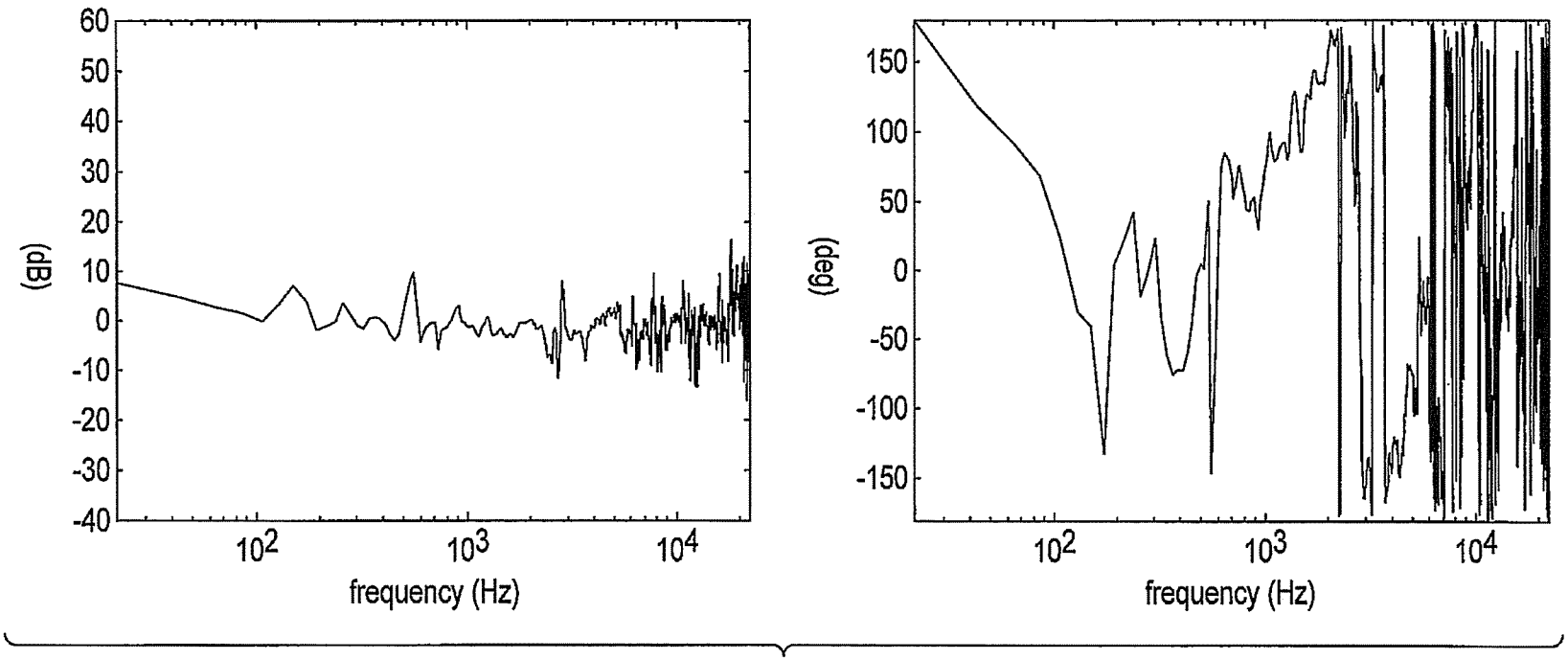
FIG. 62B is a graph showing amplitude characteristic and phase characteristic of the complex sound pressure ratio at the binaural position (14)
Figure 62C:
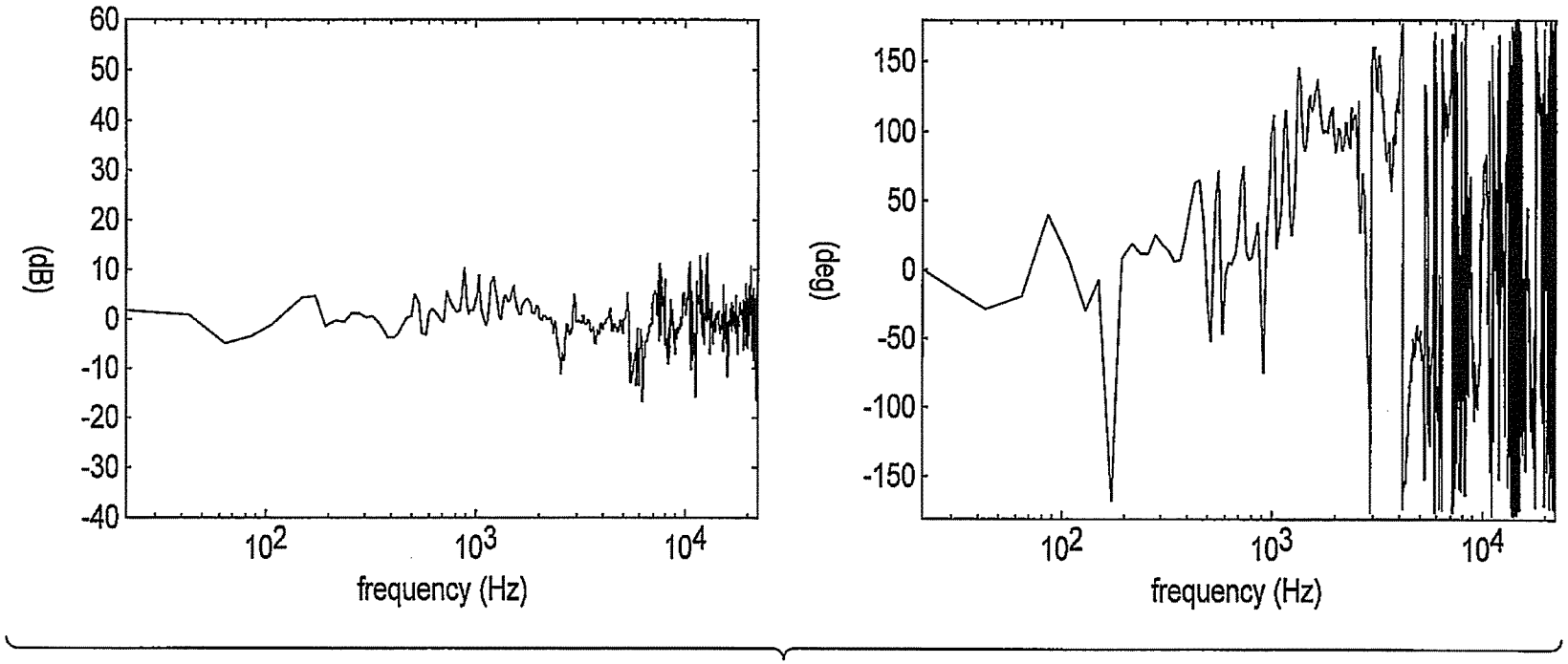
FIG. 62C is a graph showing amplitude characteristic and phase characteristic of the complex sound pressure ratio at the binaural position (12)
Figure 62D:
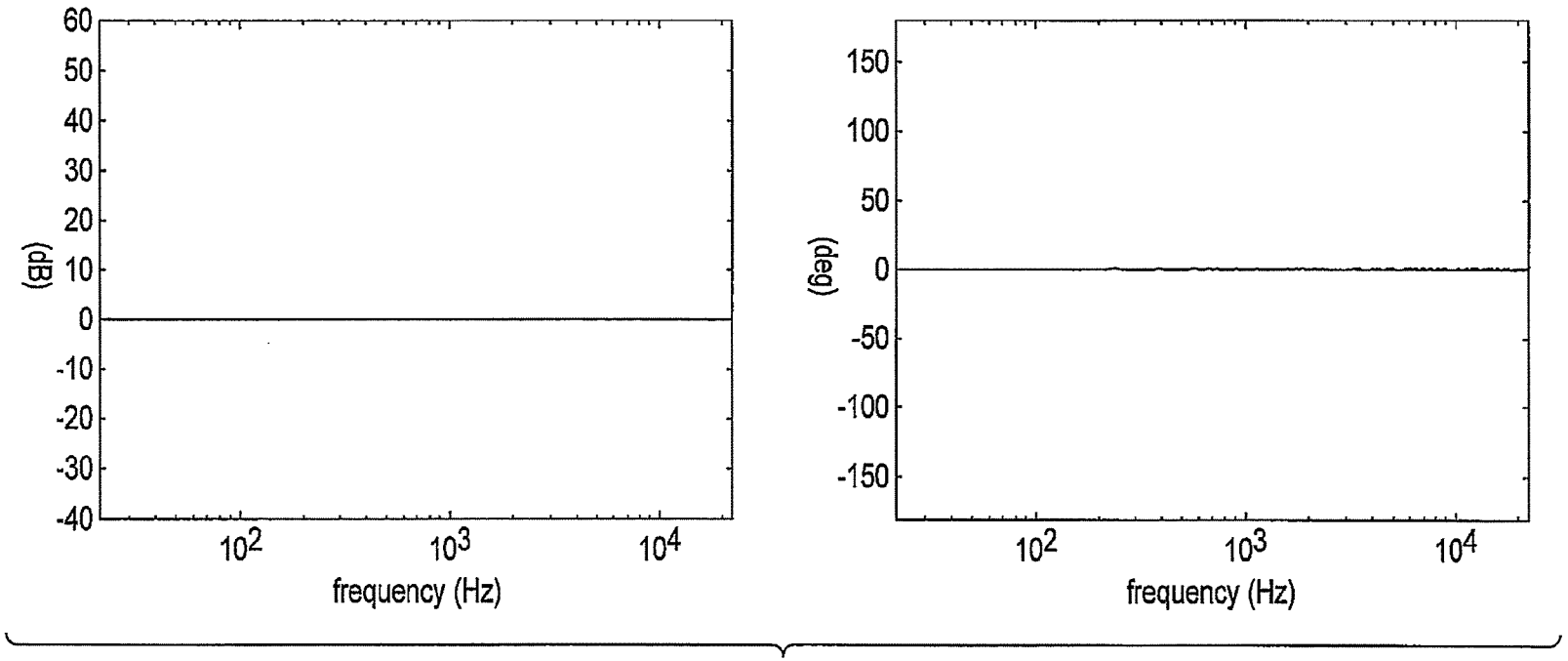
FIG. 62D is a graph showing amplitude characteristic and phase characteristic of the complex sound pressure ratio at the binaural position (10)
Figure 62E:
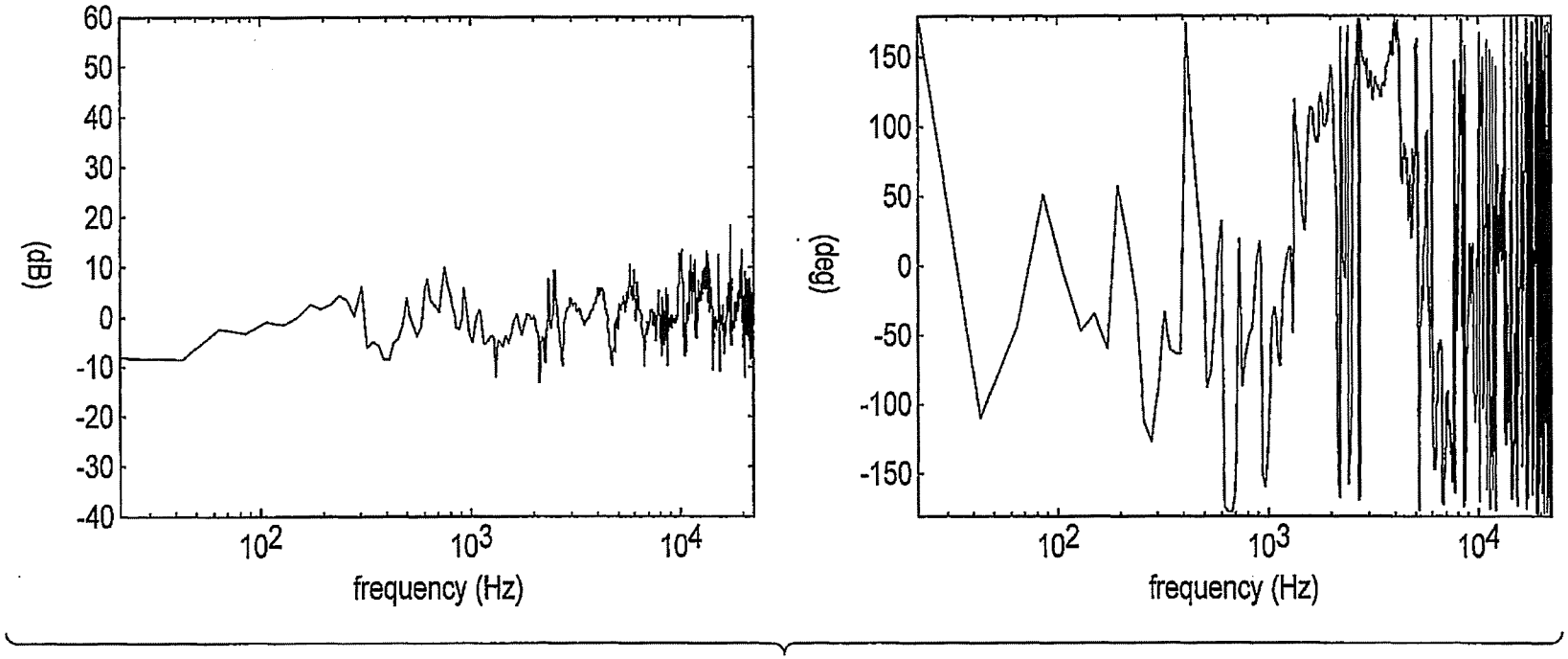
FIG. 62E is a graph showing amplitude characteristic and phase characteristic of the complex sound pressure ratio at the binaural position (8)
Figure 62F:
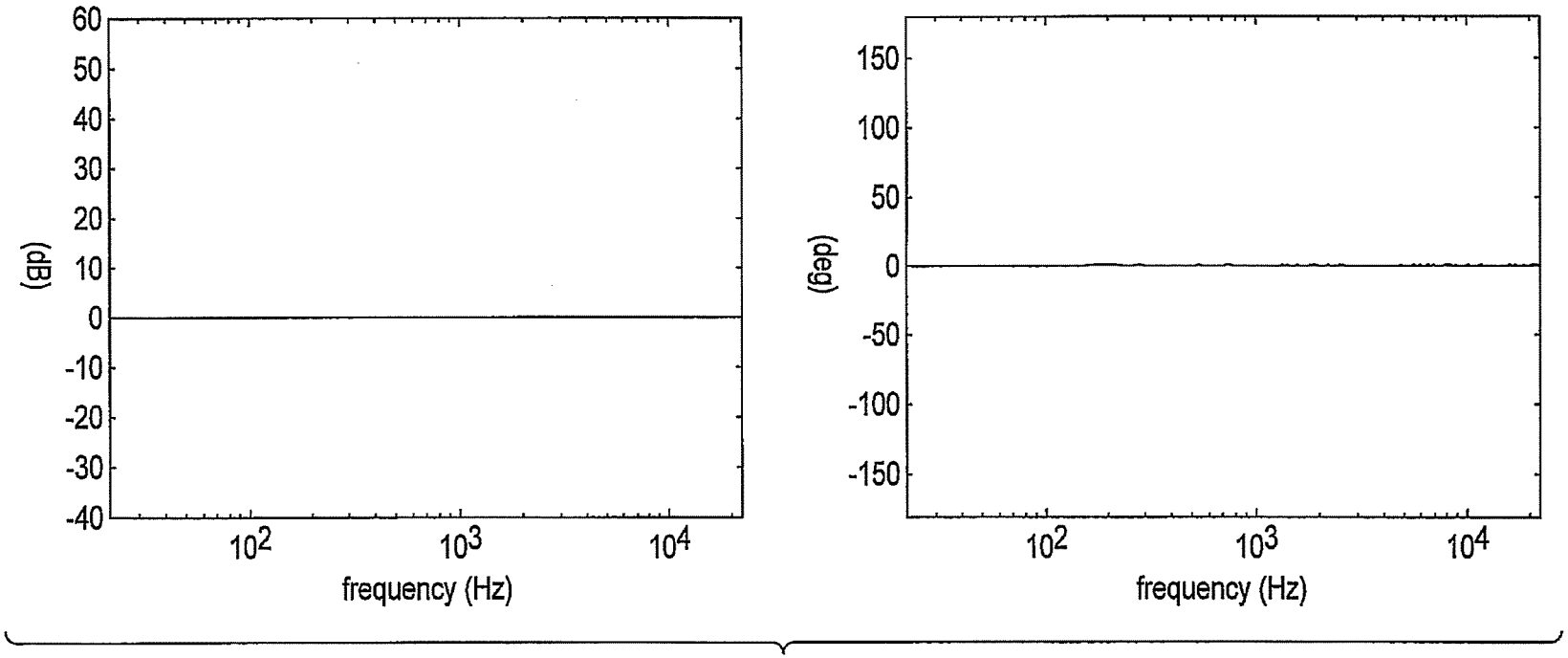
FIG. 62F is a graph showing amplitude characteristic and phase characteristic of the complex sound pressure ratio at the binaural position (6)

FIG. 60A, FIG. 60B, FIG. 60C, FIG. 60D, FIG. 60E, and FIG. 60F show amplitude characteristic and phase characteristic of $P_L/P_R$ at the binaural positions (16), (14), (12), (10), (8), and (6) when the binaural positions (16), (14), and (12) were treated as target binaural positions. It can be confirmed that a complex sound pressure ratio close to the desired ratio was obtained at the binaural positions (16), (14), and (12) treated as the target binaural positions. On the other hand, it can be also confirmed that the complex sound pressure ratio close to the desired ratio was not obtained at the binaural positions (10), (8), and (6) that were not treated as the target binaural positions. FIG. 61 shows an IACF at the binaural positions (16), (14), (12), (10), (8), and (6). According to FIG. 61, at the three binaural positions (16), (14), and (12), a maximum peak value of the IACF is approximately 1, and a maximum peak position is approximately 0 msec. Therefore, it can be confirmed that the complex sound pressure ratio close to the desired ratio was obtained at the binaural positions (16), (14), and (12) that were treated as the target binaural positions in the light of the IACF.

Figure 63:
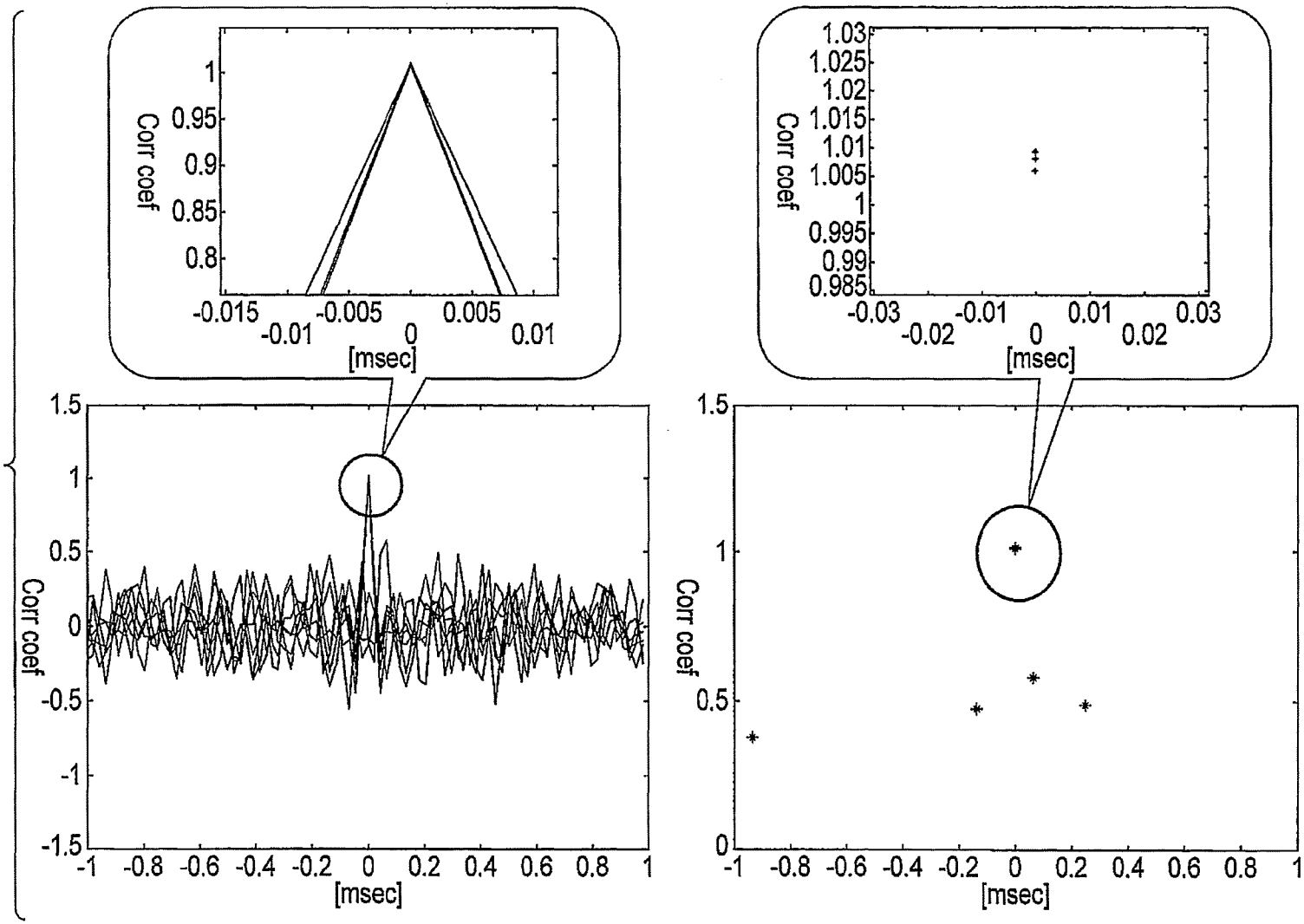
FIG. 63 is a graph showing an IACF at each of six binaural positions when control filter coefficients based on three target binaural positions are applied.

Likewise, FIG. 62A, FIG. 62B, FIG. 62C, FIG. 62D, FIG. 62E, and FIG. 62F show amplitude characteristic and phase characteristic of $P_L/P_R$ at the binaural positions (16), (14), (12), (10), (8), and (6) when the binaural positions (16), (10), and (6) were treated as the target binaural positions. It can be confirmed that the complex sound pressure ratio close the desired was obtained at each of the binaural position (16), (10), and (6) treated as the target binaural positions. On the other hand, it can be also confirmed that the complex sound pressure ratio close to the desired ratio was not obtained at each of the binaural positions (14), (12), and (8) that were not treated as the target binaural positions. In particular, the complex sound pressure ratio close to the desired ratio was not be obtained at the binaural position (8) even though the binaural positions (10) and (6) on both adjacent sides were treated as the target binaural positions. FIG. 63 shows an IACF at the binaural positions (16), (14), (12), (10), (8), and (6). According to FIG. 63, at the three binaural positions (16), (10), and (6), a maximum peak value of the IACF is approximately 1, and a maximum peak position is approximately 0 msec. Therefore, it can be confirmed that the complex sound pressure ratio close to the desired ratio was obtained at each of the binaural positions (16), (10), and (6) that were treated as the target binaural positions in the light of the IACF.

As described above, the acoustic control apparatus according to the twelfth embodiment is applied by generating the fifth or sixth embodiment when using three or more loudspeakers. Therefore, according to this acoustic control apparatus, the same effects as those of the fifth or sixth embodiment can be obtained at the target binaural positions corresponding to the total number of loudspeakers−1 in number.

Thirteenth Embodiment

The acoustic control apparatus according to the twelfth embodiment is applied by generalizing the fifth or sixth embodiment when using three or more loudspeakers. That is, the total number of target binaural positions is the total number of loudspeakers−1. The thirteenth embodiment deals with more target binaural positions than those in the twelfth embodiment to improve robustness while making reference to the seventh or eighth embodiment.

Figure 64:
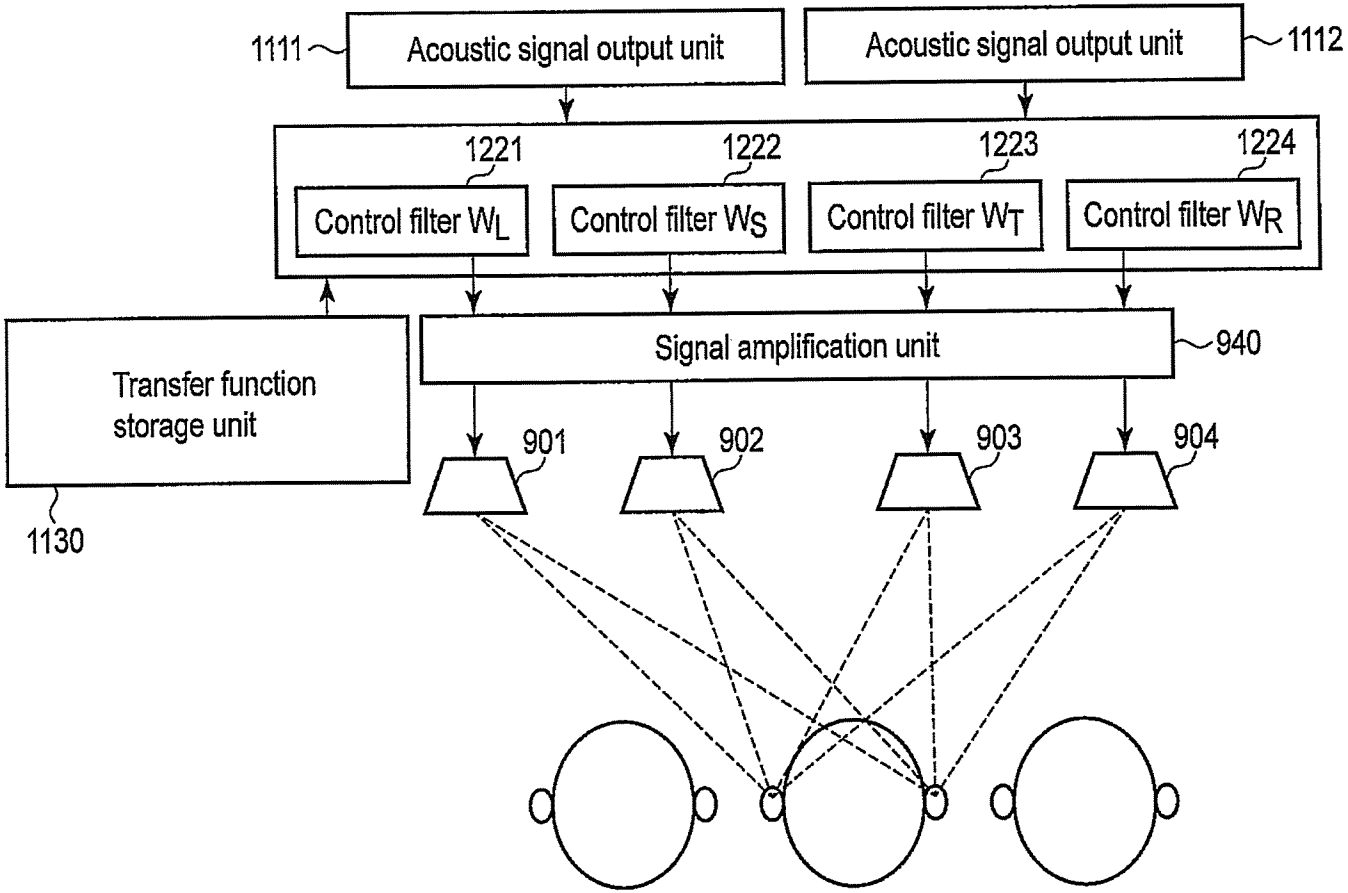
FIG. 64 is a block diagram showing an acoustic control apparatus according to a thirteenth embodiment.
Figure 65A:
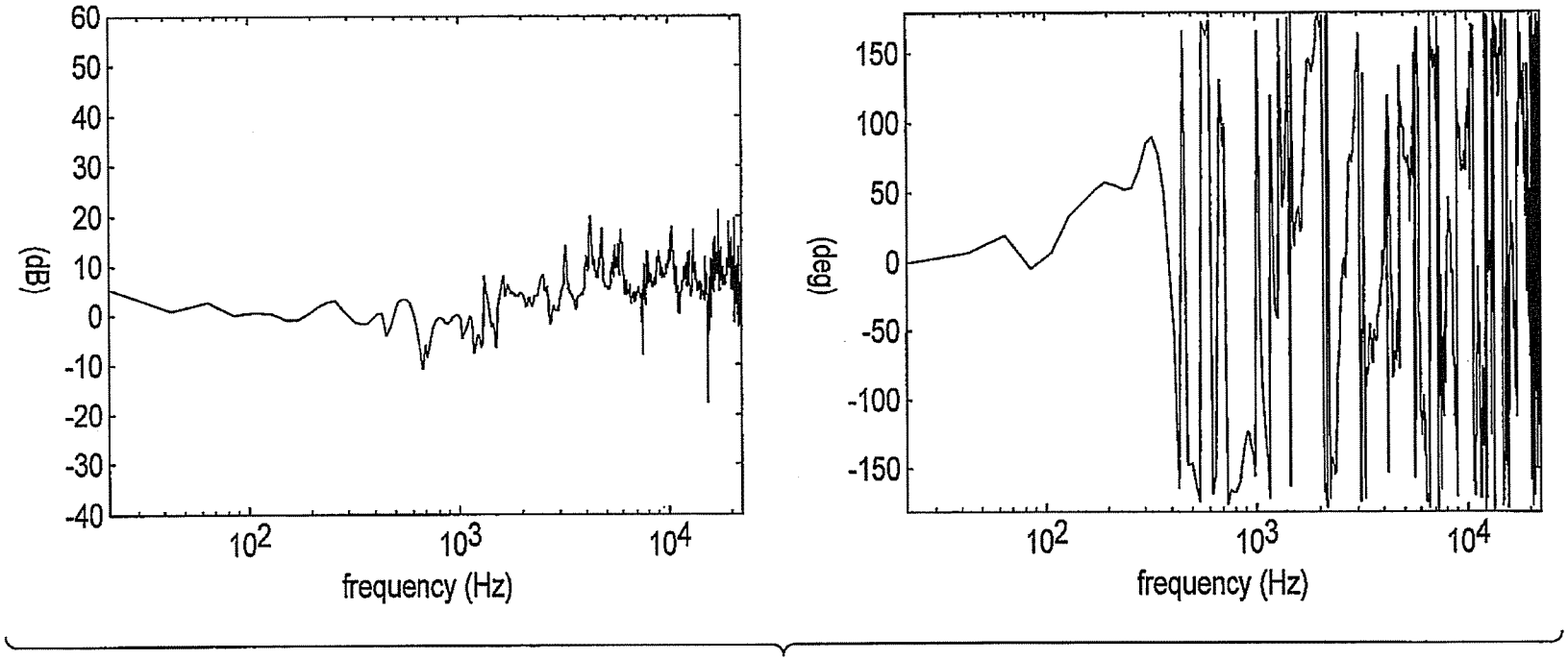
FIG. 65A is a graph showing amplitude characteristic and phase characteristic of the complex sound pressure ratio at the binaural position (16)
Figure 65B:
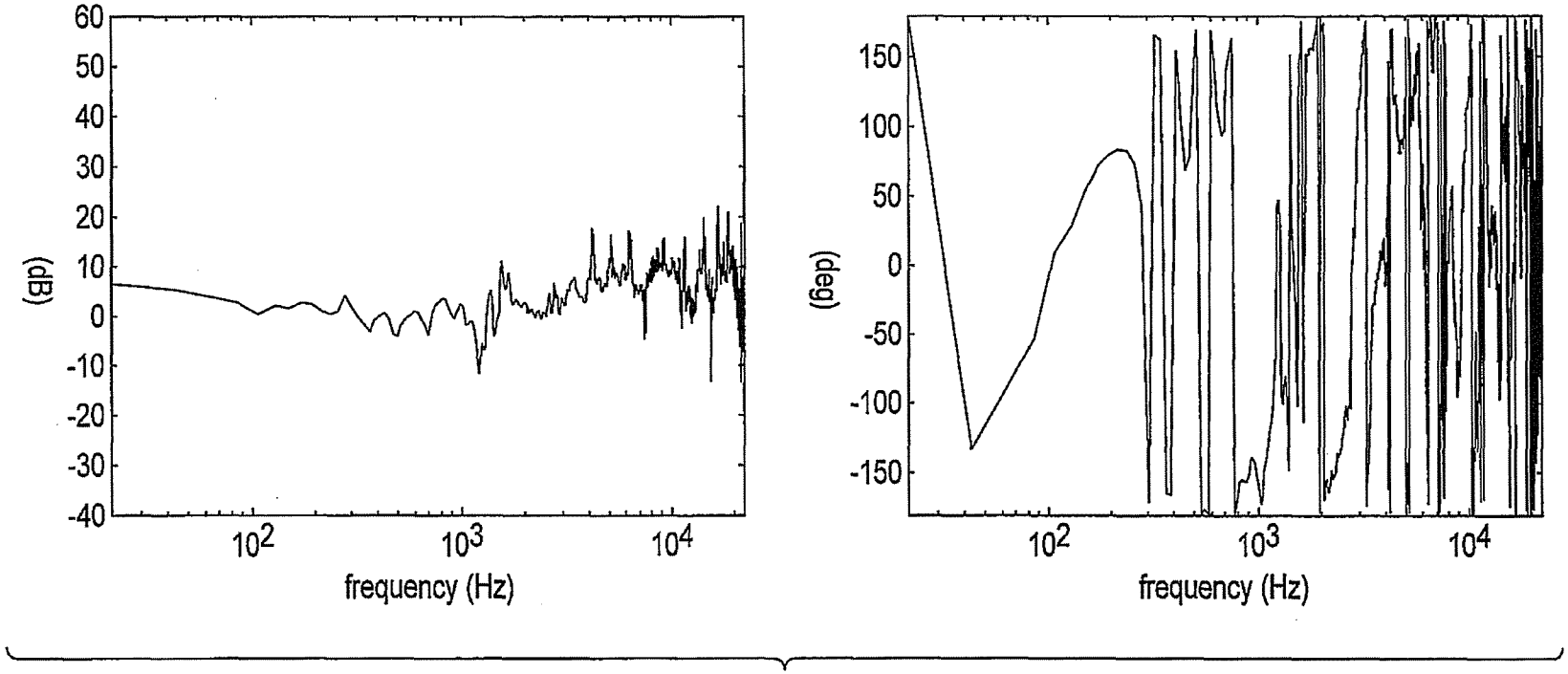
FIG. 65B is a graph showing amplitude characteristic and phase characteristic of the complex sound pressure ratio at the binaural position (14)
Figure 65C:
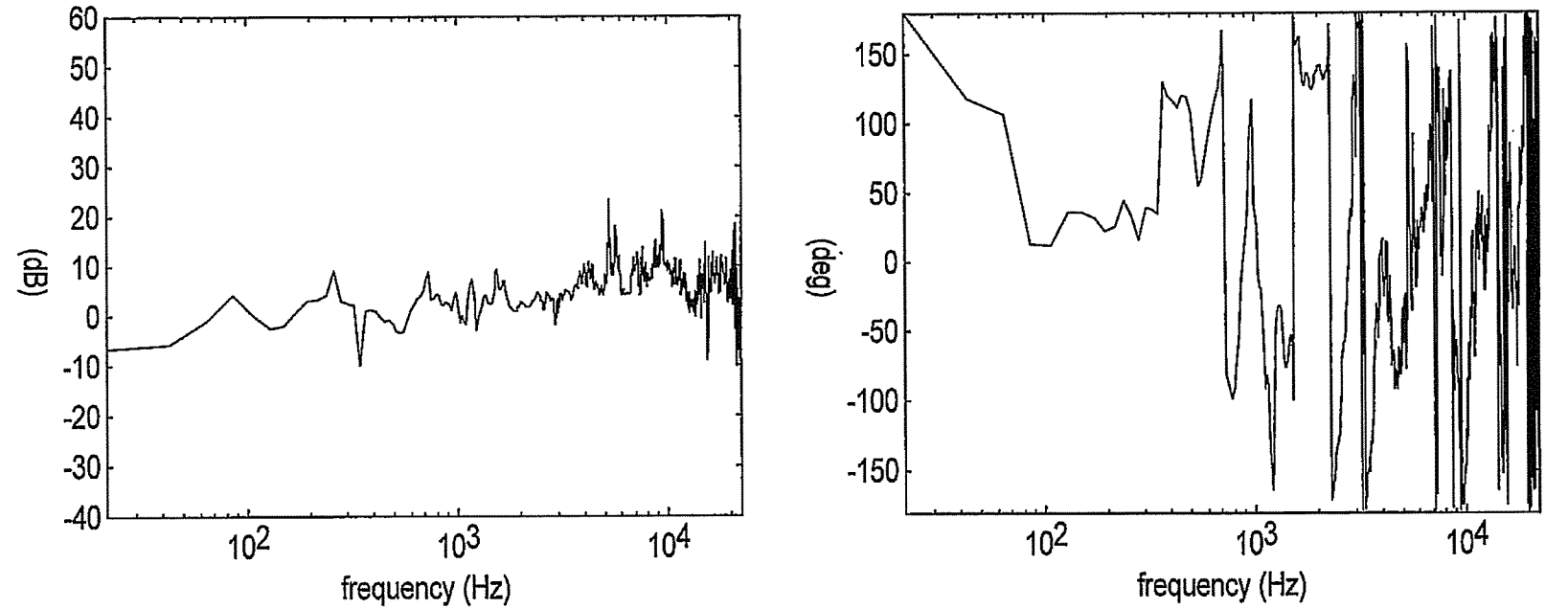
FIG. 65C is a graph showing amplitude characteristic and phase characteristic of the complex sound pressure ratio at the binaural position (12)
Figure 65D:
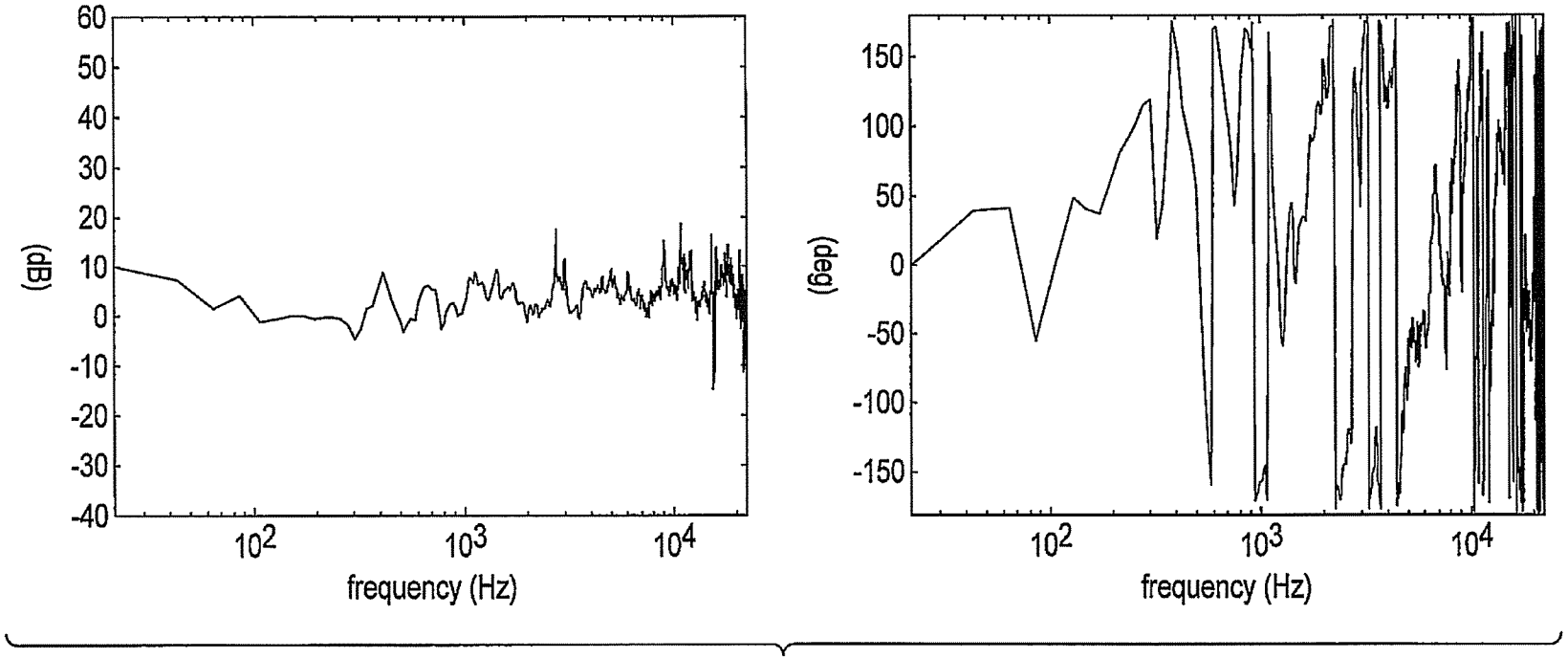
FIG. 65D is a graph showing amplitude characteristic and phase characteristic of the complex sound pressure ratio at the binaural position (10)
Figure 65E:
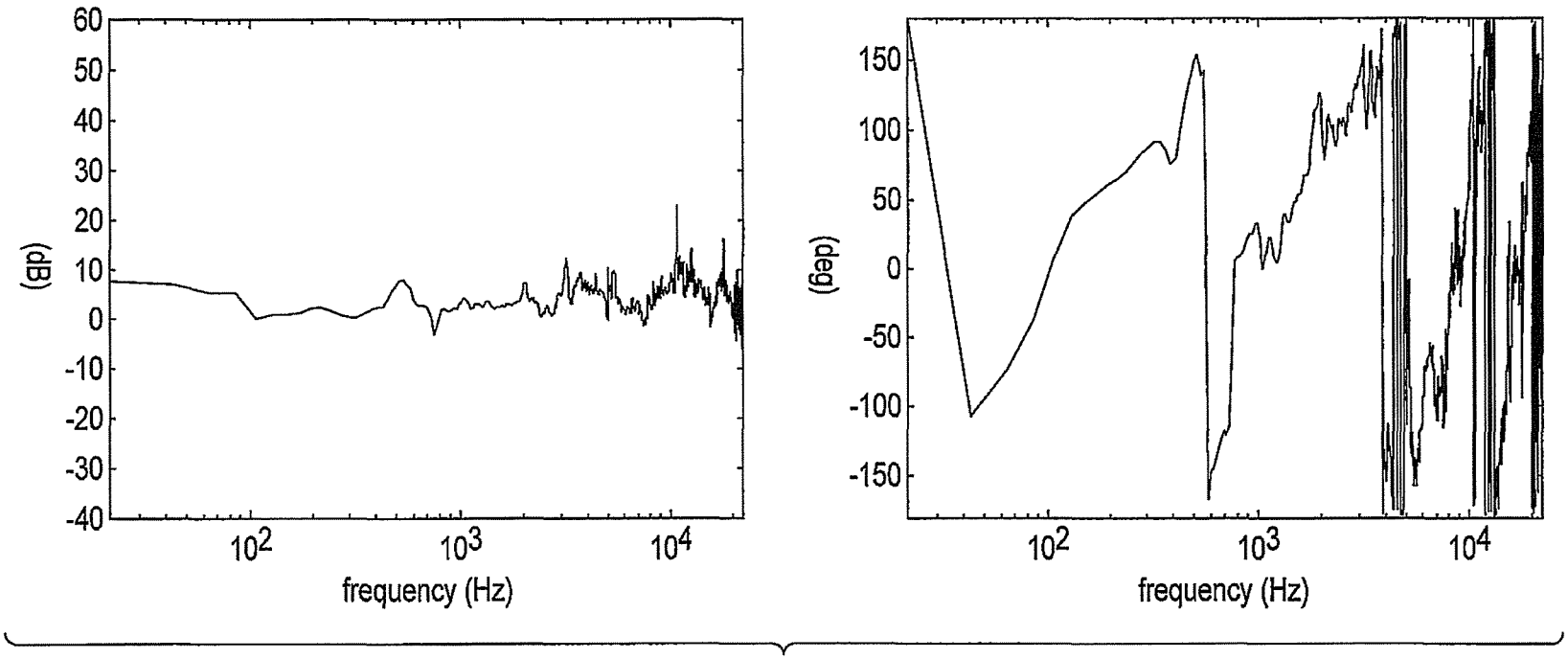
FIG. 65E is a graph showing amplitude characteristic and phase characteristic of the complex sound pressure ratio at the binaural position (8)
Figure 65F:
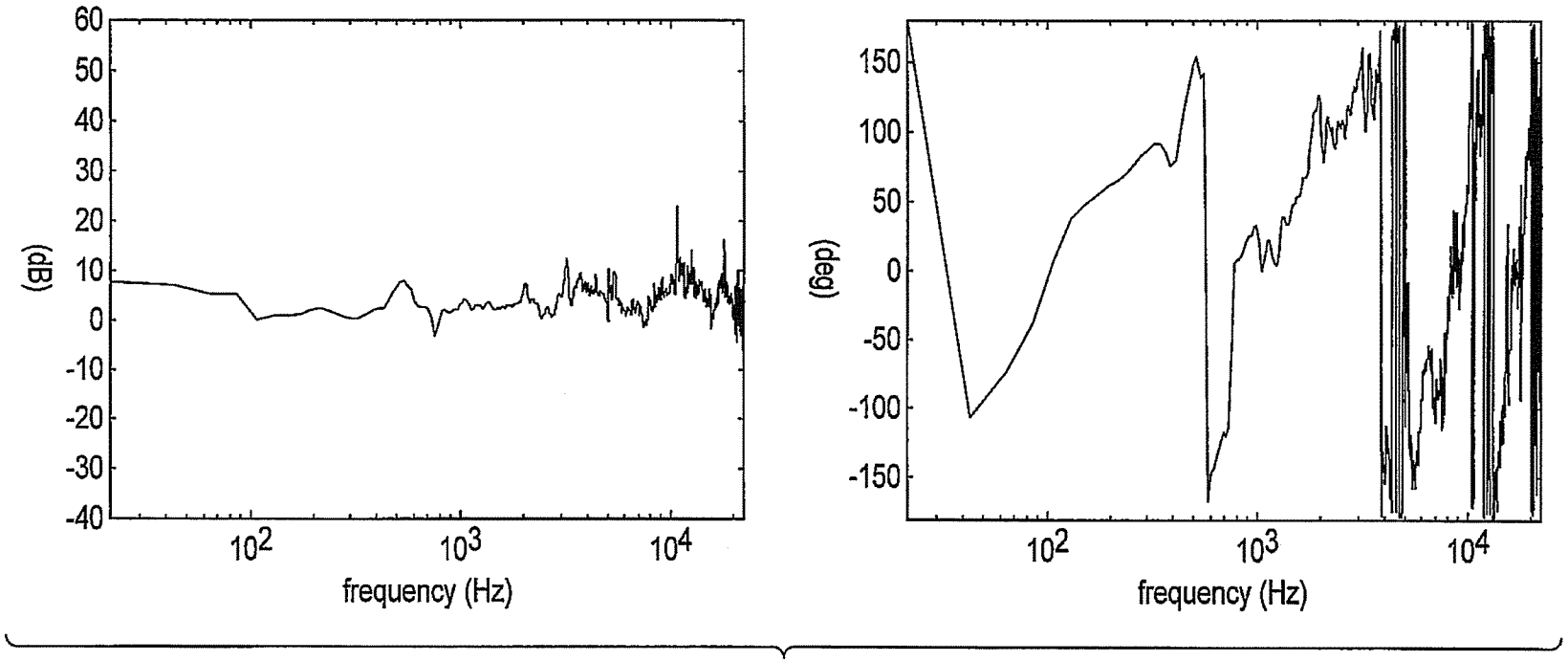
FIG. 65F is a graph showing amplitude characteristic and phase characteristic of the complex sound pressure ratio at the binaural position (6)

As shown in FIG. 64, an acoustic control apparatus according to the present embodiment comprises loudspeakers 901, 902, 903, and 904, acoustic signal output units 1111 and 1112, control filters 1221, 1222, 1223, and 1224, a transfer function storage unit 1130, and a signal amplification unit 940. In the acoustic control apparatus depicted in FIG. 64, X=4.

The acoustic control apparatus shown in FIG. 64 performs later-described acoustic control to binaural acoustic signals output from the acoustic signal output units 1111 and 1112 to approximate (e.g., conform) a spatial average of complex sound pressure ratios at four or more target binaural positions to a complex sound pressure ratio of the binaural acoustic signals. According to the acoustic control apparatus depicted in FIG. 64, the listener can perceive stereophonic effects based on the binaural acoustic signals at, e.g., 6(≥X) target binaural positions, respectively.

The acoustic signal output unit 1111 outputs a left acoustic signal ($=S_L$) in the binaural acoustic signals to the control filters 1121 and 1122. The acoustic signal output unit 1112 outputs a right acoustic signal ($=S_R$) in the binaural acoustic signals to the control filters 1123 and 1124. It is to be noted that distribution of the left acoustic signal ($=S_L$) and the right acoustic signal ($=S_R$) is as described in the twelfth embodiment, and it may be appropriately changed.

The transfer function storage unit 1130 stores head-related transfer functions in relation to at least four (=X) target binaural positions. Specifically, the transfer function storage unit 1130 stores four head-related transfer function sets from the loudspeakers 901, 902, 903, and 904 to at least four target binaural positions. It is to be noted that the head-related transfer function sets may be derived by preliminary measurement or calculation and stored in the transfer function storage unit 1130. Further, the acoustic control apparatus in FIG. 64 may derive the head-related transfer function sets by measurement or calculation at any timing (e.g., setting or activation) and store them in the transfer function storage unit 1130.

The control filters 1221, 1222, and 1223 read from the transfer function storage unit 1130 head-related transfer functions ($=C_{L1L}, \ldots, C_{LNL}$) from the loudspeaker 901 to the listener's left ear at the N (≥X) target binaural positions (i=1, . . . , N), head-related transfer functions ($=C_{L1S}, \ldots, C_{LNS}$) from the loudspeaker 902 to the listener's left ear at the N target binaural positions (i=1, . . . , N), head-related transfer functions ($=C_{L1T}, \ldots, C_{LNT}$) from the loudspeaker 903 to the listener's left ear at the N target binaural positions (i=1, . . . , N), head-related transfer functions ($=C_{L1R}, \ldots, C_{LNR}$) from the loudspeaker 904 to the listener's left ear at the N target binaural positions (i=1, . . . , N), head-related transfer functions ($=C_{R1L}, \ldots, C_{RNL}$) from the loudspeaker 901 to the listener's right ear at the N target binaural positions (i=1, . . . , N), head-related loudspeaker 902 to the listener's right ear at the N target binaural positions (i=1, . . . , N), head-related transfer functions ($=C_{R1T}, \ldots, C_{RNT}$) from the loudspeaker 903 to the listener's right ear at the N target binaural positions (i=1, . . . , N), and head-related transfer functions ($=C_{R1R}, \ldots, C_{RNR}$) from the loudspeaker 904 to the listener's right ear at the N target binaural positions (i=1, . . . , N) as required. When the listener's binaural position greatly fluctuates from any one of the target binaural positions, the control filters 1221, 1222, and 1223 may switch over the head-related transfer function.

The control filters 1221, 1222, and 1223 calculate control filter coefficients ($=W_L$, $W_S$, $W_T$) based on the head-related transfer functions read from the transfer function storage unit 1130 and a control filter coefficient ($=W_R$) of the control filter 1224. It is to be noted that the calculation of the control filter coefficients ($=W_L$, $W_S$, $W_T$) may be performed by a non-illustrated coefficient calculation unit in place of the control filters 1221, 1222, and 1223. The control filter coefficients ($=W_L$, $W_S$, $W_T$) associated with a combination of the control filter coefficient ($=W_R$) of the control filter 1224 and the N target binaural position (i=1, . . . , N) may be previously calculated, and the control filters 1221, 1222, and 1223 may read appropriate control filter coefficients ($=W_L$, $W_S$, $W_T$). It is to be noted that a calculation technique of the control filter coefficients ($=W_L$, $W_S$, $W_T$) in the present embodiment is the same as that in the twelfth embodiment except that N is X or more.

The control filter 1221 multiplies the control filter coefficient ($=W_L$) by the left acoustic signal ($=S_L$) and inputs an acoustic signal ($=W_LS_L$) to the signal amplification unit 940. The control filter 1222 multiplies the control filter coefficient ($=W_s$) by the left acoustic signal ($=S_L$) and inputs an acoustic signal ($=W_SS_L$) to the signal amplification unit 940.

The control filter 1223 multiplies the control filter coefficient ($=W_T$) by the right acoustic signal ($=S_R$) and inputs an acoustic signal ($=W_TS_R$) to the signal amplification unit 940. The control filter 1224 multiplies the control filter coefficient ($=W_R$) by the right acoustic signal ($=S_R$) and inputs an acoustic signal ($=W_RS_R$) to the signal amplification unit 940. However, if the control filter coefficient ($=W_R$) of the control filter 1124 has the through characteristic, the control filter 1124 may be omitted.

The signal amplification unit 940 amplifies the acoustic signals of 4 channels from the control filters 1221, 1222, 1223, and 1224 in accordance with gain and supplies the amplified signals to the loudspeakers 901, 902, 903, and 904.

Adequacy of effects of the acoustic control apparatus according to the present embodiment will now be described hereinafter with reference to an experimental result. Conditions of this experiment are the same as those explained in the twelfth embodiment except that the six binaural positions (16), (14), (12), (10), (8), and (6) are treated as the target binaural position. That is, the head-related transfer functions ($=C_{LiL}$, $C_{LiS}$, $C_{LiT}$, $C_{LiR}$, $C_{RiL}$, $C_{RiS}$, $C_{RiT}$, and $C_{RiR}$) from the respective loudspeakers were measured at the respective binaural positions (16), (14), (12), (10), (8), and (6), and the control filter coefficients ($=W_L$, $W_S$, $W_T$, and $W_R$) were calculated and applied based on these functions.

Figure 66:
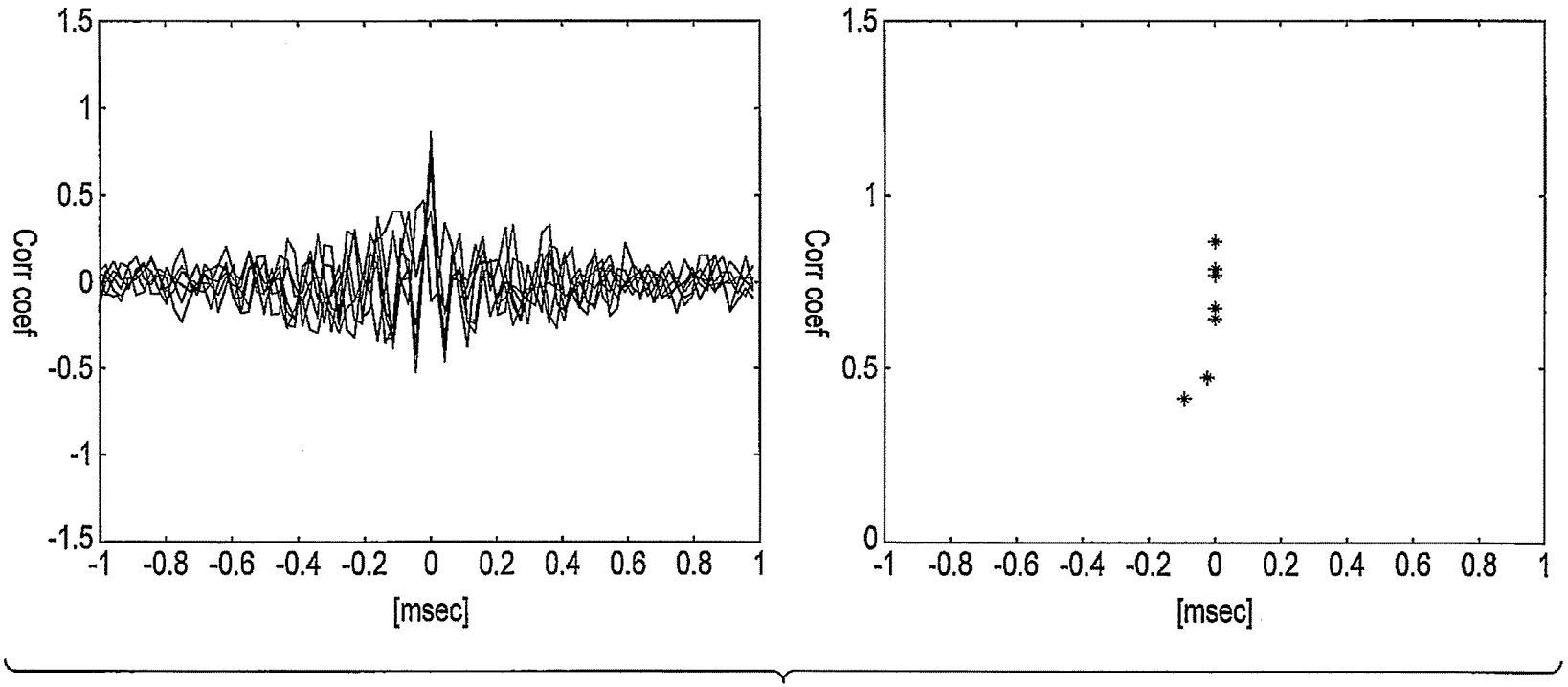
FIG. 66 is a graph showing an IACF at each of six target binaural positions when control filter coefficients based on six target binaural positions are applied.

FIG. 65A, FIG. 65B, FIG. 65C, FIG. 65D, FIG. 65E, and FIG. 65F show amplitude characteristic and phase characteristic of $P_L/P_R$ obtained by this experiment. It can be confirmed from FIG. 65A, FIG. 65B, FIG. 65C, FIG. 65D, FIG. 65E, and FIG. 65F that fluctuations of the amplitude characteristic and the phase characteristic between the respective binaural positions is suppressed as compared with the experimental result explained in the twelfth embodiment. Further, it was confirmed that a complex sound pressure ratio close to a desired ratio to some extent can be obtained at each target binaural position even though the total number of the target binaural positions is increased to be equal to or more than the total number of the loudspeakers. FIG. 66 shows an IACF at each of the binaural positions (16), (14), (12), (10), (8), and (6). It was confirmed from FIG. 66 that a maximum peak value at each target binaural position is lower than that in the experimental result explained in conjunction with the twelfth embodiment, but a maximum peak time remains at substantially 0 msec. Furthermore, it was also confirmed from examination about the listener's auditory impression that the listener can perceive a sound image even if the binaural position fluctuates.

It was confirmed from this experimental result that the complex sound pressure ratio close to the desired ratio to some extent can be obtained at each target binaural position even though the total number of the target binaural positions is increased to be equal to or more than the total number of the loudspeakers. That is, robustness can be improved by increasing the total number of the target binaural positions. On the other hand, it was confirmed from comparison between this experimental result and the experimental result explained in the twelfth embodiment that a difference from the desired ratio of the complex sound pressure ratio at each target binaural position is increased when the total number of the target binaural positions is increased. That is, when the total number of the target binaural positions is increased, robustness is improved, but a reproduction precision (e.g., the IACF) of a desired acoustic signal at each target binaural position is sacrificed.

Therefore, the total number (=N) of the target binaural positions can be determined in design while considering a trade-off between the robustness and the reproduction precision of a desired acoustic signal. For example, an allowable lower limit value of an IACF peak value may be determined in advance, and N may be determined in such a manner that the IACF peak value does not fall below this lower limit value at each target binaural position. Further, in the range of X−1 or below, it can be considered that deterioration of the reproduction precision of a desired acoustic signal does not occur even if the total number of target binaural positions is increased, and hence setting X−1 to the lower limit value of N is desired.

As described above, in the acoustic control apparatus according to the thirteenth embodiment, the total number (=N) of the target binaural positions is increased to the total number of the loudspeakers or more in the twelfth embodiment. Therefore, according to this acoustic control apparatus, although the reproduction precision of a desired acoustic signal needs to be sacrificed to some extent, the desired acoustic signal can be excellently reproduced at more binaural positions.

In the tenth to thirteenth embodiment, the description has been given on the assumption that the total number (=X) of the loudspeakers is 4 for implementation. However, the tenth to thirteenth embodiments can be also applied to a case that X=3, 5, 6, 7, . . . as a matter of course. A description will now be given as to an example where X=3 and an example where X=5.

In case of X=3, control filters and loudspeakers of 3 channels are provided. Assuming that $W_L$ is a control filter coefficient of a first channel, $W_C$ is a control filter coefficient of a second channel, and $W_R$ is a control filter coefficient of a third channel (which may have through characteristic), the respective control filter coefficients ($=W_L$, $W_C$, $W_R$) can be derived by the following Expressions (45) to (48).

$$W_R = 1 \tag{45}$$

$$W_L = -\frac{\sum_{i=1}^{N}(H_i \cdot G_i^*)}{\sum_{i=1}^{N}(G_i \cdot G_i^*)} W_R$$

$$W_C = -\frac{D \cdot W_L + E \cdot W_R}{F}$$

$$\begin{aligned} A_i &= C_{RiL} - C_{LiL} \\ B_i &= C_{RiC} - C_{LiC} \\ C_i &= C_{RiR} - C_{LiR} \\ i &= 1, 2, \ldots, N \end{aligned} \tag{46}$$

$$D = \sum_{i=1}^{N}(A_i \cdot B_i^*) \tag{47}$$

$$E = \sum_{i=1}^{N}(C_i \cdot B_i^*)$$

$$F = \sum_{i=1}^{N}(B_i \cdot B_i^*)$$

$$\begin{aligned} G_i &= A_i - \frac{B_i \cdot D}{F} \\ H_i &= C_i - \frac{B_i \cdot E}{F} \\ i &= 1, 2, \ldots, N \end{aligned} \tag{48}$$

It is to be noted that Expression (46) is used for the twelfth or thirteenth embodiment. Therefore, in regard to the tenth or eleventh embodiment, Expression (46) needs to be substituted by the following Expression (49).

$$\begin{aligned} A_i &= C_{RiL} \cdot d_{Li} - C_{LiL} \cdot d_{Ri} \\ B_i &= C_{RiC} \cdot d_{Li} - C_{LiC} \cdot d_{Ri} \\ C_i &= C_{RiR} \cdot d_{Li} - C_{LiR} \cdot d_{Ri} \\ i &= 1, 2, \ldots, N \end{aligned} \tag{49}$$

To confirm effects of the acoustic control when X=3, an experiment was conducted. Specifically, head-related transfer functions (=$d_L$, $d_R$) were measured using the technique explained in FIG. 50. A predetermined position in front of the loudspeaker (i.e., the binaural position (16)) was determined as a first binaural position, a position 50 cm moved from the predetermined position in a direction of 270 degrees (i.e., the binaural position (6)) was determined as a second binaural position. The first and second binaural positions were treated as target binaural positions. That is, head-related transfer functions (=$C_{LiL}$, $C_{LiC}$, $C_{LiR}$, $C_{RiL}$, $C_{RiC}$, $C_{RiR}$) from each loudspeaker were measured at the first and second binaural positions, and filter coefficients (=$W_L$, $W_C$, $W_R$) were calculated and applied based on these measured functions and the head-related transfer functions (=$d_L$, $d_R$).

Figure 67A:
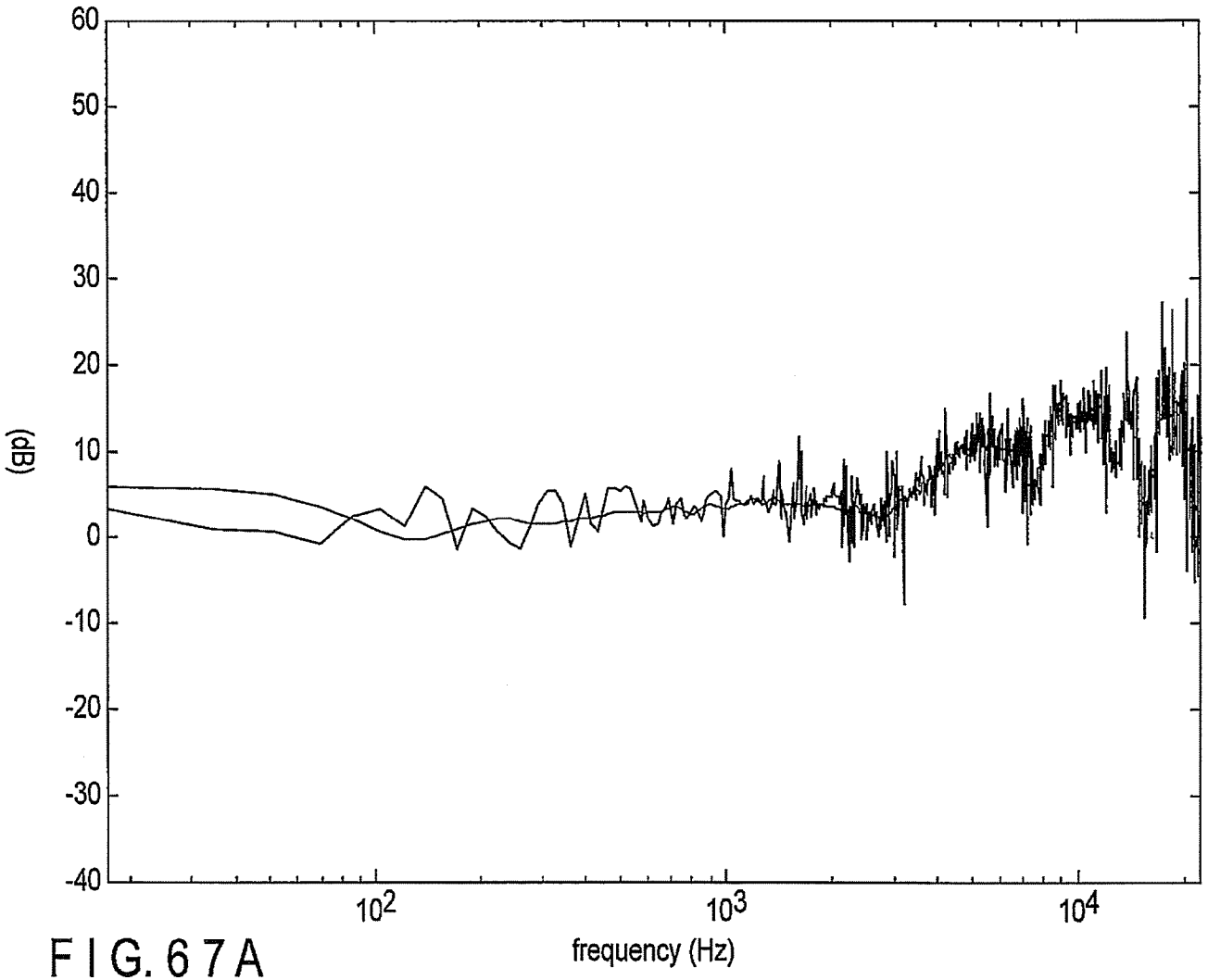
FIG. 67A is a graph showing amplitude characteristics of a complex sound pressure ratio at a first target binaural position and a desired complex sound pressure ratio when X=3 and N=2.
Figure 67B:
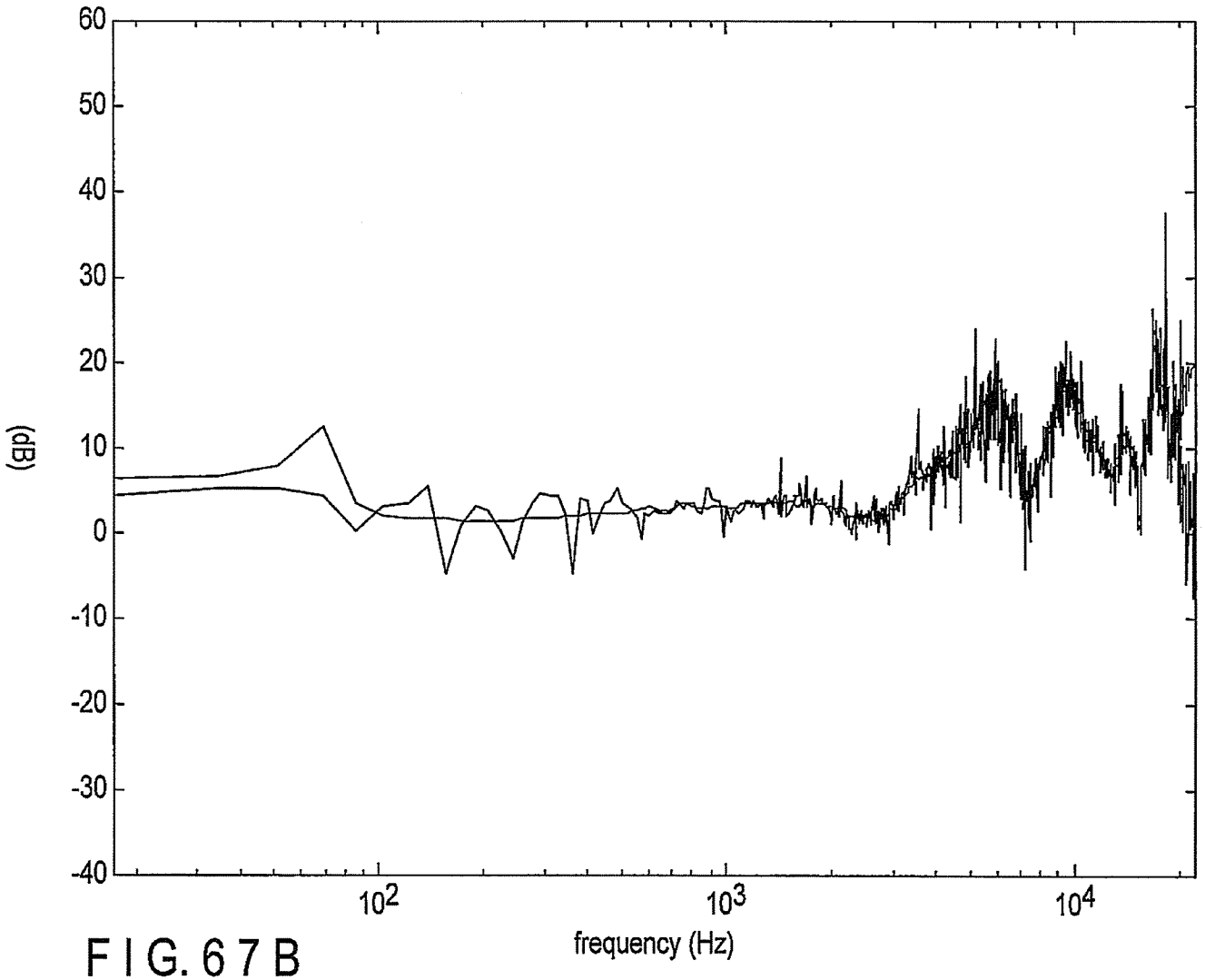
FIG. 67B is a graph showing amplitude characteristics of a complex sound pressure ratio at a second target binaural position and a desired complex sound pressure ratio when X=3 and N=2.
Figure 68A:
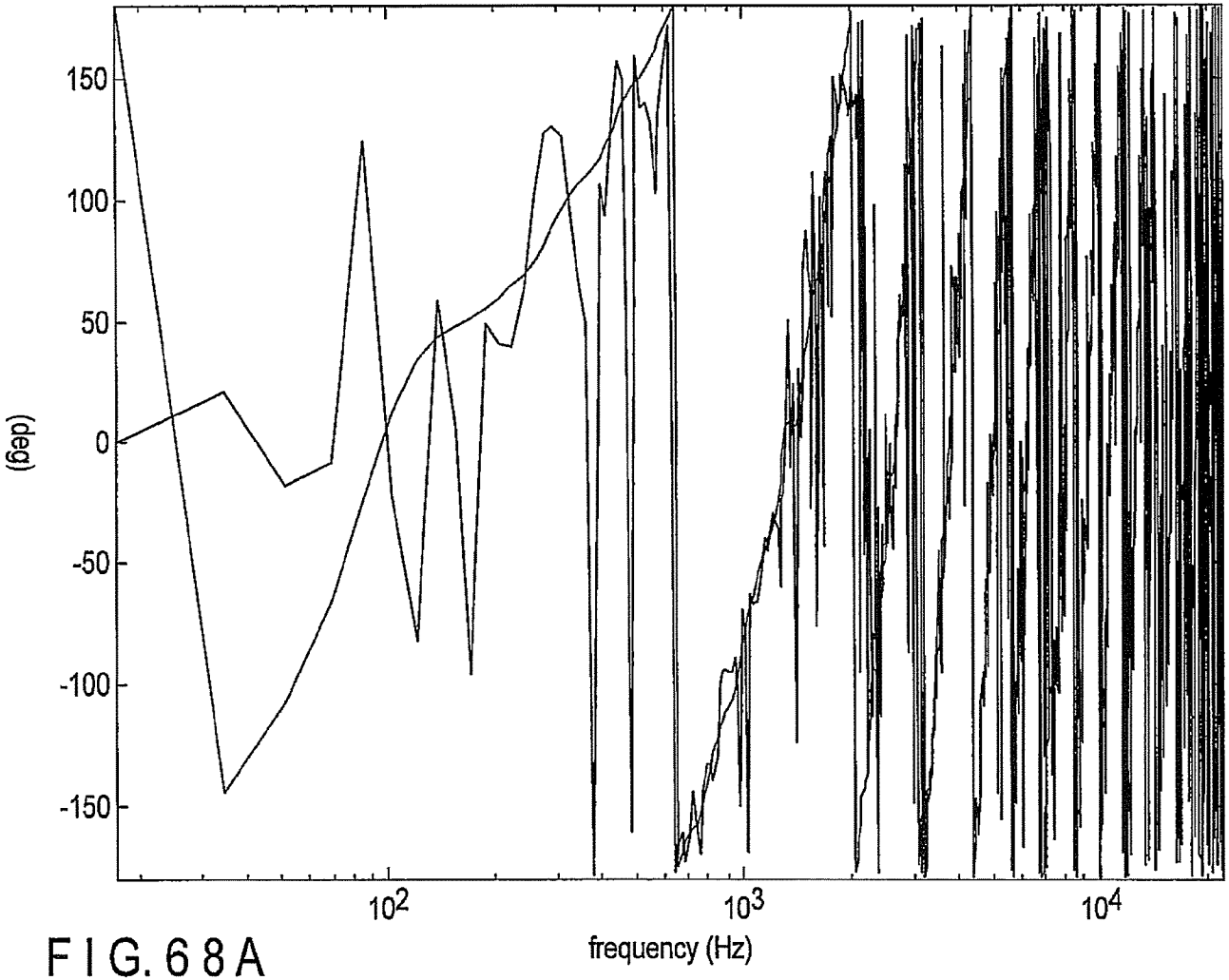
FIG. 68A is a graph showing phase characteristics of a complex sound pressure ratio at a first target binaural position and a desired complex sound pressure ratio when X=3 and N=2.
Figure 68B:
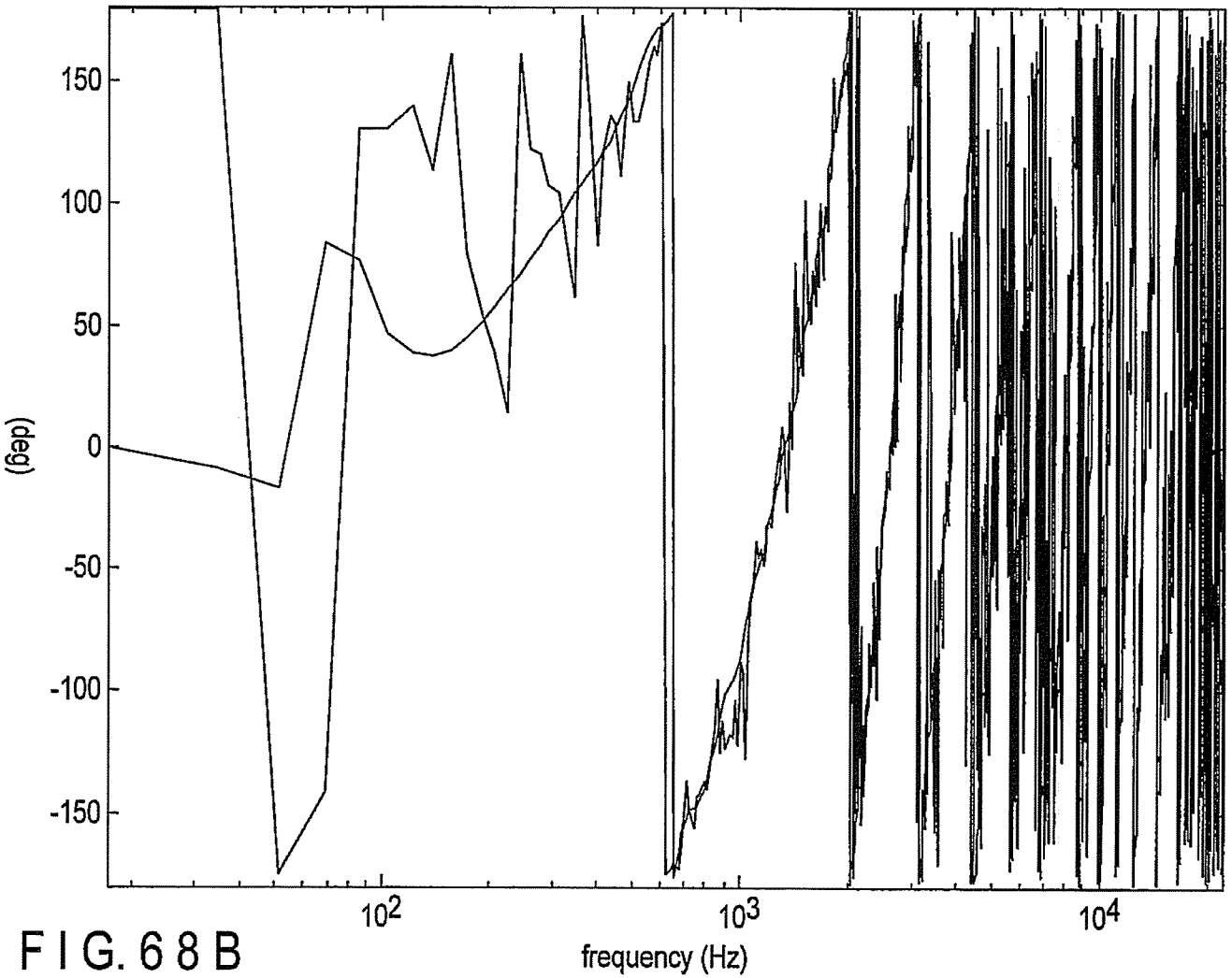
FIG. 68B is a graph showing phase characteristics of a complex sound pressure ratio at a second target binaural position and a desired complex sound pressure ratio when X=3 and N=2.
Figure 69A:
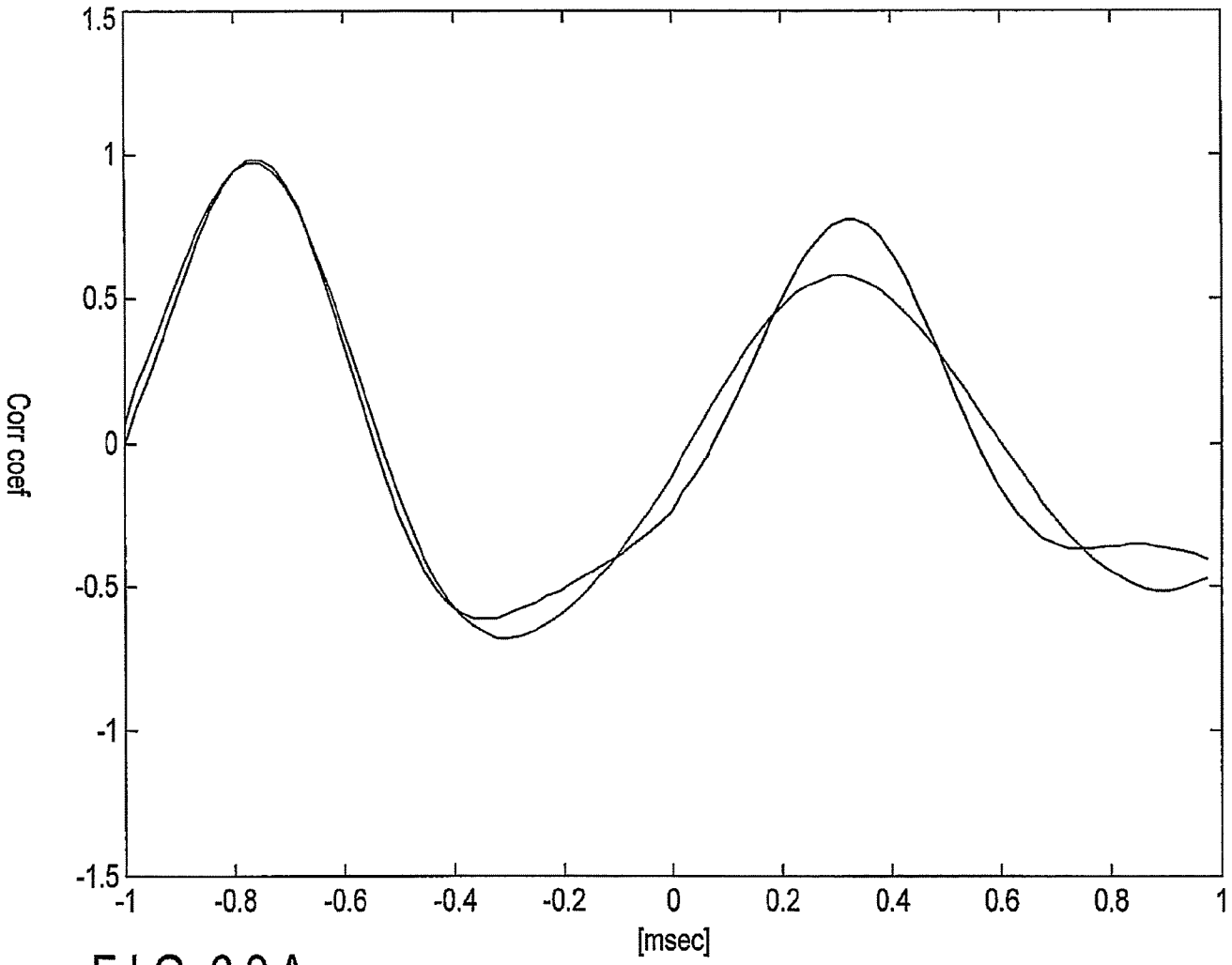
FIG. 69A is a graph showing an IACF at the first target binaural position and a desired IACF when X=3 and N=2.
Figure 69B:
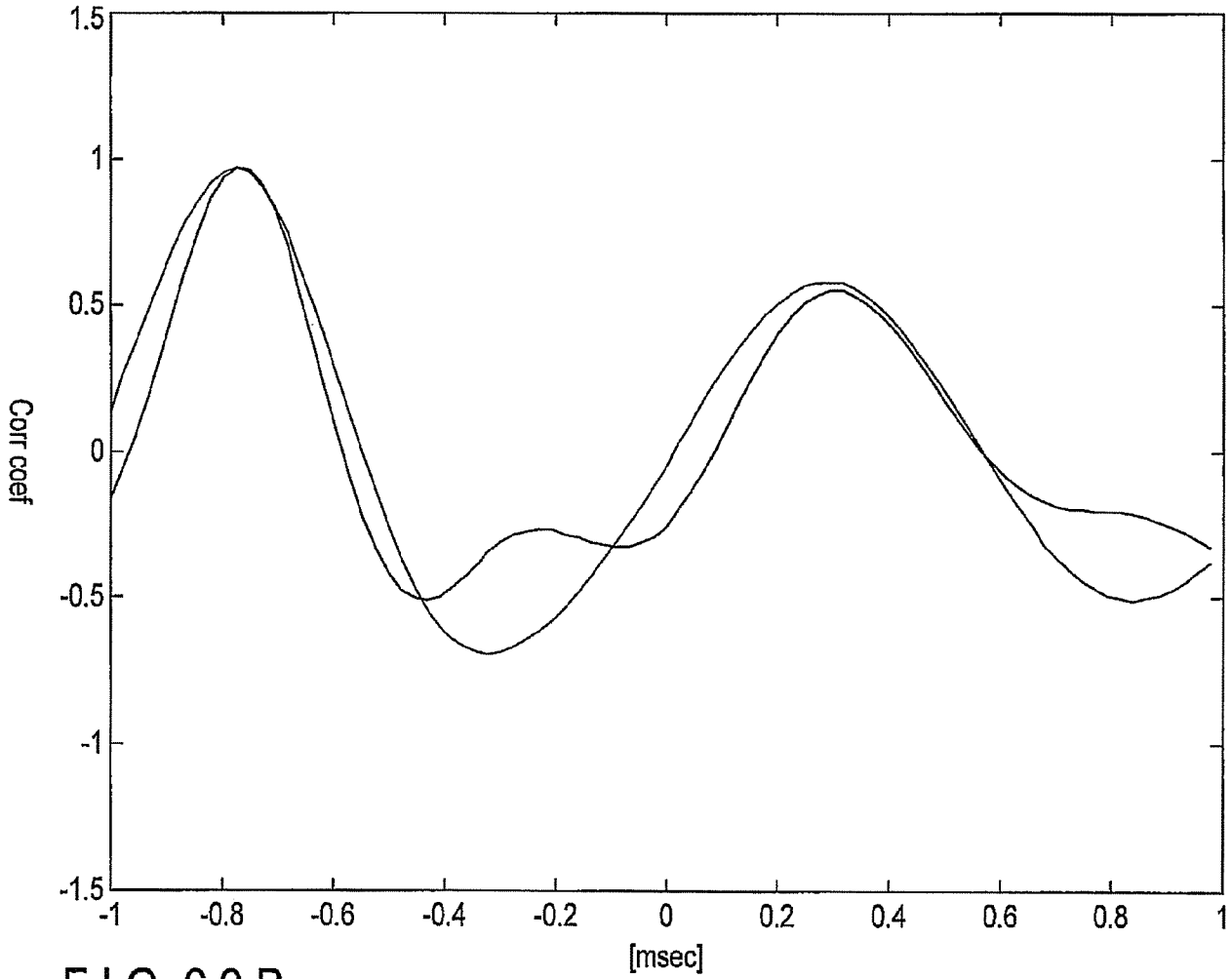
FIG. 69B is a graph showing an IACF at the second target binaural position and a desired IACF when X=3 and N=2.

FIG. 67A, FIG. 68A, and FIG. 69A show the amplitude characteristic, the phase characteristic and IACF of $P_L/P_R$ at the first binaural position together with the amplitude characteristic, the phase characteristic and the IACF of the desired ratio ($d_L/d_R$). Likewise, FIG. 67B, FIG. 68B, and FIG. 69B show the amplitude characteristic, the phase characteristic and the IACF of $P_L/P_R$ at the second binaural position together with the amplitude characteristic, the phase characteristic and the IACF of the desired ratio ($d_L/d_R$). According to this experiment, it was confirmed that, when X=3 and N=2 (=X−1), complex sound pressure ratios close to the desired was obtained at the two target binaural positions which are 50 cm apart from each other.

Furthermore, for comparison, like the first or second embodiment, an experiment was conducted with X=2 and the first binaural position alone treated as the target binaural position under the above-described conditions. That is, the head-related transfer functions (=$C_{LL}$, $C_{LR}$, $C_{RL}$, $C_{RR}$) from each loudspeaker were measured at the first binaural position, and the filter coefficients (=$W_L$, $W_R$) were calculated and applied based on these measured functions and the head-related transfer functions (=$d_L$, $d_R$).

Figure 70A:
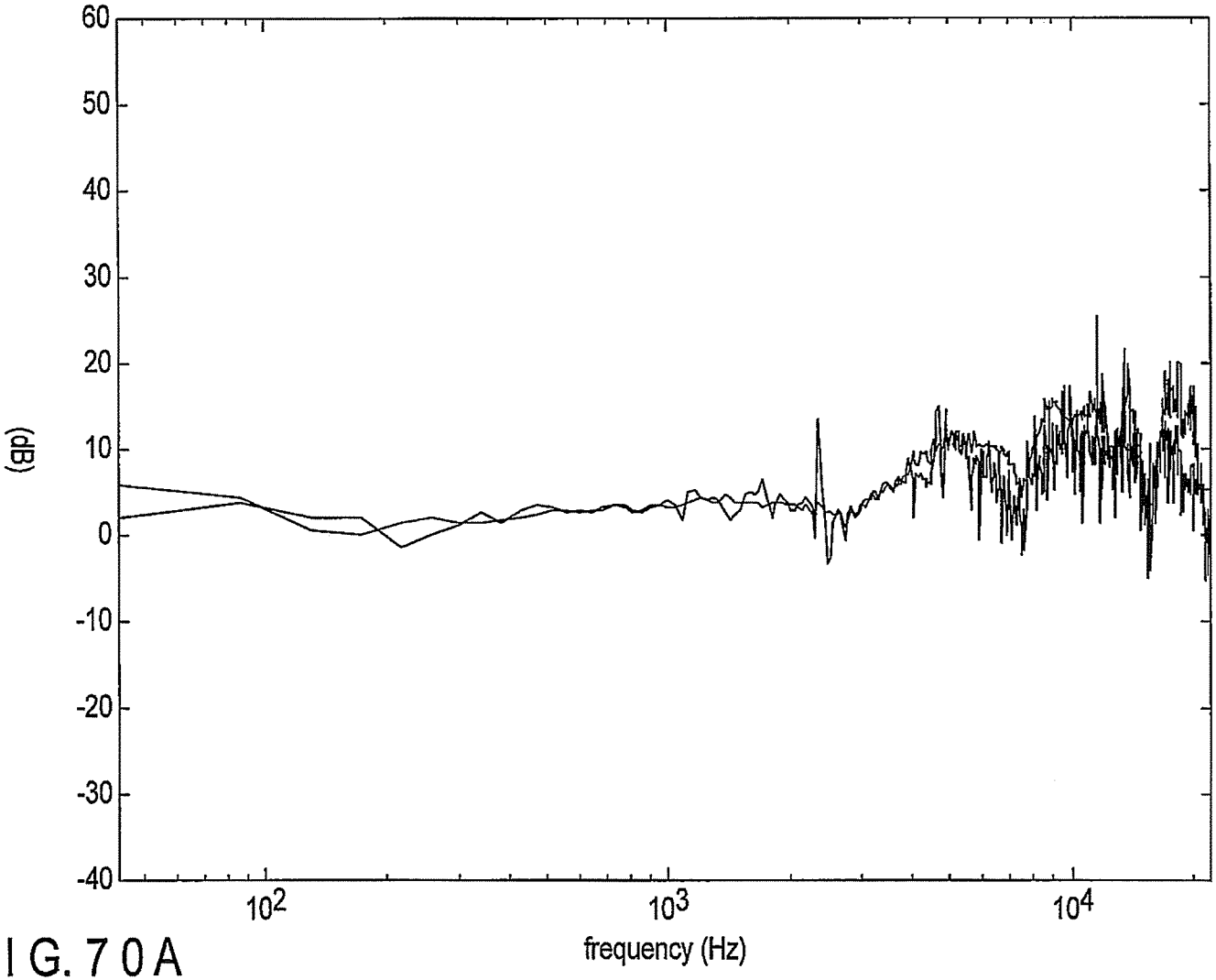
FIG. 70A is a graph showing amplitude characteristics of a complex sound pressure ratio at a target binaural position and a desired complex sound pressure ratio when X=2 and N=1.
Figure 70B:
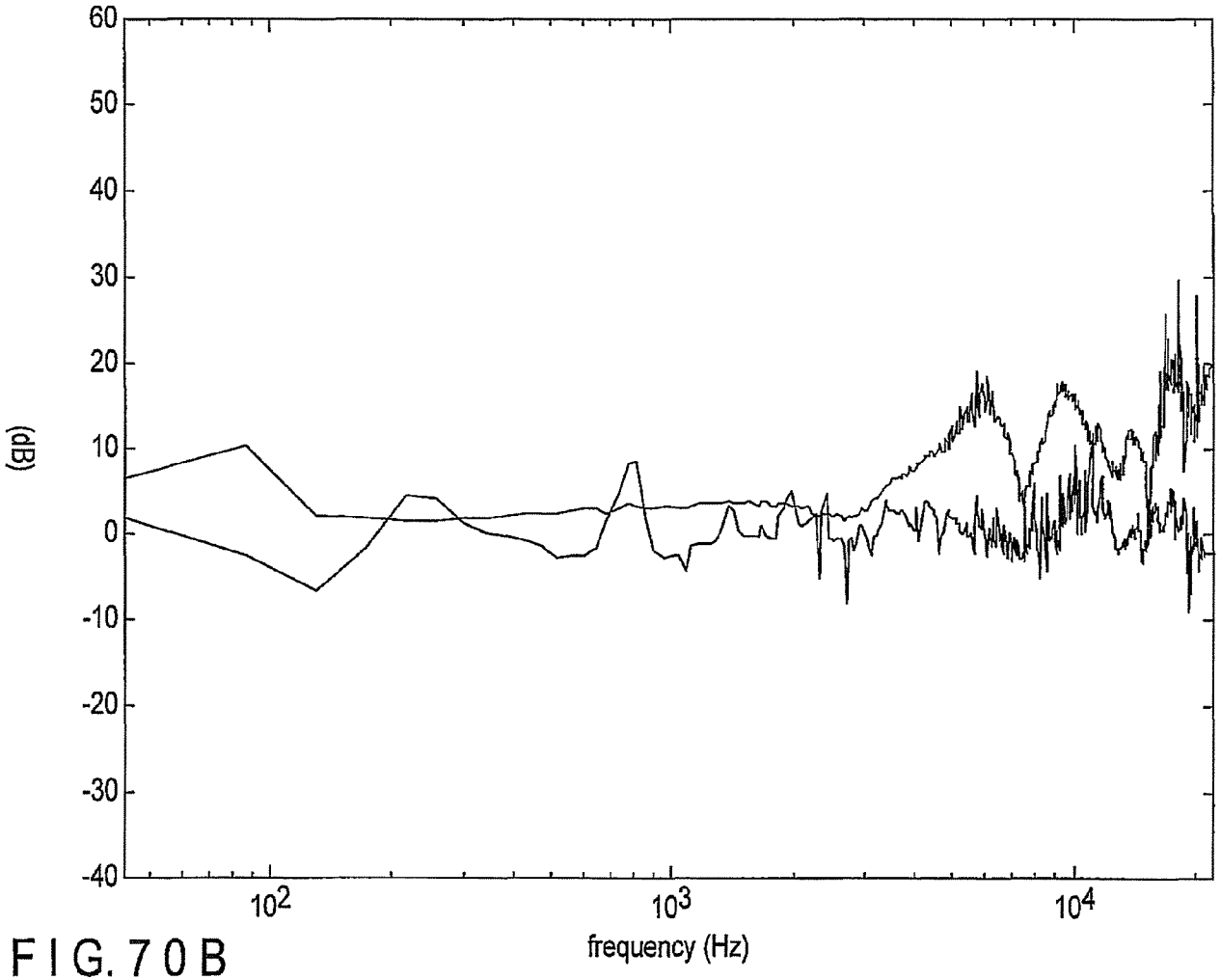
FIG. 70B is a graph showing amplitude characteristics of a complex sound pressure ratio at a binaural position that is 50 cm apart from a target binaural position and a desired complex sound pressure ratio when X=2 and N=1.
Figure 71A:
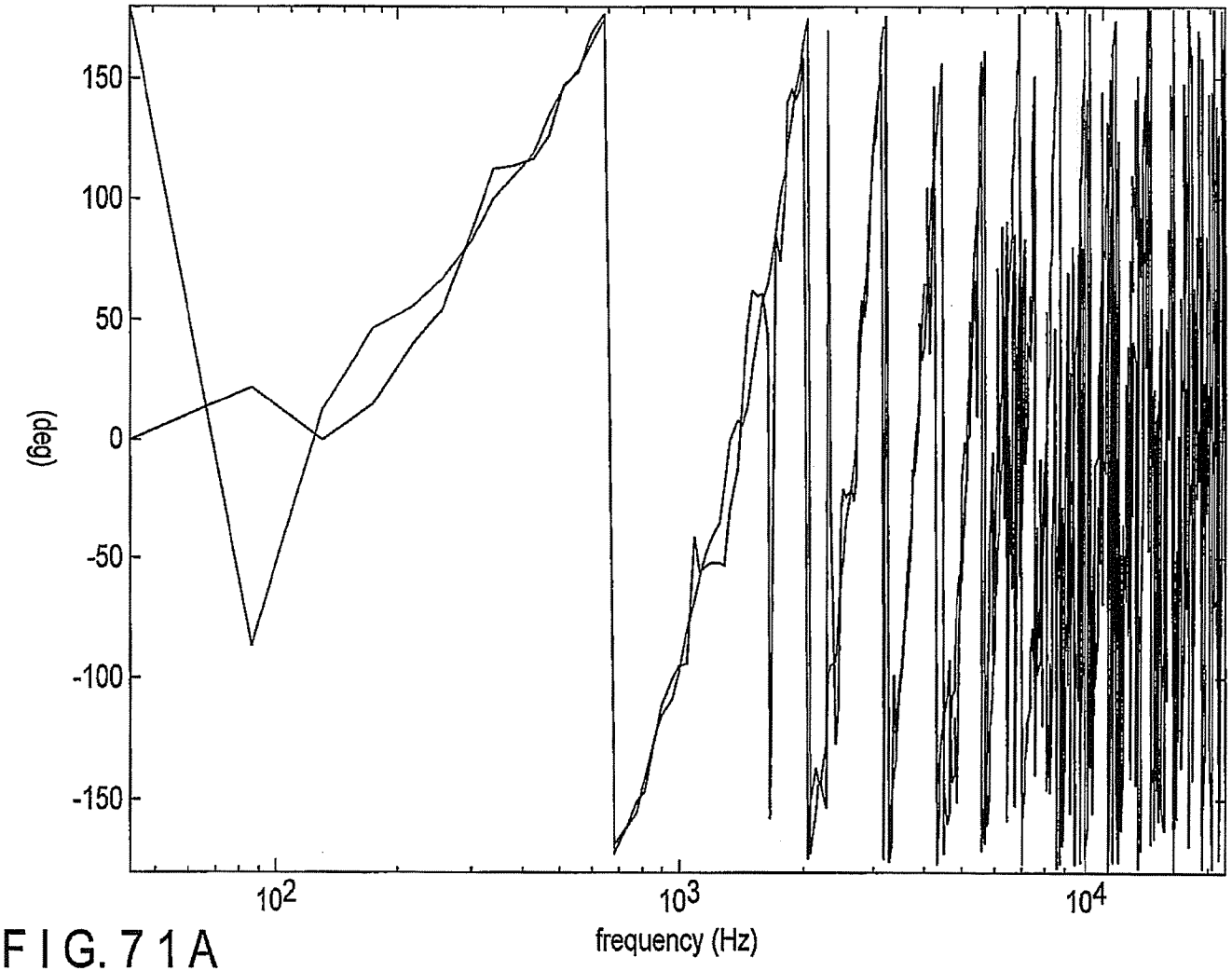
FIG. 71A is a graph showing phase characteristics of the complex sound pressure ratio at the target binaural position and the desired complex sound pressure ratio when X=2 and N=1.
Figure 71B:
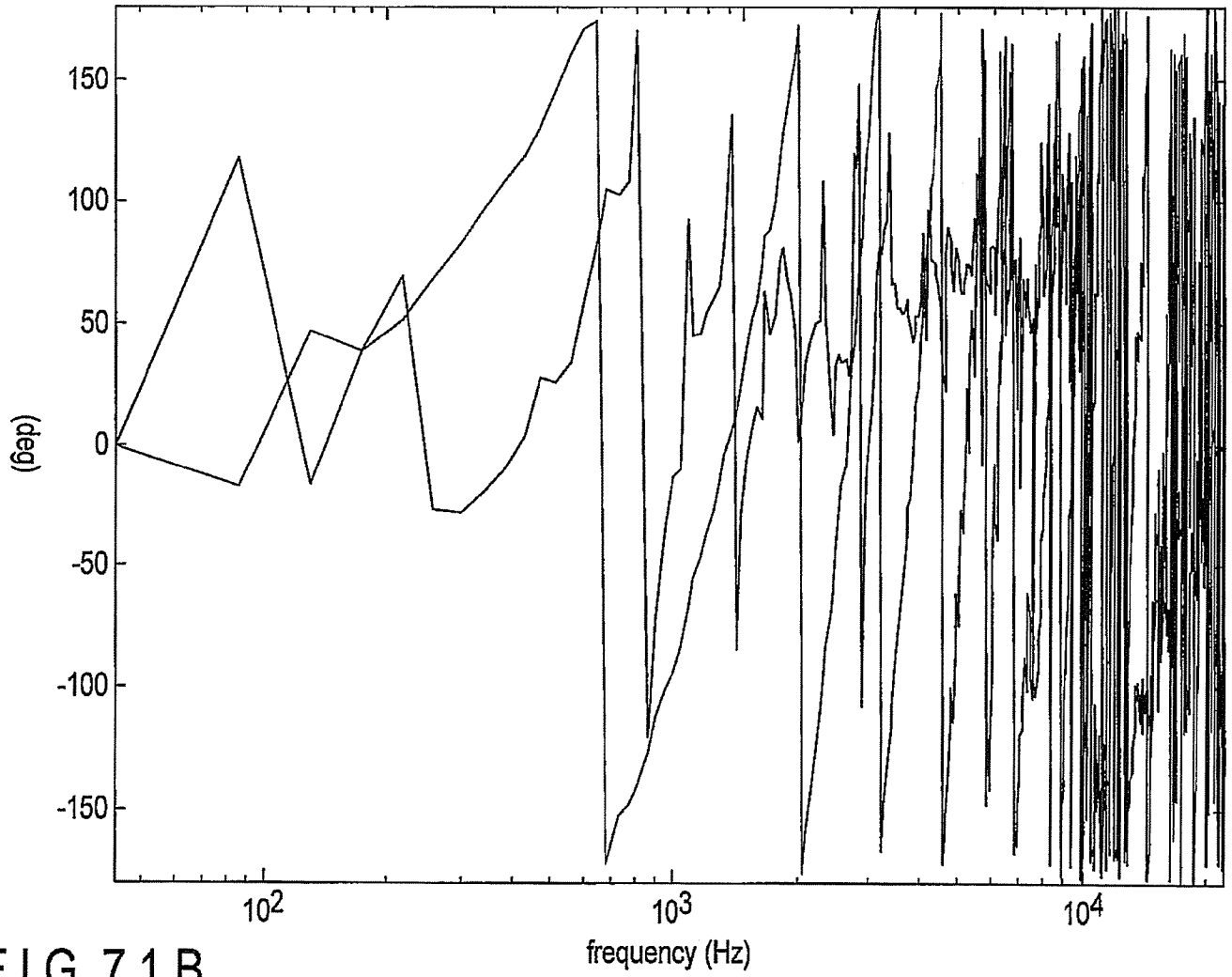
FIG. 71B is a graph showing phase characteristics of the complex sound pressure ratio at the binaural position that is 50 cm apart from the target binaural position and the desired complex sound pressure ratio when X=2 and N=1.
Figure 72A:
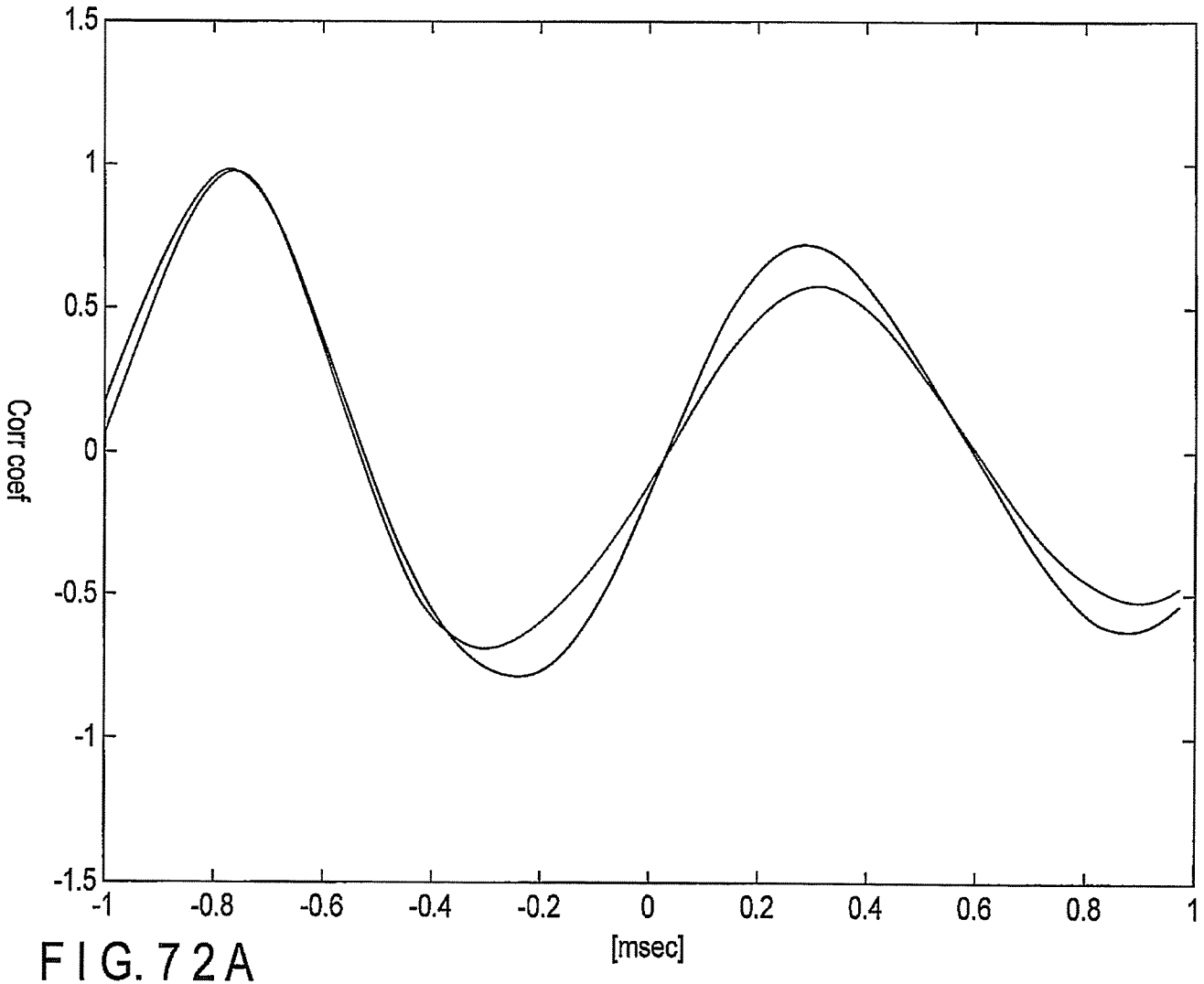
FIG. 72A is a graph showing an IACF at the target binaural position and a desired IACF when X=2 and N=1.
Figure 72B:
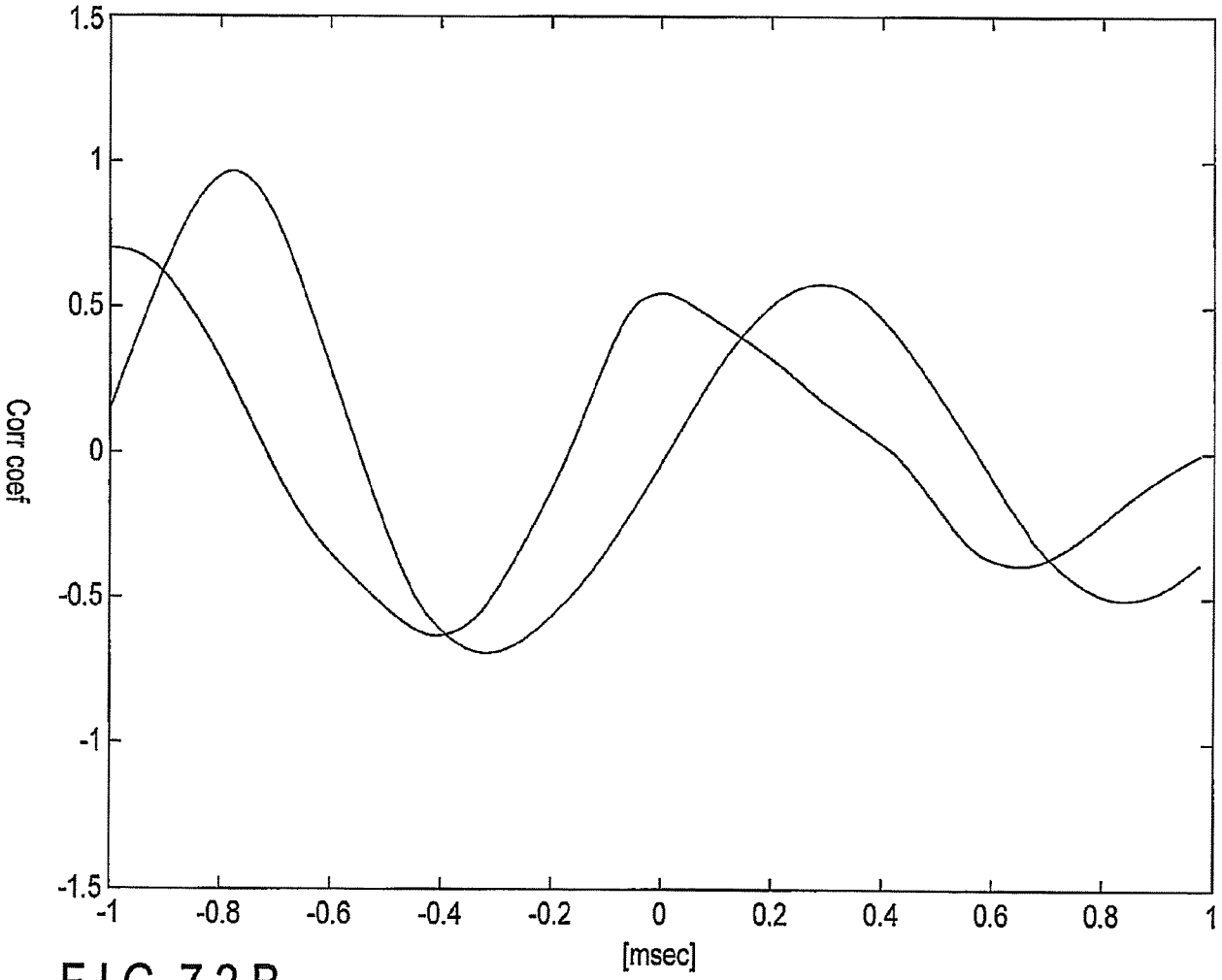
FIG. 72B is a graph showing an IACF at the binaural position that is 50 cm a part from the target binaural position and a desired IACF when X=2 and N=1.

FIG. 70A, FIG. 71A, and FIG. 72A show the amplitude characteristic, the phase characteristic and the IACF of $P_L/P_R$ at the first binaural position together with the amplitude characteristic, the phase characteristic and the IACF of the desired ratio ($d_L/d_R$). Likewise, FIG. 70B, FIG. 71B, and FIG. 72B show the amplitude characteristic, the phase characteristic and the IACF of $P_L/P_R$ at the second binaural position together with the amplitude characteristic, the phase characteristic and the IACF of the desired ratio ($d_L/d_R$). According to this comparative experiment, it was likewise confirmed that, when X=2 and N=1 (=X−1), a complex sound pressure ratio close to the desired ratio was obtained at the target binaural position. On the other hand, according to this comparative experiment, it was confirmed that the complex sound pressure ratio close to the desired ratio was not obtained at the binaural position that is 50 cm apart from the target binaural position.

When X=5, control filters and loudspeakers of 5 channels are provided. Assuming that $W_L$ is a control filter coefficient of a first channel, $W_S$ is a control filter coefficient of a second channel, $W_T$ is a control filter coefficient of a third channel, $W_U$ is a control filter coefficient of a fourth channel, and $W_R$ is a control filter coefficient of a fifth channel (which may have through characteristic), the respective control filter coefficients (=$W_L$, $W_S$, $W_T$, $W_U$, $W_R$) can be derived by the following Expressions (50) to (57).

$$W_R = 1 \tag{50}$$

$$W_L = -\frac{\sum_{i=1}^{N}(Z_i \cdot Y_i^*)}{\sum_{i=1}^{N}(Y_i \cdot Y_i^*)} W_R$$

$$W_S = -\frac{V \cdot W_L + W \cdot W_R}{X}$$

$$W_T = -\frac{O \cdot W_L + P \cdot W_S + Q \cdot W_R}{R}$$

$$W_U = -\frac{F \cdot W_L + G \cdot W_S + H \cdot W_T + I \cdot W_R}{J}$$

$$\begin{aligned} A_i &= C_{RiL} \cdot d_{Li} - C_{LiL} \cdot d_{Ri} \\ B_i &= C_{RiS} \cdot d_{Li} - C_{LiS} \cdot d_{Ri} \\ C_i &= C_{RiT} \cdot d_{Li} - C_{LiT} \cdot d_{Ri} \\ D_i &= C_{RiU} \cdot d_{Li} - C_{LiU} \cdot d_{Ri} \\ E_i &= C_{RiR} \cdot d_{Li} - C_{LiR} \cdot d_{Ri} \\ i &= 1, 2, \ldots, N \end{aligned} \tag{51}$$

-continued $$F = \sum_{i=1}^{N} (A_i \cdot D_i^*) \quad (52)$$

$$G = \sum_{i=1}^{N} (B_i \cdot D_i^*)$$

$$H = \sum_{i=1}^{N} (C_i \cdot D_i^*)$$

$$I = \sum_{i=1}^{N} (E_i \cdot D_i^*)$$

$$J = \sum_{i=1}^{N} (D_i \cdot D_i^*)$$

$$K_i = A_i - \frac{D_i \cdot F}{J} \quad (53)$$

$$L_i = B_i - \frac{D_i \cdot G}{J}$$

$$M_i = C_i - \frac{D_i \cdot H}{J}$$

$$N_i = E_i - \frac{D_i \cdot I}{J}$$

$$i = 1, 2, \ldots, N$$

$$O = \sum_{i=1}^{N} (K_i \cdot M_i^*) \quad (54)$$

$$P = \sum_{i=1}^{N} (L_i \cdot M_i^*)$$

$$Q = \sum_{i=1}^{N} (N_i \cdot M_i^*)$$

$$R = \sum_{i=1}^{N} (M_i \cdot M_i^*)$$

$$S_i = K_i - \frac{M_i \cdot O}{R} \quad (55)$$

$$T_i = L_i - \frac{M_i \cdot P}{R}$$

$$U_i = N_i - \frac{M_i \cdot Q}{R}$$

$$i = 1, 2, \ldots, N$$

$$V = \sum_{i=1}^{N} (S_i \cdot T_i^*) \quad (56)$$

$$W = \sum_{i=1}^{N} (U_i \cdot T_i^*)$$

$$X = \sum_{i=1}^{N} (T_i \cdot T_i^*)$$

$$Y_i = S_i - \frac{T_i \cdot V}{X} \quad (57)$$

$$Z_i = U_i - \frac{T_i \cdot W}{X}$$

$$i = 1, 2, \ldots, N$$

The processing in the above-described embodiments can be implemented using a general-purpose computer as basic hardware. A program implementing the processing in each of the above-described embodiments may be stored in a computer readable storage medium for provision. The program is stored in the storage medium as a file in an installable or executable format. The storage medium is a magnetic disk, an optical disc (CD-ROM, CD-R, DVD, or the like), a magnetooptic disc (MO or the like), a semiconductor memory, or the like. That is, the storage medium may be in any format provided that a program can be stored in the storage medium and that a computer can read the program from the storage medium. Furthermore, the program implementing the processing in each of the above-described embodiments may be stored on a computer (server) connected to a network such as the Internet so as to be downloaded into a computer (client) via the network.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An acoustic control apparatus, comprising:

a control filter configured to multiply a first acoustic signal by a control filter coefficient to obtain a second acoustic signal;

a first loudspeaker configured to emit the second acoustic signal; and a second loudspeaker configured to emit the first acoustic signal, wherein the control filter coefficient is calculated based on first head-related transfer function sets from the first loudspeaker and the second loudspeaker to target binaural positions and second head-related transfer function sets from a target virtual acoustic source to the target binaural positions in such a manner that a second spatial average of complex sound pressure ratios at the target binaural positions when the first loudspeaker and the second loudspeaker emit the second acoustic signal and the first acoustic signal is approximated to a first spatial average of complex sound pressure ratios at the target binaural positions if the target virtual acoustic source emitted the first acoustic signal, the target virtual acoustic source being different from the first loudspeaker and the second loudspeaker.

2. The acoustic control apparatus according to claim 1, wherein a total number of the target binaural positions is two or more.

3. An acoustic control apparatus, comprising:

a first control filter configured to multiply a first acoustic signal by a first control filter coefficient to obtain a second acoustic signal;

a second control filter configured to multiply the first acoustic signal by a second control filter coefficient to obtain a third acoustic signal;

a first loudspeaker configured to emit the second acoustic signal; and a second loudspeaker configured to emit the third acoustic signal, wherein the first control filter coefficient is calculated based on the second control filter coefficient, first head-related transfer function sets from the first loudspeaker and the second loudspeaker to target binaural positions, and second head-related transfer function sets from a target virtual acoustic source to the target binaural positions in such a manner that a second spatial average of complex sound pressure ratios at the target binaural positions when the first loudspeaker and the second loudspeaker emit the second acoustic signal and the third acoustic signal is approximated to a first spatial average of complex sound pressure ratios at the target binaural positions if the target virtual acoustic source emitted the first acoustic signal, the target virtual acoustic source being different from the first loudspeaker and the second loudspeaker.

4. The apparatus acoustic control according to claim 3, wherein a total number of the target binaural positions is two or more.

5. An acoustic control apparatus, comprising:

X−1 wherein X is an integer not smaller than 3, control filters configured to multiply a first acoustic signal by first, . . . , and X−1th control filter coefficients to obtain second, . . . , and Xth acoustic signals; and X loudspeakers configured to emit the first, . . . , and Xth acoustic signals, wherein the first, . . . , and X−1th control filter coefficients are calculated based on at least X−1 first head-related transfer function sets from the X loudspeakers to at least X−1 target binaural positions and at least one second head-related transfer function set from a target virtual acoustic source to the at least X−1 target binaural positions in such a manner that a second spatial average of at least X−1 complex sound pressure ratios at the at least X−1 target binaural positions when the X loudspeakers emit the first, . . . , and Xth acoustic signals is approximated to a first spatial average of at least X−1complex sound pressure ratios at the at least X−1 target binaural positions if the target virtual acoustic source emitted the first acoustic signal, the target virtual acoustic source being different from the X loudspeakers.

6. The acoustic control apparatus according to claim 5, wherein a total number of the target binaural positions is X or more.

7. An acoustic control apparatus, comprising:

first, . . . , and X−1th wherein X is an integer which is not smaller than 3, control filters configured to multiply first, . . . , and Mth wherein M is an integer not smaller than 2, acoustic signals by first, . . . , and X−1th control filter coefficient sets and combine results to obtain first, . . . , and X−1th combined acoustic signals; and X loudspeakers configured to emit the first, . . . , and X−1th combined acoustic signals and an Xth combined acoustic signal, the Xth combined acoustic signal obtained by combining the first, . . . , and Mth acoustic signals, wherein the first, . . . , and X−1th control filter coefficient sets are calculated based on at least X−1 first head-related transfer function sets from the X loudspeakers to at least X−1 target binaural positions and at least M second head-related transfer function sets from M target virtual acoustic sources to the at least X−1 target binaural positions in such a manner that a second spatial average of at least X−1 complex sound pressure ratios at the at least X−1 target binaural positions when the X loudspeakers emit the first, . . . , and the Xth combined acoustic signals is approximated to a first spatial average of at least X−1 complex sound pressure ratios at the at least X−1 target binaural positions if the M target virtual acoustic sources emitted the first, . . . , and Mth acoustic signals, the M target virtual acoustic sources being different from the X loudspeakers.

8. The acoustic control apparatus according to claim 7, wherein a total number of the target binaural positions is X or more.

* * * * *